US012680734B2

(12) United States Patent
Odukomaiya et al.

(10) Patent No.: US 12,680,734 B2
(45) Date of Patent: Jul. 14, 2026

(54) HEAT PUMP SYSTEMS AND METHODS

(71) Applicant: AtmosZero, Inc., Loveland, CO (US)

(72) Inventors: Adewale Odukomaiya, Denver, CO (US); Nickolas Richard Roberts, Marshfield, MA (US); Todd Matthew Bandhauer, Fort Collins, CO (US); Ashwin A. Salvi, San Diego, CA (US); Addison Killean Stark, Fort Collins, CO (US); Jason S. Paulman, Fort Collins, CO (US); Elliott C. Boyd, Fort Collins, CO (US); Robert Lyle Fuller, Grand Junction, CO (US); Jeffrey Alan Milkie, Fort Collins, CO (US)

(73) Assignee: AtmosZero, Inc., Loveland, CO (US)

( * ) Notice: Subject to any disclaimer, the term of this patent is extended or adjusted under 35 U.S.C. 154(b) by 0 days.

(21) Appl. No.: 19/328,423

(22) Filed: Sep. 15, 2025

(65) Prior Publication Data

US 2026/0022875 A1 Jan. 22, 2026

Related U.S. Application Data

(63) Continuation of application No. PCT/US2024/020302, filed on Mar. 15, 2024.
(Continued)

(51) Int. Cl.
*F25B 7/00* (2006.01)
*F01K 9/00* (2006.01)
(Continued)

(52) U.S. Cl.
CPC ..... *F25B 7/00* (2013.01); *F01K 9/003* (2013.01); *F01K 17/005* (2013.01); *F22B 1/16* (2013.01);
(Continued)

(58) Field of Classification Search
CPC .. F25B 7/00; F25B 30/02; F25B 30/06; F25B 31/006; F22B 1/16; F22B 1/18; F22B 3/00; F04B 31/064
See application file for complete search history.

(56) References Cited

U.S. PATENT DOCUMENTS 4,028,079 A * 6/1977 Scheibel ..... F25J 1/0204 62/335
6,176,092 B1 * 1/2001 Butterworth ..... F25B 31/002 62/505
(Continued)

FOREIGN PATENT DOCUMENTS

CN 216557740 U 5/2022
EP 1866579 A2 12/2007
(Continued)

OTHER PUBLICATIONS

PCT/US2024/020302 International Search Report and Written Opinion dated Aug. 23, 2024.

*Primary Examiner* — Christopher R Zerphey
(74) *Attorney, Agent, or Firm* — Polygon IP, LLP

(57) ABSTRACT

Provided herein are methods and systems for generating steam. The methods may comprise circulating a first working fluid through a first heat pump cycle, circulating a second working fluid through a second heat pump cycle, and transferring heat from said first working fluid to said second working fluid in a heat exchanger coupled to the first heat pump cycle and the second heat pump cycle. In some embodiments, the first heat pump cycle receives heat from an ambient air stream.

20 Claims, 114 Drawing Sheets

Related U.S. Application Data

(60) Provisional application No. 63/453,047, filed on Mar. 17, 2023.

(51) Int. Cl.

| | |
|---|---|
| ***F01K 17/00*** | (2006.01) |
| ***F22B 1/16*** | (2006.01) |
| ***F22B 3/02*** | (2006.01) |
| ***F25B 1/10*** | (2006.01) |
| ***F25B 30/02*** | (2006.01) |
| ***F25B 30/06*** | (2006.01) |
| ***F25B 31/00*** | (2006.01) |
| ***F25B 40/00*** | (2006.01) |

(52) U.S. Cl.

CPC ..... *F22B 3/02* (2013.01); *F25B 30/02* (2013.01); *F25B 31/006* (2013.01); *F25B 1/10* (2013.01); *F25B 30/06* (2013.01); *F25B 40/00* (2013.01); *F25B 2339/047* (2013.01); *F25B 2400/054* (2013.01); *F25B 2400/072* (2013.01); *F25B 2400/075* (2013.01); *F25B 2400/13* (2013.01)

(56) References Cited

U.S. PATENT DOCUMENTS

| | | | | |
|---|---|---|---|---|
| 7,439,702 | B2 * | 10/2008 | Smith | H02P 25/08 318/701 |
| 7,600,390 | B2 * | 10/2009 | Manole | F25B 49/022 62/228.1 |
| 7,861,548 | B2 | 1/2011 | Shibata et al. | |
| 8,701,432 | B1 * | 4/2014 | Olson | F25B 30/06 165/45 |
| 8,726,682 | B1 * | 5/2014 | Olson | F24F 5/0046 62/235.1 |
| 9,239,183 | B2 | 1/2016 | Amick | |
| 9,506,674 | B2 | 11/2016 | Morimoto et al. | |
| 10,408,473 | B2 | 9/2019 | Ostrye et al. | |
| 10,612,796 | B2 * | 4/2020 | Göransson | F24D 3/18 |
| 11,067,296 | B2 * | 7/2021 | Callemo | F24D 3/18 |
| 11,221,161 | B1 | 1/2022 | Fernando | |
| 11,566,155 | B2 | 1/2023 | Yana Motta et al. | |
| 11,674,724 | B2 | 6/2023 | Zhu et al. | |
| 12,449,121 | B1 * | 10/2025 | Roberts | F22B 1/165 |
| 2007/0271956 | A1 * | 11/2007 | Smith | F04D 13/04 62/505 |
| 2008/0203179 | A1 * | 8/2008 | Berger | F24D 19/1078 237/19 |
| 2010/0147006 | A1 * | 6/2010 | Taras | F25B 7/00 62/335 |
| 2011/0309635 | A1 * | 12/2011 | Sardo | F01K 17/005 290/1 A |
| 2012/0216551 | A1 | 8/2012 | Minor et al. | |
| 2014/0013786 | A1 * | 1/2014 | Kanamaru | F25B 7/00 62/331 |
| 2016/0138837 | A1 | 5/2016 | Gromoll et al. | |
| 2019/0211247 | A1 | 7/2019 | Kontomaris et al. | |
| 2021/0156597 | A1 | 5/2021 | Bandhauer et al. | |
| 2023/0288112 | A1 | 9/2023 | Kennedy et al. | |

FOREIGN PATENT DOCUMENTS

| | | | |
|---|---|---|---|
| EP | 2199671 | A1 | 6/2010 |
| EP | 2321589 | A1 | 5/2011 |
| EP | 2325578 | A2 | 5/2011 |
| EP | 2602571 | A1 | 6/2013 |
| EP | 3730873 | A2 | 10/2020 |
| EP | 3734188 | A1 | 11/2020 |
| EP | 3816543 | A1 | 5/2021 |
| EP | 3922931 | A1 | 12/2021 |
| EP | 4170262 | A1 | 4/2023 |
| EP | 4332463 | A1 | 3/2024 |
| WO | 2022266622 | A2 | 12/2022 |
| WO | 2023025896 | A1 | 3/2023 |
| WO | 2023174738 | A1 | 9/2023 |

* cited by examiner

| Parameter | Value |
|---|---|
| Air Temperature | 15C inlet, 12.17C outlet |
| Glycol Temperature | 11C inlet, 5C outlet |
| Steam Temperature | 90C feedwater, 150C outlet |
| Bottom Cycle Compressor 1 Isentropic Efficiency | 80% |
| Bottom Cycle Compressor 2 Isentropic Efficiency | 80% |
| Top Cycle Compressor 1 Isentropic Efficiency | 83.5% |
| Top Cycle Compressor 2 Isentropic Efficiency | 81.5% |
| Top Cycle Compressor 3 Isentropic Efficiency | 82.8% |
| Top Cycle Compressor 4 Isentropic Efficiency | 81.0% |
| Bottom Cycle Economizer Superheat | 5C |
| Top Cycle Economizer Superheat | 35C |
| Bottom Cycle Evaporator Pinch | 2C |
| Middle Heat Exchanger Pinch | 6C |
| Steam Generator Pinch | 3.47C |

FIG. 16B

| Parameter | Value |
|---|---|
| Steam Duty | 690 kW |
| Steam Flow Rate | 0.2913 kg/s |
| Air Heat Exchanged | 290 kW |
| Suction Line Heat Exchanger Effectiveness | 0.7657 |
| Bottom Compressor motor-to-shaft efficiency | 94.31% |
| First Top Compressor motor-to-shaft efficiency | 94.69% |
| Second Top Compressor motor-to-shaft efficiency | 94.49% |

| Parameter | Value |
|---|---|
| COP (Steam / compressor motor power) | 1.676 |
| % Carnot (15C-150C) | 53% |
| Bottom Economizer Flow (% of condenser flow) | 19% |
| Top Economizer Flow % (% of condenser flow) | 14% |
| Bottom Motor Coolant Flow % (% of condenser flow) | 2% |
| Top Motor Coolant Flow % (% of condenser flow) | 1% |

FIG. 16C

| Bottom Cycle Compressor | Stage 1 | Stage 2 |
|---|---|---|
| Specific Speed (Ns) | 113 | 73.96 |
| Specific Diameter (Ds) | 1.294 | 1.976 |
| Speed | 27944 RPM | 27944 RPM |
| Impeller Diameter | 4.679 in | 4.692 in |
| Power | 72.2 kW | 72.06 kW |
| Volumetric Flow Rate | 6.774 ft^3/s | 2.928 ft^3/s |
| Pressure Ratio | 2.36 | 2.39 |

| Mid Cycle Compressor | Stage 1 | Stage 2 |
|---|---|---|
| Specific Speed (Ns) | 126.1 | 111 |
| Specific Diameter (Ds) | 1.202 | 1.323 |
| Speed | 25000 RPM | 25000 RPM |
| Impeller Diameter | 5.118 in | 4.409 in |
| Power | 67.96 kW | 54.9 kW |
| Volumetric Flow Rate | 8.862 ft^3/s | 4.825 ft^3/s |
| Pressure Ratio | 1.87 | 1.63 |

| Second Top Cycle Compressor | Stage 1 | Stage 2 |
|---|---|---|
| Specific Speed (Ns) | 99.65 | 82.42 |
| Specific Diameter (Ds) | 1.534 | 1.698 |
| Speed | 27300 RPM | 27300 RPM |
| Impeller Diameter | 4.252 in | 3.701 in |
| Power | 63.4 kW | 58.13 kW |
| Volumetric Flow Rate | 3.375 ft^3/s | 1.9983 ft^3/s |
| Pressure Ratio | 1.66 | 1.60 |

FIG. 16E

| Parameter | Value |
|---|---|
| Air Temperature | -10C inlet, -12.83C outlet |
| Glycol Temperature | -14C inlet, -20C outlet |
| Steam Temperature | 90C feedwater, 150C outlet |
| Bottom Cycle Compressor 1 Isentropic Efficiency | 80% |
| Bottom Cycle Compressor 2 Isentropic Efficiency | 80% |
| Top Cycle Compressor 1 Isentropic Efficiency | 83.5% |
| Top Cycle Compressor 2 Isentropic Efficiency | 81.5% |
| Top Cycle Compressor 3 Isentropic Efficiency | 82.8% |
| Top Cycle Compressor 4 Isentropic Efficiency | 81.0% |
| Bottom Cycle Economizer Superheat | 5C |
| Top Cycle Economizer Superheat | 35C |
| Bottom Cycle Evaporator Pinch | 2C |
| Middle Heat Exchanger Pinch | 6C |
| Steam Generator Pinch | 3.47C |

FIG. 40B

| Parameter | Value |
|---|---|
| Steam Duty | 690 kW |
| Steam Flow Rate | 0.2913 kg/s |
| Air Heat Exchanged | 234 kW |
| Suction Line Heat Exchanger Effectiveness | 0.7657 |
| Add-On Compressor Motor-to-Shaft Efficiency | 94.98% |

| Parameter | Value |
|---|---|
| COP (Steam / compressor motor power) | 1.47 |
| % Carnot (15C-150C) | 56% |
| Bottom Economizer Flow % | 19% |
| Top Economizer Flow % | 14% |
| Bottom Motor Coolant Flow % | 3% |
| Top Motor Coolant Flow % | 1% |

FIG. 40C

| Bottom Cycle Air on Compressor | Stage 1 | Stage 2 |
|---|---|---|
| Specific Speed (Ns) | 176.5 | 123.8 |
| Specific Diameter (Ds) | 0.8278 | 1.185 |
| Speed | 25443 RPM | 25443 RPM |
| Impeller Diameter | 4.524 in | 4.654 in |
| Power | 43.04 kW | 45.41 kW |
| Volumetric Flow Rate | 13.61 ft^3/s | 7.288 ft^3/s |
| Pressure Ratio | 1.98 | 1.98 |

FIG. 40E

HEAT PUMP SYSTEMS AND METHODS

CROSS-REFERENCE TO RELATED APPLICATIONS

This application is a continuation of PCT Application No. PCT/US2024/020302, titled: "Heat Pump Systems and Methods", filed 2024 Mar. 15, which claims the benefit of U.S. Provisional Application No. 63/453,047, filed on 2023 Mar. 17, both of which are incorporated herein by reference in their entirety.

BACKGROUND

In the United States, the industrial sector accounts for 22% of greenhouse gas emissions, which equals approximately 1.5 gigatonnes of equivalent carbon dioxide per year (GtCO2e/year). Within the industrial sector, steam production for process heat is one of the largest energy consumers, accounting for almost 4 quads of U.S. primary energy consumption and emitting more than 200 MMtonnes of carbon dioxide (CO2) every year. Most of these emissions are generated from burning of fuels for conventional boilers, cogeneration, and process heating. Further, electrification of steam generation either depends on low-efficiency electric boilers or waste heat driven heat pumps. Relying on waste heat is a barrier for adoption due to high installation costs and lack of consistent waste heat across different industries and facilities.

SUMMARY

The present disclosure is directed to air-source heat pump systems and methods of use for industrial steam generation, that can address at least the above need(s).

In one aspect, the present disclosure provides a method for generating steam, comprising: circulating a first heat transfer fluid through an intermediate loop, wherein the intermediate loop comprises (i) a first heat exchanger receiving the first heat transfer fluid and an ambient air stream to transfer heat from the ambient air stream to the first heat transfer fluid, and (ii) a second heat exchanger receiving the heat transfer fluid and a first working fluid to transfer heat from the first heat transfer fluid to the first working fluid; circulating the first working fluid through a first heat pump cycle, wherein the first heat pump cycle comprises (i) the second heat exchanger, and (ii) a third heat exchanger receiving the first working fluid and a second working fluid to transfer heat from the first working fluid to the second working fluid; circulating the second working fluid through a second heat pump cycle, wherein the second heat pump cycle comprises (i) the third heat exchanger, and (ii) a steam generator; and providing a feed stream comprising water to the steam generator, wherein the steam generator transfers heat from the second working fluid to the feed stream to generate the steam.

In some embodiments, the method further comprises transferring heat from a heat source subunit to the intermediate loop via a heat exchanger, wherein the heat source subunit is coupled to the intermediate loop.

In some embodiments, the heat source subunit is a (i) refrigeration system, (ii) a geothermal heat source, (iii) a waste heat stream from a process, a wastewater or waste heat stream from a heat system, a power system, or a combined heat and power system, (iv) a carbon capture process, (v) a body of water, (vi) a district energy system, (vii) a solar thermal heat source, or (viii) a nuclear reactor.

In some embodiments, the body of water is a lake or a river.

In some embodiments, the carbon capture process is a direct air capture system.

In some embodiments, a subunit heat exchanger of the intermediate loop receives a subunit fluid and the first heat transfer fluid and transfers heat from the subunit fluid to the first heat transfer fluid.

In some embodiments, the subunit heat exchanger condenses at least a portion of the subunit fluid.

In some embodiments, the method further comprises transferring heat from a subunit fluid of the heat-source subunit to a second heat transfer fluid and transferring heat from the second heat transfer fluid to the intermediate loop.

In some embodiments, the first heat transfer fluid directly provides refrigeration to the heat-source subunit.

In some embodiments, the first heat transfer fluid directly cools a water stream or a water reservoir.

In some embodiments, the method further comprises directing a fluid air stream to an additional heat exchanger of the intermediate loop, and transferring heat from the ambient air to the first heat transfer fluid through the additional heat exchanger, wherein the heat exchanger is in parallel with the first heat exchanger.

In some embodiments, the method further comprises directing a fluid air stream to an additional heat exchanger of the intermediate loop, and transferring heat from the ambient air to the first heat transfer fluid through the additional heat exchanger, wherein the heat exchanger is in series with the first heat exchanger.

In some embodiments, the method further comprises transferring heat from a vapor compression system to the heat transfer fluid, wherein the intermediate loop is coupled to a vapor compression system.

In some embodiments, the first heat exchanger is within a cycle of the vapor compression system.

In some embodiments, a vapor compression fluid of the vapor compression system comprises one or more of ammonia (NH3), water (H2O), carbon dioxide (CO2) pentane (C5H12), butane (C4H10), isobutane (HC(CH3)3), propane (C3H8), or propene (C3H6).

In some embodiments, the intermediate loop is coupled to the vapor compression system using a condenser and an evaporator.

In some embodiments, the intermediate loop further comprises a heat recovery heat exchanger, wherein the heat recovery heat exchanger enables at least one of (i) operation at very low ambient temperatures or (ii) the vapor compressor cycle to be sized at a lower capacity.

In some embodiments, the intermediate loop further comprises a fourth heat exchanger receiving the first heat transfer fluid and a third working fluid to transfer heat from the first heat transfer fluid to the third working fluid.

In some embodiments, the method further comprises circulating the third working fluid through a third heat pump cycle, wherein the third heat pump cycle comprises (i) the fourth heat exchanger, and (ii) a fifth heat exchanger receiving the third working fluid and a fourth working fluid to transfer heat from the third working fluid to the fourth working fluid; circulating the fourth working fluid through a fourth heat pump cycle, wherein the fourth heat pump cycle comprises (i) the fifth heat exchanger, and (ii) a second steam generator; and providing a second feed stream comprising water to the second steam generator, wherein the second steam generator transfers heat from the fourth working fluid to the feed stream to generate the steam.

In some embodiments, the second heat exchanger and the fourth heat exchanger are configured in parallel.

In some embodiments, the second heat exchanger and the fourth heat exchanger are configured in series.

In some embodiments, the vapor compression system is air-sourced.

In some embodiments, a vapor compression fluid of the vapor compression system comprises one or more of a hydrocarbon fluid, a hydrofluoro-olefin (HFO) fluid, a hydrofluoro-chlorine (HFC) fluid, a hydrochlorofluoro-olefin (HCFO) fluid, or a natural refrigerant.

In some embodiments, the first heat exchanger (i) transfers heat to the first heat transfer fluid when a refrigeration load is low or zero or when a steam load is high or (ii) transfers heat from the first heat transfer fluid when a refrigeration load is high or when a heat pump load is low or zero.

In some embodiments, the method further comprises compressing the steam using a steam compressor.

In some embodiments, the method further comprises desuperheating the steam after the steam is compressed.

In some embodiments, the steam is desuperheated by injecting water into the steam at one or more locations to cool the steam down to a saturated state, wherein the one or more locations is downstream of the steam compressor, upstream of the steam compressor, or at the steam compressor.

In some embodiments, the steam is desuperheated by using a heat transfer fluid from one or more cycles of a heat pump at one or more locations to cool the steam down to a saturated state, wherein the one or more locations is downstream of the steam compressor, upstream of the steam compressor, or at the steam compressor.

In some embodiments, the method further comprises charging a storage tank using a fluid from the steam generator; and discharging the fluid from the storage tank, wherein the fluid is discharged as steam.

In some embodiments, the method further comprises closing one or more valves to isolate the storage tank, thereby preventing charging and discharging.

In another aspect, the present disclosure provides a system for generating steam comprising: an intermediate loop comprising a first heat exchanger and a second heat exchanger, wherein the intermediate loop is configured to circulate a first heat transfer fluid, and wherein the first heat exchanger is configured to receive an ambient air stream and the first heat transfer fluid to transfer heat from the ambient air stream to the first heat transfer fluid; a first heat pump cycle configured to circulate a first working fluid between the second heat exchanger and a third heat exchanger, wherein the second heat exchanger is configured to receive the first heat transfer fluid and the first working fluid to transfer heat from the first heat transfer fluid to the first working fluid, and wherein the third heat exchanger is configured to receive the first working fluid and a second working fluid to transfer heat from the first working fluid to the second working fluid; and a second heat pump cycle configured to circulate the second working fluid between the third heat exchanger and a fourth heat exchanger, wherein the fourth heat exchanger is configured to receive the second working fluid and a feed stream, wherein the feed stream comprises water, and wherein the first heat exchanger is decoupled from the first heat pump cycle and the second heat pump cycle.

In some embodiments, the system further comprises a heat-source subunit, wherein at least one component of the heat-source subunit is coupled to the intermediate loop.

In some embodiments, the heat-source subunit is a refrigeration system, a geothermal heat source, a waste heat stream from a process, or a wastewater or waste heat stream from a heat system, a power system, or a combined heat and power system.

In some embodiments, the heat-source subunit comprises a subunit fluid, wherein the intermediate loop comprises a subunit heat exchanger configured to receive the subunit fluid and the first heat transfer fluid to transfer heat from the subunit fluid to the first heat transfer fluid.

In some embodiments, at least a portion of the subunit fluid is condensed by the subunit heat exchanger.

In some embodiments, the system further comprises a heat-source subunit, wherein the heat-source subunit comprises a condenser and the condenser is decoupled from the intermediate loop.

In some embodiments, the condenser is configured to transfer heat from a subunit fluid of the subunit to a second heat transfer fluid, and wherein the second heat transfer fluid provides heat to the intermediate loop.

In some embodiments, the first heat transfer fluid directly provides refrigeration to the heat-source subunit.

In some embodiments, the first heat transfer fluid directly cools a water stream or a water reservoir.

In some embodiments, the intermediate loop comprises an additional heat exchanger in parallel with the first heat exchanger, wherein the additional heat exchanger receives ambient air and transfers heat from the ambient air to the first heat transfer fluid.

In some embodiments, the intermediate loop comprises an additional heat exchanger in series with the first heat exchanger, wherein the additional heat exchanger receives ambient air and transfers heat from the ambient air to the first heat transfer fluid.

In some embodiments, the intermediate loop is coupled to a vapor compression system, wherein the vapor compression system provides heat to the heat transfer fluid.

In some embodiments, the first heat exchanger is within a cycle of the vapor compression system.

In some embodiments, a vapor compression fluid of the vapor compression system comprises one or more of ammonia (NH3), water (H2O), carbon dioxide (CO2) pentane (C5H12), butane (C4H10), isobutane (HC(CH3)3), propane (C3H8), or propene (C3H6).

In some embodiments, the intermediate loop comprises an integrated vapor compression system.

In some embodiments, the integrated vapor compression system comprises a compressor, wherein the compressor is a positive displacement compressor.

In some embodiments, the positive displacement compressor is a screw compressor, a scroll compressor, or a reciprocating compressor.

In some embodiments, the positive displacement compressor is a screw compressor.

In some embodiments, the system further comprises one or more centrifugal compressor(s).

In some embodiments, the one or more centrifugal compressor(s) is one or more oil-free centrifugal compressor(s).

In some embodiments, the feed stream comprises water, and wherein the fourth heat exchanger is configured to heat the feed stream without changing a phase of the water of the feed stream.

In some embodiments, the system further comprises a flash tank downstream of the fourth heat exchanger configured to receive at least the water of the feed stream from the fourth heat exchanger.

In some embodiments, the flash tank is configured to decompresses at least the water of the feed stream and generate steam.

In some embodiments, an outlet of the fourth heat exchanger is steam, and the ambient air stream has a temperature of no greater than −20° C.

In some embodiments, the system is configured to produce steam as an outlet of the fourth heat exchanger when the ambient air stream has a temperature of no greater than −40° C.

In some embodiments, the system further comprises at least two flash tanks downstream of the fourth heat exchanger, wherein the at least two flash tanks are configured to receive at least the water of the feed stream from the fourth heat exchanger.

In some embodiments, the intermediate loop further comprises a fifth heat exchanger; and wherein the system further comprises: a third heat pump cycle configured to circulate a third working fluid between the fifth heat exchanger and a sixth heat exchanger, wherein the fifth heat exchanger is configured to receive the first heat transfer fluid and the third working fluid to transfer heat from the first heat transfer fluid to the third working fluid, and wherein the sixth heat exchanger is configured to receive the third working fluid and the fourth working fluid to transfer heat from the fourth working fluid to the fifth working fluid; and a fourth heat pump cycle configured to circulate a fourth working fluid between the sixth heat exchanger and a seventh heat exchanger, wherein the seventh heat exchanger is configured to receive the fourth working fluid and a second feed stream, wherein the second feed stream comprises water, and wherein the first heat exchanger is decoupled from the third heat pump cycle and the fourth heat pump cycle.

In some embodiments, the second heat exchanger and the fifth heat exchanger are configured in parallel.

In some embodiments, the second heat exchanger and the fifth heat exchanger are configured in series.

In some embodiments, the system further comprises a subcooler, wherein the subcooler is located downstream of the third heat exchanger or the fourth heat exchanger.

In some embodiments, the subcooler is placed at an elevation equal to or below the third heat exchanger or the fourth heat exchanger.

In some embodiments, the saturated or subcooled liquid from a top cycle is pulled from a bottom of the third heat exchanger or the fourth heat exchanger and connected to the subcooler.

In some embodiments, the saturated or subcooled liquid absorbs heat from the bottom cycle, evaporates and is driven upwards to (i) combine at an expansion valve outlet or (ii) is injected directly into the third heat exchanger or the fourth heat exchanger.

In some embodiments, a flow of a fluid of the top cycle entering the subcooler is controlled by a valve, wherein the valve is located upstream of the subcooler.

In some embodiments, a flow of a fluid of the top cycle entering the subcooler is controlled by a flow restriction, wherein the flow restriction is located on a diverted stream upstream of the subcooler.

In some embodiments, the subcooler cools a bottom cycle fluid using glycol, wherein the glycol was used to defrost a heat exchanger.

In some embodiments, the system further comprises a thermal storage system.

In some embodiments, the thermal storage system comprises a phase change material, and wherein the phase change material is configured to be (i) integrated into a heat exchanger or (ii) provided external to the heat exchanger, wherein the phase change material is further configured to charge and discharge stored energy using latent heat of phase change.

In another aspect, the present disclosure provides a method for generating steam, comprising: circulating a first working fluid through a refrigeration cycle, wherein the refrigeration cycle comprises a first heat exchanger receiving the first working fluid and a cooled fluid to transfer heat from the cooled fluid to the first working fluid; and circulating a second working fluid through a heat pump cycle, wherein the heat pump cycle comprises (i) a second heat exchanger receiving the first working fluid and the second working fluid to transfer heat from the first working fluid to the second working fluid, and (ii) a steam generator receiving the second working fluid and a feed stream to transfer heat from the second working fluid to the feed stream to produce a saturated steam stream, wherein the feed stream comprises water.

In some embodiments, the first working fluid of the refrigeration cycle comprises one or more of ammonia (NH3), water (H2O), carbon dioxide (CO2) pentane (C5H12), butane (C4H10), isobutane (HC(CH3)3), propane (C3H8), or propene (C3H6).

In some embodiments, the refrigeration cycle comprises a positive displacement compressor or a centrifugal compressor.

In some embodiments, the positive displacement compressor is a screw compressor, a scroll compressor, or a reciprocating compressor.

In some embodiments, the positive displacement compressor or the centrifugal compressor is an oil-free compressor.

In some embodiments, the refrigeration cycle comprises a third heat exchanger, wherein the third heat exchanger transfers heat from the first working fluid to an ambient air stream.

In some embodiments, a maximum temperature of the first working fluid during operation is no greater than 100° C.

In some embodiments, the first working fluid of the refrigeration cycle comprises one or more of a hydrocarbon fluid, a hydrofluoro-olefin (HFO) fluid, a hydrofluoro-chlorine (HFC) fluid, a hydrochlorofluoro-olefin (HCFO) fluid, or a natural refrigerant.

In another aspect, the present disclosure provides a system for generating steam, comprising: a refrigeration cycle configured to circulate a first working fluid, the refrigeration cycle comprising a first heat exchanger configured to receive the first working fluid and a cooled fluid to transfer heat from the cooled fluid to the first working fluid; and a heat pump cycle configured to circulate a second working fluid, the heat pump cycle comprising (i) a second heat exchanger, and (ii) a steam generator configured to receive the second working fluid and a feed stream to transfer heat from the second working fluid to the feed stream to produce a saturated steam stream, wherein the feed stream comprises water.

In some embodiments, the first working fluid of the refrigeration cycle or the second working fluid of the heat pump cycle comprises one or more of ammonia (NH3), water (H2O), carbon dioxide (CO2) pentane (C5H12), butane (C4H10), isobutane (HC(CH3)3), propane (C3H8), propene (C3H6), a hydrocarbon fluid, a hydrofluoro-olefin (HFO) fluid, and a hydrofluoro-chlorine (HFC) fluid, a hydrochlorofluoro-olefin (HCFO) fluid, or a natural refrigerant.

In some embodiments, the refrigeration cycle comprises a positive displacement compressor or a centrifugal compressor.

In some embodiments, the positive displacement compressor of the refrigeration cycle is a screw compressor.

In some embodiments, the refrigeration cycle further comprises at least one of a low-temperature evaporator, an air-cooled condenser, or a heat exchanger, coupled to a water loop comprising a condenser.

In some embodiments, the heat pump cycle further comprises at least one of an economizer, a compressor, an intercooler, or a suction-line heat exchanger.

In some embodiments, a maximum temperature of the first working fluid of the refrigeration cycle is no greater than 100° C.

In another aspect, the present disclosure provides a method for generating steam, comprising: circulating a first working fluid through a first heat pump cycle, wherein the first working fluid is subcritical in at least a portion of the first heat pump cycle; circulating a second working fluid through a second heat pump cycle, wherein the second heat pump cycle comprises a first steam generator, and wherein the second working fluid is subcritical in at least a portion of the second heat pump cycle, and wherein the first working fluid is supercritical in at least a portion of the first heat pump, the second working fluid is supercritical in at least a portion of the second heat pump system or the first working fluid and the second working fluid are supercritical in at least a portion of the first heat pump cycle and the second heat pump cycle; and providing a heat exchanger to receive the first working fluid and the second working fluid to transfer heat from the first working fluid to the second working fluid.

In some embodiments, the first working fluid comprises one or more of ammonia (NH3), water (H2O), carbon dioxide (CO2) pentane (C5H12), butane (C4H10), isobutane (HC(CH3)3), propane (C3H8), or propene (C3H6).

In some embodiments, the second working fluid comprises one or more of ammonia (NH3), water (H2O), carbon dioxide (CO2) pentane (C5H12), butane (C4H10), isobutane (HC(CH3)3), propane (C3H8), or propene (C3H6).

In some embodiments, the first working fluid or the second working fluid comprises one or more of a hydrocarbon fluid, a hydrofluoro-olefin (HFO) fluid, a hydrofluorochlorine (HFC) fluid, a hydrochlorofluoro-olefin (HCFO) fluid, or a natural refrigerant.

In some embodiments, the first heat pump cycle transfers air from an ambient air stream to the first working fluid.

In some embodiments, at least one of the first heat pump cycle or the second heat pump cycle comprises an oil-free compressor.

In some embodiments, the oil-free compressor is a positive displacement compressor or a centrifugal compressor.

In some embodiments, the second heat pump cycle comprises a second steam generator.

In some embodiments, either the first heat pump cycle or the second heat pump cycle further comprises an economizer, an intercooler, a suction-line heat exchanger or at least two condensers.

In another aspect, the present disclosure provides a system for generating steam or hot water, comprising: a first heat pump cycle configured to circulate a first working fluid, wherein the first working fluid is subcritical in at least a portion of the first heat pump cycle; a second heat pump cycle comprising a first steam generator, wherein the second heat pump cycle is configured to circulate a second working fluid, wherein the second working fluid is subcritical in at least a portion of the second heat pump cycle, wherein the first working fluid is supercritical in at least a portion of the first heat pump, the second working fluid is supercritical in at least a portion of the second heat pump system or the first working fluid and the second working fluid are supercritical in at least a portion of the first heat pump cycle and the second heat pump cycle, and wherein the first steam generator is configured to (i) receive the second working fluid from a first compressor and a feed stream comprising water, and (ii) transfer heat from the second working fluid to the feed stream to generate the steam or hot water; and a first heat exchanger configured to receive the first working fluid and the second working fluid and to transfer heat from the first working fluid to the second working fluid.

In some embodiments, the system further comprises a second steam generator in parallel with the first steam generator, wherein the second steam generator (i) receives a second supercritical fluid stream from the first compressor and a water stream, and (ii) generates the saturated steam.

In some embodiments, the system further comprises a second compressor in series with the first compressor and the first steam generator, wherein the first steam generator directs a first supercritical fluid to the second compressor and the second compressor directs a second supercritical fluid stream to the first steam generator or a second steam generator.

In some embodiments, the first steam generator and the second steam generator generate different temperature steam.

In some embodiments, the portion of the second heat pump cycle where the second working fluid is supercritical comprises at least a portion of the second working fluid within the steam generator.

In another aspect, the present disclosure provides a method for generating steam, comprising: circulating a first working fluid through a first heat pump cycle, circulating a second working fluid through a second heat pump cycle, providing a first heat exchanger to receive the first working fluid and the second working fluid and transfer heat from the first working fluid to the second working fluid; providing a first evaporator and an ambient air stream, wherein the first evaporator receives the ambient air stream and either the first working fluid or the second working fluid to transfer heat from the ambient air stream to either the first working fluid or the second working fluid; and providing a second evaporator and an external heat source, wherein the second evaporator receives either the first working fluid or the second working fluid and transfers heat from the heat sources to either the first working fluid or the second working fluid.

In some embodiments, the external heat source comprises (i) a refrigeration cycle, (ii) a geothermal heat source, (iii) a waste heat source from a process, a wastewater or waste heat stream from a heat system, a power system, or a combined heat and power system, (iv) a carbon capture process, (v) a body of water, (vi) a district energy system, (vii) a solar thermal heat source, or (viii) a nuclear reactor.

In some embodiments, the body of water is a lake or a river.

In some embodiments, the carbon capture process is a direct air capture system.

In some embodiments, an inlet temperature of the first evaporator is lower than an inlet temperature of the second evaporator.

In some embodiments, at least 500 kg/hour of steam is produced.

In another aspect, the present disclosure provides a system for generating steam, comprising: a first heat pump cycle, wherein the first heat pump cycle is configured to circulate a first working fluid; a second heat pump cycle comprising at least one compressor, at least one expansion valve, and a first steam generator, wherein the second heat pump cycle is configured to circulate a second working fluid; a first heat exchanger configured to receive the first working fluid and the second working fluid to transfer heat from the first working fluid to the second working fluid; a first evaporator, wherein the first evaporator is configured to receive an ambient air stream and the first working fluid or the second working fluid to transfer heat from the ambient air stream to the first working fluid or the second working fluid; and a second evaporator configured to transfer heat from a heat source to the first working fluid or the second working fluid.

In some embodiments, the second evaporator is coupled to (i) a coupled or decoupled refrigeration cycle, (ii) a geothermal heat source, or (iii) a waste heat source from a process, (iv) a carbon capture process, (v) a body of water, (vi) a district energy system, (vii) a solar thermal heat source, or (viii) a nuclear reactor.

In some embodiments, the body of water is a lake or a river.

In some embodiments, the carbon capture process is a direct air capture system.

In some embodiments, the second evaporator is in parallel with the first evaporator.

In some embodiments, at least one of the first evaporator or the second evaporator is intermittently bypassed.

In some embodiments, the first evaporator and the second evaporator are within the first heat pump cycle.

In some embodiments, the first evaporator and the second evaporator are within the second heat pump cycle.

In some embodiments, one of the first evaporator and the second evaporator is within the first heat pump cycle, and the other of the first evaporator and the second evaporator is within the second heat pump cycle.

In some embodiments, the first heat pump cycle comprises at least a first compressor and a second compressor and the second evaporator is in series with the second compressor and in parallel with the first compressor.

In some embodiments, the second heat pump cycle comprises at least a first compressor and a second compressor and the second evaporator is in series with the second compressor and in parallel with the first compressor.

In another aspect, the present disclosure provides a method for generating steam, comprising: circulating a first working fluid through a first heat pump cycle; circulating a second working fluid through a second heat pump cycle, wherein the second heat pump cycle comprises a first steam generator; providing a first heat exchanger to receive the first working fluid and an ambient air stream to transfer heat from the ambient air stream to the first working fluid; providing a second heat exchanger to receive the first working fluid and the second working fluid and transfer heat from the first working fluid to the second working fluid; providing a first feed stream comprising water to the first steam generator and transferring heat from the second working fluid to the first feed stream to generate the steam; and providing a second feed stream comprising water to a third heat exchanger to transfer heat from the second working fluid to the second feed stream.

In another aspect, the present disclosure provides a system for generating steam, comprising: a first heat pump cycle, wherein the first heat pump cycle is configured to circulate a first working fluid; a second heat pump cycle comprising a first steam generator, wherein the second heat pump cycle is configured to circulate a second working fluid, and wherein the first steam generator is configured to receive a first water stream and the second working fluid to transfer heat from the second working fluid to the first water stream generate the steam, a first heat exchanger configured to receive the first working fluid and the second working fluid to transfer heat from the first working fluid to the second working fluid; a second heat exchanger, wherein the second heat exchanger is configured to (i) receive the first working fluid and an ambient air stream, and (ii) transfer heat from the ambient air stream to the first working fluid; and a third heat exchanger, wherein the third heat exchanger is configured to receive a second water stream and at least one of the first working fluid and the second working fluid to transfer heat from one of the first working fluid and the second working fluid to the second water stream.

In some embodiments, the third heat exchanger and the first heat exchanger are in parallel in the first heat pump cycle.

In some embodiments, the third heat exchanger is within the second heat pump cycle.

In another aspect, the present disclosure provides a method for generating steam, comprising: circulating a working fluid through a heat pump cycle, wherein the heat pump cycle comprises a compressor; and transferring heat from the working fluid to a feed stream comprising water to generate an outlet stream comprising steam.

In some embodiments, the heat pump cycle comprises one or more oil-free compressor(s).

In some embodiments, the steam of the outlet stream has a temperature of at least 120° C.

In some embodiments, the method further comprises providing an ambient air stream thermally coupled to the heat pump cycle and transferring heat from the ambient air stream to the working fluid.

In some embodiments, the compressor comprises bearings that are lubricated with liquid refrigerant.

In some embodiments, the compressor comprises at least one jet to apply the liquid refrigerant to the bearings.

In some embodiments, the compressor comprises at least two jets to apply the liquid refrigerant to the bearings.

In some embodiments, the compressor is double ended.

In some embodiments, the compressor comprises a preload spring between a mount housing the bearings and a chassis of the compressor.

In some embodiments, the bearings comprise nitrogen treated stainless steel.

In some embodiments, the method further comprises: a. transferring heat from an ambient air to the heat pump cycle using one or more heat exchanger(s); and b. defrosting at least one of the one or more heat exchanger(s).

In some embodiments, the one or more heat exchanger(s) is defrosted by electric resistance heaters embedded in or on one or more coils of the heat exchanger.

In some embodiments, the one or more heat exchanger(s) is defrosted by heating the ambient air prior with electric resistance heaters prior to heat transfer with a heat transfer fluid.

In some embodiments, the one or more heat exchanger(s) is defrosted by thermal coupling with a hot gas bypass from a discharge line of a compressor.

In some embodiments, the one or more heat exchanger(s) is defrosted by heating an intermediate fluid and circulating the intermediate fluid in thermal contact with the one or more heat exchanger.

In some embodiments, the one or more heat exchanger(s) is defrosted by directing a fluid stream comprising water or steam onto a surface of the one or more heat exchanger.

In some embodiments, the one or more heat exchanger(s) are defrosted sequentially or simultaneously.

In some embodiments, the heat pump cycle further comprises an oil loop for lubricating one or more ball bearings with the compressor.

In some embodiments, the compressor comprises one or more magnetic coils on an end of a shaft for thrust balancing.

In some embodiments, the compressor is cooled by a motor coolant stream, wherein the motor coolant stream comprises a refrigerant.

In some embodiments, the motor coolant stream is cooled by (i) a glycol cooler, (ii) an air cooler, or (iii) a vapor compression cycle.

In some embodiments, the compressor is cooled by a water stream.

In some embodiments, the compressor is cooled by injecting a portion of the working fluid in between stages of the compressor, wherein the portion of the working fluid is cooled in an economizer before the injection.

In some embodiments, the compressor comprises one or more shaft seals.

In some embodiments, the compressor comprises one or more guide vanes.

In some embodiments, the compressor comprises one or more collectors.

In some embodiments, the compressor comprises a diffuser.

In some embodiments, the compressor comprises a shroud.

In some embodiments, the method further comprises cooling a space with air from a heat pump system, wherein the heat pump system comprises the heat pump cycle.

In some embodiments, the method further comprises transferring heat from the air to the heat pump system after the cooling of the space.

In another aspect, the present disclosure provides a method for generating steam, comprising: providing a first system in an outdoor space, wherein the first system comprises a heat transfer fluid cycle, wherein the first system transfers heat from an ambient air stream to a heat transfer fluid; and providing a second system in an indoor space, wherein the second system comprises at least one heat pump cycle, wherein the second system receives the heat transfer fluid and transfers heat to a feed stream comprising water to generate steam.

In some embodiments, the heat transfer fluid is a refrigerant fluid.

In some embodiments, the refrigerant fluid comprises one or more of water or glycol.

In some embodiments, the second system comprises at least two heat pump cycles coupled together.

In some embodiments, the steam is generated as an outlet stream from a heat exchanger coupled to the at least one heat pump cycle, wherein the heat exchanger is configured to receive the feed stream comprising water.

In some embodiments, the method further comprises decompressing a pressurized stream comprising water in a flash tank to generate the steam; wherein the flash tank is within, or coupled to, the second heat pump system and receives a fluid stream comprising water from the heat exchanger of the second heat pump system.

In some embodiments, a heat exchanger of the first heat pump system, configured to receive the ambient air, is defrosted.

In some embodiments, the heat exchanger is defrosted by electric resistance heaters embedded in or on one or more coils of the heat exchanger.

In some embodiments, the heat exchanger is defrosted by heating the ambient air prior with electric resistance heaters prior to heat transfer with the heat transfer fluid.

In some embodiments, the heat exchanger is defrosted by thermal coupling with a hot gas bypass from a discharge line of a compressor.

In some embodiments, the heat exchanger is defrosted by heating an intermediate fluid and circulating the intermediate fluid in thermal contact with the heat exchanger.

In some embodiments, the heat exchanger is defrosted by directing a fluid stream comprising water or steam onto a surface of the heat exchanger.

In some embodiments, the method further comprises transferring heat from a heat transfer fluid to the working fluid, wherein a heat transfer loop comprises the heat transfer fluid.

In some embodiments, the heat transfer loop is an intermediate heat transfer loop located between the heat pump and a second heat pump.

In some embodiments, the method further comprises routing the heat transfer fluid to an end-user, wherein the heat transfer fluid is hot water.

In another aspect, the disclosure provided a method of cooling at least one of a shaft or a rotor of an oil-free compressor comprising: providing a refrigerant fluid to a cavity in thermal contact with the at least one of the shaft or the rotor, wherein the refrigerant fluid at least partially evaporates in the cavity, and wherein the cooling the at least one of the shaft or the rotor of the oil-free compressor maintains a temperature of the rotor to below a temperature threshold for demagnetization of a permanent magnet in the rotor.

In some embodiments, the temperature threshold for demagnetization is no greater than 150° C.

In some embodiments, the compressor compresses a fluid stream comprising water or steam to generate an outlet stream comprising steam with a temperature of at least 120° C.

In some embodiments, the compressor compresses a fluid to generate an outlet stream comprising a gas with a temperature of at least 80° C.

In another aspect, the present disclosure provides a method for generating steam, comprising: providing a carbon capture system comprising a regeneration step; directing a saturated steam fluid stream to the regeneration step, wherein the saturated steam fluid stream is at least partially condensed; and directing a fluid stream exiting the regeneration step to a heat pump cycle, wherein the fluid stream from the regeneration step provides heat to the heat pump cycle, and wherein the heat pump cycle generates the steam.

In some embodiments, the fluid stream exiting the regeneration step comprises CO2.

In some embodiments, the fluid stream exiting the regeneration step further comprises nitrogen (N2) and/or oxygen (O2).

In some embodiments, at least a portion of the steam generated by the heat pump cycle is directed to the regeneration step of the carbon capture system.

In some embodiments, the method further comprises: (i) cooling a space with air from a heat pump system, wherein the heat pump system comprises the heat pump cycle and (ii) routing the air to a sorbent bed of the carbon capture system.

In another aspect, the present disclosure provides a method for high temperature compressor cooling, comprising: using one or more pumps to transport liquid from one or more locations of a main cycle to one or more motors as motor coolant during start-up conditions when a pressure ratio across a plurality of compressors of a system is below a threshold; and transitioning to pressure driven flow for the motor coolant by using the liquid from one or more locations of the main cycle and turning off the one or more pumps, upon the system gaining pressure and exiting the start-up conditions.

In some embodiments, the one or more locations in (a) is different from the one or more locations in (b).

In some embodiments, the one or more locations in (a) is (i) between an expansion valve and an evaporator of the system, (ii) between a condenser and an economizer of the system, (iii) from a condenser, (iv) at the discharge of a condenser, (v) at a discharge portion of a suction line heat exchange, (vi) at the coldest liquid in the system (vii) any location between a condenser and an expansion valve of the system, or (viii) any location on a high pressure side of the main cycle having a liquid reservoir.

In some embodiments, the another location in (b) is (i) between an expansion valve and an evaporator of the system, (ii) between a condenser and an economizer of the system, (iii) from a condenser, (iv) at the discharge of a condenser, (v) at a discharge portion of a suction line heat exchange, (vi) at the coldest liquid in the system (vii) any location between a condenser and an expansion valve of the system, or (viii) any location on a high pressure side of the main cycle having a liquid reservoir.

In another aspect, the present disclosure provides a method for high temperature compressor cooling, comprising: dividing motor coolant among a plurality of compressor stages in a system; pooling together the motor coolant that has been divided among the plurality of compressor from (a); and routing the motor coolant pooled from (b) to a suction side of a compressor having a lowest pressure.

In some embodiments, the routing the motor coolant in (c) comprises (i) piping the motor coolant to a discharge of an evaporator of the system, (ii) piping the motor coolant to an inlet of the evaporator, or between an expansion valve and the evaporator, or (iii) combining the motor coolant with a hot gas bypass stream.

In another aspect, the present disclosure provides a method for high temperature compressor cooling, comprising: dividing motor coolant among a plurality of compressor stages in a system; pooling together the motor coolant that has been divided among the plurality of compressor from (a); and routing the motor coolant pooled from (b) to one or more locations in the system based at least in part on one or more operating conditions of the system.

In some embodiments, the one or more operating conditions of the system comprise an operating temperature of the system.

In some embodiments, the motor coolant is routed to a suction side of a compressor having a lowest pressure when the operating temperature is above a threshold temperature.

In some embodiments, the motor coolant is routed to between two or more compressor stages, or downstream of a subsequent compressor stage, when the operating temperature is below a threshold temperature.

In another aspect, the present disclosure provides a method for integrating heat pump operation with carbon capture, comprising: obtaining a fluid mixture through a direct air capture (DAC) regeneration step; using the fluid mixture as a heat source for a heat pump system, wherein the heat pump system condenses and subcools the fluid mixture; and using separated subcooled water from the fluid mixture as feedwater for the heat pump to generate steam for repeating the DAC regeneration step.

In another aspect, the present disclosure provides a defrost method comprising: providing a glycol heater at one or more location(s) of a system; diverting a volume of glycol to the glycol heater to heat the volume of glycol using at least in part heat from a working fluid of a heat pump cycle; and routing the volume of glycol to one or more heat exchanger(s) of a heat pump; defrosting the one or more heat exchanger(s) using the volume of glycol.

In some embodiments, the one or more location(s) comprise a bottom cycle compressor discharge location, a top cycle compressor discharge location, or any location on the top cycle.

In some embodiments, a slipstream of a cycle refrigerant is used in parallel with a main flow of the cycle refrigerant to heat the volume of glycol.

In some embodiments, the glycol heater is operated in parallel with a heat exchanger, by at least in part (i) condensing a refrigerant using the glycol heater and (ii) routing the refrigerant to an outlet of the two-phase heat exchanger.

In some embodiments, the one or more location(s) comprise a location on a top cycle of a system at a location before an expansion valve, wherein a performance of the top cycle is improved through subcooling of a refrigerant.

In some embodiments, the subcooling reduces a vapor quality at an inlet of an evaporator.

In some embodiments, the one or more heat exchanger(s) are defrosted in parallel using a single glycol loop, wherein glycol in the single glycol loop is used to defrost each individual heat exchanger of the one or more heat exchanger(s) sequentially or simultaneously.

In another aspect, the present disclosure provides a method of heating glycol, comprising: using charging or discharging of thermal storage to heat the glycol used in a defrost cycle, wherein the defrost cycle comprises single defrosting or parallel defrosting.

In another aspect, the present disclosure provides a system comprising a suction line heat exchanger and an economizer, wherein locations of the suction line heat exchanger and the economizer are switchable in any cycle configuration.

In some embodiments, the switchability of the locations of the suction line heat exchanger and the economizer permits a liquid at an outlet of a steam generator of the system to be cooled by the suction line heat exchanger before the liquid enters the economizer.

In another aspect, the present disclosure provides a system comprising a suction line heat exchanger and an economizer, wherein a fluid flowing to an expansion valve of the economizer is pulled from a slipstream after the suction line heat exchanger which causes the fluid to cool by at least 10-50 degrees Celsius.

In another aspect, the present disclosure provides a system comprising a plurality of compressor stages, wherein an economizer or intercooler is configured to be injected into one or more locations among the plurality of compressor stages, based at least in part on an operating mode of the system.

In some embodiments, the operating mode is based at least in part on whether one or more compressors in a given cycle are operating or being bypassed.

In some embodiments, the operating mode is based at least in part on the total pressure ratio across the one or more compressors.

In some embodiments, the operating mode is based at least in part on an ambient air temperature.

In another aspect, the present disclosure provides a system comprising a plurality of compressor stages and a plurality of economizers at a plurality of intercooler or injection locations, wherein the plurality of economizers are configured to operate in parallel or series.

In another aspect, the present disclosure provides a method comprising: using an ejector in one or more cycles to recover energy in a refrigerant flow's throttling process, by at least in part increasing heat absorption capacity and reducing work performed by one or more compressors.

In another aspect, the present disclosure provides a method of using a flash tank economizer, comprising: throttling flow leaving a condenser to a lower pressure to form a two-phase fluid; providing the two-phase fluid to a flash tank; routing vapor off a top of the flash tank to an intercooler location between two or more compressor stages, thereby providing cooling and increased flow for subsequent compressor stages; and throttling a liquid on a bottom of the flash tank to an evaporator pressure, wherein the liquid is heated by a heat source or a bottom cycle.

In another aspect, the present disclosure provides a method of using a flash tank between compressor stages, comprising: cooling and throttling a refrigerant to an intermediate pressure to form a two-phase fluid after flow has exited a first heat exchanger; combining the two-phase fluid with flow from a discharge of a first compressor to form a two-phase mixture; providing the two-phase mixture to the flash tank; and routing saturated liquid at a bottom of the flash tank to a second heat exchanger, causing the refrigerant to evaporate and enter a suction of the first compressor; and routing saturated vapor at a top of the flash tank to a suction of a second compressor.

In some embodiments, the method further comprises closing a valve on an outlet stream at the top of the flash tank, wherein the closing the valve results in all fluid exiting the flash tank to route to the second heat exchanger.

In some embodiments, the method further comprises: closing a valve on a stream between an economizer and the second compressor, wherein the valve is closed during high ambient temperature.

In another aspect, the present disclosure provides a system comprising a plurality of heat pumps and a centralized bank of air-coils, wherein the centralized bank of air-coils comprises a glycol loop configured to gather heat from ambient air.

In some embodiments, the plurality of heat pumps are provided at separate locations or at a centralized location.

In some embodiments, the plurality of heat pumps are in series or parallel.

In another aspect, the present disclosure provides a steam generating air-source heat pump comprising an integrated device comprising a plurality of heat exchanger functions, wherein the integrated device comprises at least two inlet ports or at least two outlet ports.

In some embodiments, the integrated device is a combination of a steam generator, an economizer, and a suction line heat exchanger.

In some embodiments, the integrated device is a combination of a two-phase heat exchanger, an economizer, and an evaporator.

In another aspect, the present disclosure provides a method of generating steam, comprising: heating a working fluid of a topping cycle by transferring heat from a working fluid of a heat pump cycle to the working fluid of the topping cycle; compressing the working fluid of the topping cycle; generating steam by transferring heat from the working fluid of the topping cycle to a feed stream of water.

Another aspect of the present disclosure provides a non-transitory computer readable medium comprising machine executable code that, upon execution by one or more computer processors, implements any of the methods described above or elsewhere herein.

Another aspect of the present disclosure provides a system comprising one or more computer processors and computer memory coupled thereto. The computer memory comprises machine executable code that, upon execution by the one or more computer processors, implements any of the methods described above or elsewhere herein.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

The novel features of the disclosure are set forth with particularity in the appended claims. A better understanding of the features and advantages of the disclosure will be obtained by reference to the following detailed description that sets forth illustrative embodiments, in which the principles of the disclosure are utilized, and the accompanying drawings (also "Figure" and "FIG." herein), of which:

FIGS. 16B-H illustrate an operational example for the steam generating system in FIG. 16A.

FIGS. 40B-F illustrate an operational example for the steam generating system in FIG. 16 with the addition of add-on compressors as shown in FIG. 40A.

DETAILED DESCRIPTION

Figure 1:
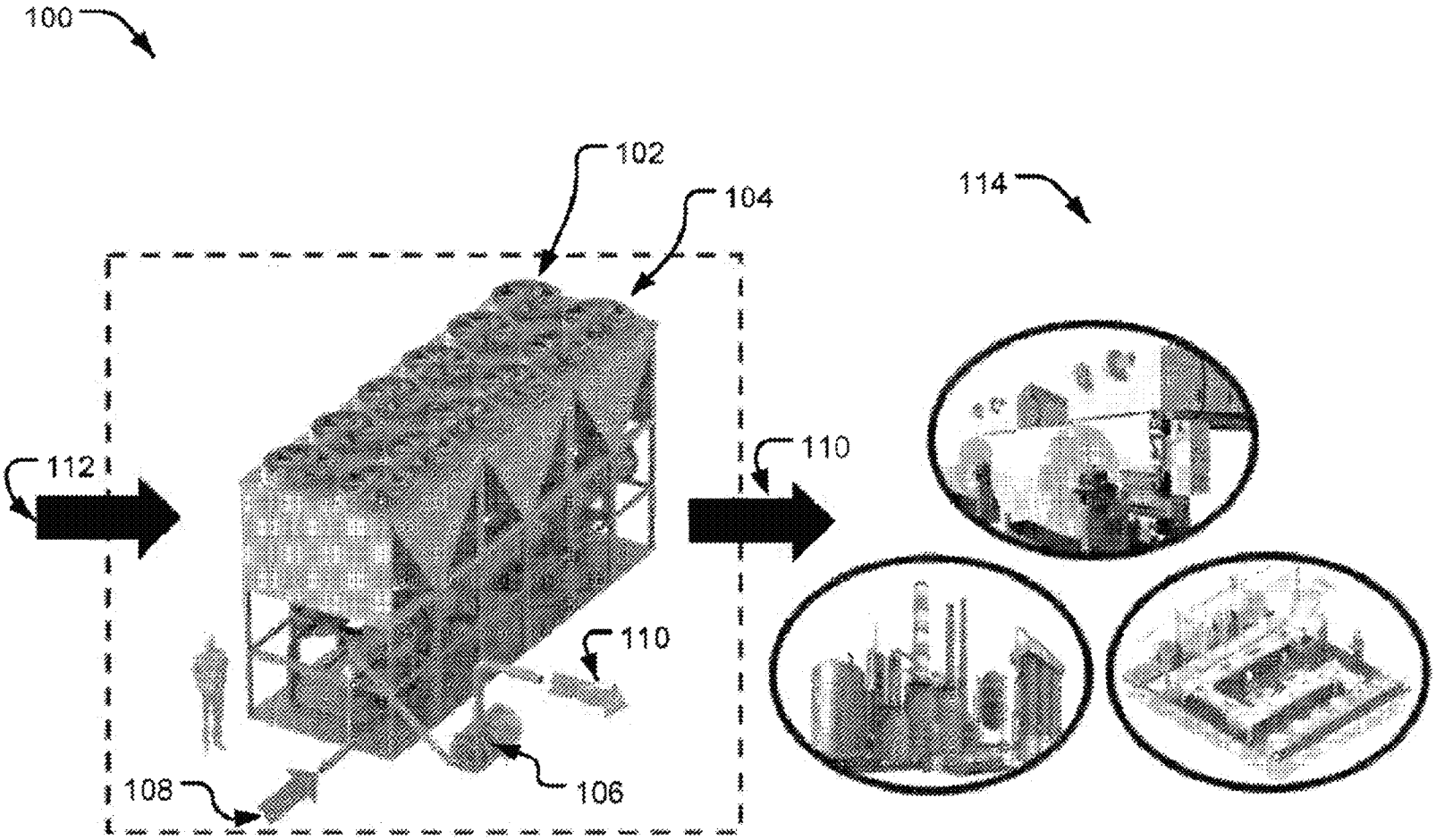
FIG. 1 illustrates a heat pump system in accordance with some embodiments described herein.

While various embodiments have been shown and described herein, it will be obvious to those skilled in the art that such embodiments are provided by way of example only. Numerous variations, changes, and substitutions may occur to those skilled in the art without departing from the disclosure. It should be understood that various alternatives to the embodiments described herein may be employed.

Whenever the term "at least," "greater than," or "greater than or equal to" precedes the first numerical value in a series of two or more numerical values, the term "at least" or "greater than" applies to each one of the numerical values in that series of numerical values.

Whenever the term "no more than," "less than," or "less than or equal to" precedes the first numerical value in a series of two or more numerical values, the term "no more than" or "less than" applies to each one of the numerical values in that series of numerical values.

The term "about" or "nearly" as used herein generally refers to within (plus or minus) 15%, 10%, 9%, 8%, 7%, 6%, 5%, 4%, 3%, 2%, or 1% of a designated value.

As used herein, the singular forms "a", "an", and "the" include plural references unless the context clearly dictates otherwise.

Definitions

The term "heat exchanger," as used herein, generally refers to a mechanism configured to transfer heat from a first one or more fluids to a second one or more fluids. In an instance, a heat exchanger may be a single heat exchanger and/or a multiple heat exchanger arrangement. A multiple heat exchanger arrangement may be comprised of two or more heat exchangers. The multiple heat exchanger arrangement may comprise two or more heat exchangers in parallel, series, or a combination thereof. A heat exchanger may refer to a steam generator, a hot water generator, an evaporator, a condenser, a two-phase heat exchanger, a three fluid heat exchanger, a heat recovery heat exchanger, a waste heat exchanger, a suction-line heat exchanger, a subcooler, a de-superheater, and/or a combination thereof. A combination of one or more heat exchangers may allow for a cost reductions, packaging efficiency, or improved system operation. A heat exchanger may be an air-source heat exchanger. A heat exchanger may change a temperature, pressure, composition, phase, or a combination thereof of one or more fluids put through the heat exchanger. A heat exchanger as referred herein may be one or more heat exchangers as described above, wherein any type of heat exchanger may be changed or replaced with any type of heat exchanger based on a desired function and/or operation. A heat exchanger described herein may refer to, or be, a shell and tube heat exchanger, a brazed plate, a welded plate, a gasketed plate, a plate-fin, or a microtube. In some cases, a heat exchanger refers to a unit that has one or more of the elements listed above. The heat exchanger may have a fin tube on a side in thermal contact with an ambient air stream, may comprise a microtube, may be additively manufactured, and/or may comprise a tube-in-tube heat exchanger. The heat exchanger may have multiple inlet or outlet ports to perform multiple functions of the heat pump. Additional elements and configurations may be selected to increase an efficiency of a heat exchanger described herein, such as one or more heat transfer enhancers selected from the group consisting of an extended surface, a fin, turbulators (e.g., twisted tape) to increase turbulence of a fluid passing through the heat exchanger, and/or surface treatments (e.g., porous media).

The term "working fluid," as used herein, generally refers to a substance (e.g., a liquid, vapor, gas, or a combination thereof) that interacts with at least one element of a system. The working fluid refers to a heat transfer fluid of a system. The working fluid may refer to a feed fluid (e.g., feed stream). The working fluid may refer to a fluid at a stage of a fluid circulating through a system and/or cycle. A working fluid may reject heat. A working fluid may absorb heat. A working fluid may change composition and/or phase while circulating through a cycle. A working fluid may be a coolant, a refrigerant, and/or a lubricant. A working fluid may comprise water, steam, glycol, air, a fluorocarbon, a hydrofluoroolefin, a hydrofluoroether, a hydrochlorofluoroolefins, a hydrocarbon, ammonia ($NH_3$), water ($H_2O$), carbon dioxide ($CO_2$), pentane ($C_5H_{12}$), butane ($C_4H_{10}$), isobutane ($HC(CH_3)_3$), propane ($C_3H_8$), and propene ($C_3H_6$), or a combination thereof. A working fluid as referred herein may be one or more working fluids as described above, wherein any type of working fluid may be changed or replaced with any type of working fluid based on a desired function and/or operation.

The term "Compressor," as used herein, generally refers to a mechanism for increasing the pressure of a substance. In an instance, a compressor may be a single compressor or a multiple stage compressor arrangement. A multiple stage compressor arrangement may be comprised of two or more compressors. The multiple stage compressor arrangement may comprise two or more compressors in parallel, series, or a combination thereof. In an instance, a compressor may comprise a multiple stage compressor, a double ended compressor, a centrifugal compressor, a lubricated compressor, an oil free compressor, an axial compressor, a steam compressor, a single shaft compressor, a magnetically coupled compressor, a multiple shaft compressor, and/or a positive displacement compressor (e.g., a screw compressor, a scroll compressor, a reciprocating compressor, etc.). A double ended compressor may be a double ended centrifugal compressor. In some embodiments a centrifugal compressor may be an oil-free centrifugal compressor. The oil-free centrifugal compressor may be configured to provide a refrigerant to a shaft and or rotor of the compressor. The refrigerant may at least partially evaporate in a motor cavity of the compressor. A compressor as described herein can be coupled to one or more heat exchangers as described above, wherein any type of compressor may be changed with any other type of compressor based on a desired function and/or operation.

The term "hot water" or "high temperature water" may refer to water stream that has a temperature of greater than or equal to about 10° C., 15° C., 20° C., 25° C., 30° C., 35° C., 40° C., 45° C., 50° C., 55° C., 60° C., 65° C., 70° C., 75° C., 80° C., 85° C., 90° C., 95° C., or greater. The hot water may have a temperature that is less than or equal to about 100° C., 95° C., 90° C., 85° C., 80° C., 75° C., 70° C., 65° C., 60° C., 55° C., 50° C., 45° C., 40° C., 35° C., 30° C., 25° C., 20° C., 15° C., 10° C., 5° C., or less. The hot water may have a temperature that is between any two values described above, for example between about 40° C. and about 80° C.

The term "warm water" or "low-temperature water" may refer to water stream that has a temperature of greater than or equal to about 1° C., 10° C., 15° C., 20° C., 25° C., 30° C., 35° C., 40° C., 45° C., 50° C., 55° C., 60° C., 65° C., 70° C., 75° C., 80° C., 85° C., 90° C., 95° C., or greater. The hot water may have a temperature that is less than or equal to about 100° C., 95° C., 90° C., 85° C., 80° C., 75° C., 70° C., 65° C., 60° C., 55° C., 50° C., 45° C., 40° C., 35° C., 30° C., 25° C., 20° C., 15° C., 10° C., 5° C., or less. The hot water may have a temperature that is between any two values described above, for example between about 15° C. and about 40° C.

Steam Generating System

In one aspect, the present disclosure provides a system for generating steam. In some embodiments, the system comprises a heat pump system (e.g., heat pump cycle). In some embodiments, the system may be configured to be a cascading steam heat pump system. In some embodiments the system may comprise a transfer fluid pump cycle (e.g., a heat transfer fluid cycle) and a heat pump system comprising at least a first heat pump cycle and a second heat pump cycle as illustrated by the non-limiting examples in FIGS. 16-19. As used herein, the term "transfer fluid pump cycle" may refer to, and be used interchangeably with, a "heat transfer fluid cycle." In some embodiments, the first heat pump cycle may be configured to be a bottom cycle and the second heat pump cycle may be configured to be a top cycle. In some embodiments, the transfer fluid pump cycle (e.g., a heat transfer fluid cycle) may be configured to circulate a transfer fluid (e.g., working fluid). In some embodiments, the transfer fluid pump cycle (e.g., a heat transfer fluid cycle) may comprise an initial heat exchanger, a first heat exchanger, and a circulation pump. In some embodiments, the initial heat exchanger and/or a heat exchanger of the described system may be an air-sourced heat exchanger. As used herein, the term "air-sourced heat exchanger" may be used interchangeably with the term "air-source heat exchanger." In some embodiments, the initial heat exchanger (e.g., an air-source heat exchanger) is decoupled from the first and second heat pump cycles (e.g., through a heat transfer fluid cycle). The air-source heat exchanger may be configured to be located separately from the first and second heat pump cycles (e.g., through a heat transfer fluid cycle). The benefits of a transfer fluid pump cycle may include increased efficiency, ability to decouple an air source heat exchanger from the main components of the heat pump system (e.g., locating the air source heat exchanger outside and the heat pump inside or close to the steam end-user), avoids long piping routes of pressurized refrigerant, simplicity in controls (e.g., easier methods of defrosting during cold weather by heating a glycol loop), and/or easier integration with other processes (e.g. waste heat sources or refrigeration system integration). The benefits of locating the heat pump closer to the steam end-user may include generation of lower pressure steam and/or increase efficiency of the heat pump. The benefits of shorter piping routes may include decreased risk of leakage and/or lower pressure drops which may increase the efficiency of the heat pump.

In one aspect, the present disclosure provides a system for generating steam. In some embodiments, the system may be a cascading steam heat pump system. The system may further comprise a transfer fluid pump cycle (e.g., a heat transfer fluid cycle), and one or more heat pump cycles (e.g., a first heat pump cycle and a second heat pump cycle). The transfer fluid pump cycle (e.g., a heat transfer fluid cycle) may be configured to circulate a transfer fluid (e.g., working fluid). The transfer fluid pump cycle (e.g., a heat transfer fluid cycle) may comprise a transfer fluid exchanger, a first heat exchanger, and a circulation pump. In some embodiments, the transfer fluid exchanger may be in fluid communication with the circulation pump and configured to receive the first transfer fluid from the circulation pump. In some embodiments, the transfer fluid absorbs heat in the transfer fluid exchanger. In some embodiments, the transfer fluid exchanger is in fluid communication with the first heat exchanger. In some embodiments, the first heat exchanger may be configured to reject heat from the transfer fluid to a first working fluid of the first heat pump cycle. In some embodiments, the first working fluid absorbs heat from the transfer fluid working fluid in the first heat exchanger. In some embodiments, the circulation pump is in fluid communication with the first heat exchanger and may be configured to receive the transfer fluid working fluid from the first heat exchanger.

In some embodiments, the first heat pump cycle may be configured to circulate a first working fluid. The first heat pump cycle may comprise the first heat exchanger, a first compressor, a second heat exchanger, and a first expansion valve. In some embodiments, the first heat exchanger may be in fluid communication with the first expansion valve and configured to receive the first working fluid from the first expansion valve. In some embodiments, the first working fluid absorbs heat from a different working fluid (e.g., the transfer fluid) in the first heat exchanger. The first compressor may be in fluid communication with the first heat exchanger and may receive the first working fluid from the first exchanger. The first compressor may increase a pressure and a temperature of the first working fluid. The compressor may increase a pressure by a factor greater than or equal to about 1.1, 1.2, 1.5, 2, 5, 10, 20, or 30. The compressor may increase a pressure by a factor between any two values described here. The compressor may increase a temperature by about 5° C., 10° C., 20° C., 30° C., 40° C., 50° C., 60° C., 80° C., 100° C., 120° C. or 150° C. The temperature increase by the compressor may be between any two values described herein. The second heat exchanger may be in fluid communication with a compressor (e.g., the first compressor) and may be configured to receive the first working fluid from the first compressor. The second heat exchanger may reject heat from the first working fluid to a different working fluid (e.g., a second working fluid). In some embodiments, the first expansion valve may be in fluid communication with the second heat exchanger and may be configured to receive the first working fluid from the second heat exchanger. The first expansion valve may expand a working fluid (e.g., the first working fluid) to a lower pressure. In some embodiments, the first heat pump cycle may comprise a heat exchanger. As used herein, the term "heat exchanger" may refer to a unit that is configured to operate as, or comprises one or more types of heat transfer units. For example, the heat exchanger may be configured to operate as one or more of a two-phase heat exchanger, an economizer, and/or an evaporator. Such a heat exchanger may be configured with two or more inlet ports and/or two or more outlet ports. These multiple inlet ports and/or outlet ports may enable multiple fluid streams to enter the heat exchanger without mixing. Such a heat exchanger may provide one type of heat exchange for a first fluid stream, while providing the same or different type of heat exchange to/from a second fluid stream. For example, a heat exchanger described herein may be configured to transfer heat between a fluid stream of a first phase and a second fluid stream of a second phase. The second phase may be the same or different from the first phase. Alternatively, or in addition, the heat exchanger may operate as an economizer. The heat exchanger may operate as a two-phase heat exchanger and an economizer. The heat exchanger may operate as a two-phase heat exchanger, an economizer, and an evaporator. In some embodiments, the first heat pump cycle may comprise a two-phase ejector. The two-phase ejector may recover energy in the refrigerant flow's throttling process.

In some embodiments, the second heat pump cycle may be configured to circulate the second working fluid. In some embodiments, the second heat pump cycle may comprise the second heat exchanger, a second compressor, a third heat exchanger, and a second expansion valve. The second heat exchanger may be in fluid communication with a second expansion valve and may receive the second working fluid from the second expansion valve. In some embodiments, the second working fluid absorbs heat from a different working fluid (e.g., the first fluid working fluid) in the second heat exchanger. The second compressor may be in fluid communication with the second heat exchanger and may receive the second working fluid from the second heat exchanger. In some embodiments, the second compressor may increase the pressure and temperature of a working fluid (e.g., the second working fluid). The compressor may increase a pressure by about a factor greater than or equal to about 1.1, 1.2, 1.5, 2, 5, 10, 20, or 30. The compressor may increase a pressure by a factor between any two values described here. The compressor may increase a temperature by about 5° C., 10° C., 20° C., 30° C., 40° C., 50° C., 60° C., 80° C., 100° C., 120° C. or 150° C. The temperature increase by the compressor may be between any two values described herein. In some embodiments, the third heat exchanger may be in fluid communication with the second compressor and may receive the second working fluid from the second compressor. The third heat exchanger may be in fluid communication with a steam generation system. The third heat exchanger may reject heat from the second working fluid to a third working fluid in the steam generation system. The third working fluid may comprise water. The second expansion valve may be in fluid communication with the third heat exchanger and may receive the second working fluid from the third heat exchanger. The second expansion valve may be configured to expand a working fluid (e.g., the second working fluid) to a lower pressure. In some embodiments, the second heat pump cycle may comprise a heat exchanger which functions as a combination of a steam generator, an economizer, and a suction-line heat exchanger. In some embodiments, the second heat pump cycle may comprise a two-phase ejector.

In some embodiments, the system further may comprise a first suction-line heat exchanger. The first suction-line heat exchanger may be located in the first heat pump cycle or the second heat pump cycle. The first suction-line heat exchanger may be located between a heat exchanger (e.g., the first heat exchanger) and a compressor (e.g., the first compressor). Alternatively, the first suction-line heat exchanger may be located between a heat exchanger (e.g., second heat exchanger) and a valve (e.g., the first expansion valve). A first suction-line heat exchanger may precool a working fluid (e.g., the first working fluid) prior to receiving heat in a heat exchanger (e.g., the first heat exchanger). In some embodiments, the system may further comprise a second suction-line heat exchanger. The second suction-line heat exchanger may be located between a heat exchanger (e.g., the second heat exchanger) and a compressor (e.g., the second compressor). Alternatively, the second suction-line heat exchanger may be located between a heat exchanger (e.g., the third heat exchanger) and a valve (e.g., the second expansion valve). A second suction-line heat exchanger may precool a working fluid (e.g., the second working fluid) prior to receiving heat in a heat exchanger (e.g., the third heat exchanger). The third heat exchanger may be a steam generator.

The benefits of the suction-line heat exchanger may include precooling a working fluid before entry into a heat exchanger, preheating a working fluid before entry into a compressor, and/or decreasing density of a fluid before entry into a compressor. The benefits of preheating a working fluid before entry into a compressor may include preventing liquid droplet formation thereby reducing risk of damage to the compressor. The benefits of decreasing density of a fluid before entry into a compressor may include increasing volumetric flow rate, which may help to balance speeds between the compressor stages for larger lift situations.

In some embodiments, a heat transfer fluid cycle may circulate a working fluid (e.g., a heat transfer working fluid). The working fluid may comprise glycol. The heat transfer fluid cycle may comprise one or more heaters. The one or more heaters may be coupled to the heat transfer cycle downstream of a heat exchanger (e.g., an evaporator). The one or more heaters may comprise an electric resistance heater. In some embodiments, a working fluid (e.g., the heat transfer fluid) may be heated by a heating and/or defrosting mechanism and/or method described herein. In some embodiments, a heat transfer fluid cycle may comprise a glycol loop as illustrated in the non-limiting example of FIGS. 55-56. The glycol loop may comprise one or more heaters. The one or more heaters may heat a working fluid of the glycol loop. The one or more heaters may comprise an electric resistance heater. The one or more heaters may comprise a glycol heater which may be configured to reject heat from the first heat pump cycle working fluid or second heat pump cycle working fluid.

The glycol heater may be located at various locations in the first heat pump cycle or the second heat pump cycle. For example, the glycol heater may be located downstream of the first compressor or the second compressor. The glycol heater may be located at any position in the first heat pump cycle. The glycol heater may be located at any position in the second heat pump cycle. The glycol heater may be located upstream of an evaporator and/or upstream of an expansion valve. The benefits of locating the glycol heater upstream of the expansion valve may include increased efficiency for the system. The glycol heater may be configured to receive a portion of the working fluid in either the first heat pump cycle or the second heat pump cycle, and the remaining portion of the working fluid may bypass the glycol heater. The benefits of diverting a stream to the glycol heater may include reducing the pressure drop on the heat pump cycle with the glycol heater (e.g., reducing the pressure drop on the first heat pump cycle side of a heat exchanger). The one or more heaters may be a thermal storage as described herein. The one or more heaters may be a combination selected from electric resistance heaters, glycol heaters, and thermal storage. The working fluid of the glycol loop may be heated by a heating and/or defrosting mechanism and/or method described herein. In some embodiments, the glycol loop may circulate at least a portion of a working fluid from a cycle (e.g., a heat transfer fluid cycle). The glycol loop may receive the working fluid downstream from one or more heat exchangers of the cycle. The glycol loop may increase the temperature of the working fluid and may deliver the working fluid upstream of the one or more heat exchangers. The glycol loop may increase the temperature of the working fluid by about 10° C., 20° C., 30° C., 40° C., 50° C., 60° C., 70° C., 80° C., 90° C., or 100° C. The temperature increase of the working fluid may be between any two values described herein. The glycol loop may increase the temperature of a working fluid from below 0° C. to about 40° C. The one or more heat exchangers may comprise one or more air-source heat exchangers. The air-sourced heat exchangers may be in parallel as illustrated in the non-limiting example of FIG. 56. The glycol loop may comprise one or more glycol loops. A system with multiple glycol loops may be operated continuously without any downtime to defrost. The one or more glycol loops may be coupled to the more or more heat exchangers, one to one. Each of a one or more glycol loops may circulate at least a portion of a working fluid from a cycle (e.g., a heat transfer fluid cycle). The one or more glycol loops may receive at least a portion of the working fluid downstream from a corresponding heat exchanger of the cycle. The one or more glycol loops may increase the temperature of the portion of the working fluid and may deliver the portion of the working fluid upstream of the corresponding heat exchangers and deliver the portion of the first working fluid back upstream of corresponding air-source heat exchanger. The heat exchanger may comprise air-source heat exchangers. In some embodiments the working fluid may comprise glycol. In some embodiments, each of the one or more glycol loops are configured to function independently from each other. In some embodiments, the one or more glycol loops may contain one or more valves configured to close off the stream when not in use.

In one aspect, the present disclosure provides a system comprising a heat pump system (e.g., one or more heat pump cycles). In some embodiments, the heat pump system may produce cold air. In some embodiments, the cold air may be used for space cooling at a facility. In some embodiments, the cold air may be exhausted from the space as warm air after cooling the space. In some embodiments, the cold air may be returned to the heat pump as warm or hot air after cooling the space.

In one aspect, the present disclosure provides a system comprising a heat pump system (e.g., one or more heat pump cycles) and a carbon capture system. In some embodiments, the carbon capture system may be a point-source system. In some embodiments, the carbon capture system may be a direct air capture system. In some embodiments, the carbon capture system may require a regeneration step which condenses steam. In some embodiments, an outlet steam may have a vapor quality greater than or equal to about 0.1, 0.2, 0.3, 0.4, 0.5, 0.6, 0.65, 0.7, 0.75, 0.8, 0.85, 0.9 or 0.95. The vapor quality of the outlet steam may be between any two values described herein. In some embodiments, the outlet steam may comprise a fluid mixture. The fluid mixture may comprise one or more of carbon dioxide (CO2), water, nitrogen, and oxygen. In some embodiments, the fluid mixture may be used as a heat source for the heat pump. In some embodiments, the heat pump may condense the fluid mixture. Alternatively, or in addition, a glycol loop or a water loop may condense the fluid mixture. In some embodiments, at least a portion of the CO2 may be separated from the fluid mixture. At least about 70, 80, or 90 percent of the CO2 of the fluid mixture may be separated. All of the CO2 of the fluid mixture may be separated. In some embodiments, at least a portion of the water (H2O) may be separated from the fluid mixture. At least about 70, 80, or 90 percent of the H2O of the fluid mixture may be separated. All of the H2O of the fluid mixture may be separated. In some embodiments, the water may be used as an input (e.g., as feedwater to be turned into steam) for the heat pump. In some embodiments, steam from the heat pump may be used as an input for the regeneration step. In some embodiments, steam is produced by a natural gas boiler.

Operating Conditions

In some embodiments, a temperature of an ambient air stream may be less than or equal to about 50° C., 40° C., 30° C., 25° C., 20° C., 15° C., 10° C., 5° C., 0° C., −5° C., −10° C., −15° C., −20° C., −25° C., −30° C., −35° C., −40° C. or lower. The temperature of an ambient air stream may be greater than or equal to about −40° C., −35° C., −30° C., −25° C., −20° C., −15° C., −10° C., −5° C., 0° C., 5° C., 10° C., 15° C., 20° C., 25° C., 30° C., 35° C., 40° C., or greater. The temperature of an ambient air stream may be between two temperatures described above, for example between about 0° C., and about 25° C.

In some embodiments, a temperature of a feed steam (e.g., a feed stream comprising water) to a heat exchanger (e.g., a steam generator) of a system described herein may be less than or equal to about 150° C., 140° C., 130° C., 120° C., 110° C., 100° C., 95° C., 90° C., 85° C., 80° C., 75° C., 70° C., 65° C., 60° C., 55° C., 50° C., 45° C., 40° C., 35° C., 30° C., 25° C., 20° C., 15° C., 10° C., 5° C. or lower. The temperature of the feed stream (e.g., a feed stream comprising water) to a heat exchanger (e.g., a steam generator) of a system described herein may be greater than or equal to about, 5° C., 10° C., 15° C., 20° C., 25° C., 30° C., 35° C., 40° C., 45° C., 50° C., 55° C., 60° C., 65° C., 70° C., 75° C., 80° C., 85° C., 90° C., 95° C., 100° C., 110° C., 120° C., 130° C., 140° C., 150° C. or greater. The temperature of the feed stream (e.g., a feed stream comprising water) to a heat exchanger (e.g., a steam generator) of a system described herein may be between two temperatures described above, for example between about 15° C. and about 95° C.

In some cases, the first heat pump cycle (e.g., a bottom cycle) may receive an ambient air stream with an air temperature that is less than or equal to about 150° C., 140° C., 130° C., 120° C., 110° C., 100° C., 95° C., 90° C., 85° C., 80° C., 75° C., 70° C., 65° C., 60° C., 55° C., 50° C., 45° C., 40° C., 35° C., 30° C., 25° C., 20° C., 15° C., 10° C., 5° C. or lower, and may output a working fluid at a temperature that is greater than or equal to about 5° C., 10° C., 15° C., 20° C., 25° C., 30° C., 35° C., 40° C., 45° C., 50° C., 55° C., 60° C., 65° C., 70° C., 75° C., 80° C., 85° C., 90° C., 95° C., 100° C., 110° C., 120° C., 130° C., 140° C., 150° C. or greater.

In some embodiments, a second heat pump cycle (e.g., a top cycle) may receive a working fluid with a temperature that is less than or equal to about 150° C., 140° C., 130° C., 120° C., 110° C., 100° C., 95° C., 90° C., 85° C., 80° C., 75° C., 70° C., 65° C., 60° C., 55° C., 50° C., 45° C., 40° C., 35° C., 30° C., 25° C., 20° C., 15° C., 10° C., 5° C. or lower, and may output a working fluid at a temperature that is greater than or equal 5° C., 10° C., 15° C., 20° C., 25° C., 30° C., 35° C., 40° C., 45° C., 50° C., 55° C., 60° C., 65° C., 70° C., 75° C., 80° C., 85° C., 90° C., 95° C., 100° C., 110° C., 120° C., 130° C., 140° C., 150° C. or greater. For example, the first heat pump (e.g., bottom cycle) may receive an ambient air stream with an air temperature of 15° C. and deliver heat (e.g., output a working fluid) at a temperature of 65° C., and the second heat pump (e.g., top cycle) may receive the 65° C. working fluid through a heat exchanger coupled to the first heat pump and second heat pump cycles and the second heat pump cycle may generate steam at a temperature of 150° C.

Performance Metrics

In some aspects, the coefficient of performance of the system may be greater than or equal to about 1, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.5, 4.0, 4.5, 5, or greater. The coefficient of performance of the system may be between any two values described herein.

In some aspects, the system may comprise a compressor. The isentropic efficiency of the compressor may be greater than or equal to about 60%, 70%, 80%, 90% or greater. The isentropic efficiency of the compressor may be between any two values described herein. The compressor may have a motor that is greater than or equal to about 70%, 80%, 85%, 90%, 95%, 96%, 97%, 98%, or 99% efficient. The efficiency of the motor may be between any two values described herein. The compressor may be designed (e.g., through double ended, preloaded springs and/or magnetic coils) to have a thrust less than about 400 lbs, 300 lbs, 250 lbs, 200 lbs, 175 lbs, 150 lbs, 125 lbs, or 100 lbs. The thrust of the compressor may be between any two values described herein.

In some aspects, the system may have a steam flow rate greater than or equal to about 0.5 t/hr, 1 t/hr, 2 t/hr, 4 t/hr, 6 t/hr, 8 t/hr, 10 t/hr, 12 t/hr, 15 t/hr, or 20 t/hr. In some aspects, the system may have a steam flow rate less than or equal to about 0.5 t/hr, 1 t/hr, 2 t/hr, 4 t/hr, 6 t/hr, 8 t/hr, 10 t/hr, 12 t/hr, 15 t/hr, or 20 t/hr. The steam flow rate may be between any two values described herein.

In some aspects, the system may comprise an air-source heat exchanger. The capacity of the air-source heat exchanger may be greater than or equal to about 100 kW, 200 kW, 300 kW, 400 kW, 500 kW, 600 kW, 800 kW, 1 MW, 2 MW, 4 MW, 6 MW, 8 MW, or 10 MW. The capacity of the air-source heat exchanger may be less than or equal to about 100 kW, 200 kW, 300 kW, 400 kW, 500 kW, 600 kW, 800 kW, 1 MW, 2 MW, 4 MW, 6 MW, 8 MW, or 10 MW. The capacity of the air-source heat exchanger may be between any two values described herein.

In some aspects, the system may comprise a glycol loop and an evaporator. The pinch point between the glycol loop and the evaporator saturation temperature may be greater than or equal to about 0.1° C., 0.2° C., 0.4° C., 0.6° C., 0.8° C., 1° C., 2° C., 4° C., 6° C., 8° C., or 10° C. The pinch point between the glycol loop and the evaporator saturation temperature may be less than or equal to about 0.1° C., 0.2° C., 0.4° C., 0.6° C., 0.8° C., 1° C., 2° C., 4° C., 6° C., 8° C., or 10° C. The pinch point between the glycol loop and the evaporator saturation temperature may be between any two values described herein.

In some aspects, the system may comprise a steam generator and steam. The pinch point between the top cycle refrigerant saturation temperature in the steam generator and the steam may be greater than or equal to about 0.1° C., 0.2° C., 0.4° C., 0.6° C., 0.8° C., 1° C., 2° C., 4° C., 6° C., 8° C., or 10° C. The pinch point between the top cycle refrigerant saturation temperature in the steam generator and the steam may be less than or equal to about 0.1° C., 0.2° C., 0.4° C., 0.6° C., 0.8° C., 1° C., 2° C., 4° C., 6° C., 8° C., or 10° C. The pinch point between the top cycle refrigerant saturation temperature in the steam generator and the steam may be between any two values described herein.

In some aspects, the system may comprise a condenser and pressurized hot water. The pinch point between the top cycle refrigerant temperature in the condenser and the pressurized hot water may be greater than or equal to about 0.1° C., 0.2° C., 0.4° C., 0.6° C., 0.8° C., 1° C., 2° C., 4° C., 6° C., 8° C., 10° C., 15° C. or 20° C. The pinch point between the top cycle refrigerant temperature in the condenser and the pressurized hot water may be less than or equal to about 0.1° C., 0.2° C., 0.4° C., 0.6° C., 0.8° C., 1° C., 2° C., 4° C., 6° C., 8° C., 10° C., 15° C. or 20° C. The pinch point between the top cycle refrigerant temperature in the condenser and the pressurized hot water may be between any two values described herein.

In some aspects, the system may comprise a top cycle evaporator and a bottom cycle condenser. The pinch point between the top cycle evaporator saturation temperature and the bottom cycle condenser saturation temperature may be greater than or equal to about 0.1° C., 0.2° C., 0.4° C., 0.6° C., 0.8° C., 1° C., 2° C., 4° C., 6° C., 8° C., or 10° C. The pinch point between the top cycle evaporator saturation temperature and the bottom cycle condenser saturation temperature may be less than or equal to about 0.1° C., 0.2° C., 0.4° C., 0.6° C., 0.8° C., 1° C., 2° C., 4° C., 6° C., 8° C., or 10° C. The pinch point between the top cycle evaporator saturation temperature and the bottom cycle condenser saturation temperature may be between any two values described herein.

In some aspects, the system may comprise an economizer. The temperature of the superheat in the economizer may be greater than or equal to about 0° C., 5° C., 10° C., 15° C., 20° C., 25° C., 30° C., 40° C. or 50° C. The temperature of the superheat in the economizer may be less than or equal to about 0° C., 5° C., 10° C., 15° C., 20° C., 25° C., 30° C., 40° C. or 50° C. The temperature of the superheat in the economizer may be between any two values described herein. The flow of the economizer may be greater than or equal to about 0%, 5%, 10%, 15%, 20%, 25%, 30%, 40%, or 50% of the main refrigerant flow. The flow of the economizer may be less than or equal to about 0%, 5%, 10%, 15%, 20%, 25%, 30%, 40%, or 50% of the main refrigerant flow. The flow of the economizer may be between any two values described herein.

In some aspects, the system may comprise a suction line heat exchanger. The suction line heat exchanger may have an effectiveness of greater than or equal to about 0.1, 0.2, 0.3, 0.4, 0.5, 0.6, 0.7, 0.8, 0.9, or 1. The effectiveness or the suction line heat exchanger may be between any two values described herein.

In some aspects, the system may comprise motor coolant. The motor coolant flow may be greater than or equal to about 0%, 1%, 2%, 3%, 4%, 5%, 6%, 8%, 10%, 12%, 15%, or 20% of the main refrigerant flow. The motor coolant flow may be less than or equal to about 0%, 1%, 2%, 3%, 4%, 5%, 6%, 8%, 10%, 12%, 15%, or 20% of the main refrigerant flow. The motor coolant flow may be between any two values described herein.

In some aspects, the system may require less power consumption to produce a given amount of steam when compared to electric boilers, as shown in Operational Example 10.

Refrigeration

In one aspect, the present disclosure provides a system for generating steam. The system may comprise a heat pump system (e.g., one or more heat pump cycles) and a refrigeration system. In some embodiments, the refrigeration system may comprise one or more heat exchangers one or more compressors one or more expansion valves and one or more other components. In some embodiments, the refrigeration system may be in thermal communication with a transfer fluid pump cycle (e.g., a heat transfer fluid cycle). In some embodiments, the refrigeration system may be directly coupled to the heat pump system. In some embodiments, the refrigeration system may be configured to be directly coupled with a condenser of the refrigeration section (e.g., an evaporator of the heat pump system). In some embodiments, the refrigeration system may be configured to be decoupled from the heat pump system. In some embodiments, the refrigeration system may be configured to be in thermal communication with the heat pump system through a decoupled condenser. In some embodiments, the decoupled condenser circulates a working fluid between the refrigeration system and the heat pump systems. In some embodiments, the refrigeration system may be configured to provide additional heat to the heat pump systems. In some embodiments, the heat pump systems are configured to provide additional cooling to the refrigeration system. In some embodiments, the refrigeration system may be configured to provide heat to the heat pump system when the refrigeration load is low and/or near zero. If the refrigeration load is zero, then the heat pump system may be configured to use heat from ambient air or another heat source. In some embodiments, the heat pump system may be configured to provide cooling to the refrigeration system when the heat pump system load is low and/or near zero. If the heat pump system load is zero, then the refrigeration system may be configured to use an air-cooled condenser, a condenser water loop, and/or other source to cool the refrigeration system. In some embodiments, the refrigeration system may be configured to be to be in thermal communication with the first heat pump cycle. In some embodiments, the refrigeration system may be configured to be in thermal communication with the second heat pump cycle. In some embodiments, the refrigeration's system may be configured to be in thermal communication with one or more of the systems heat pump systems.

In some embodiments, the refrigeration cycle is coupled to a bottom cycle and/or a top cycle of the system. In some embodiments, the refrigeration cycle is coupled to a system of the present disclosure such that one or more heat exchangers of the refrigeration cycle are in parallel with one or more heat exchangers of the top cycle. In some embodiments, the refrigeration cycle is coupled to a system of the present disclosure such that one or more heat exchangers of the refrigeration cycle are in parallel with one or more heat exchangers of the bottom cycle. In some embodiments, the refrigeration cycle is coupled to a system of the present disclosure such that one or more heat exchangers of the refrigeration cycle are in parallel with one or more heat exchangers of a heat transfer fluid cycle. Alternatively, or in addition, the refrigeration cycle may be coupled to a system of the present disclosure such that the refrigeration cycle is in series with one or more heat exchangers of the top cycle. In some embodiments, the refrigeration cycle is coupled to a system of the present disclosure such that one or more heat exchangers of the refrigeration cycle are in series with one or more heat exchangers of the bottom cycle. In some embodiments, the refrigeration cycle is coupled to a system of the present disclosure such that one or more heat exchangers of the refrigeration cycle are in series with one or more heat exchangers of a heat transfer fluid cycle. In some embodiments, the refrigeration cycle may be coupled directly to a cycle (e.g., top cycle, bottom cycle, and/or heat transfer fluid cycle). Alternatively, the refrigeration cycle may be coupled to a cycle (e.g., top cycle, bottom cycle, and/or heat transfer fluid cycle) by an additional fluid loop (e.g., an intermediate loop, a glycol loop, an oil loop, etc.) as illustrated in the non-limiting examples of FIGS. 22 and 24-26.

In some embodiments, the system may comprise a controller. The controller may be configured to control one or more operations of one or more elements of the system. The controller may be configured to control one or more operations of a refrigeration system and/or at least one operation of a cycle (e.g., bottom cycle, top cycle, etc.) of the system. The controller may control the system to use an air-source heat exchanger as a heat source to generate steam and/or hot water. The air-source heat exchanger may be used as a heat source when the refrigeration system is not operating. The controller may control the system to use the refrigeration system and the air-source heat exchanger as a heat source to generate steam and/or hot water. In some embodiments, the controller may be configured to control an amount of heat generated by the air-source heat exchanger based on the amount of heat generated refrigeration system. Alternatively, the controller may be configured to control the system to use only the refrigeration system as a heat source to generate steam and/or hot water. In some embodiments, the controller may be configured to control the system to use a heat exchanger (e.g., an air cooler or a coolant loop) to reject heat. A heat exchanger may reject heat when one or more heat sources provide excess heat to the system. In some embodiments, the controller may be configured to control the system to generate no heat, wherein the refrigeration system heat is rejected using a heat exchanger configured to reject heat. In some embodiments, the refrigeration heat is rejected into ambient air.

In some embodiments, the heat pump cycle(s) may provide an insufficient amount of steam and the system is configured to be coupled to one or more other systems to provide additional steam.

Figure 18:
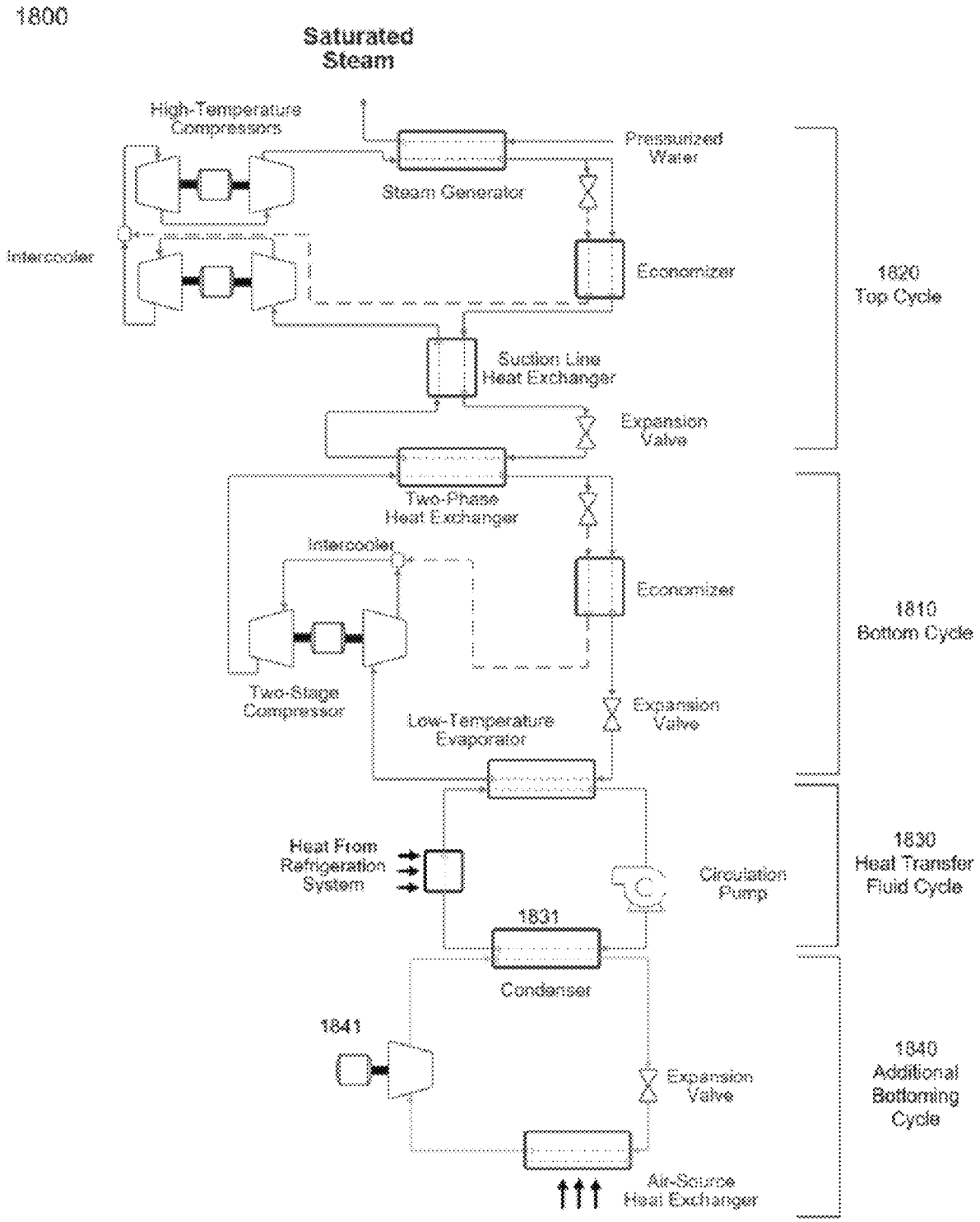
Figure 19:
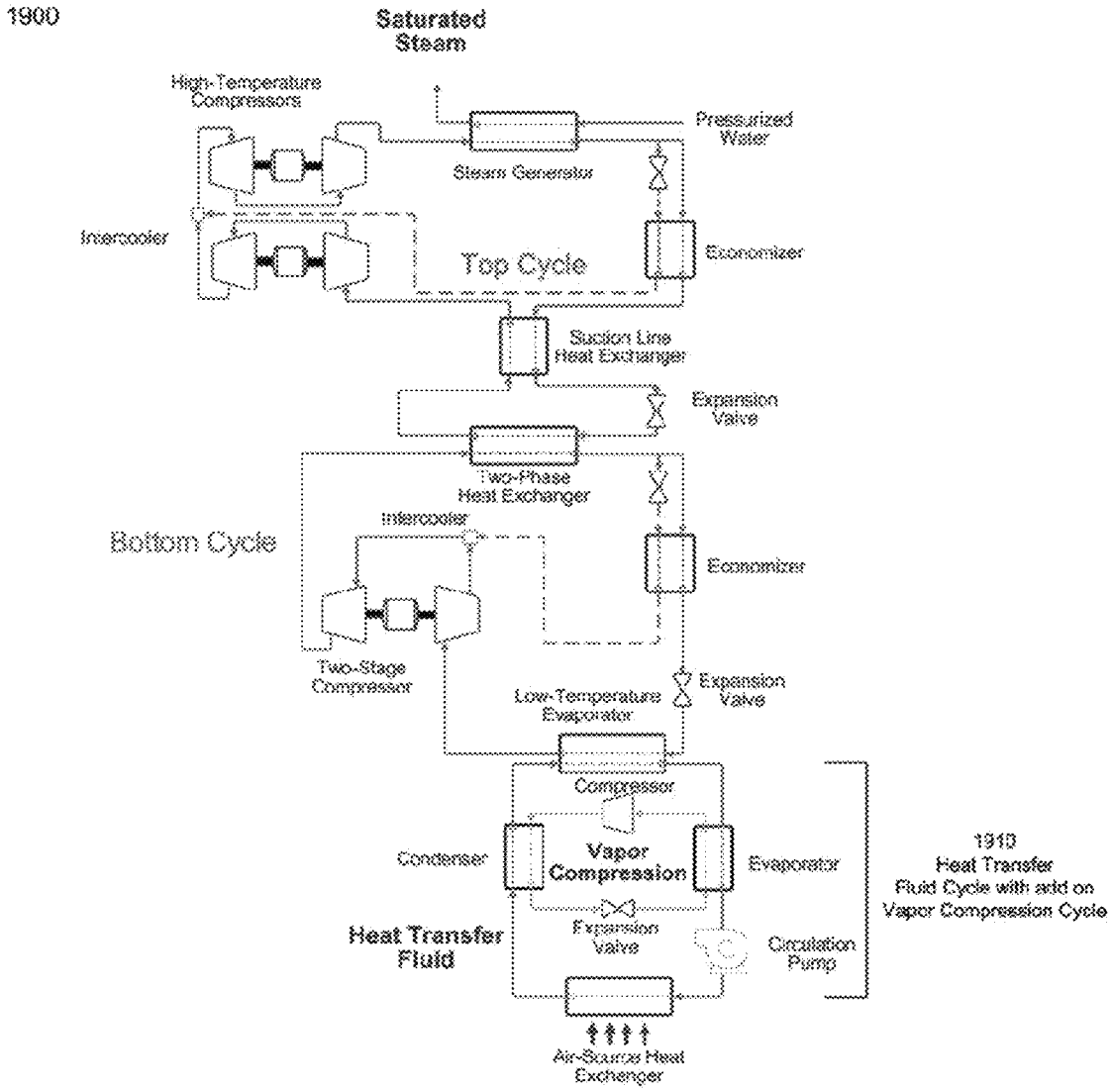

In some embodiments, the system may comprise a vapor compression system cycle as illustrated in the non-limiting examples of FIGS. 18-19. In some embodiments, the vapor compression system (VCS) cycle may be configured to circulate a working fluid. The vapor compression cycle may comprise one or more heat exchangers, one or more expansion valves, and one or more compressors. In some embodiments, the VCS cycle may be a refrigeration system. In some embodiments, the VCS cycle may be configured to operate separately from a refrigeration system. In some embodiments, the VCS cycle may comprise an air-source heat exchanger. In some embodiments, the VCS cycle is coupled to a system of the present disclosure such that one or more heat exchangers of the VCS cycle are in parallel with one or more heat exchangers of the top cycle. In some embodiments, the VCS cycle is coupled to a system of the present disclosure such that one or more heat exchangers of the VCS cycle are in parallel with one or more heat exchangers of the bottom cycle. In some embodiments, the VCS cycle is coupled to a system of the present disclosure such that one or more heat exchangers of the VCS cycle are in parallel with one or more heat exchangers of a heat transfer fluid cycle. Alternatively, or in addition, the VCS cycle may be coupled to a system of the present disclosure such that the VCS cycle is in series with one or more heat exchangers of the top cycle. In some embodiments, the VCS cycle is coupled to a system of the present disclosure such that one or more heat exchangers of the VCS cycle are in series with one or more heat exchangers of the bottom cycle. In some embodiments, the VCS cycle is coupled to a system of the present disclosure such that one or more heat exchangers of the VCS cycle are in series with one or more heat exchangers of a heat transfer fluid cycle. In some embodiments, the VCS cycle may be coupled directly to another cycle (e.g., top cycle, bottom cycle, and/or heat transfer fluid cycle). Alternatively, the VCS cycle may be coupled to a cycle (e.g., top cycle, bottom cycle, and/or heat transfer fluid cycle) by an additional fluid loop (e.g., an intermediate loop, a glycol loop, etc.).

In some embodiments, the VCS cycle is configured to be integrated into the transfer fluid cycle as an add on loop, as illustrated in FIG. 19.

In some embodiments, the VCS cycle comprises a condenser configured to increase the temperature of a working fluid of the transfer fluid cycle. The VCS cycle may increase the temperature of the working fluid by about 5° C., 10° C., 15° C., 20° C., 25° C., 30° C., 25° C., 40° C., 50° C., 60° C., or greater. The temperature increase of the working fluid may be between any two values described herein. In some embodiments, the condenser is located upstream from a low temperature evaporator of the transfer fluid cycle. This increases heat pump performance of the system and allows for compressors to operate closer to their design points. In some embodiments, the VCS cycle comprises an evaporator configured to decrease the temperature of a working fluid of the transfer fluid cycle before the working fluid enters an air-source heat exchanger of the transfer fluid cycle. The evaporator may decrease the temperature of the working fluid by about 5° C., 10° C., 15° C., 20° C., 25° C., 30° C., 35° C., 40° C., or greater. The temperature decrease of the working fluid may be between any two values described herein. The evaporator may decrease the temperature of the working fluid below the ambient air temperature. In some embodiments, the evaporator is located downstream from a low-temperature evaporator of the transfer fluid cycle. In some embodiments, the working fluid of the VCS cycle may comprise a glycol-water mixture. In some embodiments, the working fluid of the VCS cycle may comprise water, steam, glycol, air, a fluorocarbon, a hydrofluoroolefin, a hydrofluoroether, a hydrocarbon, ammonia (NH3), water (H2O), carbon dioxide (CO2), pentane (C5H12), butane (C4H10), isobutane (HC(CH3)3), propane (C3H8), and propene (C3H6), or a combination thereof. In some embodiments, the one or more compressors of the VCS cycle are configured to be screw compressors.

In some embodiments, the refrigeration system may comprise an ammonia cycle. In some embodiments, the ammonia cycle is configured to be directly coupled to a top cycle. In some embodiments, the ammonia cycle is configured to be coupled to a top cycle through an intermediate fluid loop and/or cycle. In some embodiments, the top cycle comprises a steam generator. In some embodiments, the ammonia cycle is configured to deliver cooling to a working fluid. In some embodiments, a working fluid comprises air, water, brine, and/or other fluids. In some embodiments, the ammonia cycle may comprise an air-cooled condenser and/or condenser water loop along with a top cycle coupled heat exchanger. This allows the refrigeration system to operate when no steam generation is required by rejecting the heat of the refrigeration system through the air-cooled condenser and/or condenser water loop.

Steam Generation+Cooling

In one aspect, the present disclosure provides a system for generating steam and cooling. In some embodiments, the system is configured to use a coolant (e.g., chilled water and/or chilled brine) as a heat source as illustrated in the non-limiting examples of FIGS. 20-26. The coolant may be chilled water having a temperature within the range of about 0° C. to about 15° C. The coolant may be chilled brine having a temperature less than or equal to about 0° C. Using a coolant as the heat source may eliminate the need for a separate system to provide cooling (e.g., to the chilled water or brine).

In some embodiments, the system may comprise a separate electrically powered refrigeration system (e.g., a standard chiller system, direct expansion system, and/or part of a distributed cooling system). The separate electrically powered refrigeration system may be configured to circulate a coolant. The separate electrically powered refrigeration system may be configured to supplement cooling generated by a heat pump system. In some embodiments, the system is configured to use a refrigeration system in combination with one or more other heat sources to generate steam. In some embodiments, the one or more other heat sources comprise an air-sourced heat exchanger.

In some embodiments, the separate electrically powered refrigeration system may comprise a cooling tower and one or more heat exchanger coupled to one or more cycles of a system and one or more heat pump cycles (e.g., a top heat pump cycle, a bottom heat pump cycle, and a heat transfer fluid cycle). The heat exchanger of the separate electrically powered refrigeration may be a condenser.

In some embodiments, the system may be configured to use a coolant from the separate electrically powered refrigeration system, to transfer heat to a working fluid of a heat pump cycle. The coolant may be condensed water. In some embodiments, the coolant is hotter than air temperatures. In some embodiments, the coolant has a temperature greater than or equal to about 10° C., 15° C., 20° C., 25° C., 30° C., 35° C., 40° C., 45° C., 50° C., 55° C., 60° C. The temperature of the coolant may be between any two values described herein. The use of the warmer condenser water can lead to improved heat pump performance. This may help eliminate the need for cooling towners reducing the electricity consumption associated with powering cooling towner fans.

In some embodiments, the system is configured to operate a heat pump system and refrigeration system separately. In some embodiments, the heat pump system comprises both a water heat recovery heat exchanger and an air-source heat exchanger. The water heat recovery exchanger may be a condenser water heat recovery heat exchanger. In some embodiments, the refrigeration system can comprise a cooling tower and/or air-cooled heat exchanger.

Intermediate Loop

Figure 22:
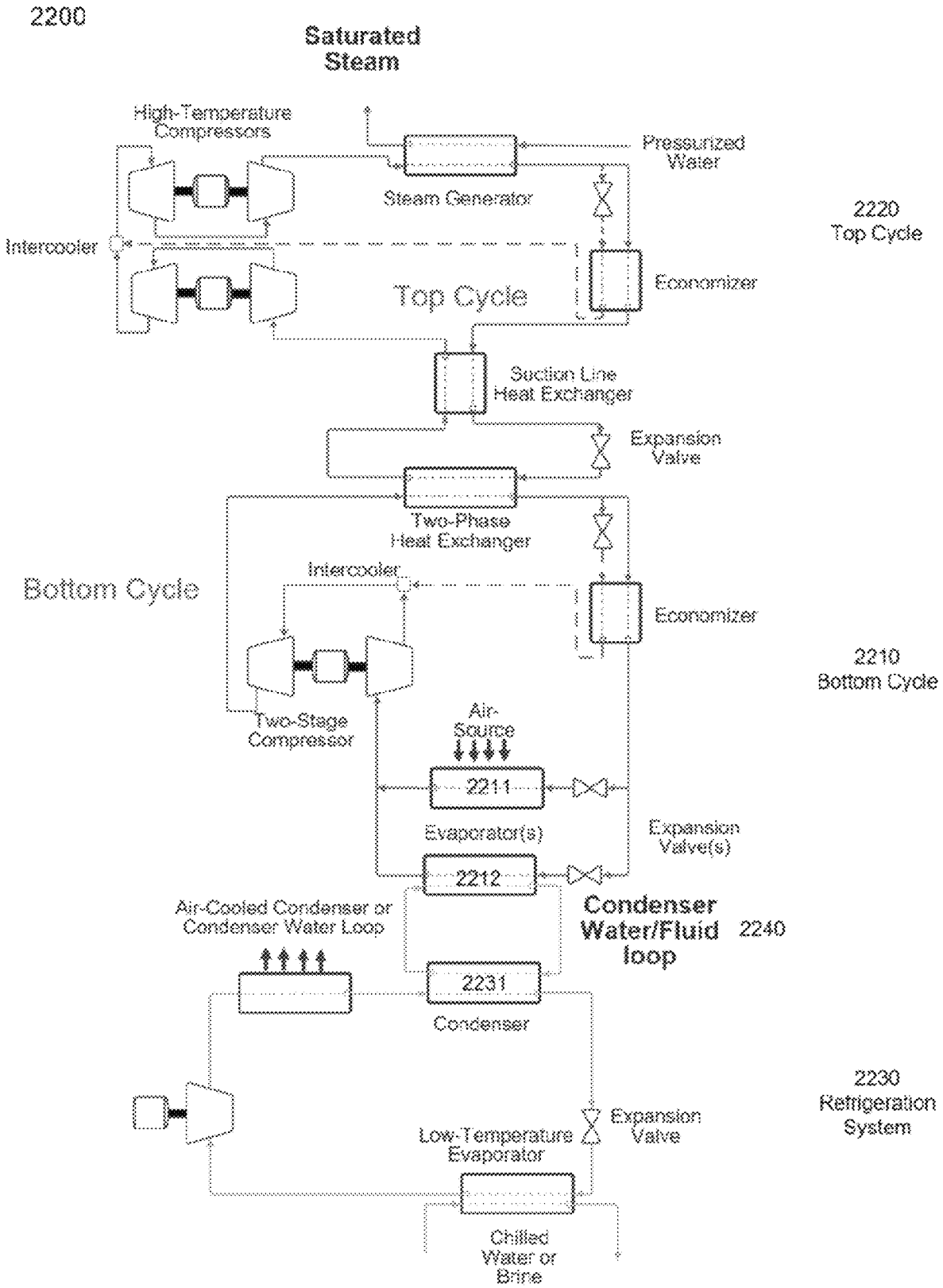
FIGS. 22-24 illustrate examples of a steam generating system comprising a refrigeration system in accordance with some embodiments described herein.
Figure 24:
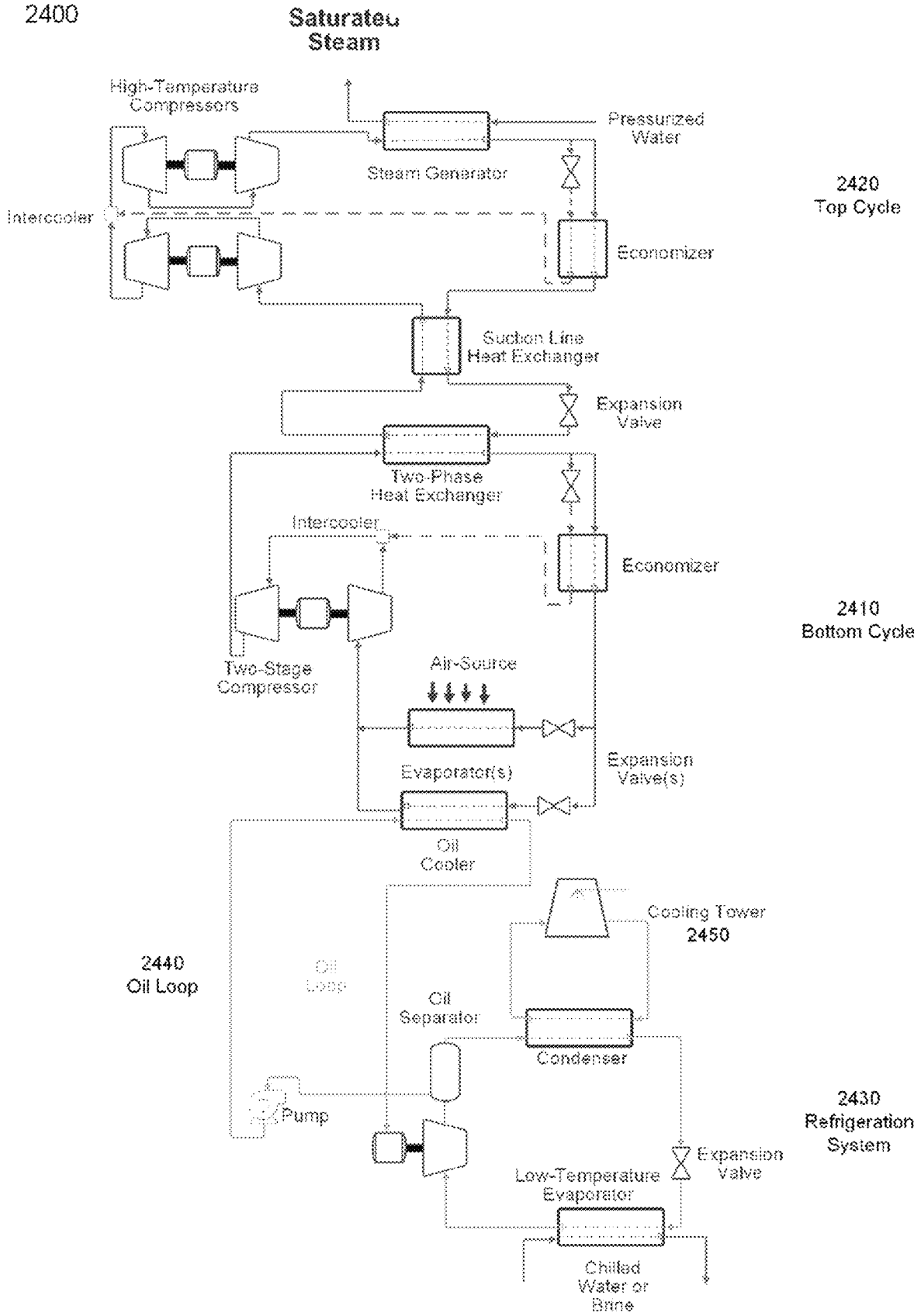
Figure 25:
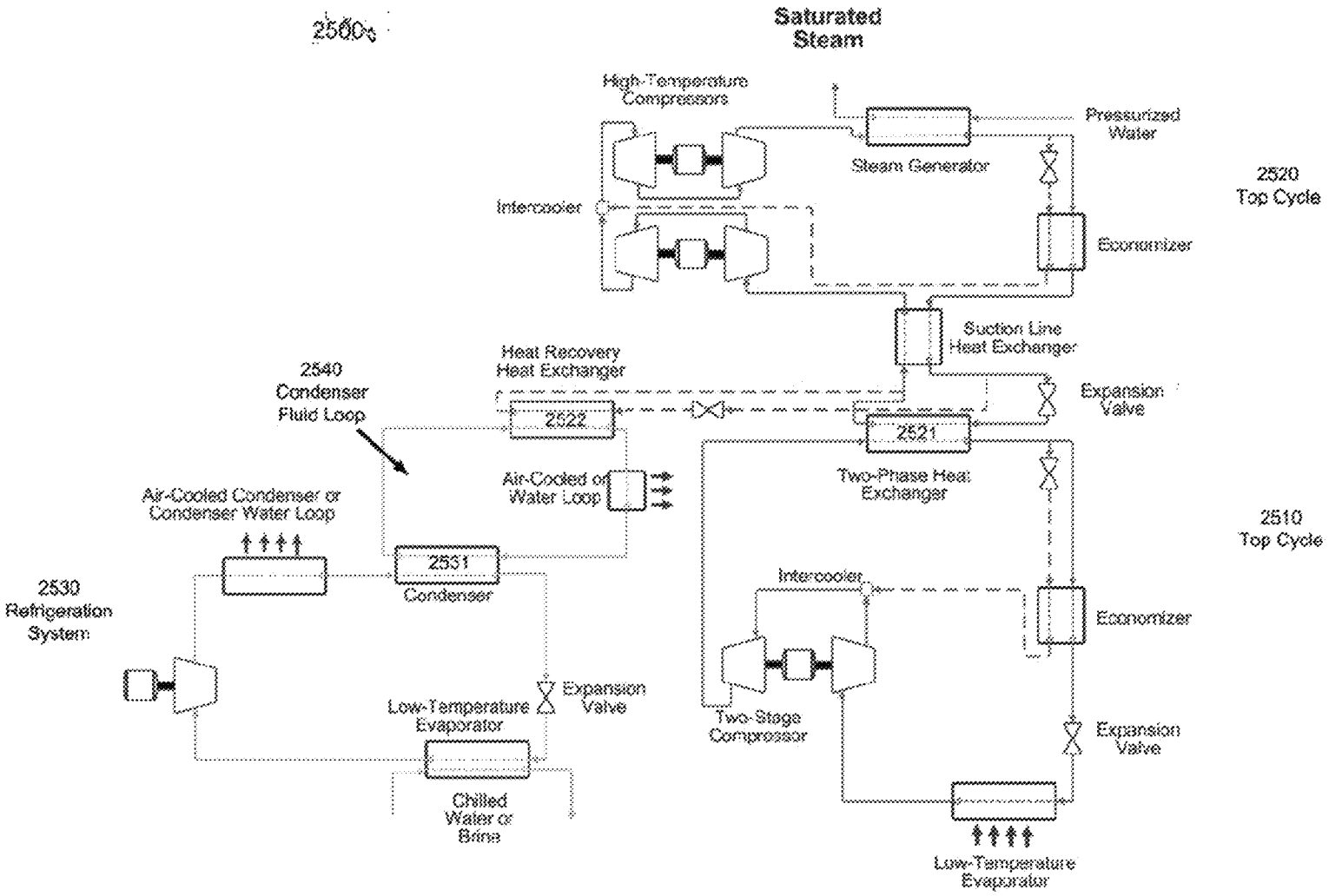
FIGS. 25-26 illustrate examples of a steam generating system comprising a refrigeration system in accordance with some embodiments described herein.

In some embodiments, the refrigeration system is configured to be coupled to the heat pump system by an intermediate loop as illustrated in the non-limiting examples of FIGS. 22 and 24-25. The intermediate loop may comprise a cooling tower and/or air-cooled heat exchanger as illustrated in FIG. 25. In some embodiments, the refrigeration system may be coupled to the intermediate loop by a heat exchanger (e.g., a condenser). The intermediate look may be coupled to a cycle of the system (e.g., a bottom cycle, a top cycle, a transfer heat fluid cycle, etc.) by a heat exchanger (e.g., an evaporator).

In some embodiments, an evaporator and an air-source heat exchanger are configured to be at different temperatures and/or pressures. The temperature of the evaporator may be greater than or equal to about −30° C., −20° C., −10° C., 0° C., 10° C., 20° C., 30° C., 40° C., 50° C., 60° C., 70° C., 80° C., 90° C. or greater. The temperature of the evaporator may be between any two values described herein. The temperature of the air-source heat exchanger may be greater than or equal to about −30° C., −20° C., −10° C., 0° C., 10° C., 20° C., 30° C., 40° C., or 50° C. The temperature of the air-source heat exchanger may be between any two values described herein. The temperature differential between the evaporator and the air-source heat exchanger may be greater than or equal to about 10° C., 20° C., 30° C., 40° C., 50° C., 60° C., 70° C., 80° C., 90° C. or greater. The temperature differential between the evaporator and the air-source heat exchanger may be between any two values described herein. In some embodiments, the system further comprises a back pressure regulator. In some embodiments, two or more evaporators are configured to be placed at separate compressor stages (i.e., the higher temperature fluid may be used at a higher compression stage).

In some embodiments, the system comprises a heat pump system and a refrigeration system as described herein. In some embodiments, the system is configured to operate the heat pump system and the refrigeration system separately. In some embodiments, the system is configured to operate the heat pump system and the refrigeration system in tandem. In some embodiments, the system is configured to be able to control the operation of the heat pump system and the refrigeration system independently.

Direct Integration

In some embodiments, a refrigeration system is directly coupled to a heat pump system. In some embodiments, the heat pump system is configured to be a condenser for the refrigeration system. In some embodiments, heat generated by the condenser is used as a heat source for a bottom cycle as illustrated in the non-limiting examples of FIG. 23 and/or top cycle of the heat pump system as illustrated in the non-limiting examples of FIG. 26. This configuration of the system, wherein a refrigeration system is directly integrated into a heat pump system, can be more efficient than using an intermediate water/cooling tower loop. In some embodiments, the heat pump system comprises both a condenser water heat recovery heat exchanger and an air-source heat exchanger. In some embodiments, the refrigeration system can comprise a cooling tower and/or an air-cooled heat exchanger.

In some embodiments, the condenser water heat recovery heat exchanger and the air-source heat exchanger are configured to be evaporators. In some embodiments, an evaporator and an air-source heat exchanger are configured to be at different temperatures and/or pressures. The temperature of the evaporator may be greater than or equal to about −30° C., −20° C., −10° C., 0° C., 10° C., 20° C., 30° C., 40° C., 50° C., 60° C., 70° C., 80° C., 90° C. or greater. The temperature of the evaporator may be between any two values described herein. The temperature of the air-source heat exchanger may be greater than or equal to about −30° C., −20° C., −10° C., 0° C., 10° C., 20° C., 30° C., 40° C., or 50° C. The temperature of the air-source heat exchanger may be between any two values described herein. The temperature differential between the evaporator and the air-source heat exchanger may be greater than or equal to about 10° C., 20° C., 30° C., 40° C., 50° C., 60° C., 70° C., 80° C., 90° C. or greater. The temperature differential between the evaporator and the air-source heat exchanger may be between any two values described herein. In some embodiments, the system further comprises a pack pressure regulator. In some embodiments, two or more evaporators are configured to be placed at separate compressor stages (i.e., the higher temperature fluid may be used at a higher compression stage).

In some embodiments, the system comprises a heat pump system and a refrigeration system as described herein. In some embodiments, the system is configured to operate the heat pump system and the refrigeration system separately. In some embodiments, the system is configured to operate the heat pump system and the refrigeration system in tandem. In some embodiments, the system is configured to be able to control an operation of the heat pump system independently from an operation of the refrigeration system.

Compressor Coolant Heat

In some embodiments, a system comprises a heat pump system and a refrigeration system. The heat pump system may comprise one or more cycles (e.g., a top cycle, a bottom cycle, a heat transfer fluid cycle etc.). The one or more cycles and/or the refrigeration system may comprise a coolant loop configured to circulate a coolant (e.g., a coolant fluid) as illustrated in the non-limiting example of FIG. 24. The coolant may comprise an oil. In some embodiments, the refrigeration system and/or the one or more cycles may comprise one or more compressors. In some embodiments, at least one compressor of the one or more compressors of the refrigeration system may be configured to receive a coolant. The coolant may be delivered by a coolant loop. One or more compressors of the present disclosure may receive a coolant. The one or more compressors may transfer heat to another fluid (e.g., a working fluid) to said coolant and/or transfer heat from another fluid (e.g., a working fluid) to said coolant. In some embodiments, a compressor of the one or more compressors described herein may increase a pressure of a fluid (e.g., a working fluid) directed through the compressor. The compressor may increase a pressure of the fluid by at least 1 kPa, 5 kPa, 10 kPa, 15 kPa, 20 kPa, 30 kPa, 50 kPa, 75 kPa, 100 kPa, 150 kPa, 200 kPa, 300 kPa, 400 kPa, 500 kPa, 700 kPa, 1000 kPa, 1500 kPa, 2000 kPa, 2500 kPa, 3000 kPa, 3500 kPa or greater. The pressure increase of the fluid may be between any two values described herein. In some embodiments, a compressor of a refrigeration system may provide heat to a heat pump system. The compressor may be configured to transfer heat from the refrigeration system directly to the heat pump system. The compressors may transfer heat from of the refrigeration system to the heat pump system through an intermediate loop. In some embodiments, one or more compressors of a refrigeration system may be configured to transfer heat to a fluid of a heat pump system, while a coolant of the refrigeration system is cooled.

In some embodiments, a heat pump system comprises both a condenser water heat recovery heat exchanger and an air-source heat exchanger. In some embodiments, the condenser water heat recovery heat exchanger and an air-source heat exchanger are in parallel. Alternatively, or in addition, the condenser water heat recovery heat exchanger and an air-source heat exchanger are in series. The condenser water heat recovery heat exchanger and the air-source heat exchanger may be configured to be evaporators. In some embodiments, an evaporator and an air-source heat exchanger are configured to be at different temperatures and/or pressures. The temperature of the evaporator may be greater than or equal to about −30° C., −20° C., −10° C., 0° C., 10° C., 20° C., 30° C., 40° C., 50° C., 60° C., 70° C., 80° C., 90° C. or greater. The temperature of the evaporator may be between any two values described herein. The temperature of the air-source heat exchanger may be greater than or equal to about −30° C., −20° C., −10° C., 0° C., 10° C., 20° C., 30° C., 40° C., or 50° C. The temperature of the air-source heat exchanger may be between any two values described herein. The temperature differential between the evaporator and the air-source heat exchanger may be greater than or equal to about 10° C., 20° C., 30° C., 40° C., 50° C., 60° C., 70° C., 80° C., 90° C. or greater. The temperature differential between the evaporator and the air-source heat exchanger may be between any two values described herein. In some embodiments, the system further comprises a pack pressure regulator. In some embodiments, the water heat recovery heat exchanger, and an air-source heat exchanger may be placed at separate compressor stages (i.e., the higher temperature fluid may be used at a higher compression stage).

In some embodiments, the system comprises a heat pump system and a refrigeration system as described herein. In some embodiments, the system is configured to operate the heat pump system and the refrigeration system separately (e.g., through one or more controllers). In some embodiments, the system is configured to operate the heat pump system and the refrigeration system in tandem. In some embodiments, the system is configured to be able to control the operation of the heat pump system and the refrigeration system independently.

Top Cycle

In some embodiments, a refrigeration cycle is configured to be in thermal communication with a top cycle of a heat pump system. In some embodiments, the system is configured to provide heat from the refrigeration system directly to the heat pump system as illustrated in the non-limiting examples of FIG. 26. In some embodiments, the system is configured to provide heat from the refrigeration system to the heat pump system through an intermediate loop as illustrated in the non-limiting examples of FIG. 25.

In some embodiments, the top cycle comprises a two-phase heat exchanger configured to be coupled to a bottom cycle and a condenser water heat recovery heat exchanger configured to be coupled to the refrigeration system. In some embodiments, the condenser water heat recovery heat exchanger and the two-phase heat exchanger are configured to be at different temperatures and/or pressures. In some embodiments, the system further comprises a pack pressure regulator. In some embodiments, the condenser water heat recovery heat exchanger and the two-phase heat exchanger are configured to be placed at separate compressor stages (i.e., the higher temperature fluid may be used at a higher compression stage).

In some embodiments, the refrigeration system and/or intermediate loop may comprise an air-cooled condenser and/or a condenser water loop.

In some embodiments, the system comprises a heat pump system and a refrigeration system as described herein. In some embodiments, the system is configured to operate the heat pump system and the refrigeration system separately. In some embodiments, the system is configured to operate the heat pump system and the refrigeration system in tandem. In some embodiments, the system is configured to be able to control the operation of the heat pump system and the refrigeration system independently.

In some embodiments, the system may comprise a controller. In some embodiments, the controller may be configured to control one or more operations and/or one or more components (e.g., compressors, expansion valves, heat exchangers, fluid streams, etc.) of a cycle and/or loop of the system. As a non-limiting example, one or more controllers may control an operation of a refrigeration cycle by controlling a working fluid of the refrigeration cycle (e.g., a heat transfer fluid).

A controller of the one or more controllers may control an operation of one or more components of the refrigeration cycle (e.g., a heat exchanger, a low temperature evaporator). In some embodiments, a controller of the refrigeration system may allow the system to couple and/or decouple from one or more cycles, fluid streams, or components of the system. As a non-limiting example, a controller may control a fluid stream of the refrigeration system to shut off an air-sourced heat exchanger and/or switch on a secondary heat source (e.g., waste heat stream, geothermal heat source, or refrigeration subunit).

A benefit of a controlled system as described herein is the ability to accept heat from a variety of heat sources, while closing off components or systems when not in use, in order to increase efficiency of the system. Another benefit of a controlled system as described herein is that the controlled system may ensure sufficient cooling and/or sufficient steam generation relative to a measured or inputted threshold.

The controller may control the system to use air as a heat source to generate steam and/or hot water when a different heat source (e.g., waste heat stream, geothermal heat source, an electrical heater and/or a refrigeration system) is not operating. The controller may control the system to use a refrigeration system and an air-source heat exchanger as a heat source. The controller may control the heat generated by an air-source heat exchanger based on the amount of heat generated by a different heat source (e.g., a waste heat stream, a geothermal heat source, an electrical heater and/or a refrigeration system). The controller may control the system to use only a refrigeration system as a heat source to generate steam and/or hot water. In some embodiments, the controller may control a heat exchanger to reject heat. The heat exchanger may reject heat in response to a heat source generating too much heat (e.g., an amount of heat over a determined threshold). The heat exchanger may be an air cooler and or coolant loop. The controller may control the system to generate no heat. The controller may control a refrigeration system to reject heat. In some embodiments, the refrigeration system is configured to reject heat into the ambient air.

Hot Water Generation

In one aspect, the present disclosure provides a system for generating steam and/or hot water. In some embodiments, the system comprises a heat pump system. In some embodiments, the system is configured to be a cascading steam heat pump system. The heat pump system may comprise one or more heat pump cycles (e.g., a first heat pump cycle and a second heat pump cycle). In some embodiments, the one or more heat pump cycles include at least a bottom cycle and at least a top cycle.

In some embodiments, a bottom cycle may be configured to circulate a working fluid. The bottom cycle may comprise one or more heat exchangers, one or more expansion valves, one or more compressors, and one or more other elements. The one or more other elements of the bottom cycle may include at least one economizer. The benefits of an economizer may include improved efficiency (e.g., by reducing the vapor quality of the refrigerant entering an expansion valve) and/or increased mass flow rate between compressor stages while maintaining volumetric flow rate. The increased mass flow may help to reduce the required operating speed of the later compressor stages and/or balance thrust between two stages of a double-ended centrifugal compressor.

Medium Temperature Hot Water Generation

In some embodiments, a top cycle may be configured to circulate a working fluid. In some embodiments, the top cycle comprises one or more heat exchangers, one or more expansion valves, one or more compressors, and one or more other elements. The one or more other elements of the top cycle may include at least one economizer. The bottom cycle may comprise a hot water heat exchanger. The hot water heat exchanger may to be in parallel with a second heat exchanger of the bottom cycle as illustrated in the non-limiting examples of FIG. 27. The second heat exchanger may couple the top cycle to a bottom heat cycle. The second heat exchanger may be a two-phase heat exchanger. The hot water heat exchanger and the two-phase heat exchanger may be a single, three-fluid heat exchanger. In some embodiments, a hot water heat exchanger may transfer of heat from a working fluid to a water stream. The hot water heat exchanger may be configured to perform at least a partial heat transfer from the working fluid to the water stream. In some embodiments, a hot water heat exchanger generates hot water in a temperature range of about 20° C. to about 30° C., 30° C. to about 40° C., 40° C. to about 50° C., about 50° C. to about 60° C., about 60° C. to about 70° C., about 70° C. to about 80° C., about 80° C. to about 90° C., about 90° C. to about 100° C., or about 100° C. to 110° C. In some embodiments a hot water heat exchanger generates hot water at a temperature greater than or equal to about 20° C., 30° C., 40° C., 50° C., 60° C., 70° C., 80° C., 90° C., 100° C., 110° C., or greater. The hot water heat exchanger may generate hot water at a temperature between any two values described herein. In some embodiments, the system further comprises at least one of a refrigeration system, a waste heat system, a thermal storage, a backup system, a supplemental system, and/or a combination thereof.

Hot Temperature Hot Water Generation

In some embodiments, a top cycle comprises a hot water heat exchanger. In some embodiments, the hot water heat exchanger is configured in series with a second heat exchanger of the top cycle. The hot water heat exchanger may be downstream from a low-pressure compressor as illustrated in the non-limiting example of FIG. 28. The second heat exchanger may couple the top heat cycle to a bottom heat cycle. The second heat exchanger may be a two-phase heat exchanger.

In some embodiments, a hot water heat exchanger generates hot water at a temperature greater than or equal to about 20° C., 30° C., 40° C., 50° C., 60° C., 70° C., 80° C., 90° C., or 100° C. The hot water heat exchanger may generate hot water at a temperature between any two values described herein. In some embodiments a hot water heat exchanger generates hot water at a saturation point of at least about 104° C. In some embodiments, the system further comprises at least one of a refrigeration system, a waste heat system, a thermal storage, a backup system, a supplemental system, and/or a combination thereof.

In some embodiments, a cycle (e.g., a top cycle or bottom cycle) comprises at least one economizer and/or at least one intercooler. In some embodiments, the heat pump system is configured to pull a working fluid from a fluid stream of at least one economizer and/or the at least one intercooler to generate hot water as illustrated in the non-limiting examples of FIGS. 28-30. The working fluid may be a refrigerant. The cycle may comprise one or more valves configured to throttle a working fluid to a lower pressure (e.g., an intermediate pressure or an evaporator pressure). The working fluid may be a working fluid of a top cycle and/or a bottom cycle. In some embodiments, the system may combine a throttled fluid steam with a main fluid stream between a compressor stage. The main fluid stream may comprise a working fluid of a top and/or a bottom cycle. The throttled fluid may comprise the working fluid of the top and/or the bottom cycle. In some embodiments, the system is configured to prevent liquid and/or a two-phase mixture from being input to a compressor inlet, which could damage the compressor. The throttled fluid may be a refrigerant. The throttled fluid may be a two-phase mixture. The throttled fluid may comprise a liquid and/or a vapor. The main fluid stream may comprise a superheated vapor. In some embodiments, the system is configured to superheat a combined two-phase mixture and/or a superheated vapor.

In some embodiments, a hot water heat exchanger is configured to inject a fluid directly into an intercooler fluid stream. The fluid may or may not pass through a valve between the hot water heat exchanger and the intercooler. The fluid output by a hot water heat exchanger may be a refrigerant.

Condensers in Series

Figure 31:
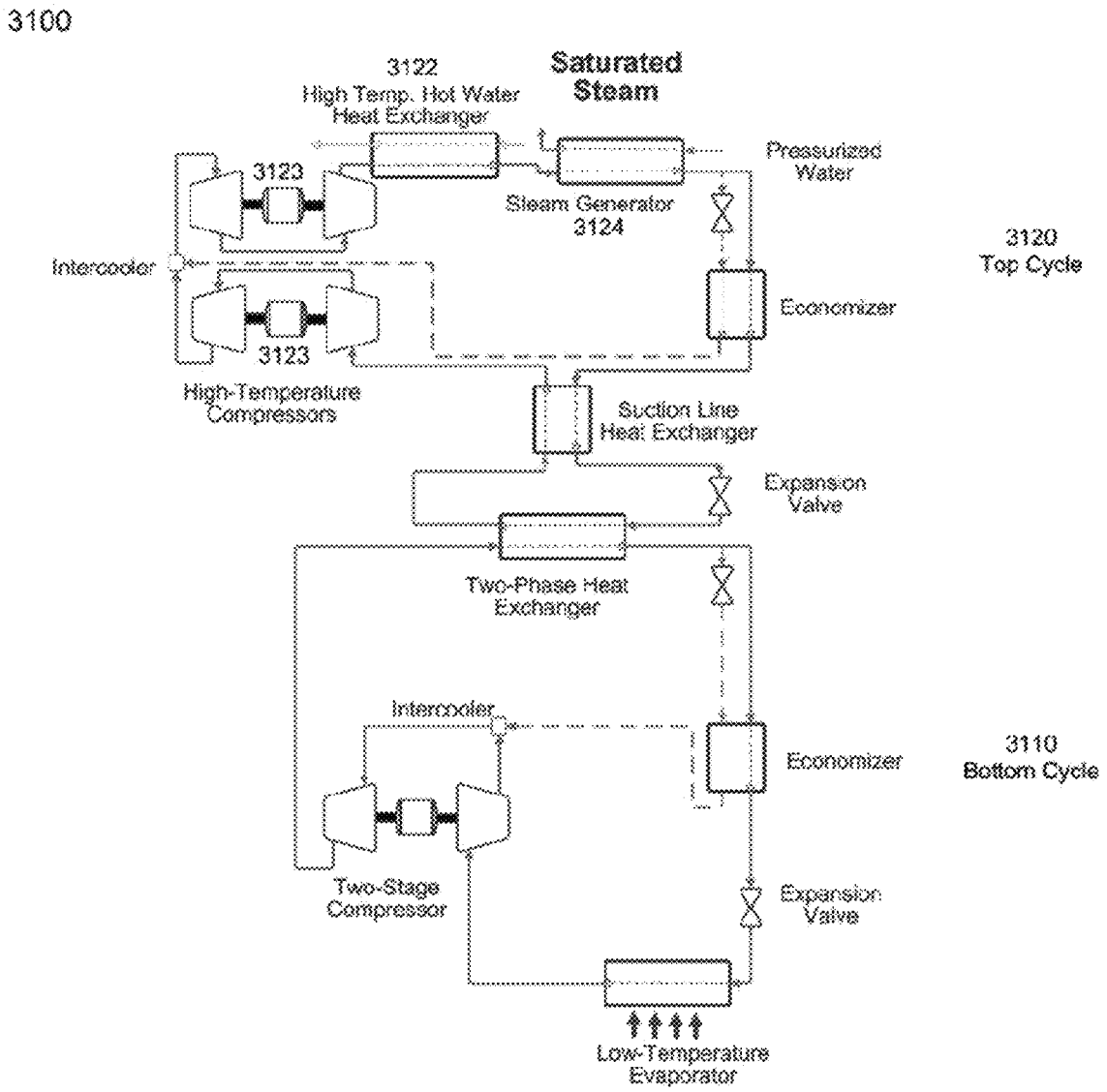

In some embodiments, a hot water heat exchanger may be in series with a steam generator. In a non-limiting example, the hot water heat exchanger may be upstream of the steam generator as illustrated in FIG. 31. The hot water heat exchanger may be arranged between a compressor and the steam generator. The hot water heat exchanger may be downstream of the compressor. The hot water heat exchanger may receive a first working fluid, (e.g., a vapor), discharged by the compressor to generate hot water. The hot water heat exchanger may output a working fluid (e.g., the first working fluid). In some embodiments, the working fluid output by the hot water heat exchanger may comprise a refrigerant. In some embodiments, the hot water heat exchanger may be a high temperature hot water heat exchanger. In some embodiments, the working fluid output by the hot water heat exchanger may comprise a refrigerant that is a vapor or partially condensed two-phase fluid. In some embodiments, the hot water heat exchanger may be downstream of the steam generator. In some embodiments, the refrigerant may enter the hot water heat exchanger as a vapor, a partially condensed two-phase fluid, or a liquid.

Condensers in Parallel

In some embodiments, a hot water heat exchanger may be in parallel with a steam generator. In a non-limiting example, the hot water heat exchanger and the steam generator may be downstream of a compressor as illustrated in the non-limiting example of FIG. 32. The hot water heat exchanger may receive a first working fluid (e.g., a hot vapor). In some embodiments, the hot water heat exchanger may output a working fluid (e.g., the first working fluid). The working fluid output by the hot water heat exchanger may comprise a saturated liquid. Alternatively, the hot water heat exchanger may be configured to output a working fluid, where the working fluid output by the hot water heat exchanger may comprise a subcooled liquid.

Three Fluid Condenser

In some embodiment, a heat exchanger of a top cycle may be a three-fluid heat exchanger. In some embodiments, the three-fluid heat exchanger may generate steam and/or generate hot water. In some embodiments, the three-fluid heat exchanger may be a single device as illustrated in the non-limiting example of FIG. 33.

Steam in Parallel/Series

In some embodiments, a hot water heat exchanger is coupled to a cycle (e.g., a bottom cycle, a top cycle, etc.) of the system. In some embodiments, the hot water heat exchanger is coupled to a cycle of the present disclosure such that one or more heat exchangers of the cycle are in parallel with the hot water heat exchanger. In some embodiments, the hot water heat exchanger is coupled to a cycle of the present disclosure such that the hot water heat exchanger may be in series with one or more heat exchangers of the cycle. In some embodiments, the hot water heat exchanger may be coupled directly to a cycle (e.g., a top cycle, a bottom cycle, and/or a heat transfer fluid cycle). Alternatively, the refrigeration cycle may be coupled to a cycle (e.g., a top cycle, a bottom cycle, and/or a heat transfer fluid cycle) by an additional fluid loop (e.g., an intermediate loop, a glycol loop, etc.).

Figure 34:
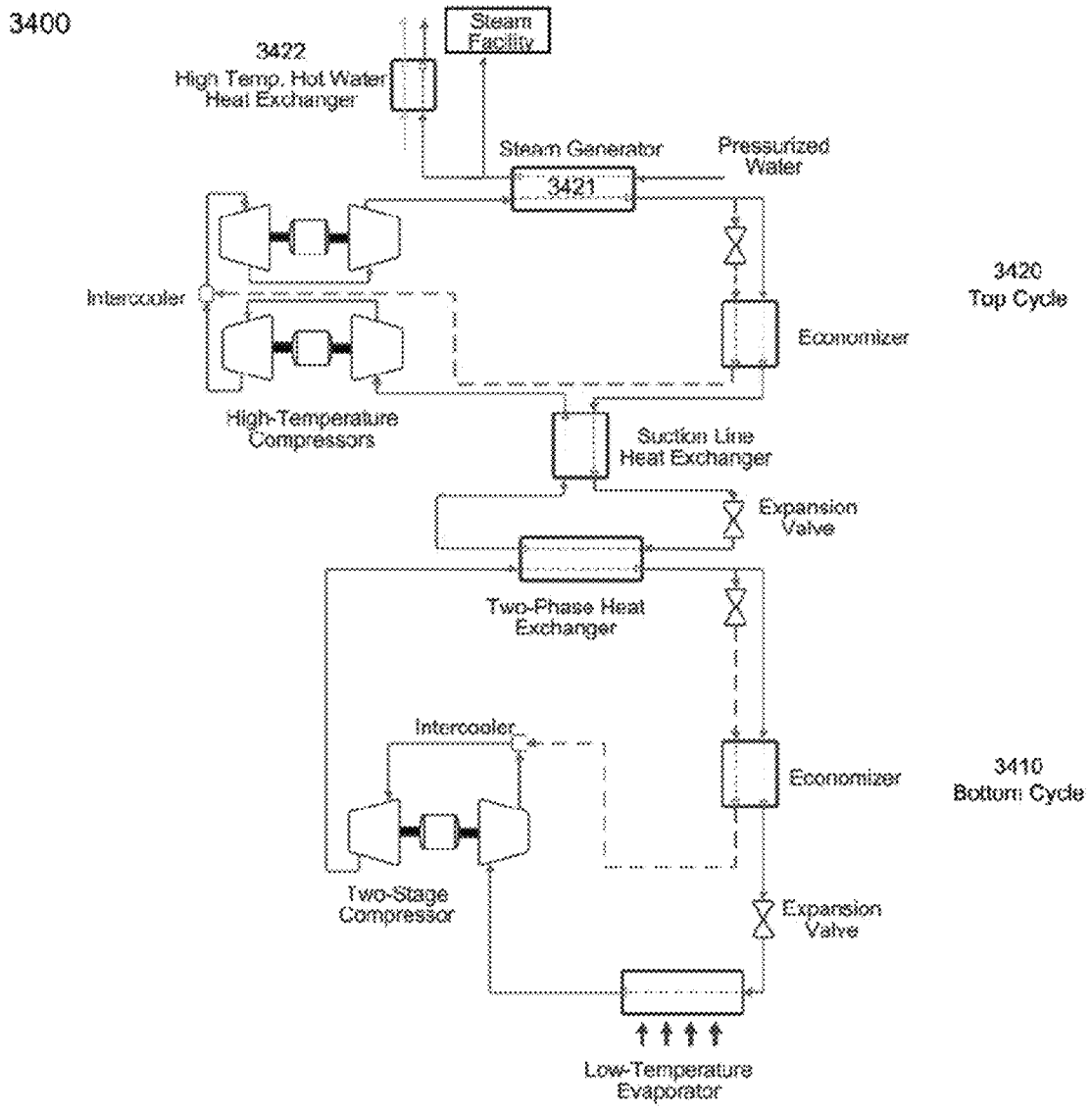
FIGS. 34-35 illustrate examples of a steam generating system capable of generating steam and/or hot water in accordance with some embodiments described herein.

In some embodiments, a hot water heat exchanger is configured to be located downstream from a steam generator as illustrated in the non-limiting examples of FIG. 34. The hot water heat exchanger may receive steam from the steam generator to generate hot water. The hot water heat exchanger may be in parallel with a steam stream directed to a facility. The hot water heat exchanger may be in series with the steam stream directed to a facility. In some embodiments, a compressor (e.g., a steam compressor) may be located between the steam generator and the hot water heat exchanger as illustrated in the non-limiting examples of FIG. 35. The steam generator may output superheated steam from a heat pump cycle. In some embodiments, the hot water heat exchanger may de-superheat the steam output by the heat pump cycle. In some further embodiments, a steam stream directed to a facility is configured to receive a de-superheated steam output by the hot water heat exchanger. The de-superheated steam may comprise a saturated steam.

In some embodiments, a steam generating system described herein may comprises a steam generator. The steam generator may be configured to generate a stream of pressurized hot water. The pressurized hot water stream may be delivered to a flash tank, wherein the flash tank uses the pressurized hot water stream to generate steam.

Subcooling

In some embodiments, a working fluid may be subcooled. Subcooling may enable improved control of expansion valves and improve efficiency of the cycle. For example, subcooling a fluid stream prior to entry to an expansion valve may provide improved control of the expansion valve operation at lower material temperatures (e.g., preventing the fluid stream from becoming a two-phase mixture). Alternatively, or in addition, subcooling a fluid stream prior to entry to an expansion valve may improve efficiency of a cycle comprising the expansion valve by transferring more energy from the condenser side and/or lowering the inlet vapor quality to an evaporator thereby allowing for greater heat transfer for a given flow rate. Further, the motor coolant may require subcooled liquid. In some embodiments, the working fluid of the bottom cycle is subcooled by a subcooler. In some embodiments, the working fluid of the top cycle is subcooled by a subcooler. In some embodiments, the subcooler is a thermosyphon. In some embodiments, the subcooler is located at an elevation equal to or below the two-phase heat exchanger. In some embodiments, the subcooler is used in parallel with an evaporator. When the subcooler is used in parallel with an evaporator, it may be important to control the flow fraction to the subcooler. The flow fraction may be controlled by a thermosyphon approach, a control valve, and/or adding a flow restriction.

Hot Water Generation Controls

In some embodiments, the system comprises a controller. The controller may be configured to control the operations of one or more elements of the system. The controller may be configured to control the operations of a refrigeration system and/or at least one of a bottom cycle, a top cycle, etc. of the system. The controller may control the operations of the system to generate hot water and/or steam. In some embodiments, the controller to control the system to generate only hot water or steam. In some embodiments, the controller is configured to control the system to generate hot water and steam simultaneously. In some embodiments, the hot water generated is low temperature hot water. In some embodiments, the hot water generated is high temperature hot water. In some embodiments, the controller is configured to shut off and/or turn on any element and/or operation of the system. The controller may determine whether to shut off and/or turn on any part of the system based on an input. The input may comprise at least one of a user input, data from the system, data from an external source, or any combination thereof. The data may comprise at least one of pressure data, electrical data, temperature data, operational data, safety data, output data, system data, environmental data, or other data. The user input may comprise one or more of an operational instruction, an output quota, a priority ranking, an emergency shut off, or other user input.

In a non-limiting example, the controller may control the system to generate only hot water. The controller may control the system to turn off steam generation operations when the water generated is a high temperature hot water. The controller may control the system to generate hot water and steam. The hot water generated may be a high temperature hot water.

In a non-limiting example, the controller may control the system to only generate high temperature hot water. The high temperature hot water may be generated in a top cycle. In some embodiments, the controller may control the system to generate both steam and low temperature hot water. The low temperature hot water may be generated in a bottom cycle while the steam may be generated in a top cycle.

In a non-limiting example, the controller is configured to control the system to generate only low temperature hot water. The controller may turn off a top cycle, when only low temperature hot water is needed.

In some embodiments, the controller is configured to control the system to generate steam, high temperature hot water, and/or low temperature hot water. The controller may control the system to generate any combination of steam and/or hot water. The controller may control the system to generate one or more hot water streams. In some embodiments, at least one of the one or more generated hot water streams may have different temperatures. In some embodiments, the one or more generated hot water streams have the same temperature. The one or more generated hot water streams may have any combination of different and/or same temperatures.

Cold Weather Operations

Heat Cold Air

In some embodiments, a system described herein is configured to perform cold weather operations. In some embodiments, the system is configured to collect waste heat. In some embodiments, the system is configured to use waste heat to heat a fluid (e.g., a working fluid, water, air, etc.,) as illustrated in the non-limiting examples of FIGS. 36 and 57-67. The system may use collected waste heat to maintain a higher refrigerant saturation temperature in a heat exchanger. The heat exchanger may comprise an evaporator. The heat exchanger may be an air-source heat exchanger.

In some embodiments, the system may use a heater to heat a fluid. The fluid may be air. The heater may be an electric resistance heater as illustrated in the non-limiting example of FIG. 37. The heater may be used to maintain a higher refrigerant saturation temperature in a heat exchanger. The heat exchanger may comprise an evaporator. The heat exchanger may be an air-source heat exchanger.

Figure 38:
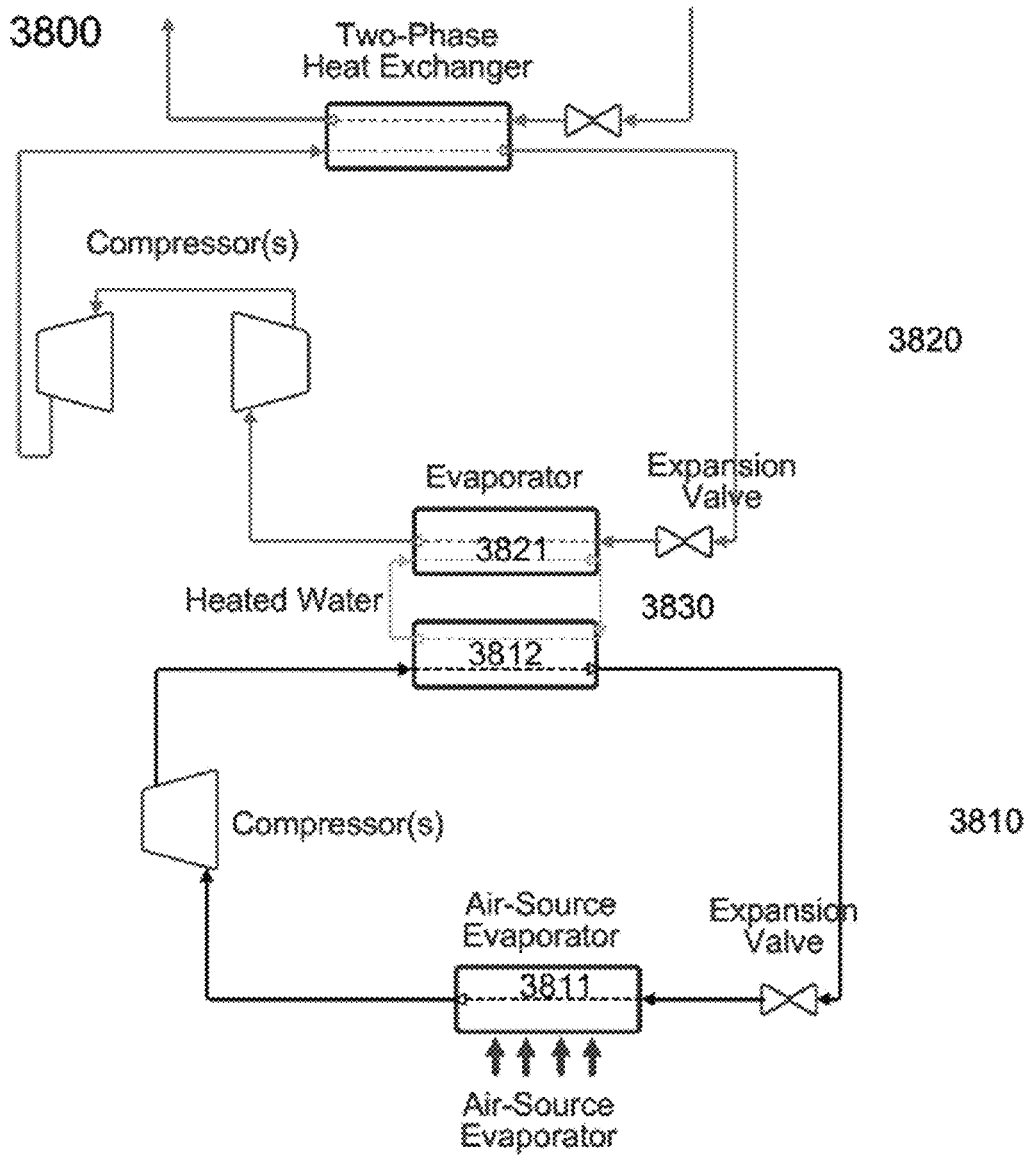
FIG. 38 illustrates an example of a heat pump cycle in accordance with some embodiments described herein.

In some embodiments, the system comprises a main heat pump system (e.g., a heat pump system as described herein) and a separated air-sourced heat pump system as illustrated in the non-limiting example of FIG. 38. The separated air-sourced heat pump system may comprise at least one heat exchanger, at least one compressor, and at least one expansion valve. The at least one heat exchanger may comprise at least one air-source heat exchanger. In some embodiments, the system is configured to use a separated air-sourced heat pump system in extreme cold conditions. The separated air-sourced heat pump system may be configured to deliver a working fluid to a bottom cycle of the main heat pump system. The working fluid delivered by the separated air-sourced heat pump system may be a coolant. In some embodiments, the coolant has a temperature less than or equal to about −10° C., −5° C., 0° C., 5° C., 10° C., 15° C., 20° C., 25° C., or 30° C. The coolant temperature may be between any two values described herein.

Figure 39:
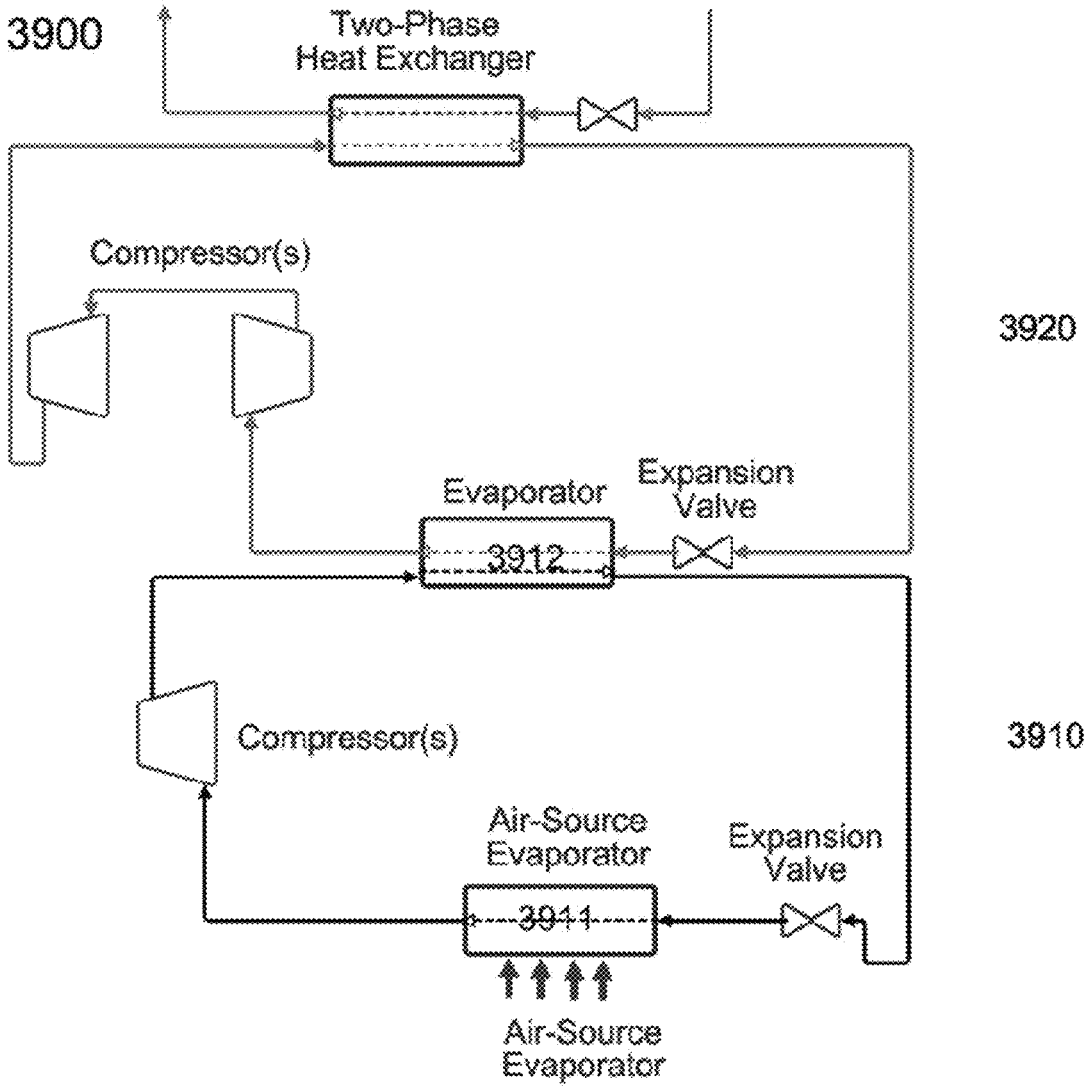
FIG. 39 illustrates an example of a heat pump cycle in accordance with some embodiments described herein.

In some embodiments, a separated air-sourced heat pump system is coupled to heat pump cycle (e.g., a bottom cycle, a top cycle, etc.) of the system as illustrated in the non-limiting example of FIG. 39. In some embodiments, the separated air-sourced heat pump system is coupled to a system of the present disclosure such that one or more heat exchangers of the separated air-sourced heat pump system are in parallel with one or more heat exchangers of the top cycle. In some embodiments, the separated air-sourced heat pump system is coupled to a system of the present disclosure such that one or more heat exchangers of the separated air-sourced heat pump system are in parallel with one or more heat exchangers of the bottom cycle. In some embodiments, the separated air-sourced heat pump system is coupled to a system of the present disclosure such that one or more heat exchangers of the separated air-sourced heat pump system are in parallel with one or more heat exchangers of a heat transfer fluid cycle. Alternatively, or in addition, the separated air-sourced heat pump system may be coupled to a system of the present disclosure such that the separated air-sourced heat pump system is in series with one or more heat exchangers of the top cycle. In some embodiments, the separated air-sourced heat pump system is coupled to a system of the present disclosure such that one or more heat exchangers of the separated air-sourced heat pump system are in series with one or more heat exchangers of the bottom cycle. In some embodiments, the separated air-sourced heat pump system is coupled to a system of the present disclosure such that one or more heat exchangers of the separated air-sourced heat pump system are in series with one or more heat exchangers of a heat transfer fluid cycle. In some embodiments, the separated air-sourced heat pump system may be coupled directly to a cycle (e.g., a top cycle, a bottom cycle, and/or a heat transfer fluid cycle). Alternatively, the separated air-sourced heat pump system may be coupled to a cycle of the system (e.g., a top cycle, a bottom cycle, and/or a heat transfer fluid cycle) by an additional fluid loop (e.g., an intermediate loop, a glycol loop, etc.).

In some embodiments, a heat pump system comprises at least one compressor. In some embodiments, a bottom cycle comprises the at least one compressor(s). In some embodiments, the at least one compressors comprises at least one main compressor and/or at least one add-on compressor as illustrated in the non-limiting example of FIG. 40A. The add on compressor may be configured to maintain a suction temperature in main compressor. The compressor(s) may be configured to maintain a suction temperature during cold weather operations. The suction temperature may be great than or equal to about 0° C., 5° C., 10° C., 15° C., 20° C., 25° C., or 30° C. The suction temperature may be about 7° C. The suction temperature may be between any two values described herein. The heat pump system may further comprise at least one valve. The heat pump system may further comprise at least one bypass line. In some embodiments, one or more of the at least one valves may be configured to control the bypass lines. The valves and bypass lines may be configured isolate one or more of the one or more compressors. The benefits of isolating a compressor may include the ability to turn off the isolated compressor (e.g., when the ambient temperature exceeds a certain temperature). The compressors may be configured to maintain a suction temperature in a centrifugal compressor. The suction temperature may be greater than or equal to about 0° C., 5° C., 10° C., 15° C., 20° C., 25° C., or 30° C. The suction temperature may be between any two values described herein. The centrifugal compressor may be coupled to a bottom cycle. Alternatively, the compressor may be coupled to a top cycle.

In some embodiments, a top cycle is configured to circulate a working fluid. In some embodiments, a working fluid of the top cycle comprises a hydrocarbon, a natural fluid, an exotic fluid, a supercritical fluid, and/or a combination thereof. The top cycle may comprise at least one compressor. The compressor(s) may be turned on during cold weather operations. The compressor(s) may overcome heat losses of a bottom cycle. In some embodiments, the top cycle may comprise at least one bypass line as illustrated in the non-limiting example of FIG. 41. In some embodiments, the system further comprises one or more valves. The valves may be configured to control the bypass lines to and isolate one or more of the compressors. The valve(s) and/or bypass line(s) may be configured to shut off one or more compressor(s). The one or more compressor(s) may be shut off to maintain an efficiency of one or more operating compressor(s).

Super Critical

In some embodiments, a heat pump system is configured to generate steam at temperatures greater than a critical temperature. In some embodiments, the heat pump system may comprise one or more cycles (e.g., a top cycle and a bottom cycle etc.). A bottom cycle may circulate a first working fluid. A top cycle may circulate a second working fluid. The first working fluid may be a subcritical fluid in at least a portion of the bottom cycle. The second working fluid may be a supercritical fluid in at least a portion of the top cycle. The top cycle may comprise a steam generator. The steam generator may be downstream from a compressor. A compressor may receive a working fluid and output a supercritical fluid. A steam generator may receive the supercritical fluid from the compressor. A steam generator may receive a feed fluid. In some embodiments, a steam generator transfers heat from a first supercritical to a feed fluid to generate steam. The feed fluid may comprise water. The generated steam may comprise steam at temperatures greater than a critical temperature of the second working fluid.

Figure 42:
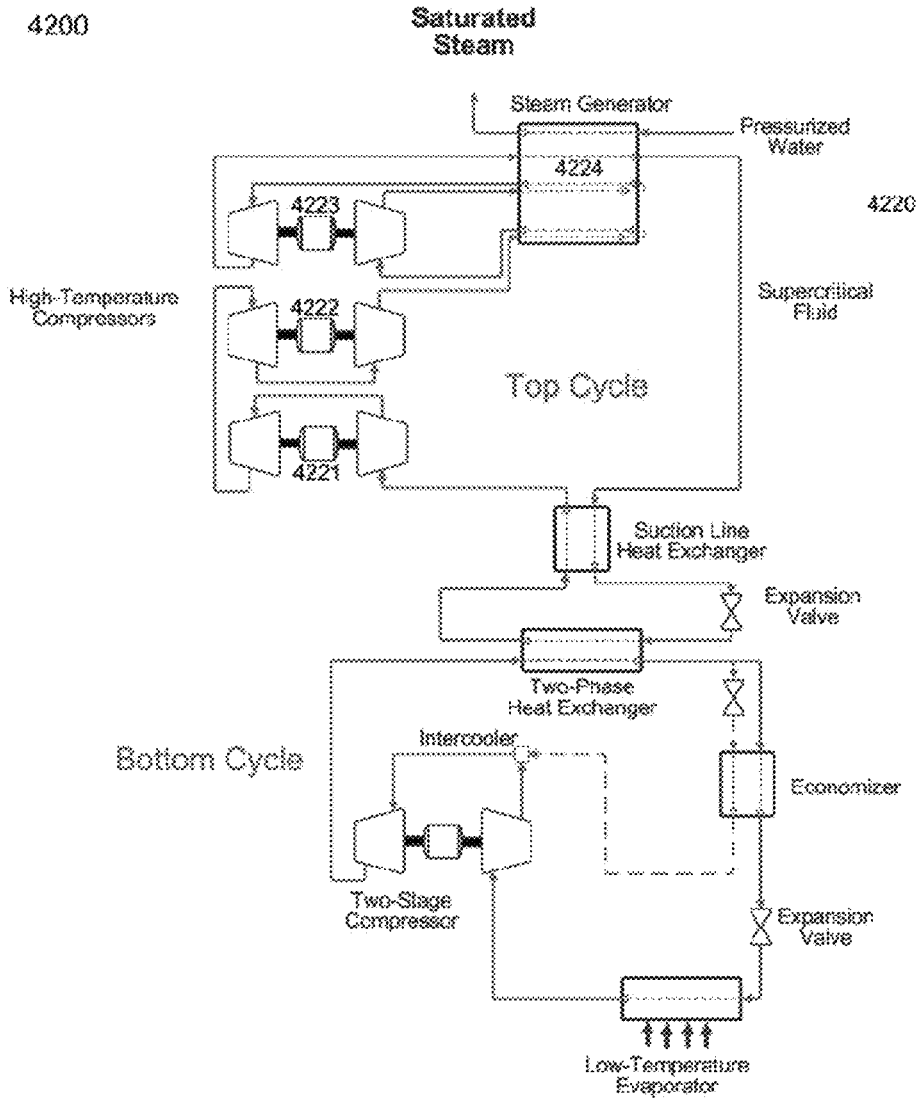
FIG. 42 illustrate examples of a steam generating system configured to generate a supercritical fluid in accordance with some embodiments described herein.

In some embodiments, a cycle comprises a one or more compressors (e.g., a first compressor, a second compressor, and a third compressor) as illustrated in the non-limiting example of FIG. 42. A first compressor may receive a subcritical fluid. The first compressor may output a first supercritical fluid. A first steam generator may receive the first supercritical fluid from the first compressor and generate steam. The first steam generator may output a second supercritical fluid.

A second compressor may receive the second supercritical fluid from the first steam generator. The second compressor may output a third supercritical fluid. The first steam generator may receive the third supercritical fluid from the second compressor and generate steam. In some embodiments, a cycle and/or a system may comprise one or more (e.g., three, four, etc.) steam generators and/or one or more (e.g., three, four, etc.) compressors configured as described above. In some embodiments, a cycle comprises a one or more compressors. In some embodiments, at least one of the one or more compressors may output a supercritical fluid to a steam generator. In some embodiments, at least one of the one or more compressors may output a non-supercritical fluid. The non-supercritical fluid may be output upstream from the at least one compressor outputting the supercritical fluid to a steam generator. A compressor may comprise one or more compressor stages. The compressor stages may comprise a first and a second compressor stage. The first compressor stage may receive and/or output a non-supercritical fluid. The second compressor stage may receive a non-supercritical fluid output by the first stage. The second compressor stage may output a supercritical fluid.

In some embodiments, a cycle comprises one or more compressors, a first steam generator, and a second steam generator. A compressor may comprise one or more compressor stages. The compressor stages may comprise a first and second compressor stage. At least one of the compressor stages may output a supercritical fluid to a steam generator. At least one of the compressor stages may to output a non-supercritical fluid.

In some embodiments, a cycle comprises one or more compressors. A compressor may comprise one or more compressor stages. The first compressor stage may receive a subcritical fluid. The first compressor stage may output a first supercritical fluid stream. The first steam generator may transfer heat from a first portion of the first supercritical fluid stream to a feed fluid and generate steam and/or hot water. The first feed fluid may comprise water. The second steam generator may transfer heat from a second portion of the first supercritical fluid stream to a feed fluid and generate steam and/or hot water. In some embodiments, the cycle may comprise at least one economizer and/or at least one intercooler. An economizer and/or an intercooler may receive a non-supercritical fluid. The non-supercritical fluid may be a working fluid from the cycle. Alternatively, the non-supercritical fluid may be a working fluid from a different cycle and/or loop.

In some embodiments, a steam generator is coupled to a cycle (e.g., a bottom cycle, a top cycle, etc.) of the system. In some embodiments, the steam generator is coupled to a cycle of the present disclosure such that one or more heat exchangers of the cycle are in parallel with the steam generator. In some embodiments, steam generator is coupled to a cycle of the present disclosure such that the steam generator is in series with one or more heat exchangers of the cycle. In some embodiments, the steam generator may be coupled directly to a cycle (e.g., a top cycle, a bottom cycle, and/or a heat transfer fluid cycle). Alternatively, the steam generator may be coupled to a cycle (e.g., a top cycle, a bottom cycle, and/or a heat transfer fluid cycle) by an additional fluid loop (e.g., an intermediate loop, a glycol loop, etc.). A heat exchanger of the cycle may be a steam generator.

Steam Compressors

In some embodiments, a steam generator system as described herein comprises one or more steam compressors and one or more heat pump cycles (e.g., a first heat pump cycle and a second heat pump cycle). The one or more heat pump cycles may comprise a steam generator. The steam generator may output steam from a heat pump cycle. A steam compressor may be downstream from the steam generator of a cycle as illustrated in the non-limiting example of FIG. 43. A compressor may raise a temperature of steam generated by a heat pump cycle. The use of steam compressor(s) may allow for a steam generator system to make up for a loss of heat and pressure of steam delivered by a heat pump system as a result of cold weather. This provides a system with the benefit of being able to maintain a consistent pressure and temperature of steam output and delivered by the system during periods of increased heat loss. In some embodiments, one or more steam compressors may be configured to raise the saturation temperature of steam generated by a heat pump system by up to about 5° C., 10° C., 20° C., 30° C., 40° C., 50° C., 60° C., 70° C., 80° C., 90° C., 100° C., or greater. The one or more steam compressors may be configured to raise the saturation temperature of steam generated by a heat pump system by a temperature between any two values described herein. In some embodiments, one or more steam compressors may be configured to raise the saturation temperature of steam generated by a heat pump system to about 90° C., 100° C., 110° C., 120° C., 130° C., 140° C., 150° C., 175° C., 200° C., 225° C., or greater. The one or more steam compressors may be configured to raise the saturation temperature of steam generated by a heat pump system to a temperature between any two values described herein. In some embodiments, one or more steam compressors may be configured to raise the pressure of steam generated by a heat pump system by about 30 kPa to about 2500 kPa. In some embodiments, one or more steam compressors may be configured to raise the pressure of steam generated by a heat pump system by up to about 30 kPa, 50 kPa, 100 kPa, 200 kPa, 500 kPa, 1000 kPa, 1500 kPa, 2000 kPa, 2500 kPa, or greater. The one or more steam compressors may be configured to raise the pressure of steam generated by a heat pump system by a pressure between any two values described herein. In some embodiments, one or more steam compressors may be configured to raise the pressure of steam generated by a heat pump system to about 50 kPa, 100 kPa, 200 kPa, 500 kPa, 1000 kPa, 1500 kPa, 2000 kPa, 2500 kPa, or greater. The one or more steam compressors may be configured to raise the pressure of steam generated by a heat pump system to a pressure between any two values described herein. In some embodiments, one or more steam compressors may be configured to raise the temperature of steam generated by a heat pump system to a minimum temperature requirement (e.g., 120° C.). In some embodiments, one or more steam compressors may be configured to raise the temperature of steam generated by a heat pump system by more than 30° C.

In some instances, high-pressure saturated steam may be desired at a lower temperature than that of the steam exiting the steam compressor (e.g., when the steam at the outlet of the steam compressor is superheated). In some embodiments, water injection is used to decrease the temperature of the output steam. The water injection may decrease the temperature of the output steam by about 10° C., 12° C., 15° C., 20° C., 25° C., 30° C., 40° C., 50° C., 60° C., 70° C., 80° C., 100° C., 125° C., 150° C., or greater. The temperature decrease of the output steam may be between any two values described herein. In some embodiments, water is injected upstream of the steam compressor. In some embodiments, water is injected into the steam compressor. In some embodiments, water is injected downstream of the steam compressor. In some embodiments, a heat exchanger is located downstream of the steam compressor. In some embodiments, the water injection allows the steam compressor to operate at a lower temperature (e.g., when water is injected upstream of or into the compressor). The type of compressor used to determine the ideal location for injection. For example, a screw compressor or a piston compressor may have an ideal location for injection at any location, while a centrifugal steam compressor may have an ideal location for injection downstream of the compressor. A lower operating temperature may improve the durability of the steam compressor and/or allow for inclusion of additional commercial equipment (e.g., seals). In some embodiments, the heat exchanger uses refrigerant from another location in the heat pump cycle to cool the steam. Alternatively, or in addition, the benefits of the water injection may include increasing the overall steam flow rate output of the heat pump system.

Topping Cycle

Figure 44:
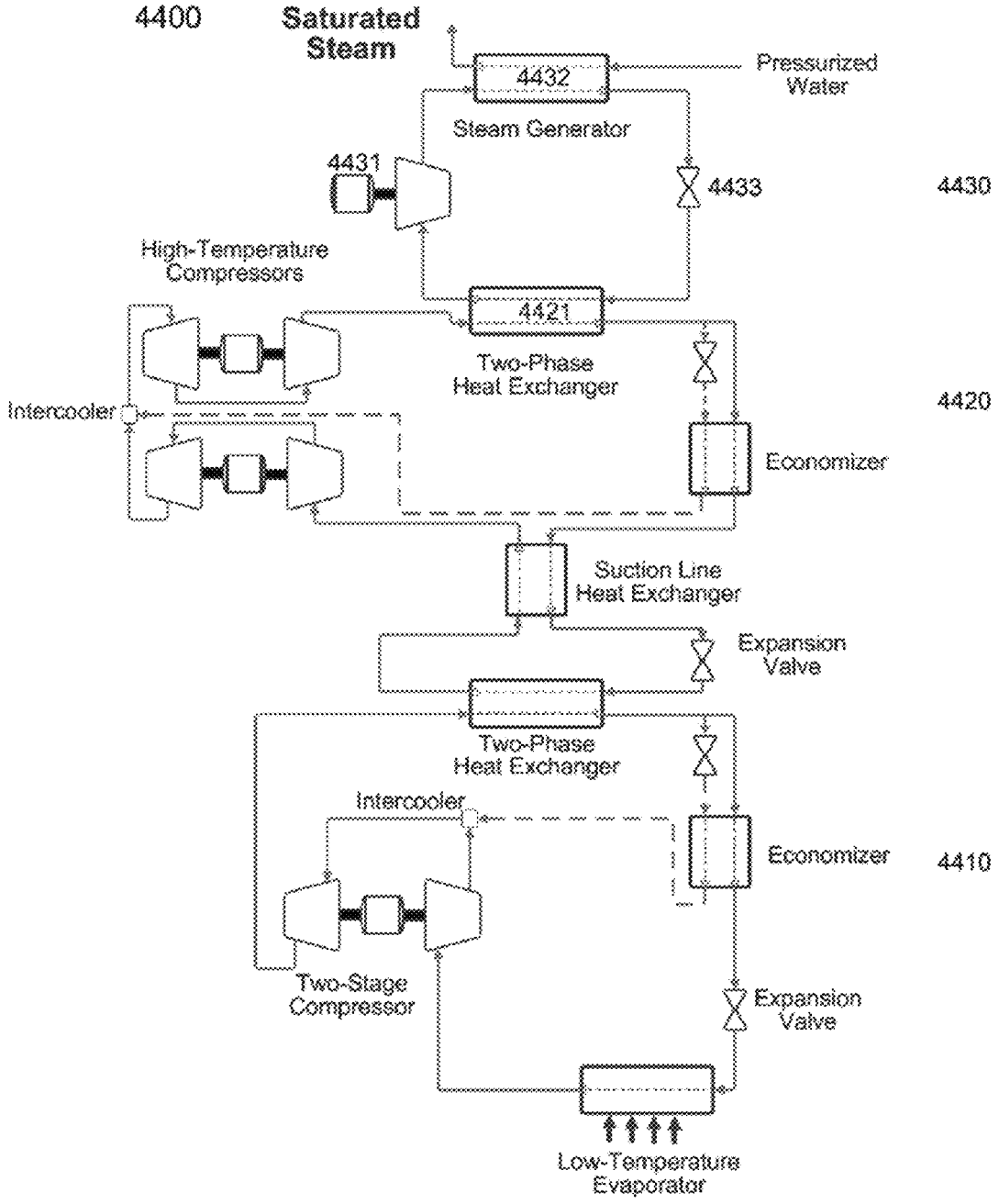
FIGS. 44-45 illustrate examples of a steam generating system comprising an additional topping cycle in accordance with some embodiments described herein.
Figure 45:
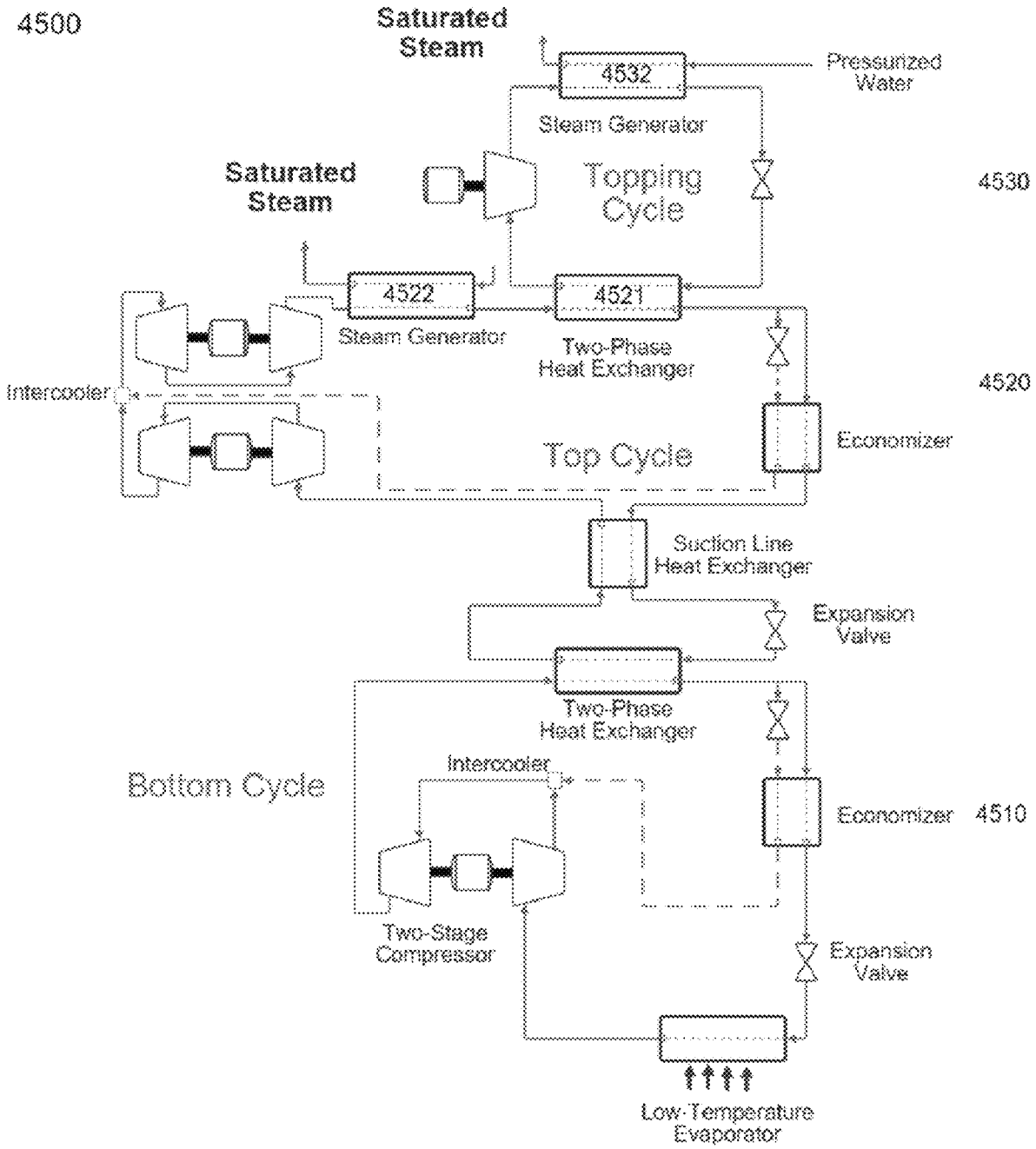

In some embodiments, a system described herein may comprise a bottom heat pump cycle, a top heat pump cycle, and a topping cycle as illustrated in the non-limiting examples of FIGS. 44-45. A topping cycle may comprise a steam generator, a valve, a compressor, a heat exchanger, and/or a steam generator. A topping cycle may circulate a working fluid. The working fluid of the topping cycle may be a hydrocarbon, a natural fluid, an exotic fluid, or a supercritical fluid. A topping cycle may generate steam with a temperature greater than a temperature of steam generated using a top and bottom heat pump cycle alone.

A topping cycle may be turned on in response to cold weather and/or an elevated steam pressure demand. In some embodiments, a heat pump system can comprise one or more topping cycles. The one or more topping cycles may deliver steam and/or hot water. The one or more topping cycles may deliver steam and/or hot water at one or more different pressures. The one or more topping cycles may deliver steam and/or hot water at pressures greater than or equal to about 50 kPa, 100 kPa, 200 kPa, 500 kPa, 1000 kPa, 1500 kPa, 2000 kPa, 2500 kPa, or greater. The one or more topping cycles may deliver steam and/or hot water at pressures between any two values described herein. The one or more topping cycles may deliver steam and/or hot water at different pressures simultaneously. The one or more topping cycles may deliver steam and hot water simultaneously.

In some embodiments, a topping cycle is coupled to a cycle (e.g., a bottom cycle, a top cycle, etc.) of the system. In some embodiments, the topping cycle is coupled to a cycle of the present disclosure such that one or more heat exchangers of the cycle are in parallel with the topping cycle. In some embodiments, the topping cycle is coupled to a cycle of the present disclosure such that the topping cycle in series with one or more heat exchangers (e.g., a steam generator) of the cycle as illustrated in the non-limiting example of FIG. 45. In some embodiments, the topping cycle may be coupled directly to a cycle (e.g., top cycle, bottom cycle, and/or a heat transfer fluid cycle). Alternatively, the refrigeration cycle may be coupled to a cycle (e.g., top cycle, bottom cycle, and/or heat transfer fluid cycle) by an additional fluid loop (e.g., an intermediate loop, a glycol loop, etc.). In some embodiments, the topping cycle replaces a steam generator of the top heat pump cycle.

Defrosting

In some embodiments, a heat pump system may comprise one or more cycles (e.g., a first heat pump cycle and a second heat pump cycle). The one or more cycles may comprise one or more hot gas bypass lines as illustrated in the non-limiting examples of FIGS. 46-47. A hot gas bypass line may comprise one or more valves. A hot gas bypass lines may deliver a hot fluid from a first section of a cycle to a second section of a cycle. The first section may be from a first cycle and the second section may be a different section from the first cycle. Alternatively, the first section may be from a first cycle and the second section may be from a second cycle.

In some embodiments, one or more hot gas bypass lines may be configured to defrost one or more components of a cycle using a hot fluid (e.g., hot water, steam, etc.). The hot fluid may be from a compressor discharge. The hot fluid may be from a section of a heat pump system having an elevated pressure. A hot gas bypass line may deliver a hot fluid upstream of one or more heat exchangers. The one or more heat exchangers may comprise an air-source heat exchanger. In some embodiments, one or more hot gas bypass lines may be in parallel. The one or more hot gas bypass lines may be coupled to a corresponding heat exchanger of the one or more heat exchangers as illustrated in the non-limiting example of FIG. 47. The one or more hot gas bypass lines may be controlled to defrost the corresponding heat exchanger of the one or more heat exchangers independently from each other.

Figure 48:
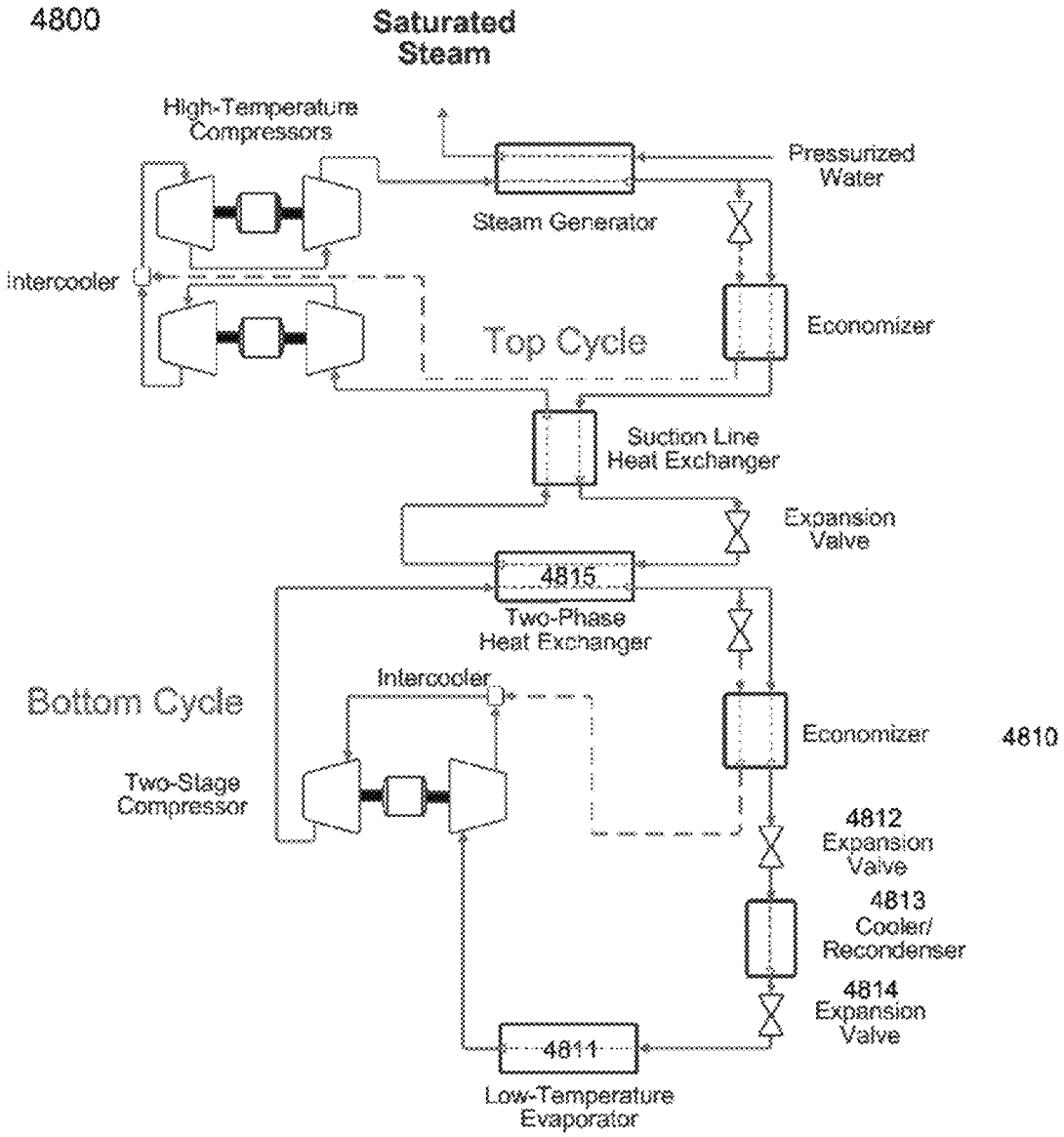
FIG. 48 illustrate examples of a steam generating system in accordance with some embodiments described herein.

In some embodiments, a heat pump system may comprise a cooler/recondenser as illustrated in the non-limiting example of FIG. 48 to help provide defrosting to a component of the system (e.g., a low temperature evaporator). During normal operation of the system, a first expansion valve downstream from an economizer may be opened fully to cause a minimal pressure change in a fluid (e.g., a working fluid of a cycle). The cooler/recondenser may provide zero change to the working fluid, wherein a second expansion valve and a heat exchanger (e.g., a low-temperature evaporator) operate as normal. When required (e.g., during cold weather operations), the cooler/recondenser may provide further subcooling to a working fluid prior to the second expansion valve. In some embodiments, the first expansion valve partially expands the working fluid to an intermediate pressure between the two-phase heat exchanger and the low-temperature evaporator. The cooler/recondenser may then recondense and/or subcool the partially expanded working fluid output by the first expansion valve. In some embodiments, the cooler/recondenser can be a separate unit installed in a cycle and/or a loop. In some embodiments, the cooler/recondenser may be an existing low-temperature evaporator having a position in the cycle and/or loop configured to be changed by one or more valves. In some embodiments, an expansion valve can be a separate unit installed in a cycle and/or loop. In some embodiments, an expansion valve may be an existing expansion valves having a position in the cycle and/or loop configured to be changed by one or more valves.

Resistance Heaters

Figure 49:
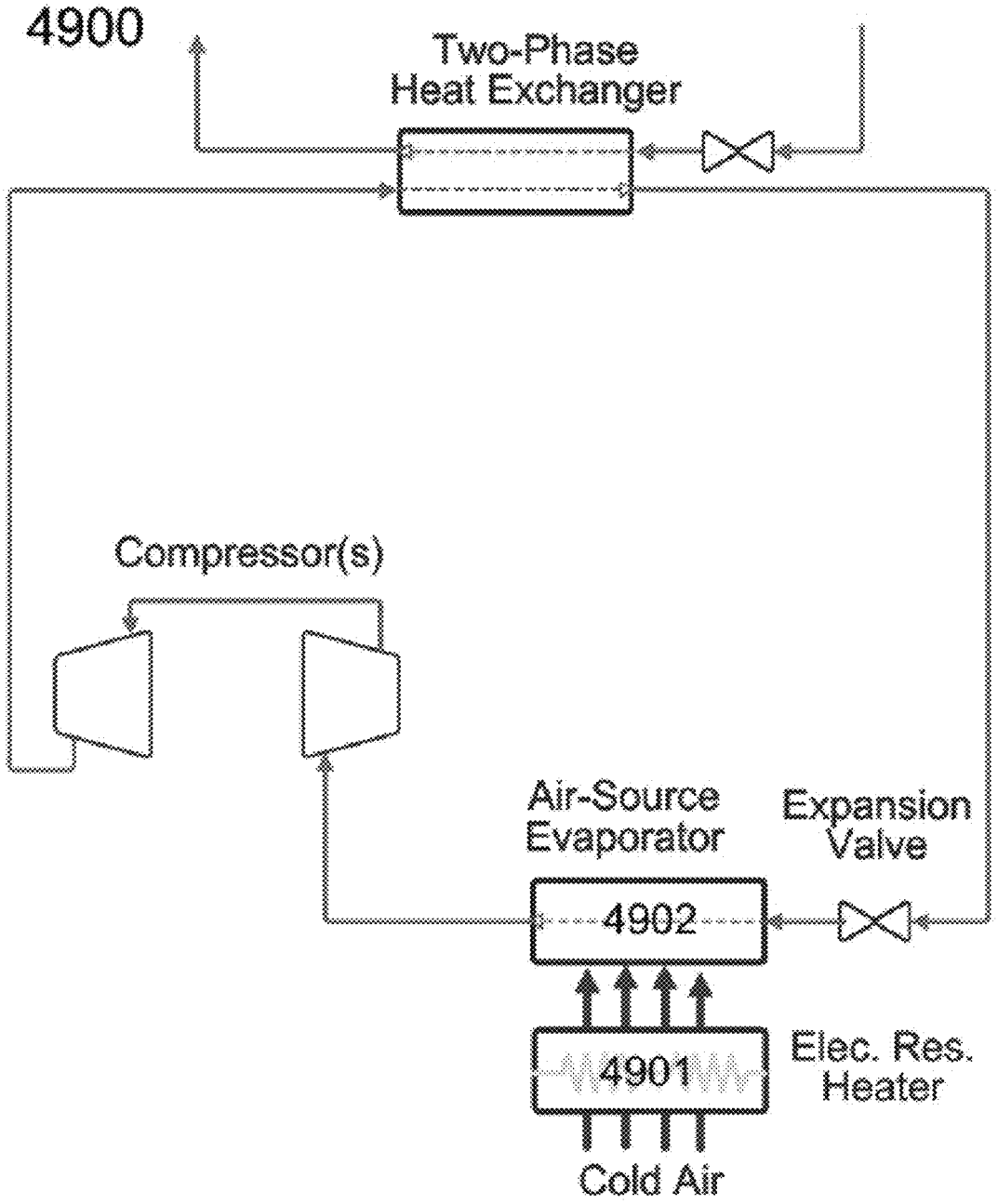
FIGS. 49-50 illustrate examples of a heat pump cycle with an air heater in accordance with some embodiments described herein.
Figure 50:
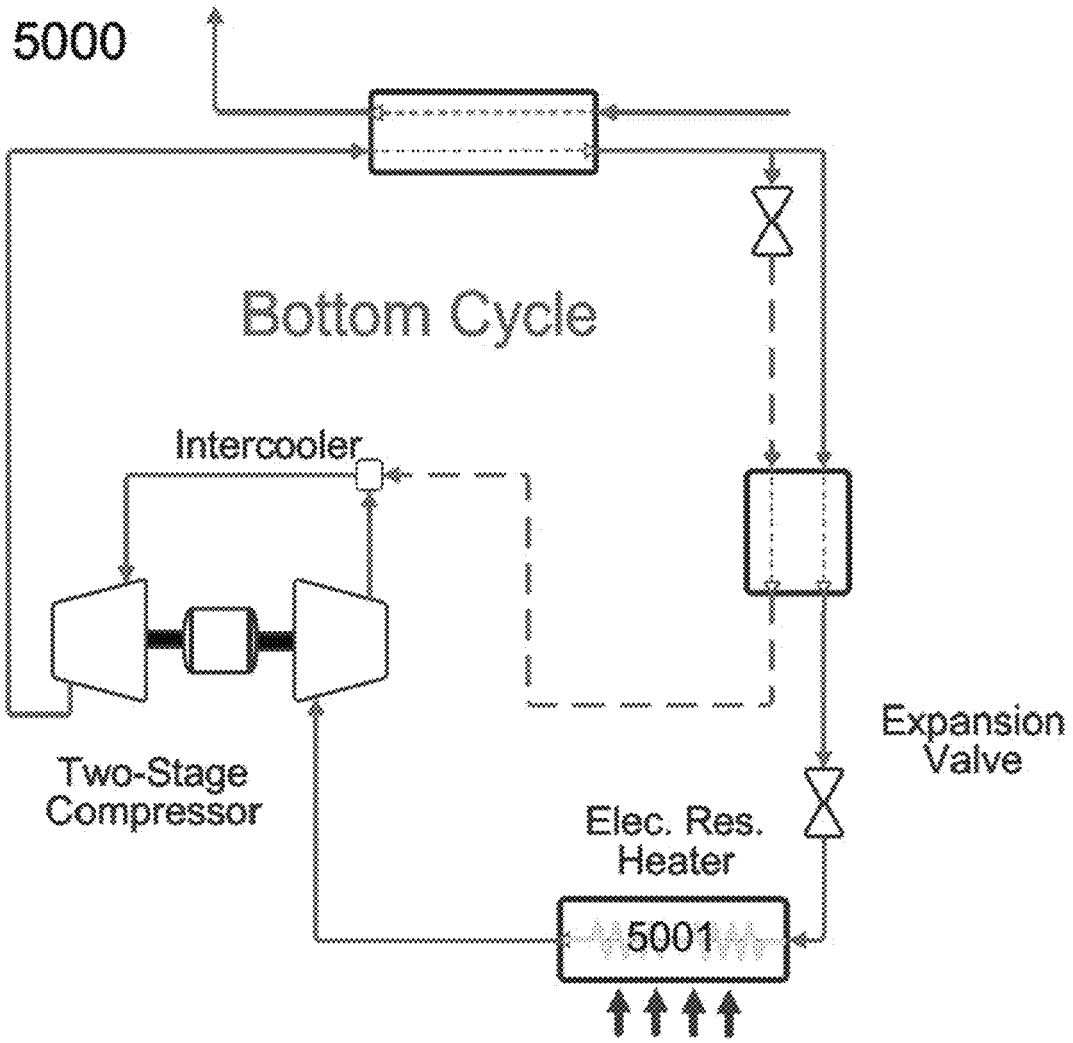

In some embodiments, a heat pump system may comprise one or more resistance heaters as illustrated in the non-limiting examples of FIGS. 49-50. A resistance heater may be configured to defrost one or more elements of a cycle. The one or more elements of the cycle may comprise a heat exchanger. The heat exchanger may be an air-source heat exchanger. A resistance heater may heat a fluid (e.g., a working fluid, a feed fluid, water, air, etc.). A resistance heater may heat air entering an air-source heat exchanger. The one or more resistance heaters may replace one or more heat bypass lines.

Direct Spray Line

In some embodiments, a heat pump system may comprise a defrost spray line and one or more cycles (e.g., a first heat pump cycle and a second heat pump cycle). A defrost spray line may deliver a hot fluid from a first location (e.g., a steam generator of a cycle) to a second location of a cycle as illustrated in the non-limiting examples of FIGS. 51-52. The first section may be from a first cycle and the second section may be a different section from the first cycle. Alternatively, the first section may be from a first cycle and the second section may be from a second cycle.

In some embodiments, one or more defrost spray lines may be configured to defrost one or more components of a cycle using the hot liquid (e.g., hot water, steam, etc.). A hot fluid may be from a compressor discharge, from a section of a heat pump system having an elevated pressure; from a heat exchanger; or from a combination thereof. A defrost spray line may deliver a hot fluid to defrost one or more heat exchanger. The one or more heat exchangers may comprise an air-source heat exchanger. In some embodiments, two defrost spray lines of the one or more defrost spray lines may be in parallel. The one or more defrost spray lines may be coupled to a corresponding one or more heat exchangers. The one or more defrost spray lines may be controlled to defrost the corresponding heat exchanger of the one or more heat exchangers independently from each other.

A defrost spray line may deliver a hot fluid directly to a plurality of evaporator coils of one or more evaporators. A defrost spray line may deliver a hot fluid to a one or more air-source heat exchangers. In some embodiments, the heat pump system is an enclosed system.

Thermal Storage+Hot Water

In some embodiments, a heat pump system may comprise a defrost spray line. In some embodiments, a defrost spray line may be coupled to a thermal storage unit (e.g., a hot water tank). The defrost spray line may deliver a hot fluid to be stored in the thermal storage unit as illustrated in the non-limiting example of FIG. 53. The defrost spray line may deliver at least a portion of a hot fluid stream to defrost a section of the heat pump system and/or to be stored in the thermal storage unit.

In some embodiments, a defrost spray line may deliver a first portion of a hot fluid stream directly to a section of a heat pump system to be defrosted and/or a second portion of the hot fluid stream to a thermal storage unit. The defrost spray line may syphon at least a percentage of the hot fluid generated by one or more heat exchangers. The percentage of hot fluid syphoned by the defrost spray line may be less than or equal to about 2%, 5%, 10% or 20%. The percentage of hot fluid syphoned by the defrost spray line may be between any two values described herein. The one or more heat exchangers may comprise a hot water generator and/or a steam generator. In some embodiments, at least one of the hot water generator(s) and/or steam generator(s) are directly coupled to a top and/or bottom cycle of the heat pump system. In some embodiments, at least one of the hot water generator(s) and/or steam generator(s) are decoupled from a top and/or a bottom cycle of the heat pump system.

In some embodiments, a thermal storage unit may be configured to collect a hot fluid during periods of high efficiency of the system and/or release a hot fluid during periods of low efficiency of the system. Therefore, the system may be configured to generate and store excess hot fluid (e.g., water or steam) during periods of operation that require little to no hot fluid (e.g., water or stream) to optimize and maintain operations of the system, such as during the day when the weather is warmer, and utilize the collected and stored hot fluid (e.g., water or steam) generated during the day to assist in optimizing and maintaining operations during periods of cold weather, such as at night.

A hot fluid may comprise hot water and/or steam generated by the system. The hot fluid may be hot water or steam depending on one or more factors such as, where a hot fluid may be sourced from, a system's needs, an operation and output of the system, a desired use of the hot fluid, etc.

Alternatively, a thermal storage unit may comprise a heat storage fluid that is configured to collect heat from the system during periods of high efficiency and/or release heat to the system during periods of low efficiency. A heat storage fluid may comprise a sensible heat storage material, a latent heat storage material (e.g., a phase change material), a thermochemical heat storage material, or any combination thereof. The phase change material (PCM) may be an organic PCM (e.g., paraffin waxes, sugar alcohols, or fatty acids), an inorganic PCM (e.g., salts, salt hydrates, salt-water solutions, or metals), or an organic-inorganic eutectic PCM (e.g., combinations of two or more organic and/or inorganic PCMs with a single, minimum transition temperature). In some embodiments, a heat exchanger can charge and discharge stored energy using the latent heat of the phase change material. In the case of phase change materials, heat can be exchanged with a heat source that is held at a constant temperature. One or more factors not presented herein may be used to determine the type of fluid used and/or stored.

In some embodiments, a system as described herein may comprise a thermal storage unit. In some embodiments, the thermal storage unit may store a hot fluid from a one or more cycles (e.g., a top cycle or a bottom cycle) of the system. The thermal storage unit may receive a portion of a hot fluid stream directly at least one of the one or more cycles. The hot fluid may be delivered from one or more heat exchangers to the thermal storage unit. The one or more heat exchanger may comprise a hot water generator and/or a steam generator. In some embodiments, at least one of the hot water generator(s) and/or steam generator(s) are directly coupled to a top and/or bottom cycle of the heat pump system. In some embodiments, at least one of the hot water generator(s) and/or steam generator(s) are decoupled from a top and/or bottom cycle of the heat pump system. In some embodiments, a thermal unit may heat a fluid using one or more heat sources. The one or more heat sources may comprise a heat exchanger and/or a secondary heat source. The secondary heat source may comprise a waste heat stream, a geothermal heat source, a Combined heat and power (CHP) system, a refrigeration subunit, or a combination thereof. To assist with start-up, specifically for the top cycle, the system may temporarily rely on a secondary heat source.

In some embodiments, a thermal storage unit is used to assist in heating a working fluid at a start of a system operation, to smooth a load of the system in case of a sudden decrease of temperature and/or an increase in steam demand, to provide an additional heat source to a cycle (e.g., a top heat pump cycle or a bottom heat pump cycle).

In some embodiments, a thermal storage unit is coupled to a cycle (e.g., a bottom cycle, a top cycle, etc.) of the system. In some embodiments, the thermal storage unit is coupled to a system of the present disclosure such that the thermal storage unit is in parallel with one or more heat exchangers (e.g., a steam generator) of the top cycle. In the case of the steam generator, excess steam may be generated, and energy may be stored at times where electricity is cheaper or renewables are more available, then the energy may be discharged to generate steam when electricity is more expensive or renewables are not available. Alternatively, or in addition, the benefits of the thermal storage may include increasing efficiency at low turndown (e.g., by the heat pump slowly discharging thermal energy). In some embodiments, the thermal storage unit is coupled to a system of the present disclosure such that the thermal storage unit is in parallel with one or more heat exchangers (e.g., an evaporator) of the bottom cycle. In the case of the evaporator, thermal storage may be used at times when the ambient temperature is cold or defrosting is occurring, therefore improving performance of the heat pump system. Alternatively, or in addition, thermal storage may be used in cases of intermittent waste heat availability (e.g., when the waste heat source is from batch processes). Alternatively, or in addition, thermal storage may be used to disconnect first heat pump cycle operation from second heat pump cycle operation (e.g., when the first heat pump cycle and second heat pump cycle are not operating at the same time). Operating the first heat pump cycle and the second heat pump cycle at different times may provide load shaving and shifting benefits. In some embodiments, the thermal storage unit is coupled to a system of the present disclosure such that the thermal storage unit is in parallel with one or more heat exchangers of a heat transfer fluid cycle. Alternatively, or in addition, the thermal storage unit may be coupled to a system of the present disclosure such that the thermal storage unit is in series with one or more heat exchangers (e.g., a steam generator) of the top cycle. In some embodiments, the thermal storage unit is coupled to a system of the present disclosure such that the thermal storage unit is in series with one or more heat exchangers (e.g., an evaporator) of the bottom cycle. In some embodiments, the thermal storage unit is coupled to a system of the present disclosure such that the thermal storage unit is in series with one or more heat exchangers of a heat transfer fluid cycle. In some embodiments, the thermal storage unit may be coupled directly to a cycle (e.g., a top cycle, a bottom cycle, and/or a heat transfer fluid cycle). Alternatively, the thermal storage unit may be coupled to a cycle (e.g., a top cycle, a bottom cycle, and/or a heat transfer fluid cycle) by an additional fluid loop (e.g., an intermediate loop, a glycol loop, etc.).

In some embodiments, the system may comprise a controller. The controller may be configured to control the operations of one or more elements of the system. The controller may be configured to control the operations of a thermal storage unit and/or at least one cycle (e.g., a bottom cycle, a top cycle, etc.) of the system.

In some embodiments, a system as described herein may use one or more thermal or non-thermal methods to defrost one or more components of a cycle. The non-thermal methods may comprise using a temperature resistant coating, chemical de-icers (e.g., ice, alcohol, mag chlorine, etc.), and/or physical removal (pressurized air, vibrations, blunt force, etc.). Other methods for defrosting and warming not described herein may be used.

In some embodiments a heat exchanger is configured to be condenser, an evaporator, a low temperature evaporator, a two-phase heat exchanger, an air-sourced heat exchanger, a suction-lined heat exchanger, and/or a combination thereof. In some embodiments, the system comprises one or more different types of heat exchangers. In some embodiments, the heat exchanger of the system may comprise any combination of one or more different types of heat exchangers.

In some embodiments, one more of the compressors are configured to be electrically powered. In some embodiments, one more of the compressors are centrifugal compressors. In some embodiments one more of the compressors are screw compressors. In some embodiments, one more of the compressors are axial compressors. In some embodiments, one more of the compressors are positive displacement compressors. In some embodiments, one more of the compressors are double ended compressors. Double ended compressors may result in higher efficiencies per stage, lower operating speeds, and/or lower thrust on bearing systems. In some embodiments, the system comprises multiple levels of compressors. In some embodiments, the multiple levels of compressors comprise one or more compressors. In some embodiments, the multiple levels of compressors are arranged in parallel. In some embodiments, the multiple levels of compressors are arranged in series. In some embodiments, the multiple levels of compressors are arranged in a combination of in parallel and in series. In some embodiments, one more of the compressors further comprise bypass lines configured to bypass one or more levels of the multiple levels of compressors. In some embodiments, the compressors of the system are any combination of different types of compressors described herein.

In some embodiments the system may comprise one or more working fluids. In some embodiments, one or more cycles of the system may comprise one or more working fluids. In some embodiments, one or more cycles comprise different working fluids. In some embodiments, one or more cycles comprise the same working fluids. In some embodiments the working fluids of the system may be a same or different type of fluid from each other. Using different working fluids in the cycles may allow for use of working fluids with customized properties that are optimal for each individual cycle. Alternatively, using the same working fluid in the cycles may reduce the complexity and cost of the system.

In some embodiments, some of the steam generating systems described herein, may comprise a first heat pump cycle (e.g., a bottom cycle) and a second heat pump cycle (e.g., a top cycle). The first heat pump cycle may be located outdoors. The first heat pump cycle may use air as a heat source, as illustrated in the non-limiting examples of FIGS. 14-19, to deliver a fluid (e.g., a hot refrigerant or heat transfer fluid) to the second heat pump cycle, wherein the second heat pump cycle may be located indoors. The second heat pump cycle may generate steam.

Operational Examples

1. In one example, a first heat pump cycle receives an ambient air stream at a temperature of 15° C. and delivers heat at a temperature of 65° C. to a heat exchanger coupled to the first heat pump cycle and a second heat pump cycle (e.g., a top cycle). The second heat pump cycle generates steam with a temperature of 150° C.

2. A bottom cycle evaporator uses an ambient air stream with a temperature of 15° C. to evaporate a refrigerant stream (e.g., refrigerant, or refrigerant working fluid). The refrigerant enters the evaporator as a two-phase fluid with about 30% vapor quality and a nominal temperature of 7° C. The outlet of the evaporator is superheated, and has a temperature of 12° C. (e.g., 5° C. of superheating).

3. A condenser coupled to a first heat pump cycle (e.g., a bottom cycle condenser) receives fluid superheated to about 80° C. and condenses the fluid at about 65° C. The fluid leaves the condenser at about 63.5° C. A second condenser coupled to a second heat pump cycle (e.g., a top cycle condenser, a steam generator) receives a fluid at about 205° C. and condenses the fluid at about 155° C. The fluid leaves slightly subcooled at 153° C. The feed stream enters a steam generator at 148° C. as a pressurized water stream and is evaporated at 150° C. The fluid leaves the heat exchanger as a saturated vapor.

4. In an economizer coupled to a first heat pump cycle (e.g., a bottom cycle), the evaporating stream is about 30° C.

and cools a refrigeration stream from about 64° C. to about 45° C. In an economizer coupled to a second heat pump cycle (e.g., a top cycle) the evaporating stream is about 100° C. and cools a stream from about 153° C. to about 147° C.

5. A heat pump cycle system has a design point of using R513a refrigerant gas (an azeotropic blend of hydrofluorochlorine (HFC) and hydrofluoro-olefin (HFO) gases), receives and ambient air stream at a pressure of 394 kPa and a temperature of 11.3° C., with a saturated temperature of 7.2° C. The system outlets a fluid steam comprising steam with a pressure of 1983 kPa, a temperature of 81.5° C. and a saturated temperature of 65.4° C. The inlet temperature can drop in colder temperature operation to an inlet pressure of 110 kPa and a temperature of −22.8° C. with a saturated temperature of −32.8° C. A pressure ratio of a compressor is between about 2 and as high as 9 in various stages of the heat pump cycle system. A pressure ratio of a double ended compressor can be up to about 6. To reach greater pressure ratios (up to about 20 or greater) multiple compressor units are used in series.

6. During cold weather operation, the compressor(s) may increase pressure by 23 times the inlet pressure. For example, the compressor may increase pressure from 86 kPa to 1962 kPa. In this specific case, the temperature may rise from −28° C. in the inlet to 86° C. at the outlet. Alternatively, the compressor may increase pressure by 5.6 times the inlet pressure (348 kPa to 1962 kPa). In this case, the temperature increases from 3.9° C. to 75° C. Alternatively, the compressor may increase pressure by 1.2 times the inlet pressure. In this case, the temperature may only rise by 6° C. Alternatively, the compressor may increase pressure by 8.1 times the inlet pressure. For example, the compressor may increase pressure from 358 kPa to 2912 kPa. In this case, the temperature may increase from 112° C. to 196° C.

7. A VCS cycle may increase the temperature of a working fluid from −24° C. to −7° C. Alternatively, a VCS cycle may increase the temperature by less if the ambient temperature is warmer. Alternatively, a VCS cycle may increase the temperature by more so that the outlet glycol temperature is warmer, for example 15° C.

8. An evaporator may decrease the temperature of a working fluid from −12° C. to −28° C. Alternatively, an evaporator may decrease the temperature by less if ambient temperatures are warmer. Alternatively, the glycol inlet temperature could be warmer, for example, 9° C.

9. In some embodiments, an evaporator and an air-source heat exchanger are configured to be at different temperatures and/or pressures. The temperature of the air-source heat exchanger may be 7° C. The pressure of the air-source heat exchanger may be 414 kPa. The temperature of the evaporator may be 61.7° C. The pressure of the evaporator may be 410 kPa.

10. In some embodiments, the system may require less power to produce a given amount of steam when compared to electric boilers. Table 1 illustrates exemplary power requirements to produce 1,000 kW of steam for 8,760 hours/year for electric boilers, glycol coupled air-source heat pumps, direct coupled air-source heat pumps, and 60° C. waste heat driven heat pumps. The lower power requirement enables significant cost savings.

TABLE 1

Power Requirements for Various Types of Steam Generators

| | Electric Boiler | Glycol Coupled Air-Source Heat Pump | Direct Coupled Air-Source Heat Pump | 60° C. Waste Heat Driven Heat Pump |
|---|---|---|---|---|
| Performance (Efficiency or COP) | 0.98 | 1.5 | 1.55 | 2.25 |
| Power Required | 1020 | 667 | 645 | 444 |
| Annual Consumption (kWh) | 8,938,776 | 5,840,000 | 5,649,888 | 3,893,333 |
| % Power reduction | — | 35% | 37% | 56% |

Example Embodiments

FIG. 1 illustrates a heat pump system in accordance with some embodiments described herein. FIG. 1 illustrates an exemplary steam generation system 100 in an industrial application. FIG. 1 provides an overview of the system 100, which includes a two-stage air-source heat pump comprising a bottom heat pump cycle 102 (i.e., a first heat pump cycle) and a top heat pump cycle 104 (i.e., a second heat pump cycle) that are thermally coupled by an intermediate heat exchanger (i.e., a heat exchanger). The system 100 also includes a steam compressor 106. The working fluid in the bottom heat pump cycle 102 rejects heat to the working fluid in the top heat pump cycle 104. A steam generator rejects heat from a working fluid of the top heat pump to a third working fluid 108. The third working fluid 108 passes through a steam compressor 106 after absorbing heat from the steam generator. The third working fluid 108 comprises water and may evaporate into steam 110. The system may be powered by electricity 112.

Figure 2:
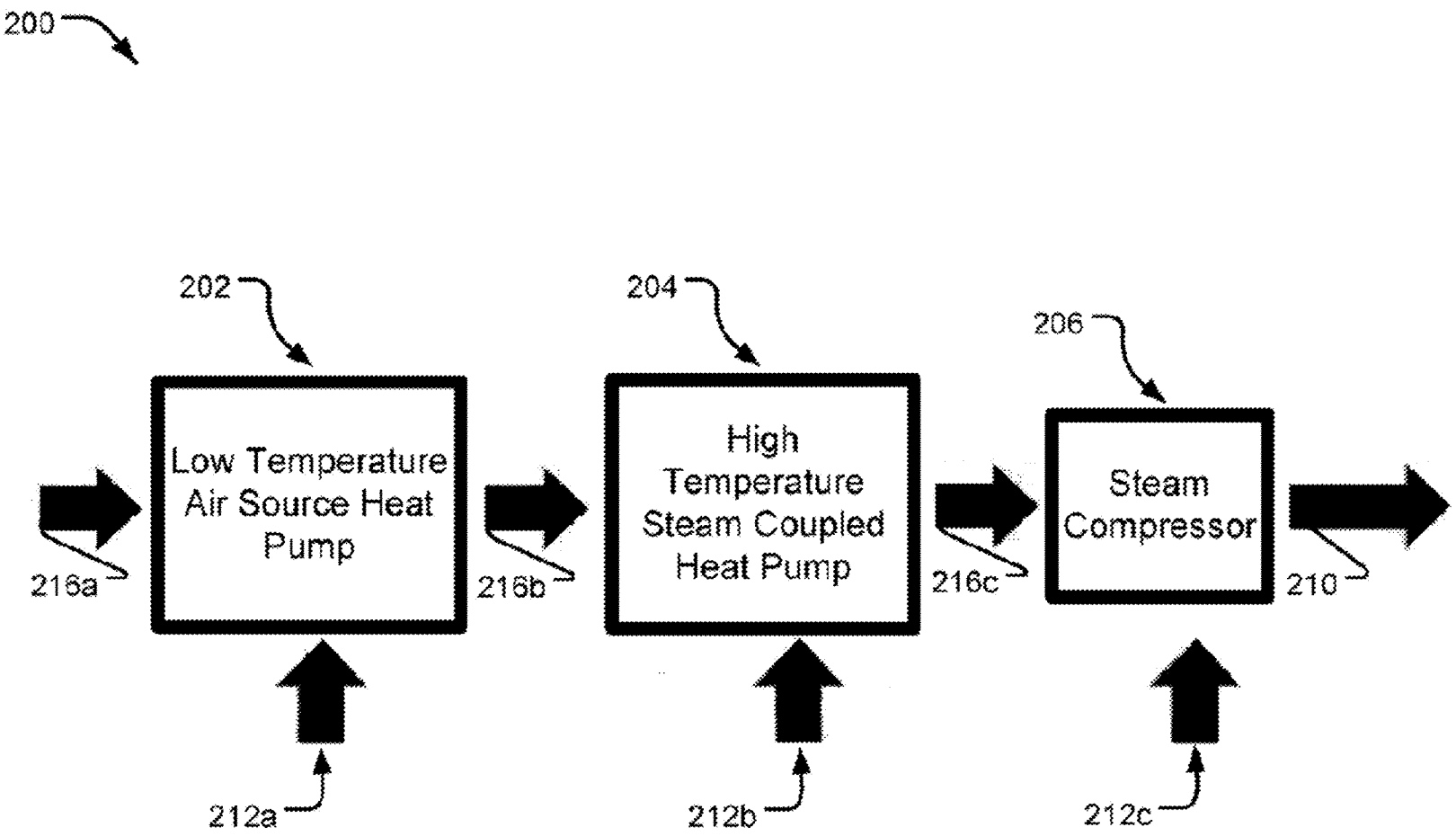
FIG. 2 illustrates a diagram of a cascading heat pump system, in accordance with some embodiments described herein.

FIG. 2 illustrates a diagram of a cascading heat pump system, in accordance with some embodiments described herein. The steam generation system 200 includes a bottom heat pump cycle 202 (i.e., a first heat pump cycle) and a top heat pump cycle 204 (i.e., a second heat pump cycle) arranges in a thermal cascading manner. The system also includes a steam compressor 206. Heat transfer 216*a* involved the bottom heat pump cycle 202 capturing heat from the ambient air by evaporating a working fluid, which may be a refrigerant. Electricity 212*a* may be applied to the bottom heat pump cycle 202. Heat transfer 216*b* involves the condenser of the bottom heat pump cycle 202 rejecting heat to the evaporator in the top heat pump cycle 204.

Figure 3:
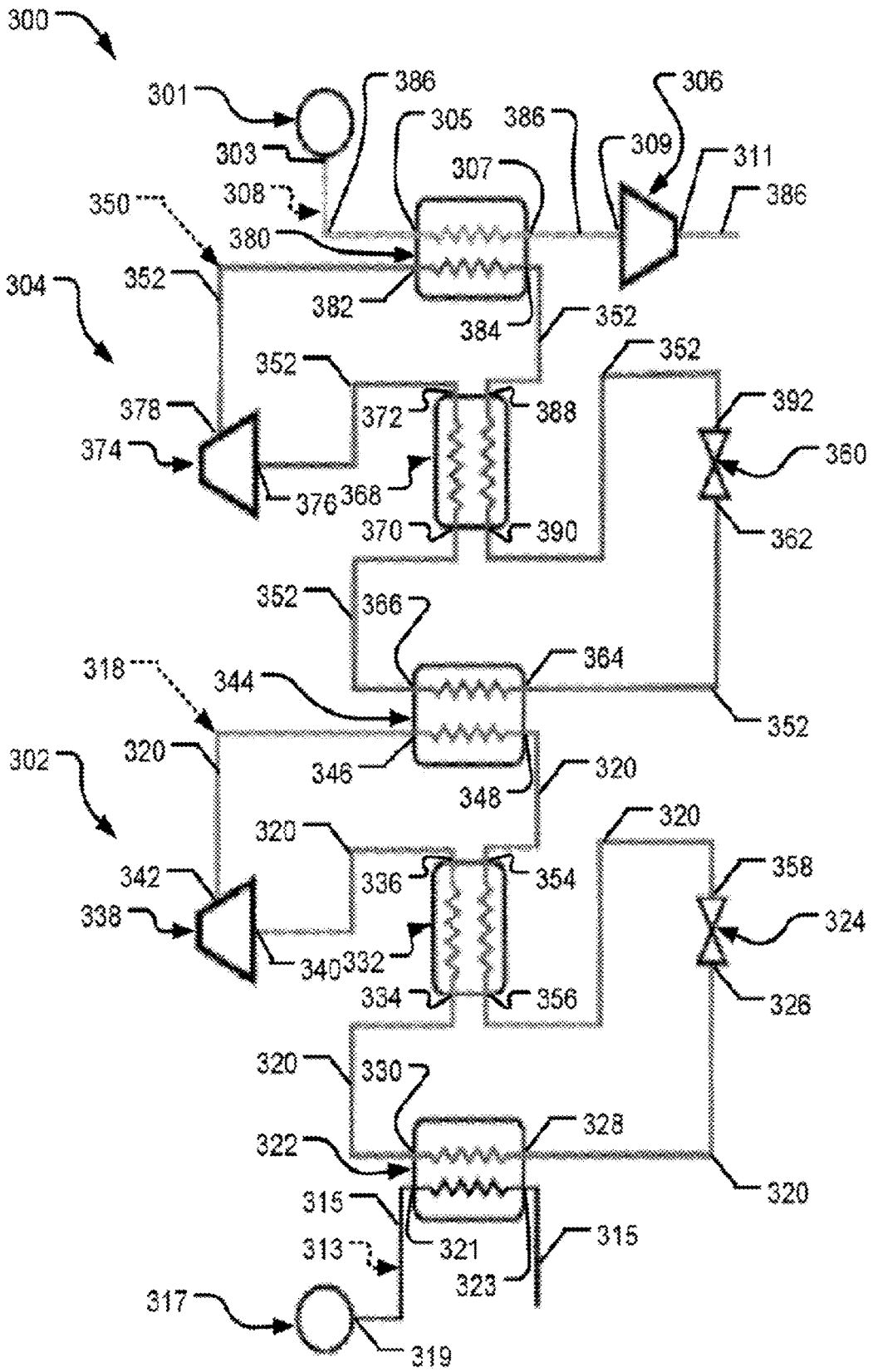
FIG. 3 illustrates a diagrammatic view of a stem generation system in accordance with some embodiments described herein.

FIG. 3 is a diagrammatic view of a stem generation system in accordance with some embodiments described herein. FIG. 3 shows a steam generation system 300 including a first heat pump cycle 302, a second heat pump cycle 304 in thermal communication. The system also includes a steam compressor 306. The first heat pump cycle 302 circulates a first working fluid 318 via a conduit 320. A heat exchanger 322 receives the first working fluid 318 from an expansion valve 324. The working fluid exits the expansion valve outlet 326 and enters the heat exchanger inlet 328. Heat absorption vaporizes the first working fluid 318 such that the working fluid is a low-pressure vapor when it exits the heat exchanger 322 at the heat exchanger outlet 330. A suction-line heat exchanger 332 may be incorporated into the first heat pump cycle 302.

Figure 4:
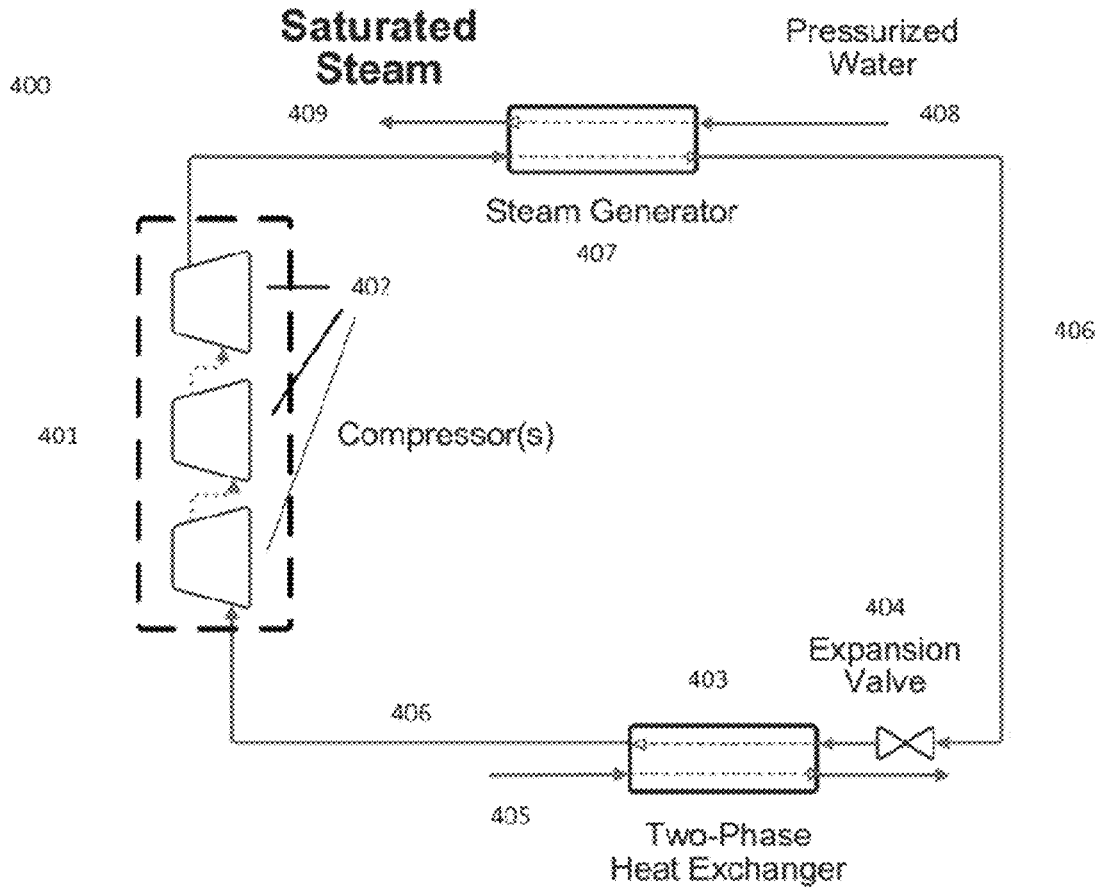
FIG. 4 illustrates an example of a heat pump cycle in accordance with some embodiments described herein.

FIG. 4 illustrates an example of a heat pump cycle in accordance with some embodiments described herein. The heat pump cycle 400 in FIG. 4 comprises three compressors 402 in series in the heat pump cycle between a heat exchanger 403 and a steam generator 407. The steam generator is configured to accept pressurized water 408 and the working fluid of the heat pump cycle 406, and outlet saturated steam 409 and the working fluid of the heat pump cycle. This configuration of compressors may increase the pressure lift of the cycle, reduce the pressure lift per compressor, and/or achieve lower ambient temperature operation.

Figure 5:
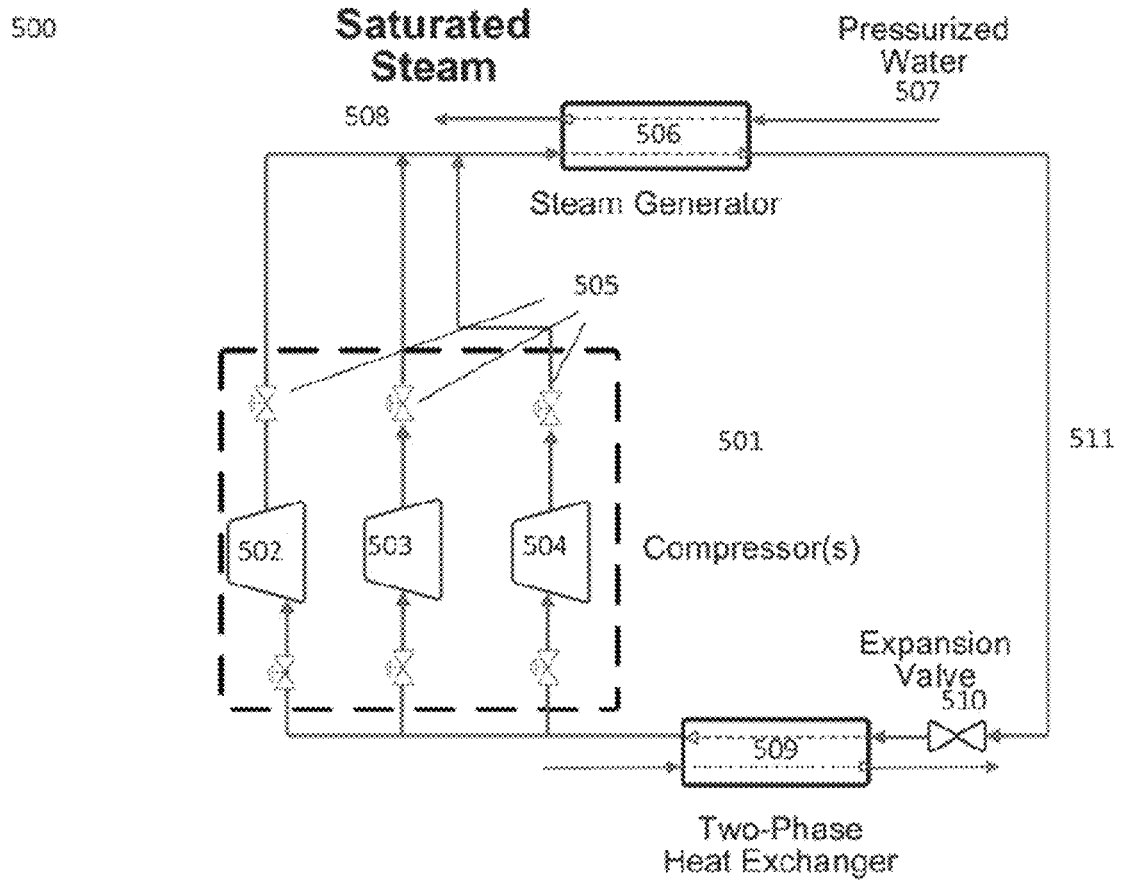
FIG. 5 illustrates an example of a heat pump cycle in accordance with some embodiments described herein.

FIG. 5 illustrates an example of a heat pump cycle in accordance with some embodiments described herein. The heat pump cycle 500 in FIG. 5 includes compressors 502, 503, 504 in parallel 501. Each compressor 502, 503, 504 is configured to receive the working fluid 511 separately from another of the three compressors. The three compressors are located in the heat pump cycle between a first heat exchanger (e.g., a two-phase heat exchanger) 509 and a second heat exchanger (e.g., a steam generator) 506. The heat pump cycle also includes an expansion valve 510, and multiple fluid stream control valves 505. The heat pump cycle transfers heat from the working fluid 511 to a pressurized water stream 507 to generate a saturated steam fluid stream 508. This configuration of compressors may increase turndown range, increase the capacity of the heat pump and/or maintain high efficiency in each compressor stage during turndown by shutting off individual compressors.

Figure 6:
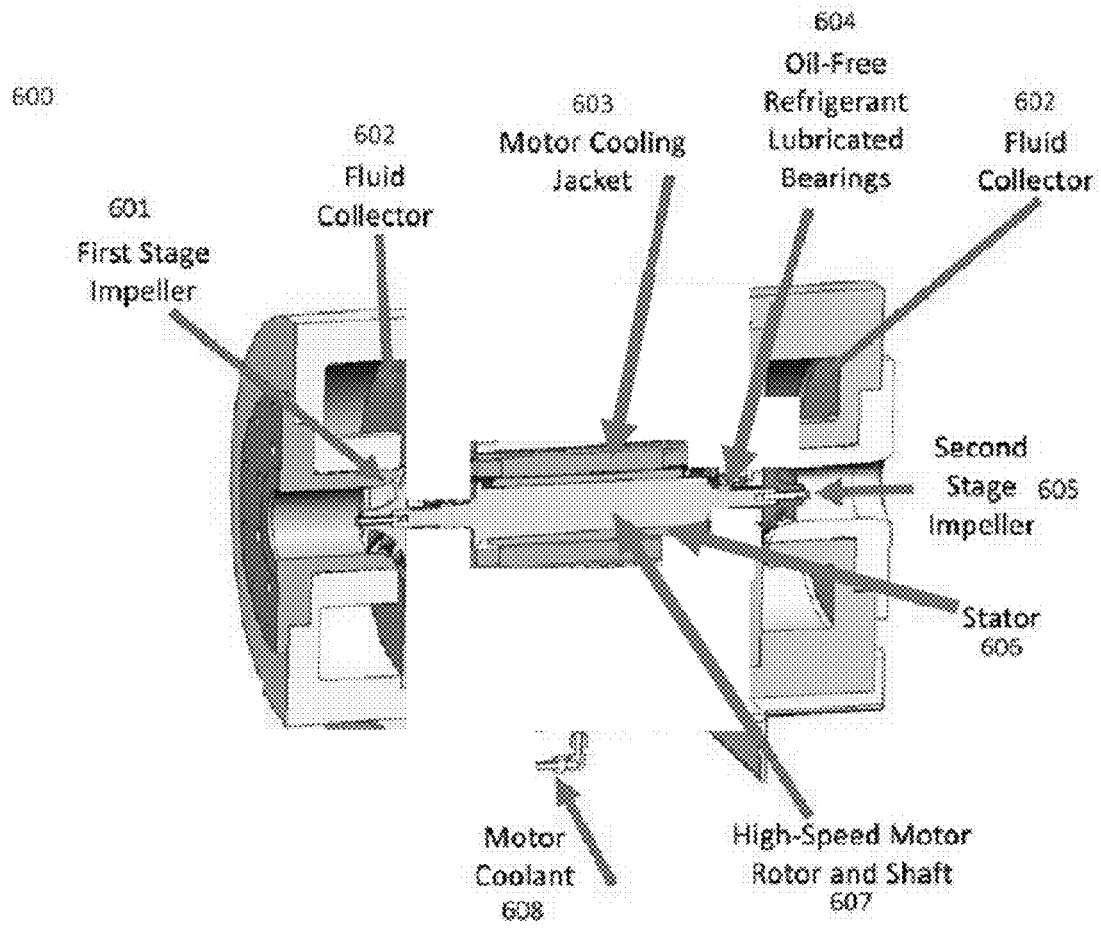
FIG. 6 illustrates an example of a compressor as incorporated into some embodiments described herein.

FIG. 6 illustrates an example of a compressor 600 (e.g., a double ended compressor) which includes refrigerated lubricated ball bearings 604, in accordance with some embodiments of one or more compressors of the present disclosure. The compressor also includes a first stage impeller 601, a fluid collector 602, a motor cooling jacket 603, a second stage impeller 605, a stator 606, a motor coolant 608, and a high-speed motor rotor and shaft 607. The refrigerant may be sprayed by an even number of jets to maintain thermal symmetry of the bearings. The bearings may be treated with nitrogen, which can extend the functional life of the bearings. In some embodiments, the volume collectors 602 may be a dumped fluid collector 602. In some embodiments, the volume collectors 602 may be one or more dumped fluid collectors 602. In some embodiments, the first stage impeller 601 and/or second stage impeller 605 may be an unshrouded impeller 611. In some embodiments, the first stage impeller 601 and/or second stage impeller 605 may be a shrouded impeller 611. The unshrouded impeller 611 may result in increased thrust and have a wider operating range. The unshrouded impeller may achieve higher pressure ratios than the shrouded impeller. The shrouded impeller may reduce the thrust on the compressor bearings 604 and reduces refrigerant leakage.

In some embodiments, one or more refrigerated lubricated ball bearing 604 may be lubricated by a refrigerant. The refrigerant may be provided by one or more fluid jets. A refrigerant may be filtered before lubricating a ball bearing 604.

In some embodiments, a bearing for a compressor may be one or more of magnetic bearings, a foil bearings, refrigerant lubricated ball bearings, oil lubricated ball bearings, or a combination thereof.

In some embodiments, a heat pump cycle may comprise a compressor (e.g., an oil free centrifugal compressor). The compressor may be configured to receive a working fluid (e.g., a refrigerant) within one or more cavities of the compressor. The one or more cavities may be in thermal communication with a shaft and/or a rotor of the compressor. The working fluid may at least partially evaporate within the one or more cavities. The working fluid may provide cooling to a shaft and/or a rotor of the compressor. The working fluid may help the compressor maintain a temperature of the rotor and/or the shaft to a temperature below a threshold temperature. The threshold temperature may be a threshold temperature for demagnetization of a permanent magnet in the rotor. The compressor may be configured to compresses a fluid stream comprising water or steam to generate an outlet stream. The outlet stream may comprise steam having a temperature of at least 120° C.

In some embodiments, the ball bearings 604 are part of a ball bearing assembly which includes the ball bearing 604, a mount, and a preload spring and shim pack in accordance with some embodiments of the present disclosure. The ball bearing 604 may be secured within a compressor by the mount. The mount may be a resilient mount configured to absorb rigid body vibrational modes. The ball bearing may be coupled to preload spring and shim pack. The preload spring and shim pack may be configured to balance a thrust load of the compressor 600 between compressor stages.

In some embodiments, the compressor 600 may have inlet guide vanes. The inlet guide vanes may pre-swirl a fluid entering the compressor 600. The inlet guide vanes may improve off-design performance (i.e., at part-load), by providing motion to a fluid in the same direction as a compressor wheel rotation.

The compressor 600 may have outlet guide vanes (not shown) to help convert the fluid from a high velocity state from the rotation of the compressor wheel to a desired high pressure, low velocity state.

In some embodiments, the compressor 600 may have dumped volume fluid collectors 602 having a constant diameter/cross section throughout. The dumped volume fluid collector may significantly increase an operational range of the compressor 600 and may help avoid choke and stall. This helps prevent damage or very low efficiency of the compressor 600 that may be caused by choking and stalling.

In some embodiments, the compressor 600 may have a variable geometry fluid collector 602. The variable geometry fluid collector 602 may increase efficiency at the design point of the compressor 600. In some embodiments, the compressor 600 may have a combination of fluid collector types and the variable geometry fluid collector 602. This may allow the compressor to be configured to function based on different systems and desired effects.

In some embodiments, the compressor 600 may have a vaneless diffuser. The vaneless diffuser may enhance the operating flow range of the compressor 600 by reducing the obstruction of the refrigerant vapor lower static pressure recovery (i.e., conversion from high velocity state to high pressure state).

In some embodiments, the compressor 600 may have a vaned diffuser. The vaned diffuser may comprise one or more rows of vanes. The vaned diffuser may improve peak efficiency of the compressor 600. In some embodiments, a combination of diffuser styles may be used in the compressor 600 to enable a desired operational range and/or efficiency.

In some embodiments, the double ended compressor may balance a thrust between compressor stages. In some embodiments a pre-loaded spring is used to help balance a thrust between compressor stages. In some embodiments, a bearing may be treated with nitrogen. In some embodiments, a bearing may be coupled to a resilient mount configured to absorb vibrational modes. In some embodiments, one or more features for a compressor as described above may be implemented into one or more compressors help improve the performance of and/or extend the life of the compressor.

In some embodiments, one or more oil lubricated ball bearing may be lubricated by an oil. The oil may be provided by one or more oil loops. The one or more oil loops may comprise an oil separator to separate the oil from a fluid (e.g., a refrigerant). In some embodiments, a magnetic coupling may be used to separate the oil from the fluid. In some embodiments, a hydrodynamic seal may be used to separate the oil from the fluid. In some embodiments, one or more features for a compressor as described above may be implemented into one or more compressors to help improve the performance of and/or extend the life of the compressor.

Figure 7:
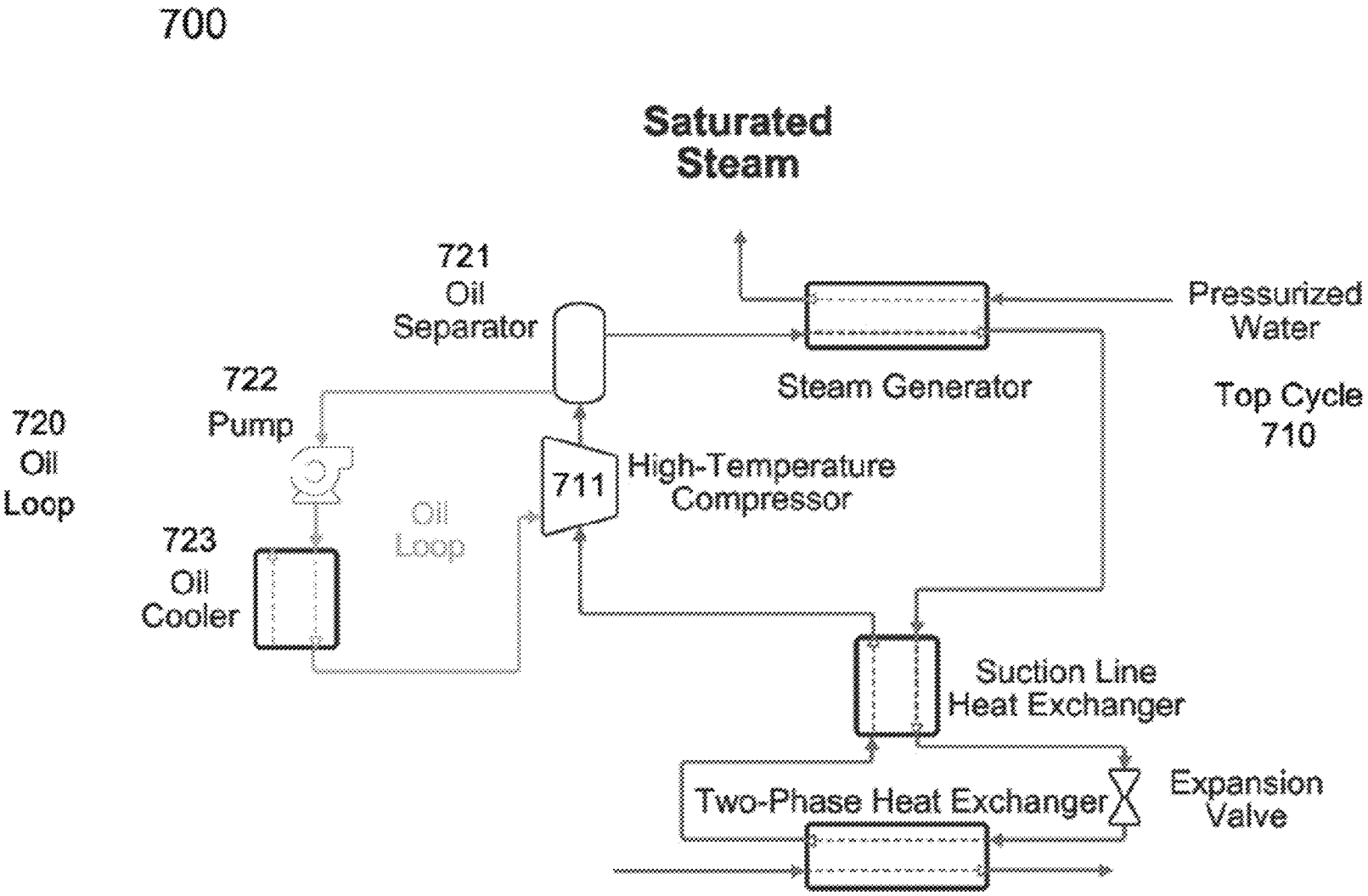
FIG. 7 illustrates an example of a heat pump cycle with an oil loop in accordance with some embodiments described herein.

FIG. 7 illustrates an example of a heat pump cycle in accordance with some embodiments described herein. The heat pump cycle 700 in FIG. 7 includes a top cycle 710 configured to circulate a first working fluid 712 and an oil loop 720 configured to circulate an oil 724. The oil loop comprises an oil separator configured to separate the oil 724 and the working fluid 712. The oil separator is downstream from a high temperature compressor 711 of the top cycle 710. A pump 722 is configured to pump the oil 724 separated by the oil separator through the oil loop. An oil cooler is configured to receive the oil from the oil separator 721 and reduce a temperature of the oil 724. The high temperature compressor 711 is configured to receive the oil from the oil cooler 723. The oil from the oil cooler is configured to cool the compressor.

Figure 8A:
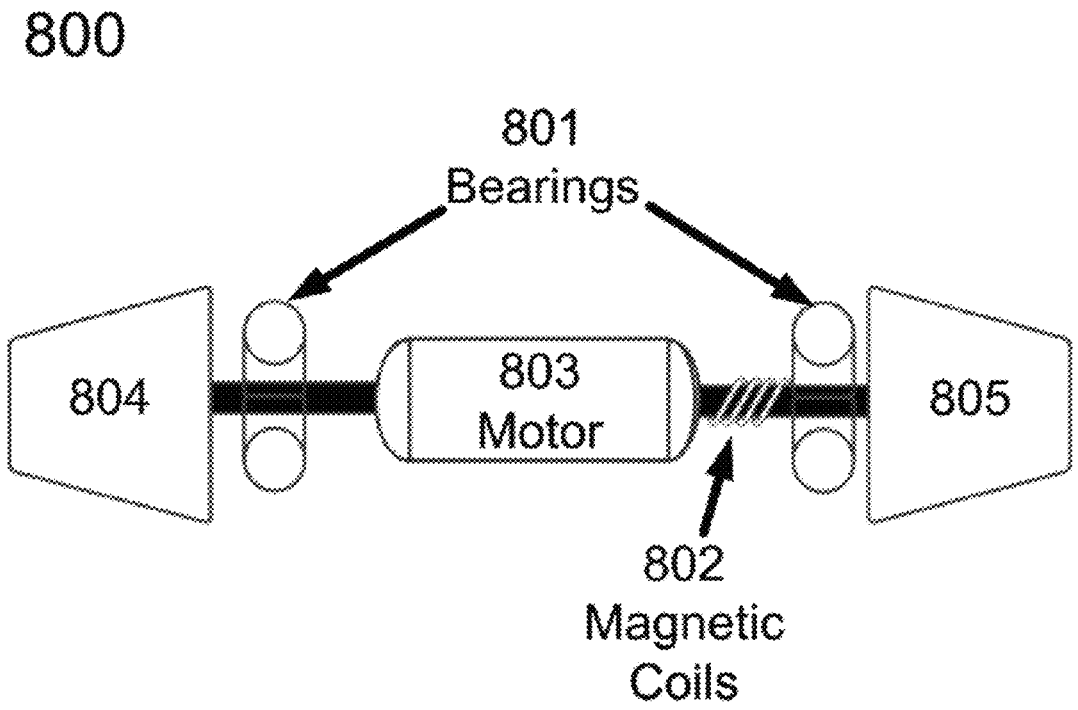
FIG. 8A. illustrates a schematic of an example of a compressor in accordance with some embodiments described herein.

FIG. 8A. illustrates a simple schematic of an example of a compressor in accordance with some embodiments described herein. The compressor 800 (e.g., a double ended compressor) comprises bearings 801, magnetic coils, a first stage compressor 804, a second stage compressor, and a motor 803. The magnetic coils 802 may be configured to monitor and balance the thrust of a compressor by sending electrons through the magnetic coils 802. The magnetic coils 802 may be between the first stage compressor 804 and the second stage compressor 805.

Figure 8B:
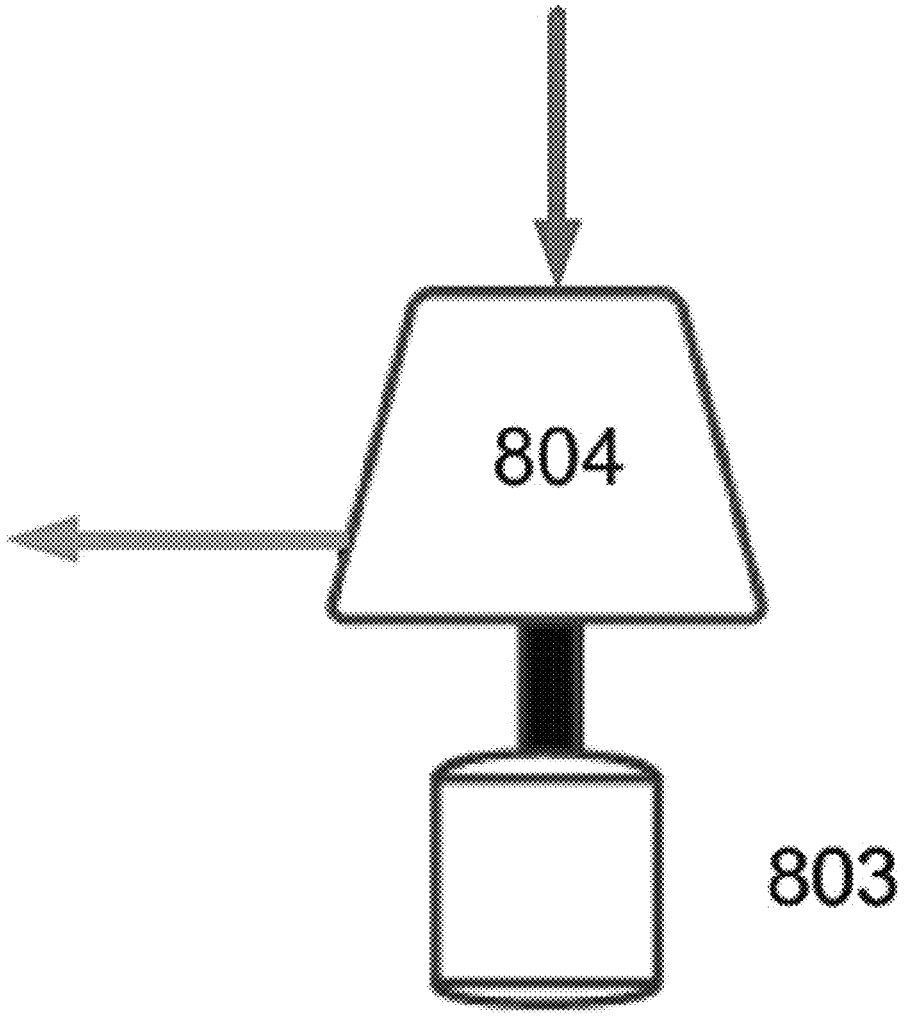
FIG. 8B. illustrates a schematic of an example of a compressor in accordance with some embodiments.

FIG. 8B. illustrates a simple schematic of an example of a compressor in accordance with some embodiments. The compressor 800 in FIG. 8B is rotated vertically. Rotating the compressor may help balance the trust in one direction.

Figure 9:
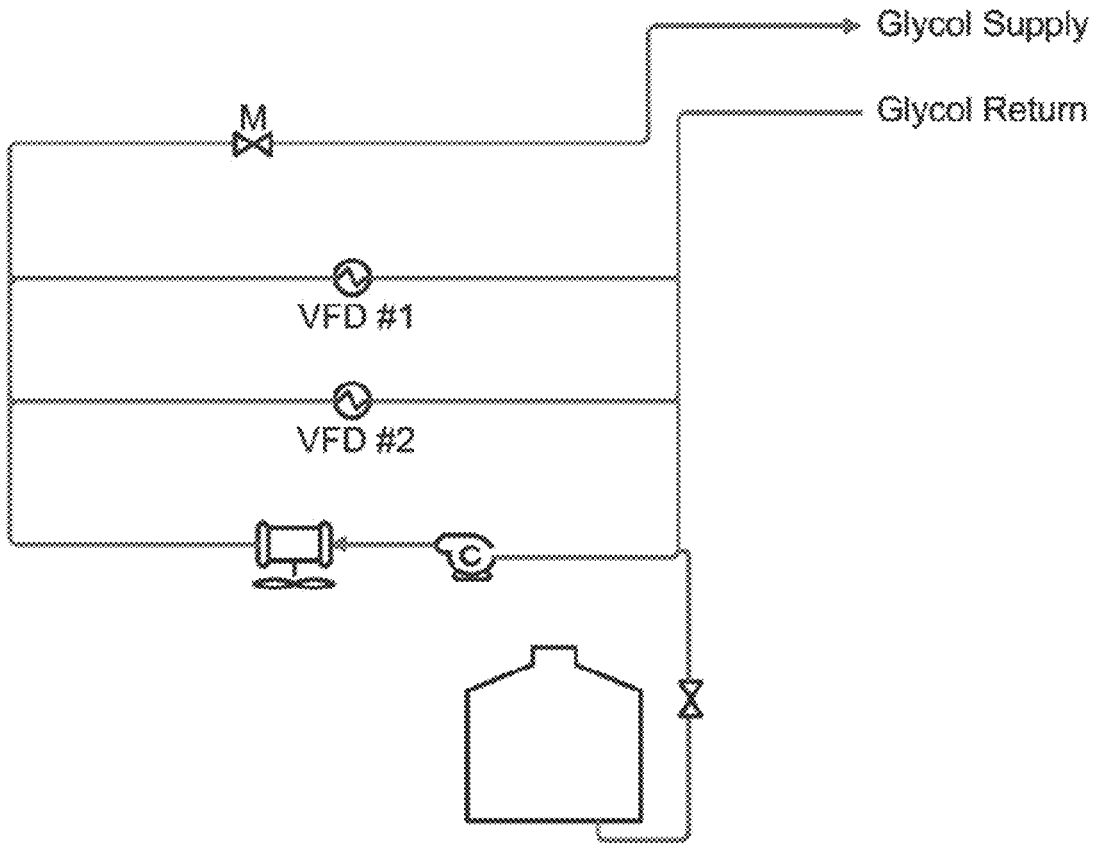
FIG. 9. illustrates an example of a glycol loop in accordance with some embodiments described herein.

FIG. 9. Illustrates an example of a glycol loop 900 in accordance with some embodiments described herein.

Figure 10:
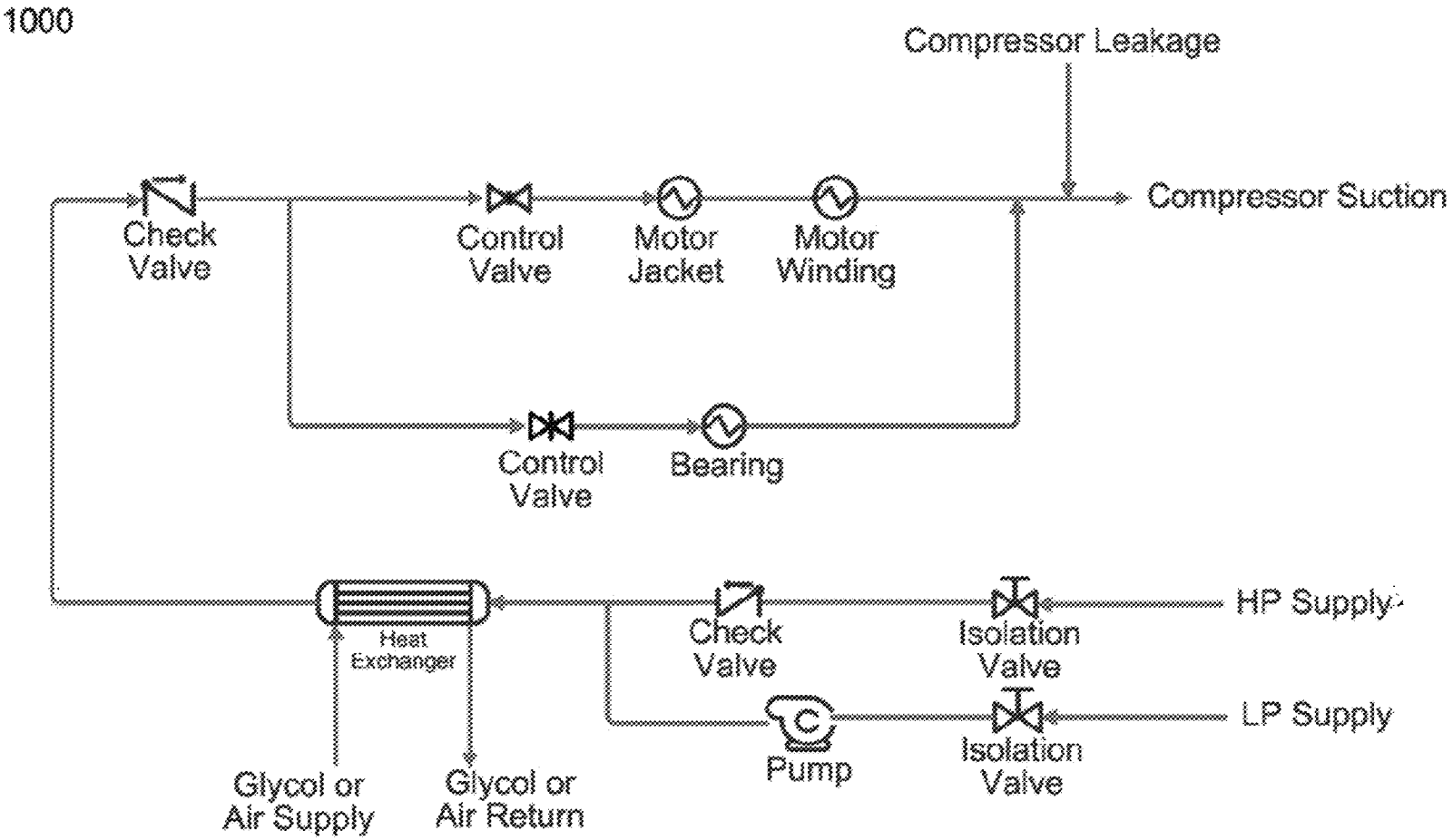
FIG. 10 illustrates an example of a heat pump cycle in accordance with some embodiments described herein.

FIG. 10 illustrates an example of a heat pump cycle 1000 in accordance with some embodiments described herein. The heat pump cycle 1000 may be coupled to the glycol loop 900 as illustrated FIG. 9. In some embodiments. The heat pump cycle 1000 may be coupled to the glycol loop by a heat exchanger as illustrated.

Figure 11:
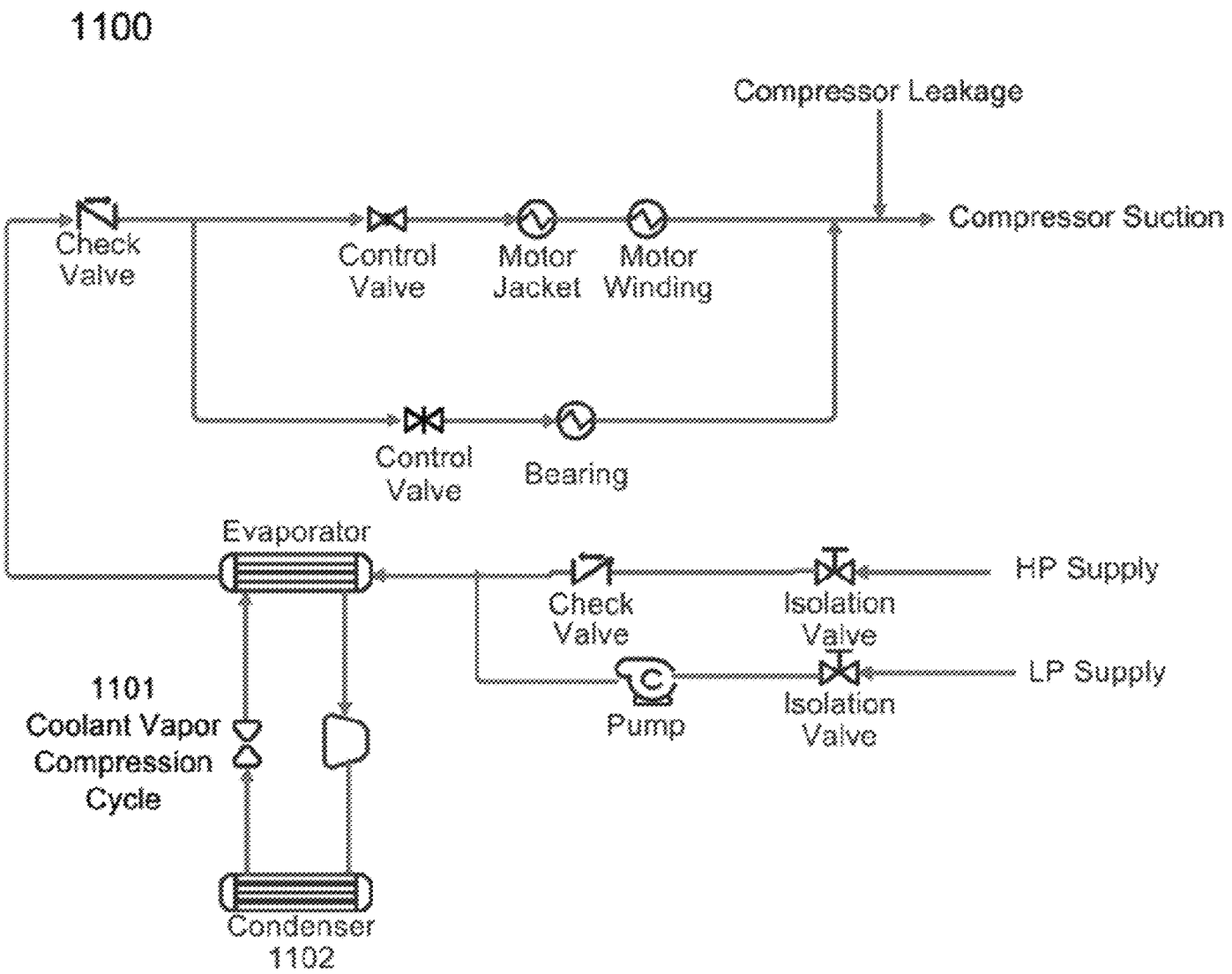
FIG. 11 illustrates an example of a heat pump cycle in accordance with some embodiments described herein.

FIG. 11 illustrates an example of a heat pump cycle 1100 in accordance with some embodiments described herein. The heat pump cycle 1000 comprises a coolant vapor compression cycle 1101 comprising a condenser 1102.

Figure 12:
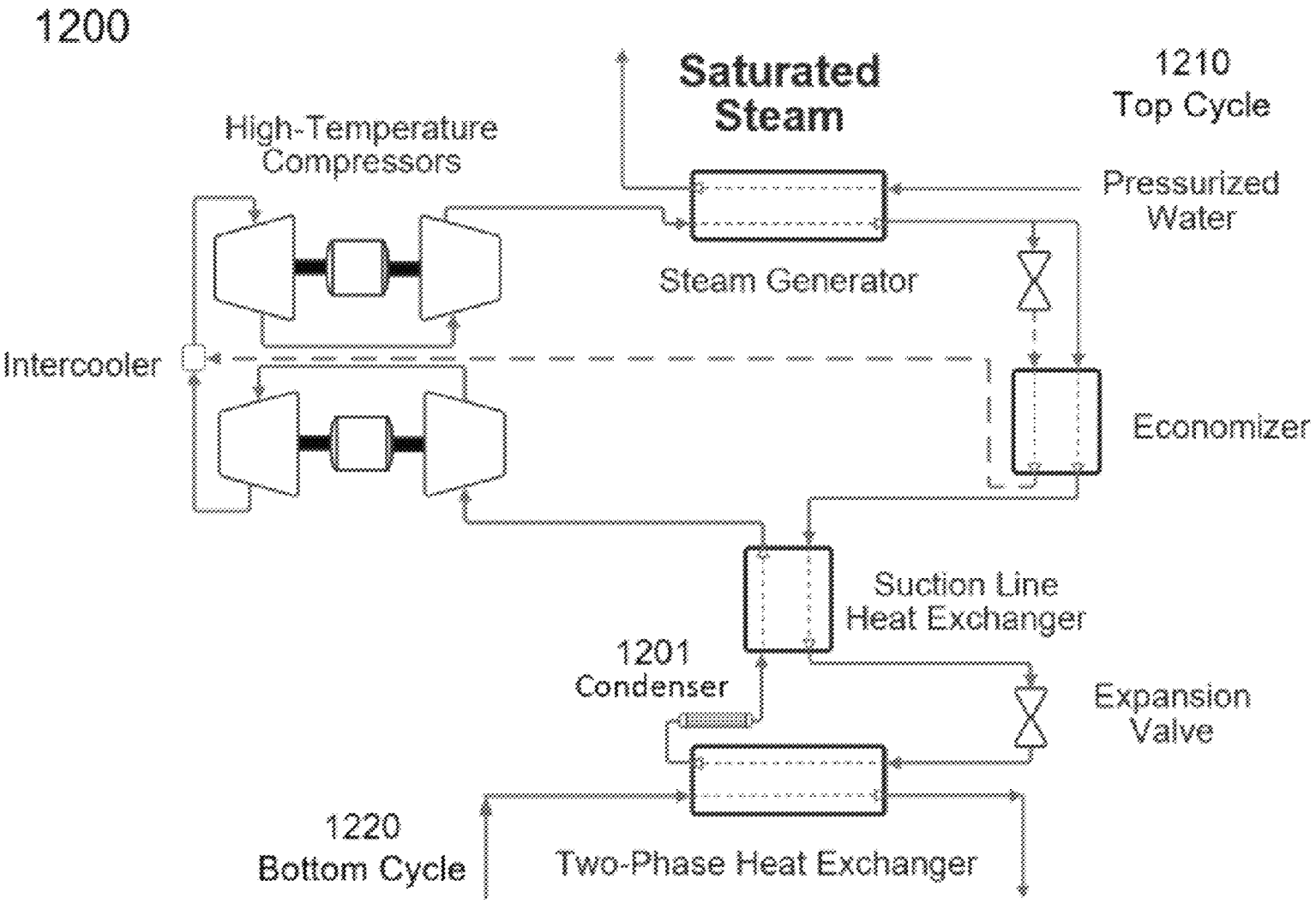
FIG. 12 illustrates an example of a part of a steam generating system in accordance with some embodiments described herein.

FIG. 12 illustrates an example of a part of a steam generating system in accordance with some embodiments described herein. The heat pump cycle 1200 in FIG. 12 includes a top cycle 1210 and a bottom cycle 1220. A condenser 1201 may couple the top cycle 1210 to a coolant vapor compression cycle (similar to the one shown in FIG. 11).

Figure 13:
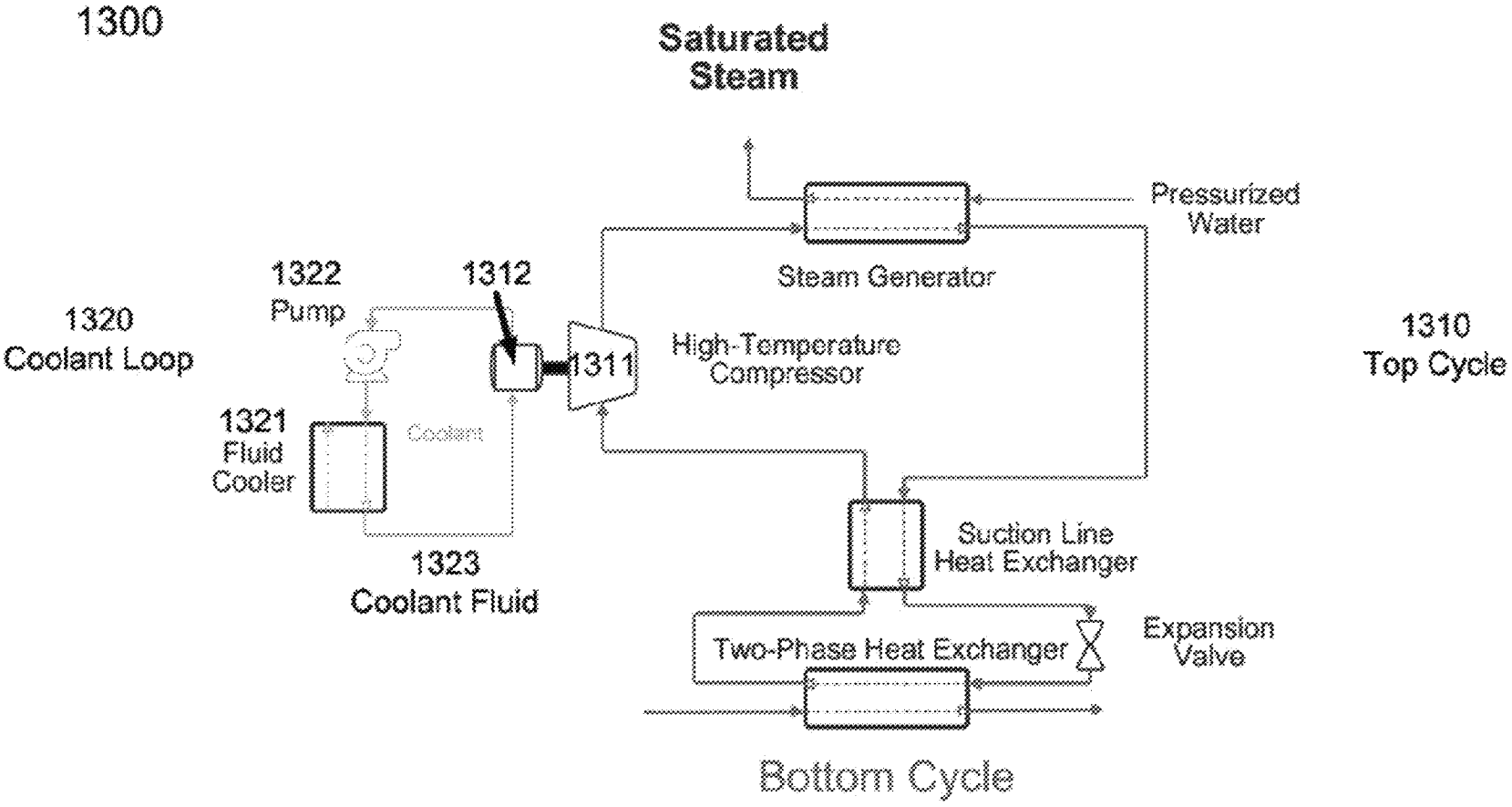
FIG. 13 illustrates an example of a heat pump cycle comprising a motor coolant loop in accordance with some embodiments described herein.

FIG. 13 illustrates an example of a heat pump cycle in accordance with some embodiments described herein. The heat pump cycle 1300 in FIG. 13 includes a top cycle 1310 coupled to a coolant loop 1320 configured to circulate a coolant fluid 1323. The coolant loop 1320 comprises a pump 1322 configured to pump the coolant fluid 1323 through the coolant loop 1320. A fluid cooler 1321 is configured to reduce the temperature of the coolant fluid 1323. A high temperature compressor 1311 of the top cycle comprises a motor 1312. The high temperature compressor 1311 is configured to receive the coolant fluid 1323 from the fluid cooler 1321. The coolant fluid 1323 from the coolant cooler 1321 is configured to cool the motor 1312 of the high temperature compressor 1311.

Figure 14:
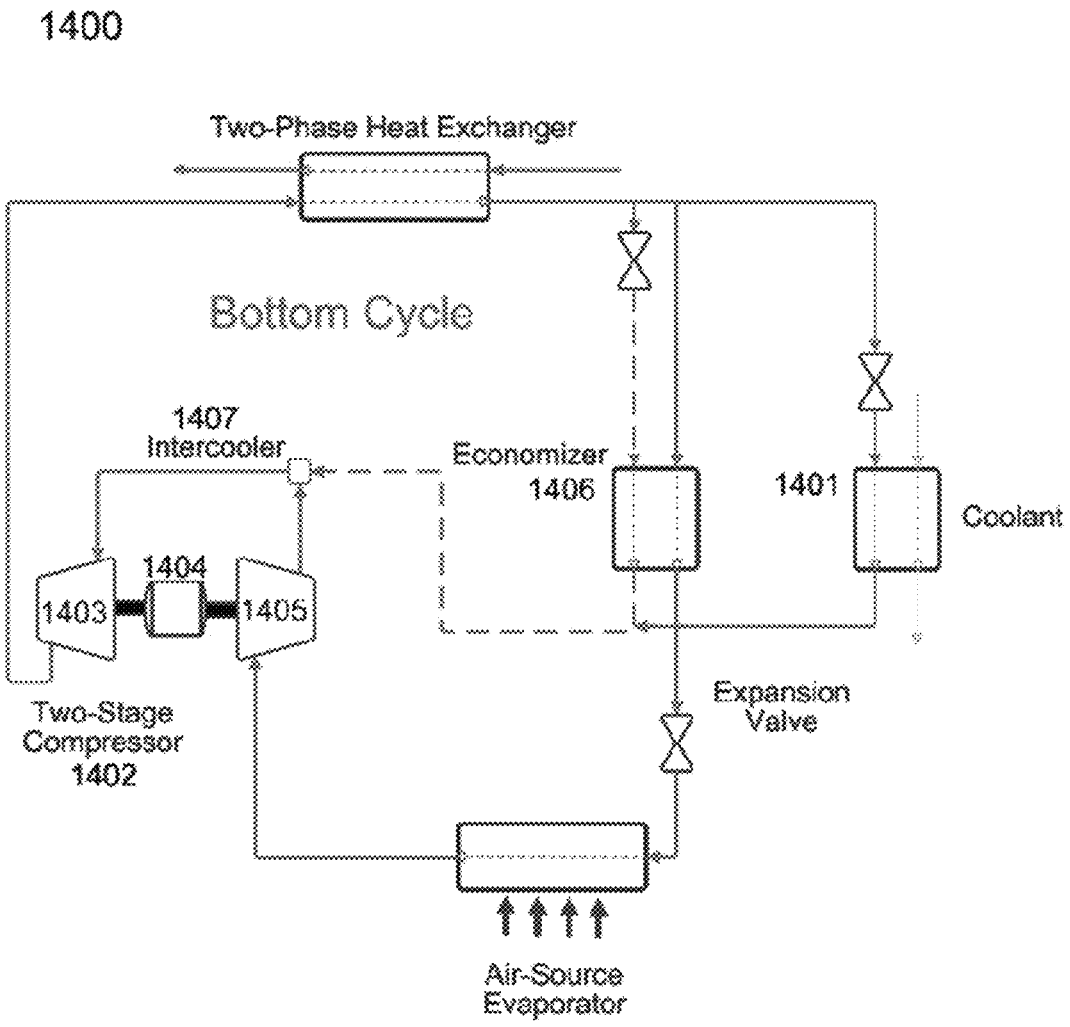
FIGS. 14-15 illustrate examples of a heat pump cycle in accordance with some embodiments described herein.

FIG. 14 illustrates an example of a heat pump cycle in accordance with some embodiments described herein. The heat pump cycle 1400 in FIG. 14 comprises a heat exchanger 1401, an economizer 1406, an intercooler 1407 and a two-stage compressor 1402. The two-stage compressor comprises a first stage compressor 1405, a second stage compressor 1403, and a motor 1404 between the first stage compressor 1405 and the second stage compressor 1403. The heat exchanger 1401 and the economizer 1406 may be in parallel and configured to deliver a fluid to the intercooler 1407. The intercooler is configured to receive a fluid steam from the heat exchanger 1401 and an economizer 1406 in parallel and the first stage compressor 1405. The intercooler 1407 may be between the first stage compressor 1405 and a second stage compressor 1403. The second stage compressor is configured to receive a fluid from the intercooler 1407.

Figure 15:
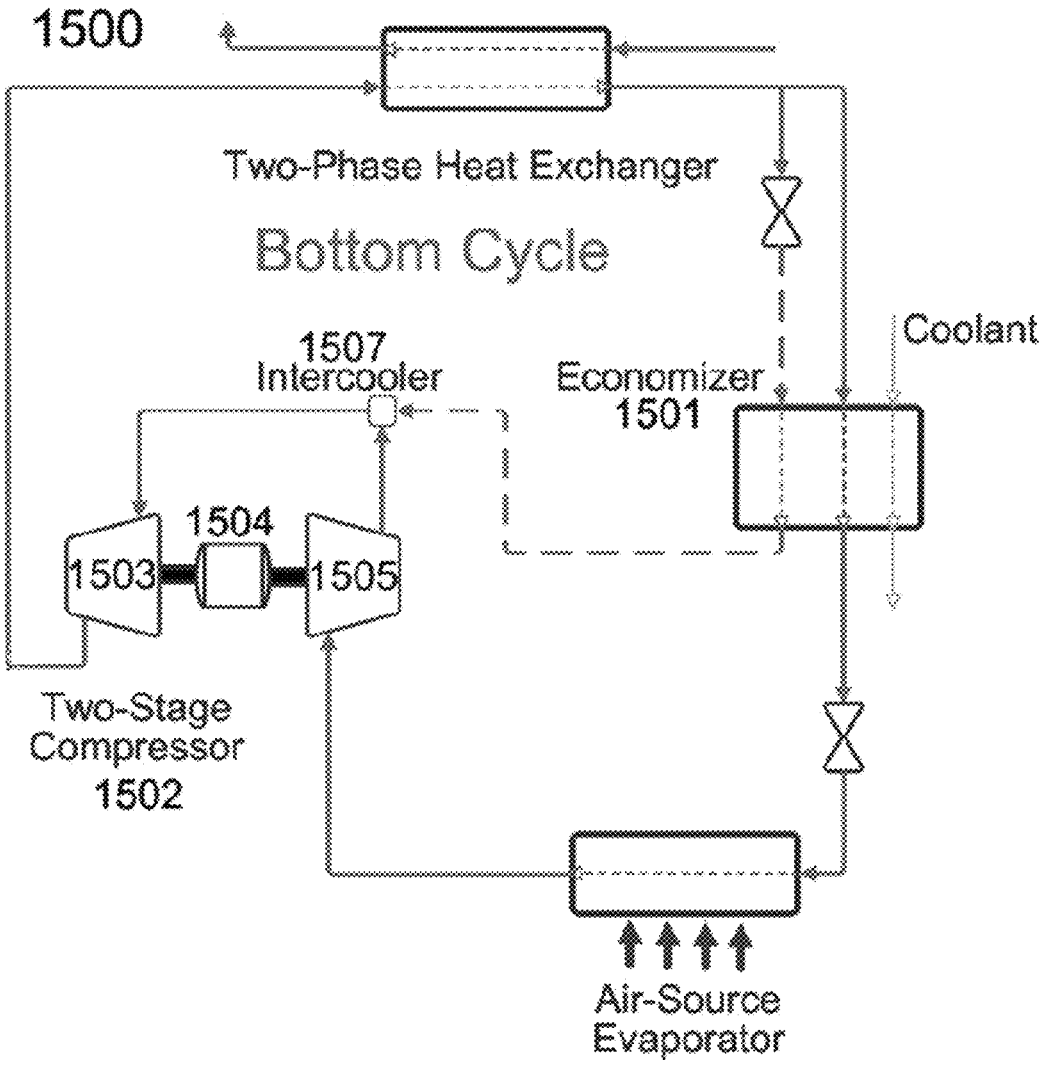

FIG. 15 illustrates an example of a heat pump cycle in accordance with some embodiments described herein. The heat pump cycle 1500 in FIG. 15 comprises a heat exchanger 1501, an intercooler 1507 and a two-stage compressor 1502. The two-stage compressor comprises a first stage compressor 1505, a second stage compressor 1503, and a motor 1504 between the first stage compressor 1505 and the second stage compressor 1503. The heat exchanger 1501 is a three-fluid heat exchanger and is configured to deliver a fluid to the intercooler 1507. The intercooler may be configured to receive a fluid steam from the heat exchanger 1501 and the first stage compressor 1505. The intercooler 1507 may be between the first stage compressor 1505 and a second stage compressor 1503. The second stage compressor is configured to receive a fluid from the intercooler 1507.

Figure 89:
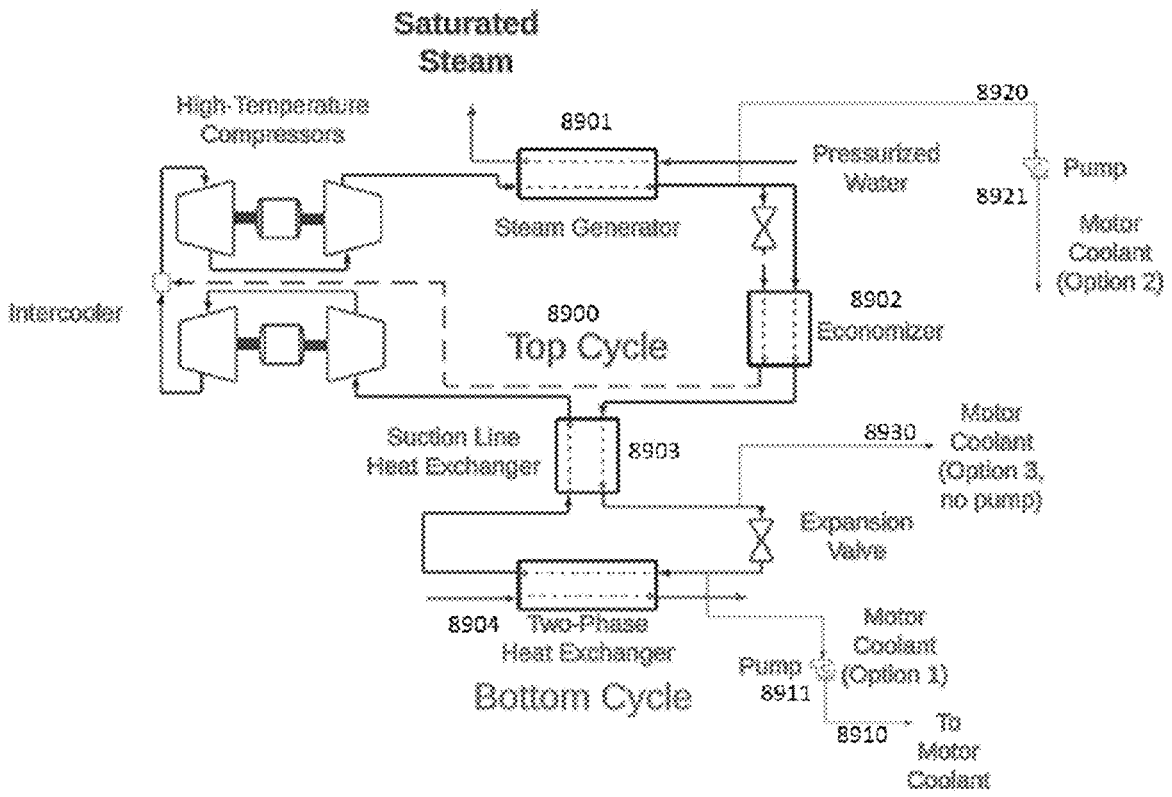
FIGS. 89-90 illustrate examples of heat pump cycles with motor coolant streams in accordance with some embodiments described herein.
Figure 90:
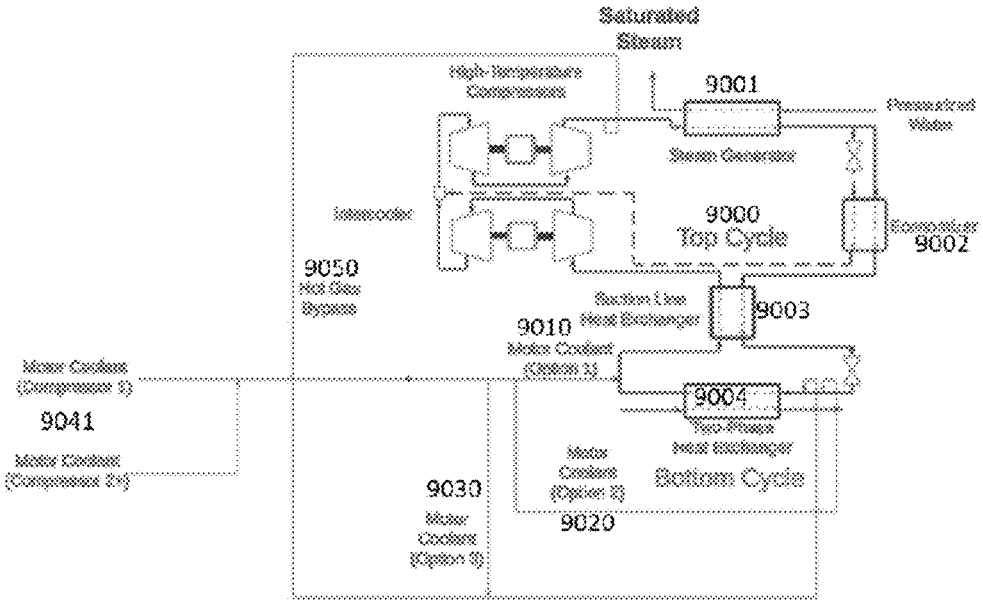

FIGS. 89 and 90 illustrate examples of heat pump cycles in accordance with some embodiments described herein. Although FIGS. 89 and 90 illustrate a configuration within a top heat pump cycle, features of this configuration may also be used in a bottom heat pump cycle. The top heat pump cycle 8900 in FIG. 89 comprises a steam generator 8901, an economizer 8902, a suction-line heat exchanger 8903, and a two-phase heat exchanger 8904. The top heat pump cycle 8900 further comprises a first optional motor coolant stream 8910, a second optional motor coolant stream 8920, and a third optional motor coolant stream 8930. The first optional motor coolant stream 8910 may be pulled from the bottom of the two-phase heat exchanger 8904 or immediately upstream of the two-phase heat exchanger 8904. The second optional motor coolant stream 8920 may be pulled from the bottom of the steam generator 8901 or downstream of the steam generator 8901 (e.g., on the high-pressure side of the top heat pump cycle). The third optional motor coolant stream 8930 may be pulled from the discharge of the suction-line heat exchanger 8903 (e.g., the coldest liquid in the cycle). The first optional motor coolant stream 8910 and the second optional motor coolant stream 8920 may comprise pumps 8911 and 9821 to transport liquid from the main cycle to the motors. The third optional motor coolant stream 8930 may be pressure driven. The first optional motor coolant stream 8910 and the second optional motor coolant stream 8920 may be used during start up conditions when there is limited pressure ratio across the compressors necessary to drive sufficient flow to the motor coolant. The third optional motor coolant stream 8930 may be used once the system gains pressure.

FIG. 90 illustrates an embodiment of the top heat pump cycle of FIG. 89. The top heat pump cycle 9000 in FIG. 90 comprises a steam generator 9001, an economizer 9002, a suction-line heat exchanger 9003, and a two-phase heat exchanger 9004. The top heat pump cycle 9000 further comprises a first optional motor coolant stream 9010, a second optional motor coolant stream 9020, and a third optional motor coolant stream 9030. The first optional motor coolant stream 9010, the second optional motor coolant stream 9020, and the third optional motor coolant stream 9030 are configured to be the pooled outlet streams from all cooled compressor stages 9041. The first optional motor coolant stream 9010, the second optional motor coolant stream 9020, and the third optional motor coolant stream 9030 are configured to be injected into the low-pressure section of the top heat pump cycle (e.g., on the suction side of the compressor). The first optional motor coolant stream 9010 may be injected into the discharge of the two-phase heat exchanger 9004. The second optional motor coolant stream 9020 may be injected into the inlet of the two-phase heat exchanger 9004 or immediately upstream of the two-phase heat exchanger 9004. The third optional motor coolant stream 9030 may be injected into a hot gas bypass stream 9050.

Figure 93:
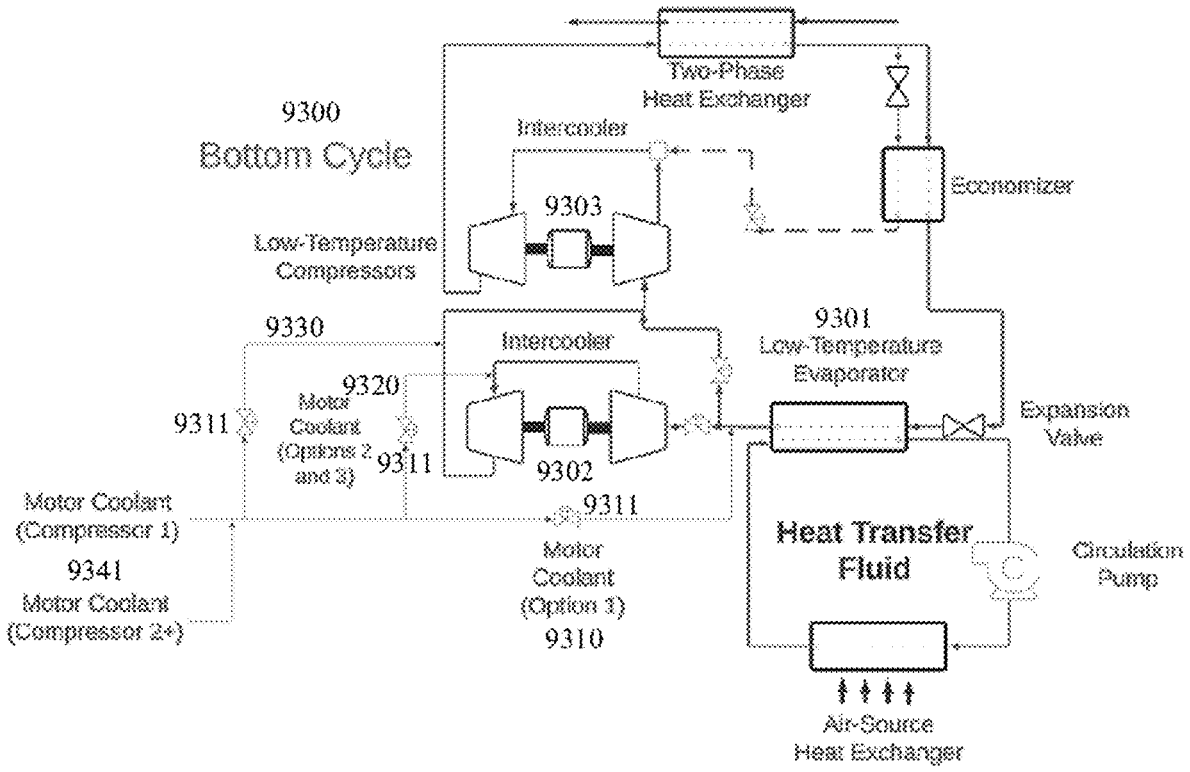
FIG. 93 illustrates an example of a steam generating system with motor coolant streams in accordance with some embodiments described herein.

FIG. 93 illustrates an example of a bottom heat pump cycle in accordance with some embodiments described herein. The bottom heat pump cycle 9300 in FIG. 93 comprises an evaporator 9301, a first compressor 9302, and a second compressor 9303. The bottom heat pump cycle 9300 further comprises a first optional motor coolant stream 9310, a second optional motor coolant stream 9320, and a third optional motor coolant stream 9330. The first optional motor coolant stream 9310, the second optional motor coolant stream 9320, and the third optional motor coolant stream 9330 are configured to be the pooled outlet streams from all cooled compressor stages 9341. The first optional motor coolant stream 9310, the second optional motor coolant stream 9320, and the third optional motor coolant stream 9330 each further comprise a valve 9311. The first optional motor coolant stream 9310 may be injected into the discharge of the evaporator 9301. The second optional motor coolant stream 9320 may be injected between the first phase and the second phase of the first compressor 9302. The third optional motor coolant stream 9030 may be injected into the output of the first compressor 9302. The valves 9311 may be open or closed. The benefit of the valves 9311 is that they may be used to direct flow to different positions in the bottom heat pump cycle 9300 depending on the operating conditions. Further, this configuration may allow for avoidance of overcooling of the working fluid in the bottom heat pump cycle 9300. The valve 9311 on the first optional motor coolant stream 9310 may be open when the operating temperatures are high. The valves 9311 on the second optional motor coolant stream 9320 or the third motor coolant stream 9330 may be closed when the operating temperatures are high. The valve 9311 on the first optional motor coolant stream 9310 may be closed when the operating temperatures are low (e.g., when the ambient temperature is below safe limits for the electronics and internal components of the compressor). The valves 9311 on the second optional motor coolant stream 9320 or the third motor coolant stream 9330 may be open when the operating temperatures are low. This configuration has the benefit of allowing the motors to be cooled at an optimum temperature and avoids overcooling or overheating the motor and internal components.

FIGS. 16-19 illustrate examples of a steam generating system in accordance with some embodiments described herein. The steam generating system 1600 in FIG. 16A comprises a top cycle 1630, a bottom cycle 1620, and a heat transfer fluid cycle 1610. The heat transfer fluid cycle 1610 comprises an air-source heat exchanger 1611. The heat transfer fluid cycle 1610 is coupled to the bottom cycle 1620 by a heat exchanger 1621 (e.g., a low temperature evaporator). The bottom cycle 1620 is coupled to the top cycle 1630 by a heat exchanger 1622 (e.g., a two-phase heat exchanger). The top cycle comprises a steam generator 1631 configured to generate steam as described herein. The top cycle may further comprise a first compressor 1632, a second compressor 1633, an economizer 1634, and a suction-line heat exchanger 1635. The bottom cycle may further comprise a two-stage compressor 1623 and an economizer 1624.

Figure 16A:
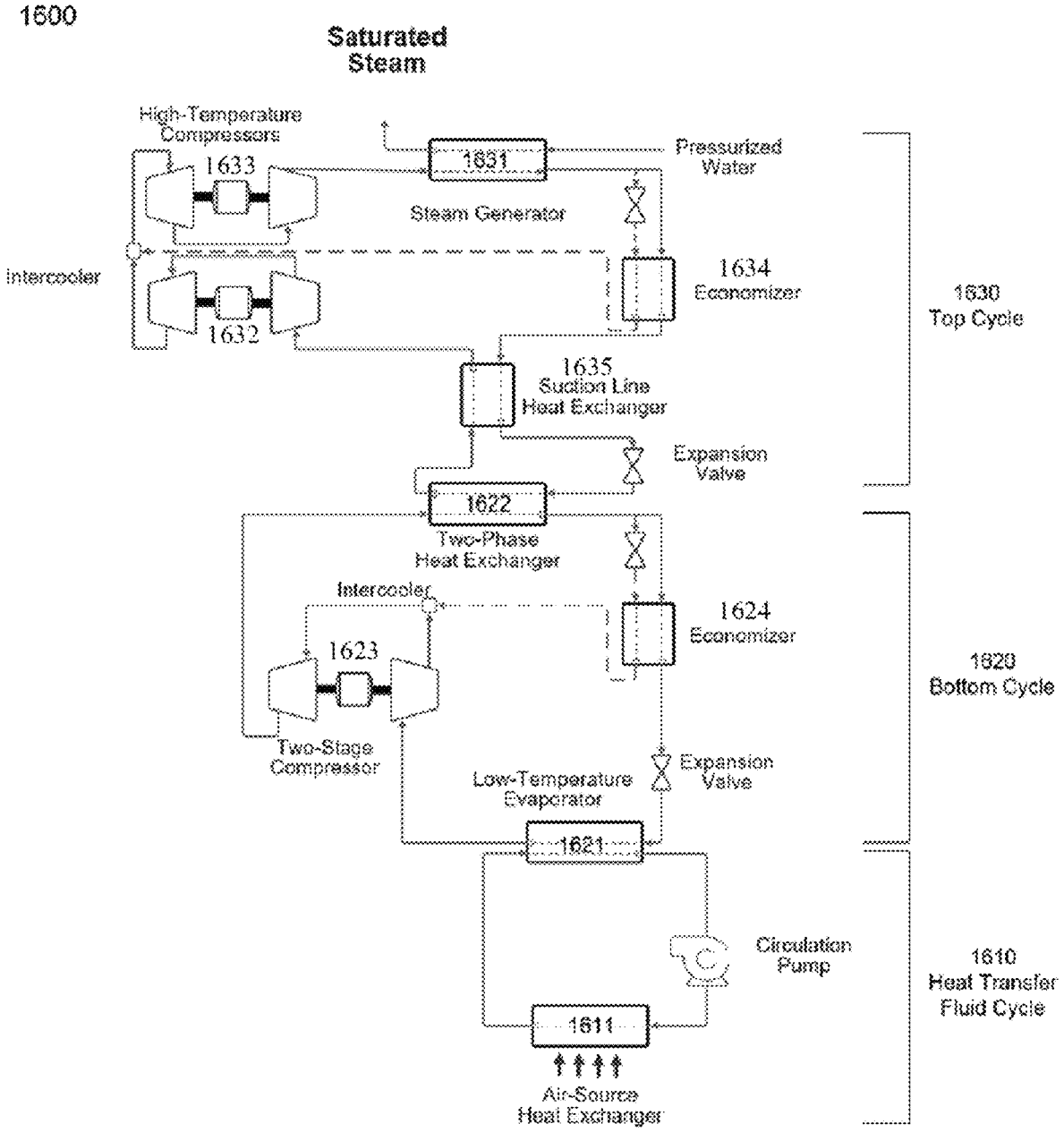
FIG. 16A illustrates an example of a steam generating system comprising a heat transfer fluid cycle in accordance with some embodiments described herein.
Figure 16D:
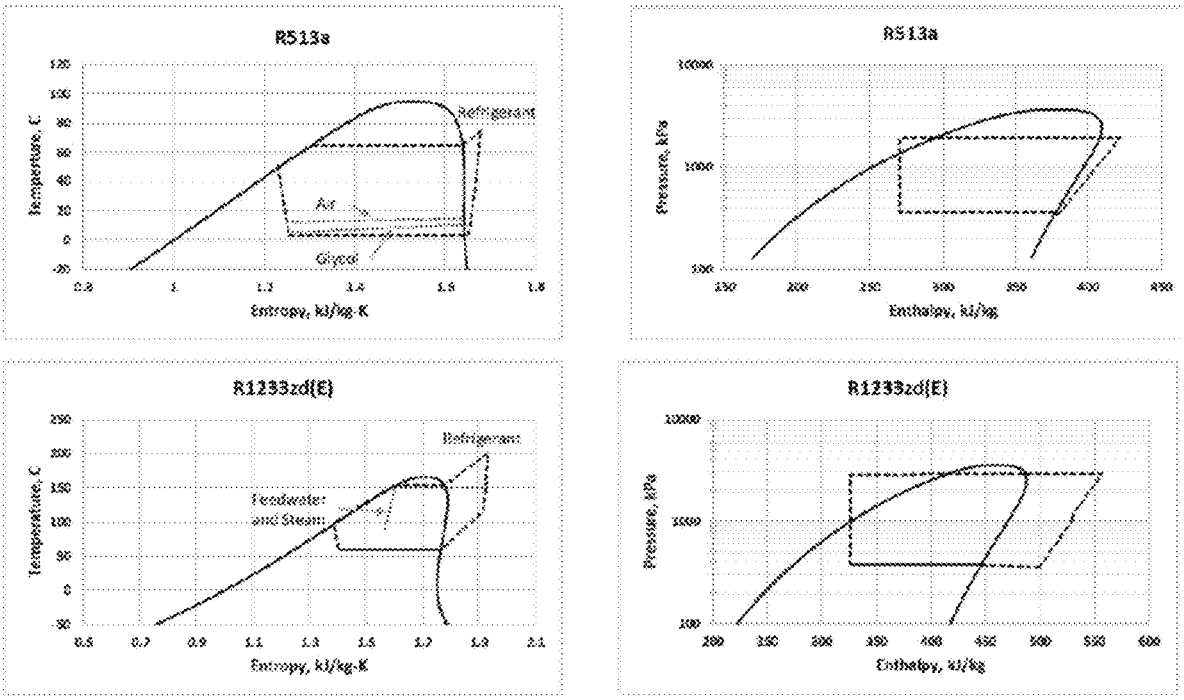
Figure 16F:
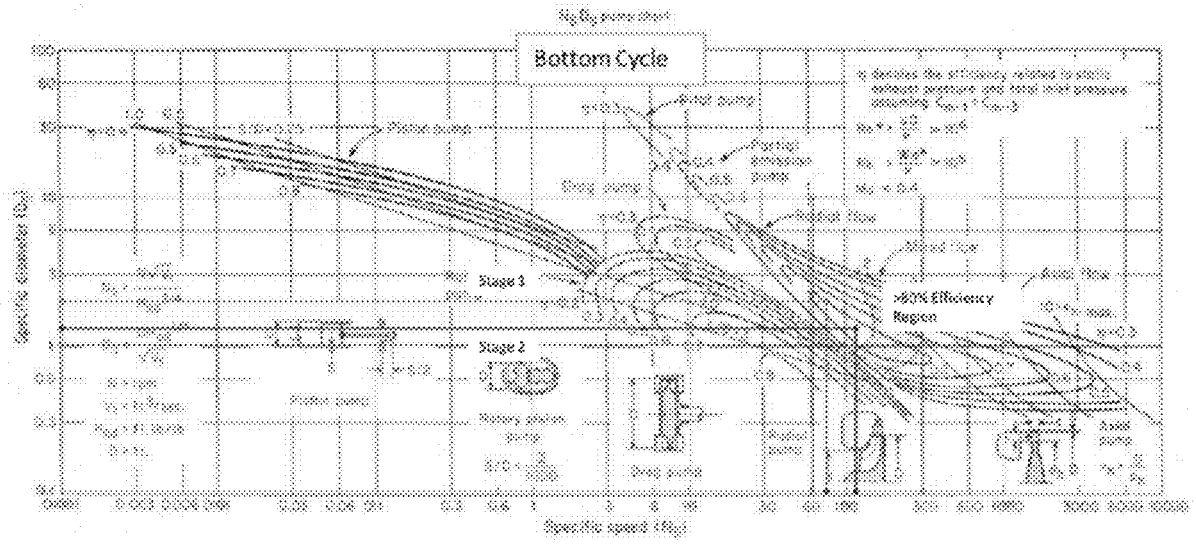
Figure 16G:
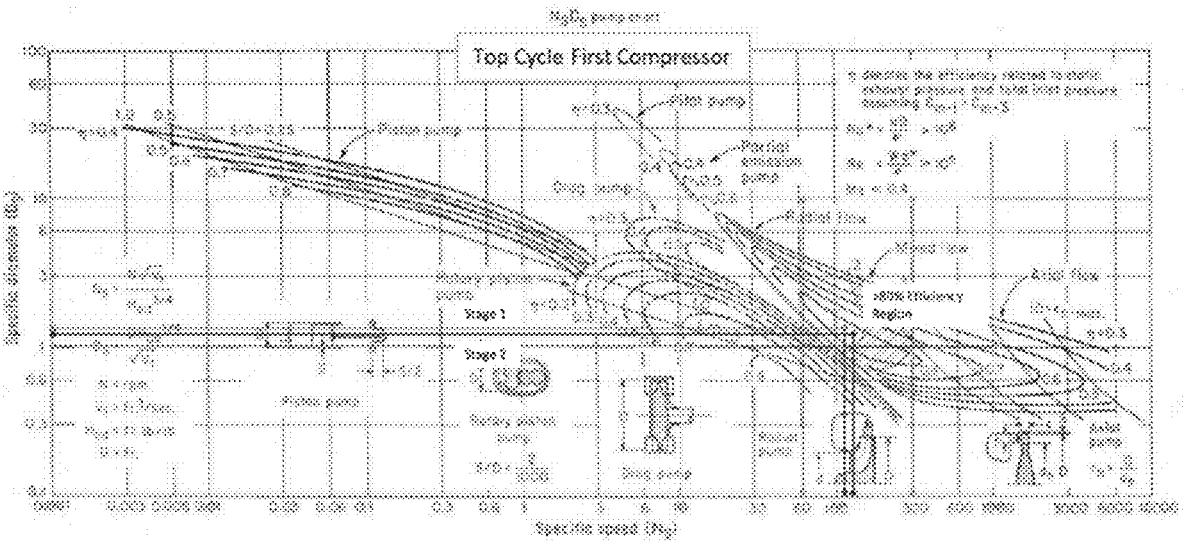
Figure 16H:
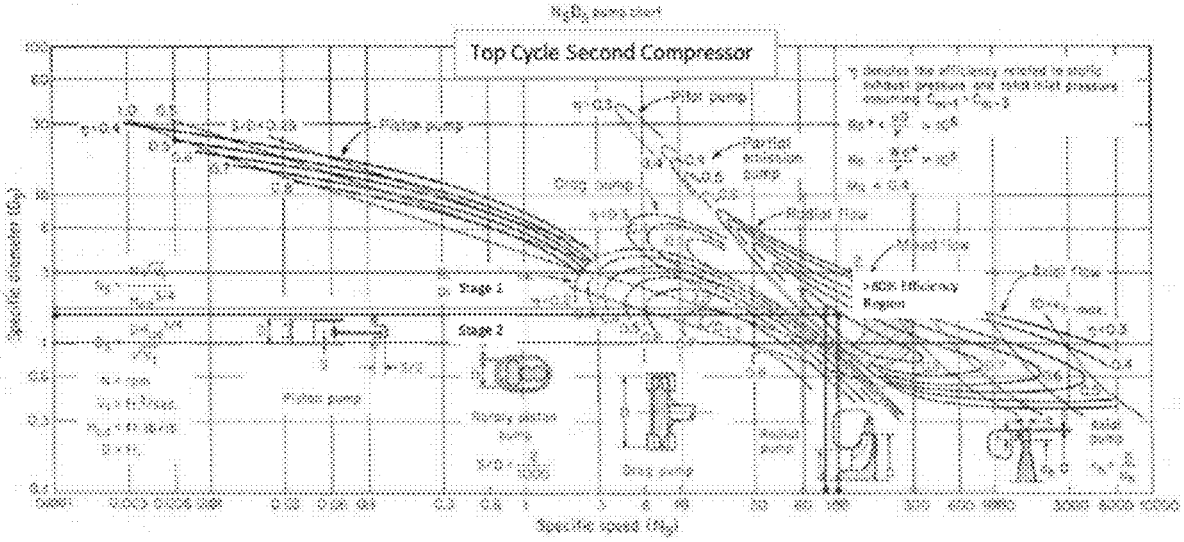

FIGS. 16B-H illustrate an operational example for the steam generating system in FIG. 16A. FIGS. 16B-C are tables showing the parameters of the system and their operation values given a set of example constraints (e.g., inlet air temperature, steam duty). Notably, the % Carnot is greater than 50%. FIG. 16D illustrates the thermodynamic curves of the bottom heat pump cycle using R513a and the top heat pump cycle using R1233zd(E). FIG. 16E is a table showing the specific speed (Ns) and specific diameter (Ds) of the bottom cycle compressor, the first top cycle compressor, and the second top cycle compressor. Notably, all of the compressors are operating at less than 30,000 RPM and the impeller diameters are between 3 inches and 6 inches. FIG. 16F-H are NsDs graphs showing the region in which greater than 80% efficiency of the compressors can be achieved for the bottom cycle compressor, the first top cycle compressor, and the second top cycle compressor.

Figure 17:
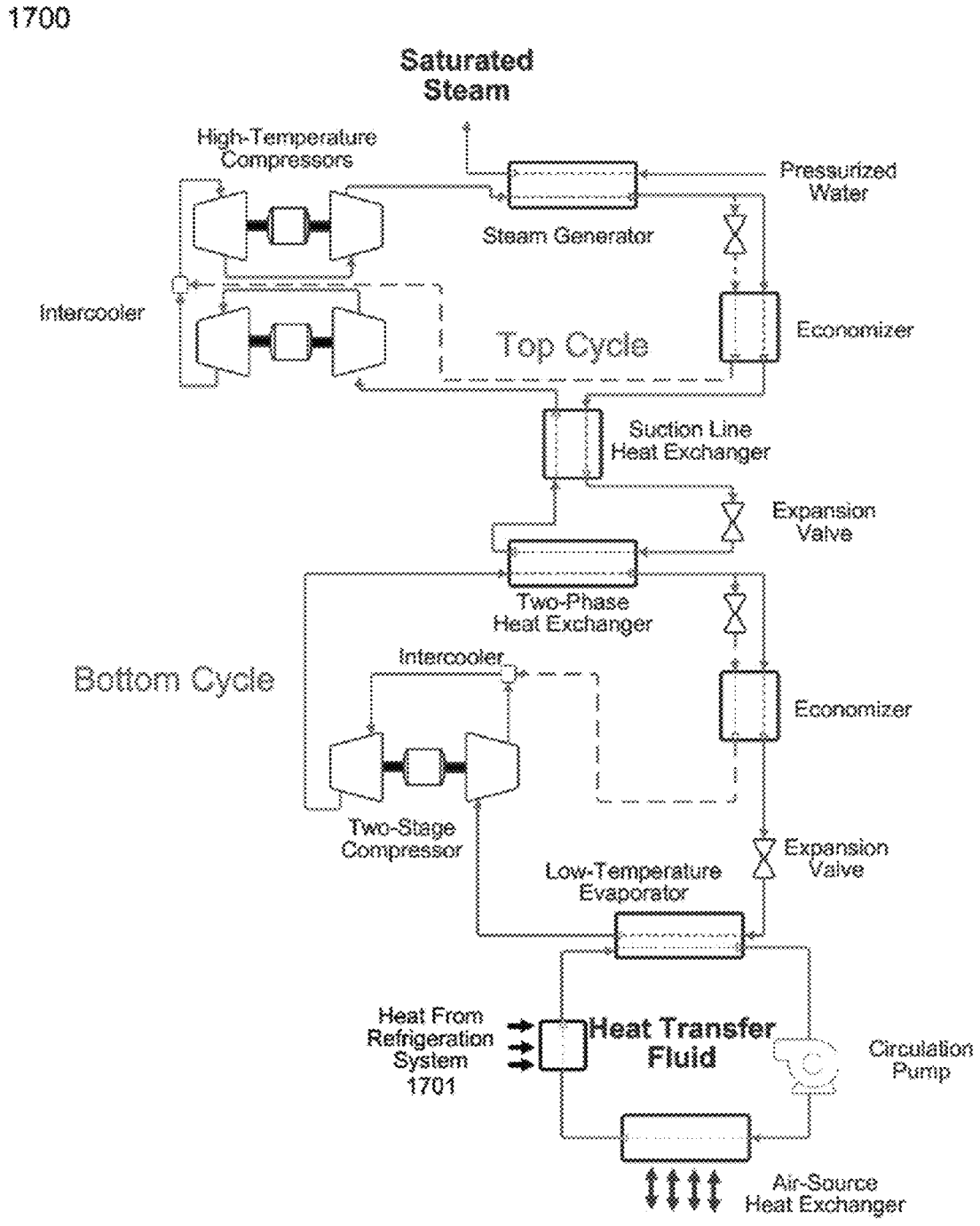
FIGS. 17-19 illustrate examples of a steam generating system comprising a heat transfer fluid cycle in accordance with some embodiments described herein.

The steam generating system 1700 in FIG. 17 illustrates an alternative configuration a steam generating system illustrated in FIG. 16, further comprising an additional heat exchanger 1701 that may be thermally coupled to a refrigeration system. In some embodiments, the additional heat exchanger 1701 may be a heat source and receive heat from the refrigeration system. In some embodiments, the additional heat exchanger 1701 may transfer heat to the refrigeration system as described herein.

The steam generating system 1800 in FIG. 18 illustrates an alternative configuration a steam generating comprising a top cycle 1820, a bottom cycle 1810, a heat fluid transfer cycle 1830 (similar to the steam generating system illustrated in FIG. 17) and further comprising an additional bottoming cycle 1840. The bottoming cycle 1840 may be coupled to a heat transfer fluid cycle 1830 by a heat exchanger 1831 of the heat transfer fluid cycle 1830. In some embodiments, the additional bottoming cycle 1840 may be a separate cycle from the steam generating system 1800 and/or be separate from a refrigeration system coupled to the heat transfer cycle 1830. In some embodiments, the additional bottoming cycle 1840 may be a vapor compression cycle. The vapor compression cycle may circulate ammonia or another working fluid described herein. The vapor compression cycle may comprise a compressor 1841. The compressor 1841 may be a screw compressor. In some embodiments, the system 1800 may comprise additional air-coupled heat exchangers to reject heat from the refrigeration system. In some embodiments, the heat transfer fluid cycle 1830, may comprise one or more air-source heat exchangers to heat a heat transfer fluid during warmer weather operation (i.e., a bottoming vapor compression system can be turned off) as described herein.

The steam generating system 1900 in FIG. 19 illustrates an alternative configuration of a steam generating system illustrated in FIG. 18, wherein the system 1900 comprises a heat transfer fluid cycle with an add-on vapor compression cycle 1910. The heat transfer fluid cycle with an add-on vapor compression cycle 1910 may be configured such that a vapor compression cycle is integrated into a heat transfer fluid cycle. A condenser of the heat transfer fluid cycle with an add-on vapor compression cycle 1910 may increase the temperature of a heat transfer fluid upstream of a low-temperature evaporator. This may help increase the transfer fluid heat cycle's performance and allow compressors of the system to operate closer to their design point. An evaporator of the heat transfer fluid cycle with an add-on vapor compression cycle 1910 may then cool the heat transfer fluid downstream of the low-temperature evaporator before it re-enters the air-source heat exchanger, allowing for a more efficient transfer of heat from a working fluid of the heat transfer fluid cycle with an add-on vapor compression cycle 1910 at a start of the system 1900. In some embodiments, a working fluid of a heat transfer fluid cycle is a glycol water mixture. In some embodiments, a working fluid of a vapor compression cycle may comprise ammonia or another working fluid described herein. In some embodiments, a vapor compression cycle may comprise a compressor. The compressor may be a screw compressor as described herein.

Figure 94:
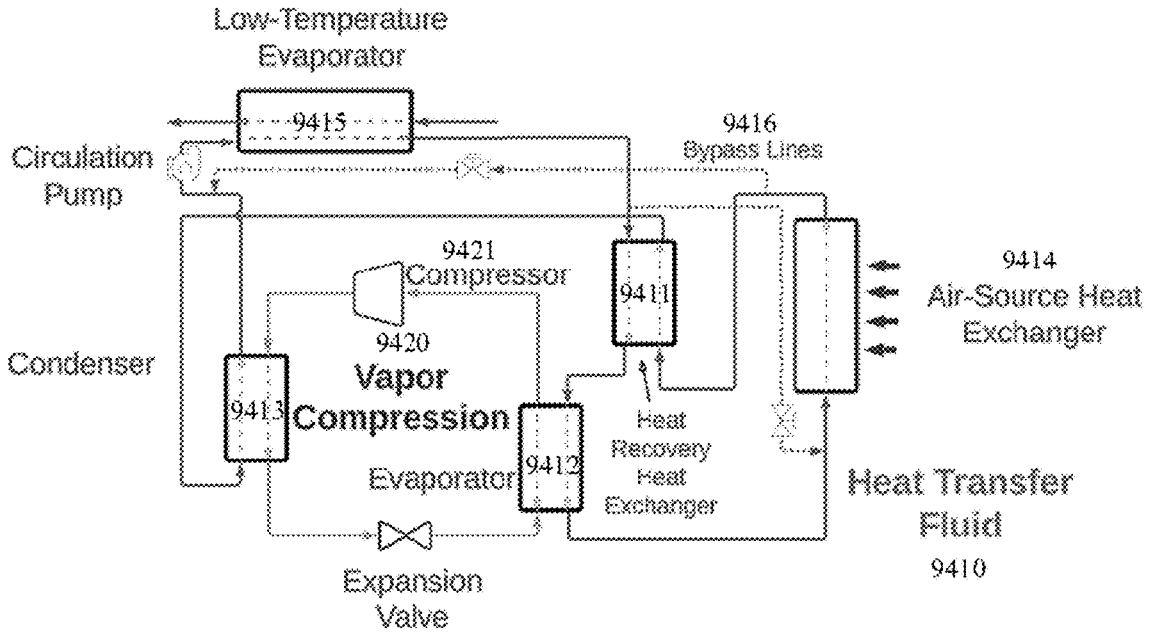
FIG. 94 illustrates an example of a bottoming cycle with a heat recovery heat exchanger in accordance with some embodiments described herein.

The steam generating system 9400 in FIG. 94 illustrates an alternative configuration of a steam generating system illustrated in FIG. 19, wherein the system 9400 comprises a heat transfer fluid cycle 9410 with an add-on vapor compression cycle 9420. The heat transfer fluid cycle with an add-on vapor compression cycle 9420 may be configured such that a vapor compression cycle is integrated into a heat transfer fluid cycle. The heat transfer fluid cycle may comprise a heat recovery heat exchanger 9411, an evaporator 9412, a condenser 9413, an air-source heat exchanger 9414 and a low-temperature evaporator 9415. The add-on vapor compression cycle 9420 may comprise a compressor 9421. The heat recovery heat exchanger 9411 may be configured to receive a first working fluid output stream from a low-temperature evaporator 9415. The heat recovery heat exchanger 9411 may be configured to decrease the temperature of the first working fluid stream before the first working fluid stream enters the evaporator 9412. The evaporator may be configured to decrease the temperature of the first working fluid stream before the first working fluid stream enters an air-source heat exchanger 9414. An add-on vapor compression cycle output stream of the evaporator 9412 may be configured to enter a compressor 9421. The heat recovery heat exchanger 9411 may be configured to increase the temperature of a second working fluid stream before the second working fluid stream enters the condenser 9413. The condenser 9413 may be configured to increase the temperature of the second working fluid stream before the first working fluid stream enters the low-temperature evaporator 9415. This configuration may increase the heat pump performance and/or allow for a compressor (e.g., a compressor of the bottom heat pump cycle) to operate closer to its design point. Alternatively, or in addition, this configuration may enable operation at very low ambient temperature. The very low ambient temperatures may be less than or equal to about −40° C., −30° C., −20° C., −10° C., 0° C., 10° C., or 20° C. The very low ambient temperature may be between any two values described herein. Alternatively, or in addition, the heat recovery heat exchanger 9411 may enable the add-on vapor compression cycle 9420 to be sized at a lower capacity (e.g., by reducing the amount of heat pumping required by the add-on vapor compression cycle). The heat recovery heat exchanger 9411, the evaporator 9412, and the condenser 9413 may be bypassed by bypass lines 9416. The bypass lines may be used during warmer ambient temperature conditions.

Figure 20:
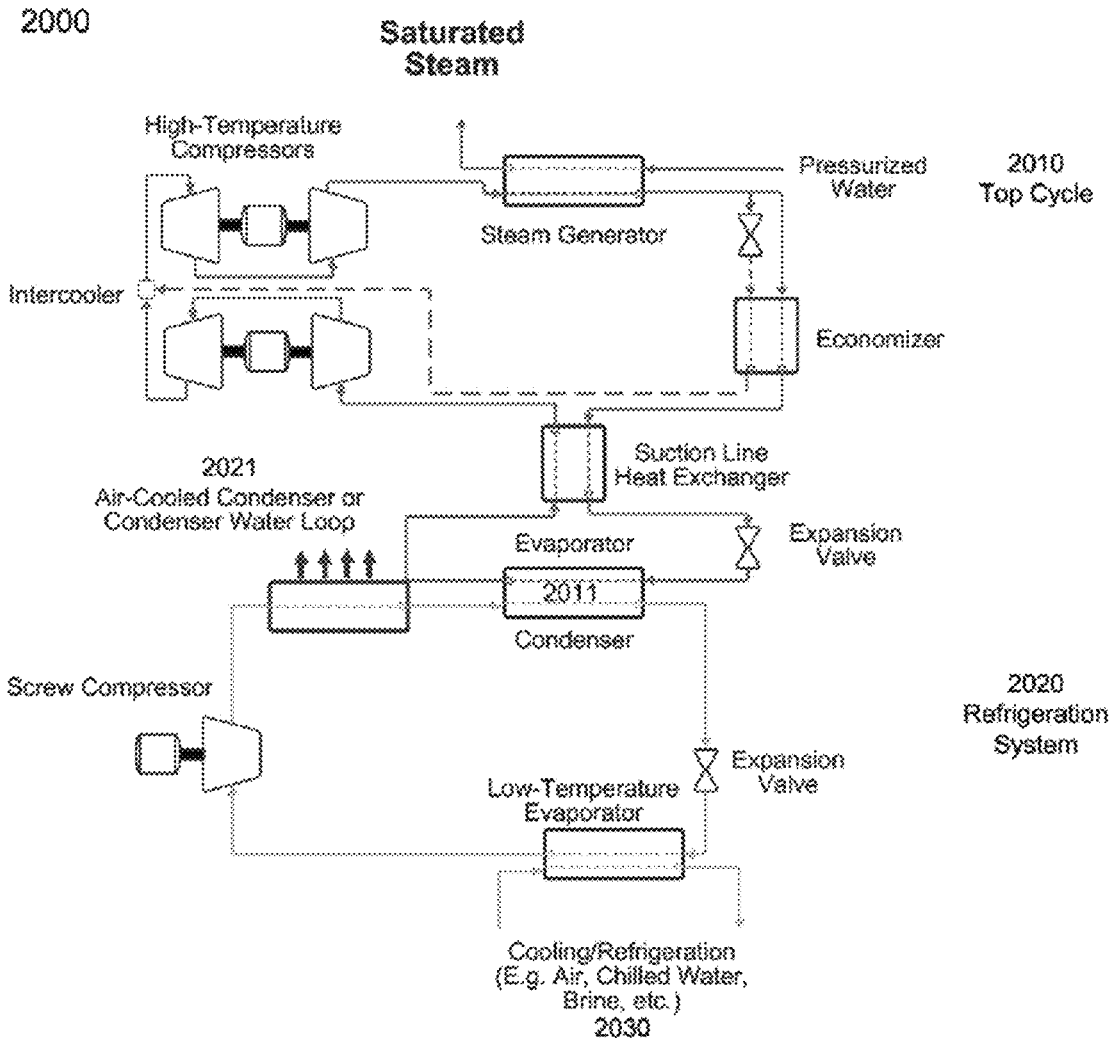
FIG. 20 illustrates examples of a steam generating system comprising a refrigeration system in accordance with some embodiments described herein.

FIG. 20 illustrates an example of a steam generating system in accordance with some embodiments described herein. The steam generating system 2000 in FIG. 20 comprises a top cycle 2010 and a refrigeration system 2020. In some embodiments, the refrigeration system 2020 may be coupled directly to the top cycle 2010 by a heat exchanger 2011. The refrigeration system 2020 may provide cooling from the top cycle 2010 to a fluid 2030. The fluid 2030 may comprise air, water, brine, and/or other fluids. The refrigeration system 2020 may comprise an air-cooled condenser/condenser water loop 2021 to be used in combination with the top cycle coupled heat exchanger 2011, such that the system can continue to operate when no steam generation is required. In some embodiments, an intermediate fluid loop (e.g., a heat transfer fluid cycle as illustrated in FIG. 17) can also be used to couple the top cycle 2010 and the refrigeration system 2020 and to reject heat when steam is not being generated. In some embodiments, a working fluid of the refrigeration system 2020 cycle may comprise ammonia or another working fluid described herein. In some embodiments the refrigeration system 2020 may comprise a compressor. The compressor may be a screw compressor.

Figure 21:
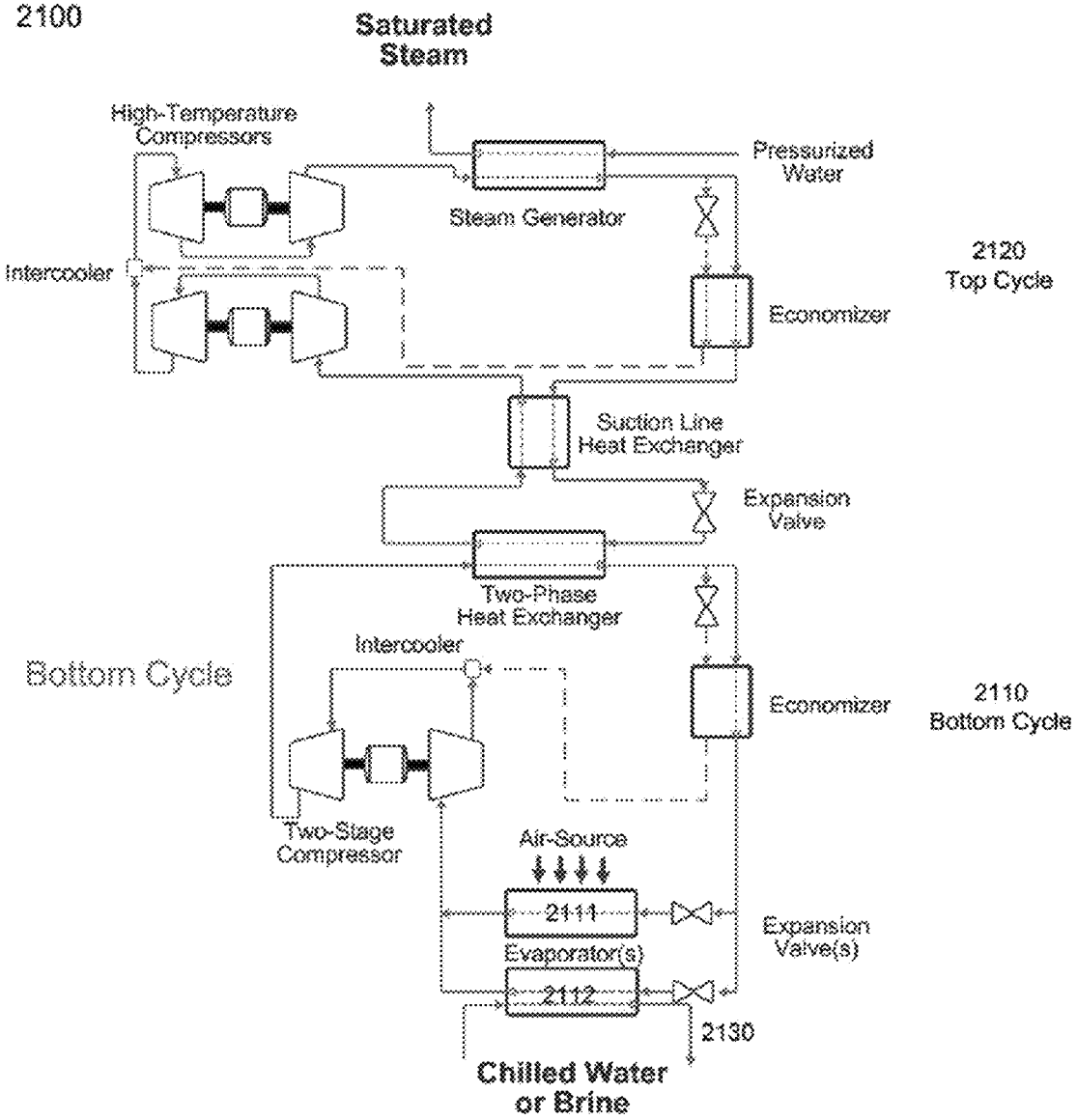
FIG. 21 illustrates examples of a steam generating system in accordance with some embodiments described herein.

FIG. 21 illustrate an example of a steam generating system in accordance with some embodiments described herein. The steam generating system 2100 in FIG. 21 comprises a top cycle 2120, a bottom cycle 2110, and a chilled fluid stream 2130. The bottom cycle 2110 may comprise a first exchanger 2112 in parallel with the second heat exchanger 2111. The first heat exchanger may transfer heat from the chilled fluid stream 2130 to a working fluid of the bottom cycle 2110. The second heat exchanger 2111 may be an air-source heat exchanger, where in the air-source heat exchanger 2111 is configured to work in tandem with a heat exchanger 2112. The heat exchanger 2112 does not provide sufficient heat from the chilled fluid stream 2130. In some environments, the chilled fluid stream may be chilled water with the temperature in the range of about −5° C. to about 15° C., about −5° C. to about 0° C., about 0° C. to about 5° C., about 5° C. to about 10° C., or about 10° C. to about 15° C. In some environments, the chilled fluid stream may be chilled water with the temperature of less than 0° C. In some environments, the chilled fluid stream may be chilled water with the temperature of greater than 15° C. In some embodiments, the chilled fluid stream 2130 may comprise a chilled brine with a temperature less than 0° C. The chilled brine may comprise a glycol mixture and or another heat transfer fluid (e.g., air). In some embodiments, the system 2100 may further comprise a separate electrically powered refrigeration system to supplement the cooling generated by the system 2100.

Figure 23:
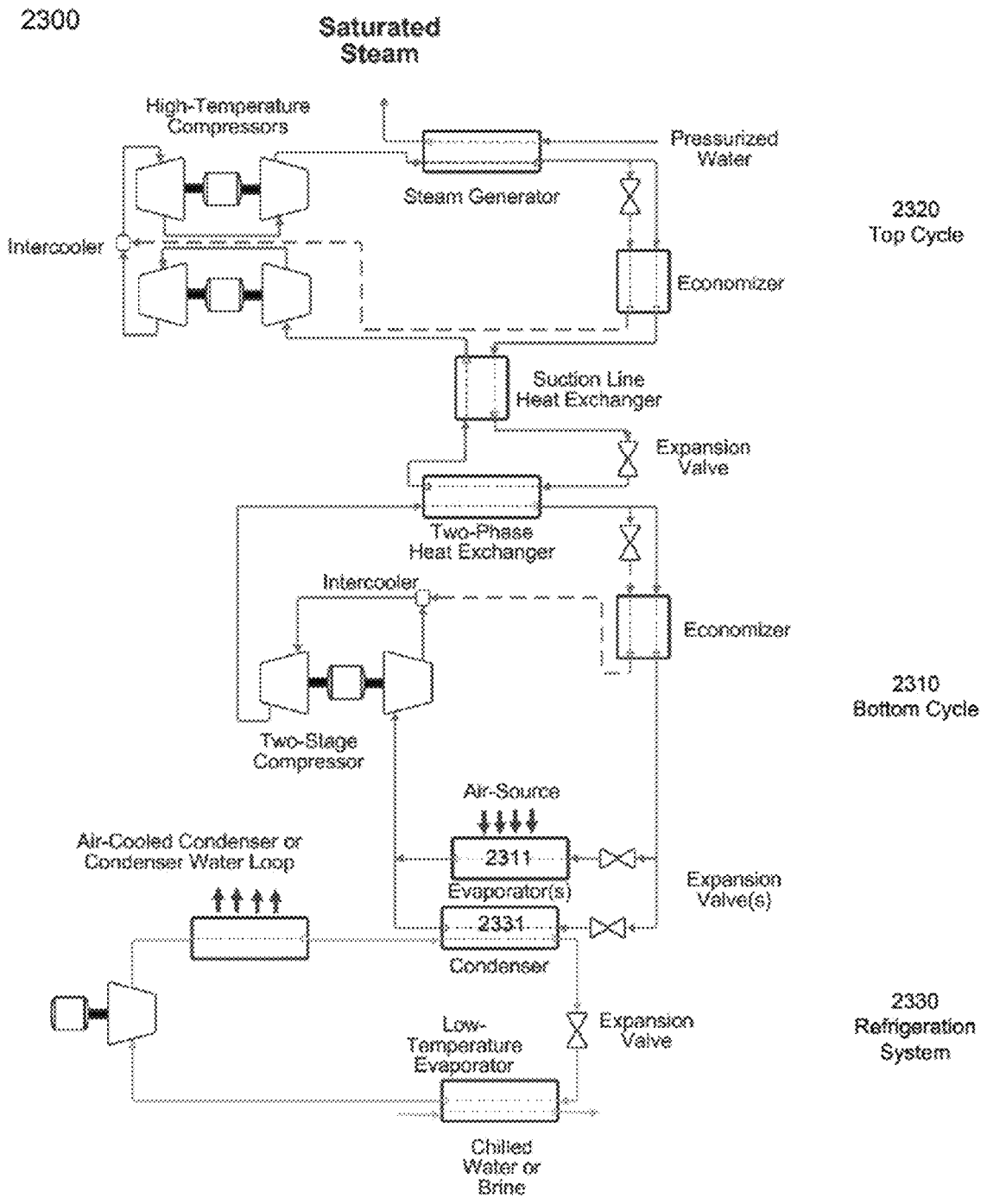

FIGS. 22-24 illustrate examples of a steam generating system in accordance with some embodiments described herein. The steam generating system 2200 of FIG. 22 comprises a top cycle 2220, a bottom cycle 2210 and a refrigeration system 2230. The system 2200 may use condenser fluid from the refrigeration system 2230 as a heat source. The refrigeration system 2230 may comprise a heat exchanger 2231. The refrigeration system 2230 may be coupled to the bottom cycle 2210 by an intermediate loop 2240 as described herein. The heat exchanger 2231 may be a condenser coupled to the intermediate loop 2240, where the intermediate loop 2240 is coupled to the bottom cycle 2210 by heat exchanger 2212. The heat exchanger 2212 may be an evaporator configured to transfer condenser fluid heat from the refrigeration system 2230 to the bottom cycle 2210. The bottom cycle 2210 may further comprise an air-source heat exchanger 2211 in parallel with the heat exchanger 2212. Having the heat exchanger 2231 of the refrigeration system 2230 coupled to the bottom cycle may provide improved performance of the system 2200 because a condenser fluid of the refrigeration system 2230 may be hotter than air temperatures, and therefore eliminate the need for a cooling tower and the electricity required to run cooling tower fans. The temperature of the condenser fluid may be up to or greater than 35 degrees Celsius. In some embodiments, the system may further comprise add-ons such as a combined condenser water heat recovery and an air-source heat exchanger; a cooling tower or air-cooled heat exchanger coupled to the refrigeration system 2230; and/or a cooling tower or air cooled heat exchanger coupled to the intermediate loop 2240. In some embodiments, the refrigeration system 2230 may be a standard chiller system, a direct expansion system, or a part of a distributed cooling system.

The steam generating system 2300 in FIG. 23 illustrates an alternative configuration of a steam generating system illustrated in FIG. 22 comprising a top cycle 2320, a bottom cycle 2310 and a refrigeration system 2330. The system 2200 may use a condenser fluid from the refrigeration system 2230 as a heat source. The refrigeration system 2330 may be directly coupled to the bottom cycle 2310 by a heat exchanger 2331. The coupling heat exchanger 2331 may be a condenser, where the condenser fluid of the refrigeration system 2330 functions as a heat source for the bottom cycle 2310. The bottom cycle 2310 made further comprise an air-source heat exchanger 2311 in parallel with the heat exchanger 2331 as described herein. In some embodiments, the system may further comprise add-ons such as a combined condenser water heat recovery and an air-source heat exchanger and/or a cooling tower or air-cooled heat exchanger coupled to the refrigeration system 2230. In some embodiments, the refrigeration system 2230 may be a standard chiller system, a direct expansion system, or a part of a distributed cooling system.

The steam generating system 2400 in FIG. 24 illustrates an alternative configuration of a steam generating system illustrated in FIG. 22, comprising a top cycle 2420, a bottom cycle 2410 and a refrigeration system 2430. The refrigeration system 2430 comprises a compressor 2431. The refrigeration system 2430 may be coupled to the bottom cycle 2410 through an oil loop 2440. The oil loop 2440 is configured to cool the motor of the compressor 2431 of the refrigeration system 2430 similarly as illustrated in FIG. 7, where the oil loop 2440 is coupled to the compressor 2431 of refrigeration system 2430 and heat exchanger 2412 of the bottom cycle 2410. The oil loop may circulate a fluid (e.g., oil) to transfer heat from a motor of the compressor 2431 the heat exchanger 2412. The heat exchanger 2412 may comprise an evaporator. The fluid of the oil loop 2440 may act as a coolant for the compressor, wherein the heat from the compressor 2431 may act as a heat source for the bottom cycle 2410. The bottom cycle 2410 made further comprise an air-source heat exchanger 2411 in parallel with the heat exchanger 2412. The refrigeration system 2430 may further be coupled to a cooling tower 2450. The cooling tower 2450 may be coupled to a condenser of the refrigeration system 2430. In some embodiments, a back pressure regulator may be used and/or the air-source heat exchanger 2411 and the evaporator of the heat exchanger 2412 would be located at separate compressor stages as explained herein. In some embodiments, the air-source heat exchanger of the bottom cycle and the second heat exchanger, collecting heat from the refrigeration system, may be at different pressures/temperatures.

FIG. 25 illustrate examples of a steam generating system in accordance with some embodiments described herein where heat from a refrigeration system is indirectly coupled to a heat pump system. The steam generating system 2500 of FIG. 25 comprises a top cycle 2520, a bottom cycle 2510 and a refrigeration system 2530. The refrigeration system 2530 may be coupled to the top cycle 2520, similarly to how the refrigeration system 2230 is coupled to the bottom cycle 2210 as illustrated in FIG. 22. The system 2500 may use a condenser fluid from the refrigeration system 2530 as a heat source for the top cycle 2520. The refrigeration system 2530 may comprise a heat exchanger 2531. The refrigeration system 2230 may be coupled to the top cycle 2520 by an intermediate loop 2540. The heat exchanger 2531 may be a condenser coupled to the intermediate loop 5240, where in the intermediate loop 2540 is that coupled to the bottom cycle 2520 by heat exchanger 2522. The heat exchanger 2522 may be an evaporator configured to transfer condenser fluid heat from the refrigeration system 2530 to the bottom cycle 2210. The top cycle 2520 may further comprise and two-phase heat exchanger 2521 coupled to the bottom cycle 2510.

Figure 26:
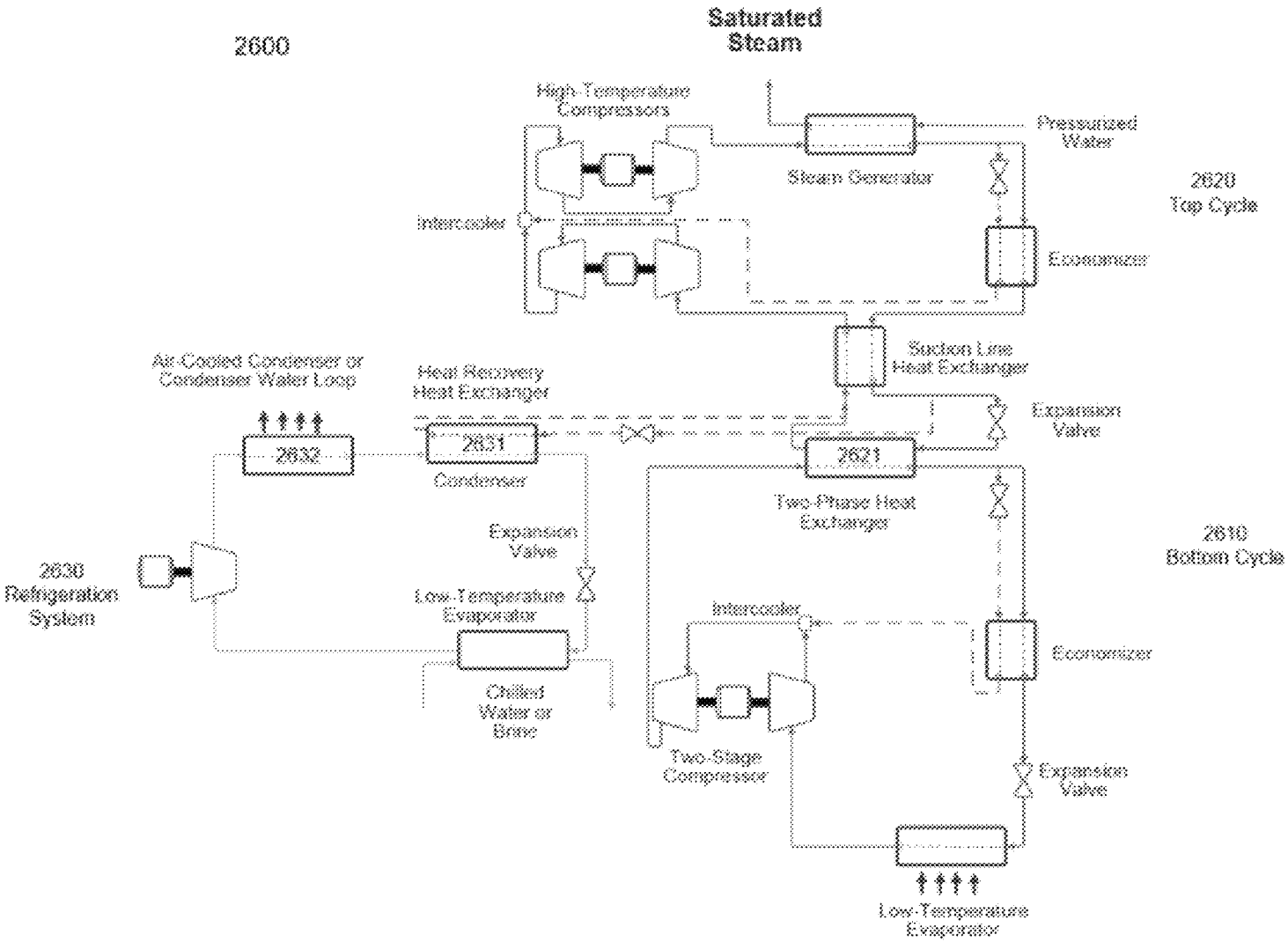

FIG. 26 illustrates an example of a steam generating system in accordance with some embodiments described herein where heat from a refrigeration system is directly coupled to a heat pump system. The steam generating system 2600 in FIG. 26 illustrates an alternative configuration of a steam generating system illustrated in FIG. 25 comprising a top cycle 2620, a bottom cycle 2610 and a refrigeration system 2630. The system 2600 may use condenser fluid from the refrigeration system 2630 as a heat source. The refrigeration system 2630 may be directly coupled to the top cycle 2620 by a heat exchanger 2631. The coupling exchanger 2631 may comprise a condenser, wherein a condenser fluid of the refrigeration system 2630 functions as a heat source for the top cycle 2620. The top cycle 2620 may further comprise a two-phase heat exchanger 2621 coupled to the bottom cycle 2610. In some embodiments, the refrigeration system may further comprise an air-cooled condenser or a condenser water loop heat exchanger 2632. In some embodiments, the refrigeration system 2630 may be a standard chiller system, a direct expansion system, or a part of a distributed cooling system.

Figure 27:
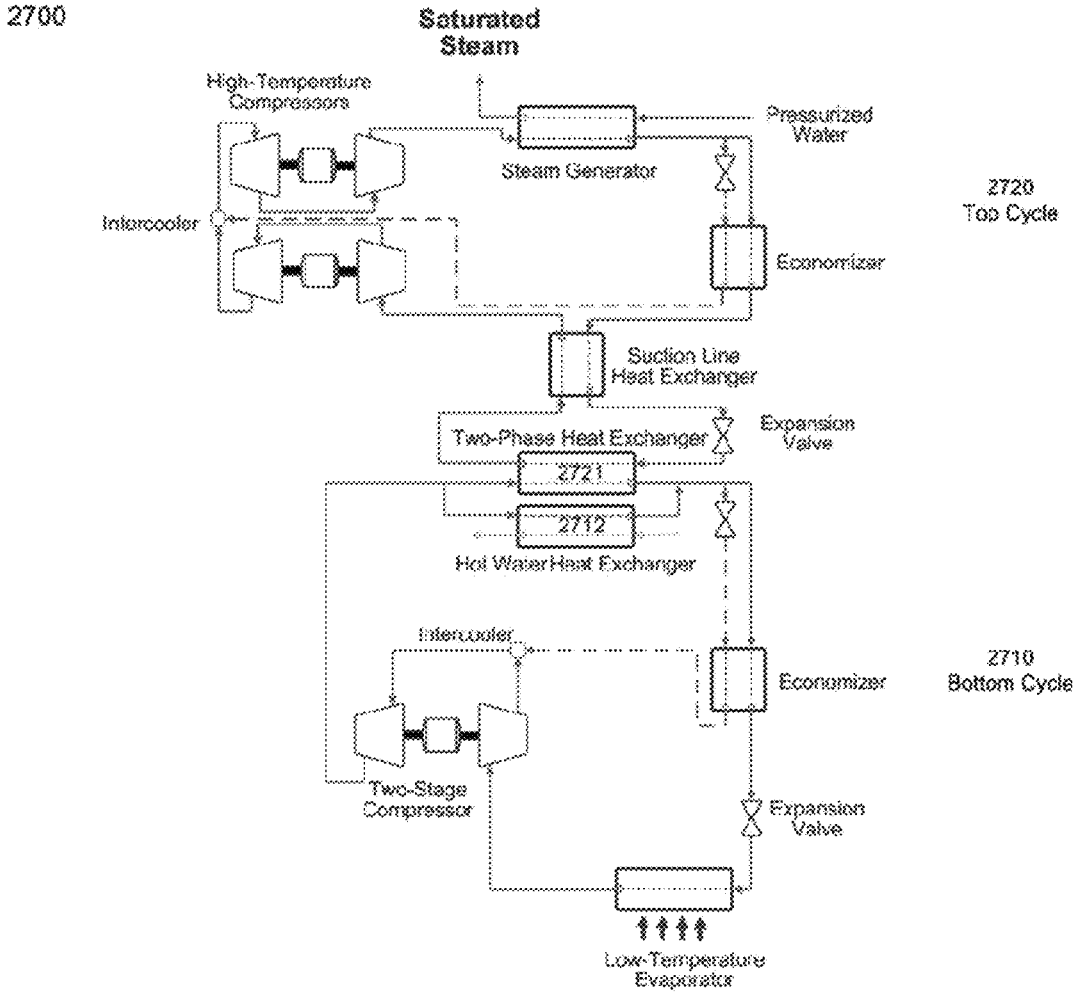
FIG. 27 illustrate an example of a steam generating system capable of generating steam and/or hot water in accordance with some embodiments described herein.

FIG. 27 illustrates an example of a steam generating system in accordance with some embodiments described herein where the system is capable of also generating hot water in a bottom cycle. The steam generating system 2700 of FIG. 27 comprises a top cycle 2720 and a bottom cycle 2710. The bottom cycle comprises a hot water heat exchanger 2712 in parallel with a two-phase heat exchanger 2721. The two-phase heat exchanger 2721 couples the bottom cycle 2710 to the top cycle 2720. The hot water heat exchanger 2712 may receive a water stream and transfer heat from a portion of a working fluid stream of the bottom cycle 2710 to generate hot water. The condensed working fluid output by the hot water heat exchanger 2712 may then be circulated back into the bottom cycle 2710 with the condensed working fluid output by the two-phase heat exchanger 2721 from the two-phase heat exchanger 2821.

The generated hot water may have temperature of about 20° C. to about 30° C., 30° C. to about 40° C., 40° C. to about 50° C., about 50° C. to about 60° C., about 60° C. to about 70° C., about 70° C. to about 80° C., about 80° C. to about 90° C., about 90° C. to about 100° C., or about 100° C. to 110° C., or greater as described herein.

Figure 28:
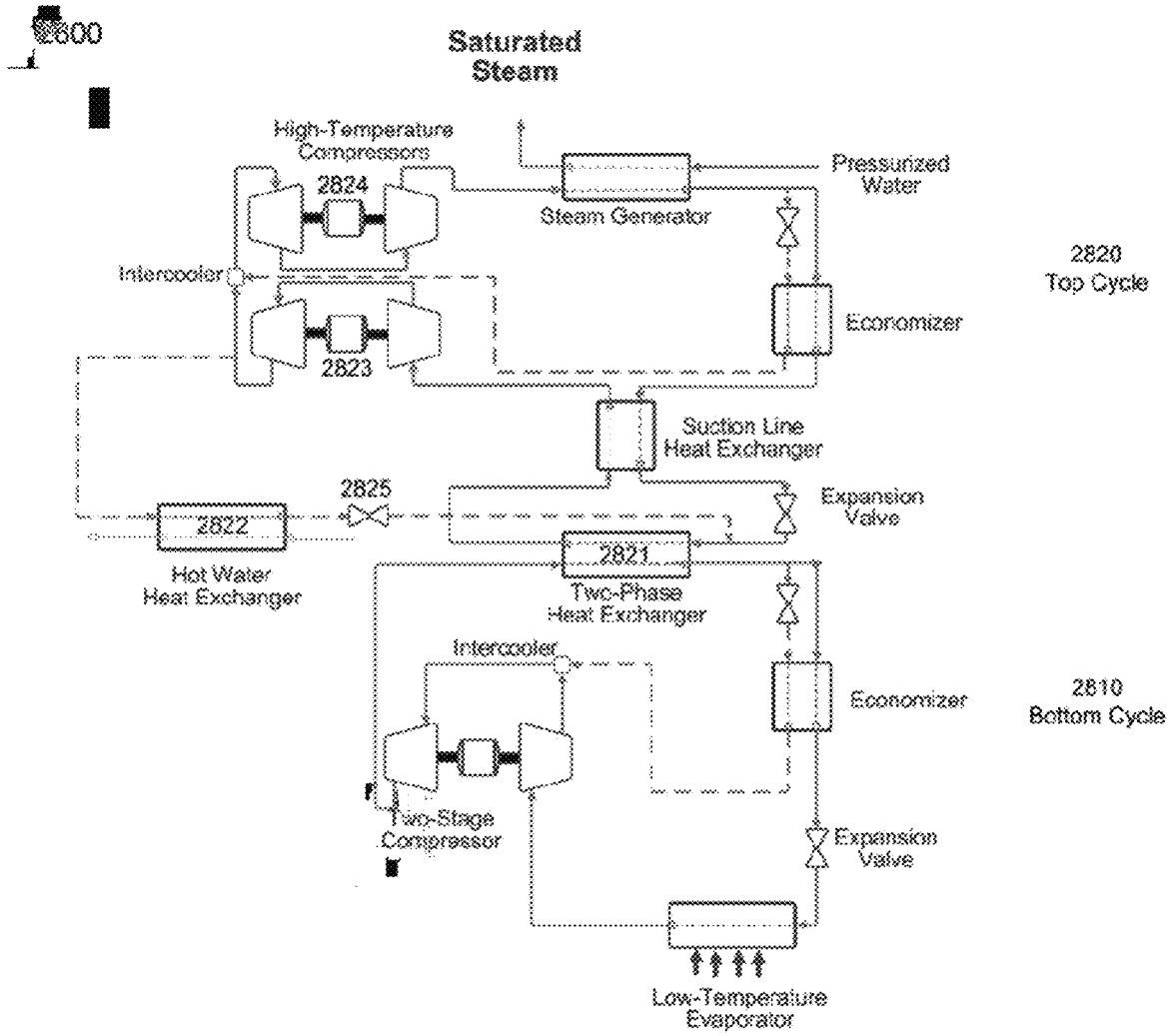
FIGS. 28-33 illustrate examples of a steam generating system capable of generating steam and/or hot water in accordance with some embodiments described herein.

FIGS. 28-33 illustrate examples of a steam generating system capable of generating steam and/or hot water in a top cycle in accordance with some embodiments described herein. The steam generating system 2800 of FIG. 28 is capable of generating steam and/or hot water and comprises a top cycle 2820 and a bottom cycle 2810. The top cycle 2810 comprises a hot water heat exchanger 2822 in series with a two-phase heat exchanger 2821, wherein the two-phase heat exchanger 2821 couples the top cycle 2820 and the bottom cycle 2810. The hot water heat exchanger 2822 may receive a portion of a working fluid stream at an intermediate stage of a first compressor 2823 and a second compressor 2824 of the top cycle 2820. Compressors 2823 and 2824 may be high temperature compressors. The hot water heat exchanger 2812 may receive a portion of a working fluid stream between the first and second compressors 2823 and 2824 at an intermediate pressure (i.e., before the fluid passed through the second compressor 2824). The first compressor may be a low-pressure compressor. The hot water heat exchanger 2822 may receive a water stream and transfer heat from a portion of a working fluid stream from the first compressor 2823 to generate hot water. The condensed working fluid output by the hot water heat exchanger 2822 may then be circulated back into the top cycle 2820 upstream from the two-phase heat exchanger 2821. In some embodiments, a condensed working fluid output by the hot water heat exchanger 2822 may be throttled by an expansion valve 2825 to an evaporator pressure before being circulated back into the top cycle 2820 upstream from the two-phase heat exchanger 2821. The generated hot water may have temperature up to about 20° C., 30° C., 40° C., 50° C., 60° C., 70° C., 80° C., 90° C., 100° C., 110° C., or greater as described herein.

Figure 29:
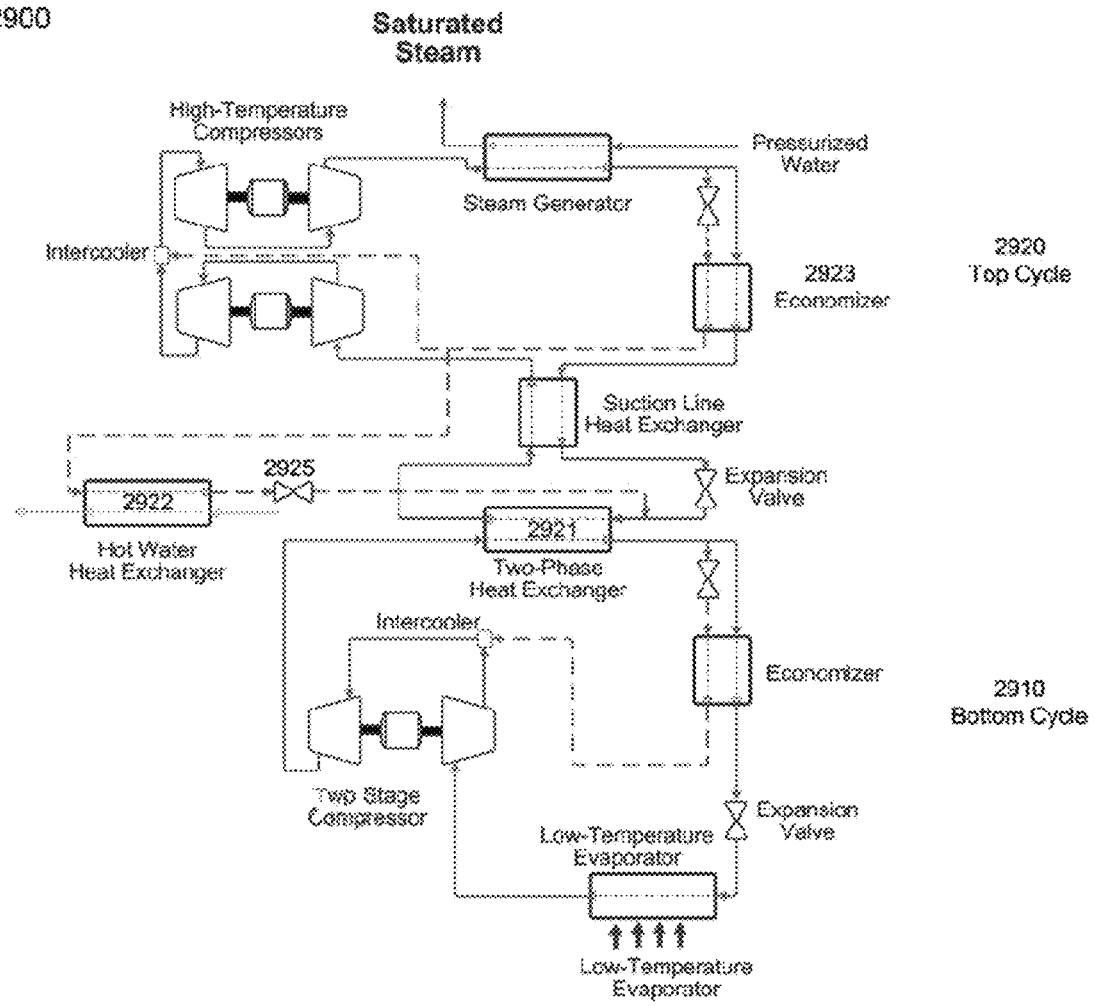

FIG. 29 illustrates an alternative embodiment of the steam generating system of FIG. 28. The steam generating system 2900 of FIG. 29 is capable of generating steam and/or hot water and comprises a top cycle 2920 and a bottom cycle 2910. The top cycle 2910 comprises a hot water heat exchanger 2922 in series with a two-phase heat exchanger 2921. The two-phase heat exchanger 2921 couples the top cycle 2920 and the bottom cycle 2910. The hot water heat exchanger 2922 may receive a portion of a working fluid stream from an economizer 2923. The hot water heat exchanger 2922 may receive a water stream and transfer heat from a portion of a working fluid stream from the economizer 2923 to generate hot water. The condensed working fluid output by the hot water heat exchanger may then be circulated back into the top cycle 2920 upstream from the two-phase heat exchanger 2921. In some embodiments, a condensed working fluid output by the hot water heat exchanger 2922 may be throttled by an expansion valve 2925 to an evaporator pressure before being circulated back into the top cycle 2920 upstream from the two-phase heat exchanger 2921. The generated hot water may have temperature up to about 20° C., 30° C., 40° C., 50° C., 60° C., 70° C., 80° C., 90° C., 100° C., 110° C., or greater as described herein. In some embodiments, the hot water generator may receive a working fluid from an intercooler of the top cycle.

Figure 30:
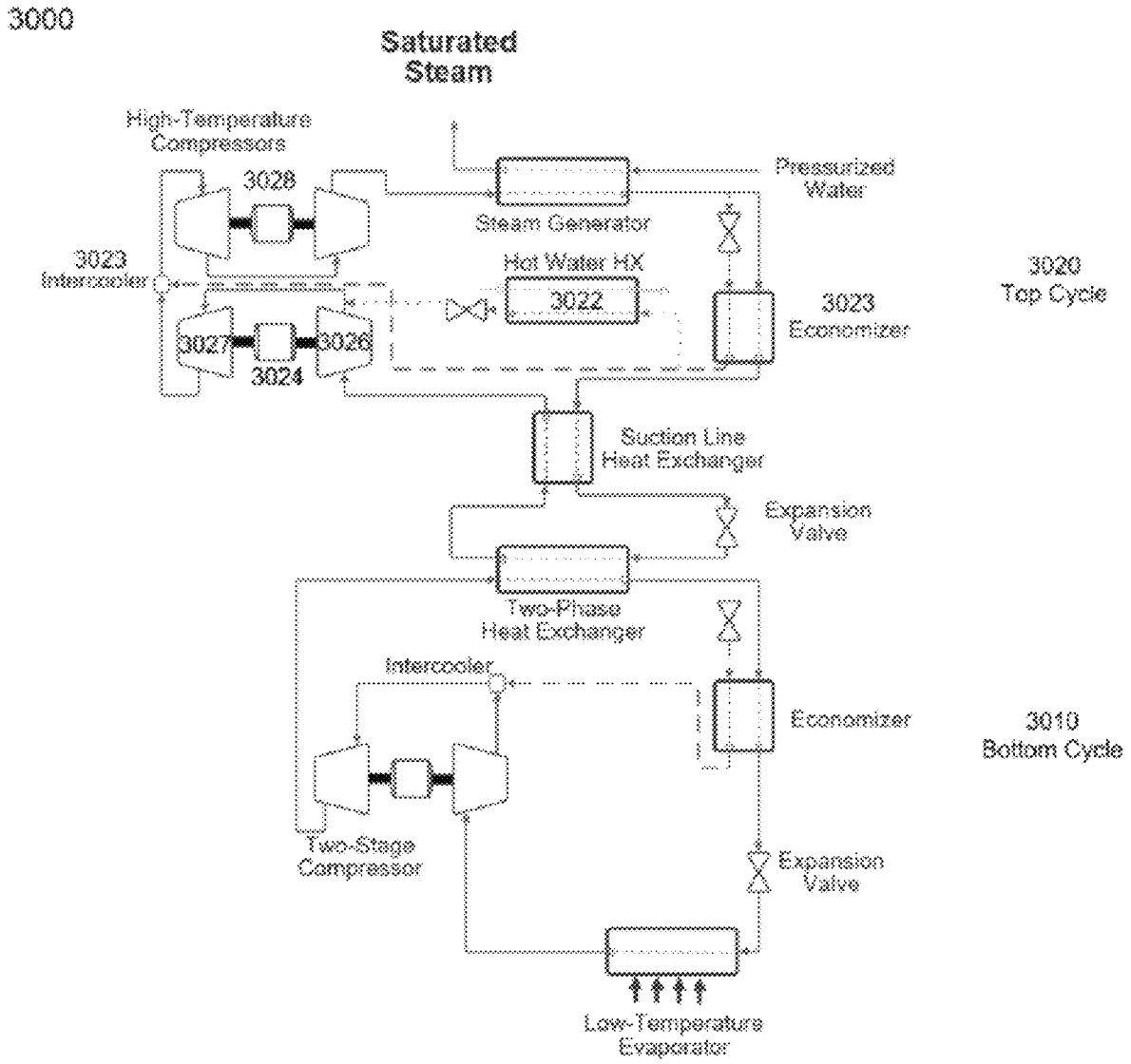

FIG. 30 illustrates an alternative embodiment of the steam generating system of FIG. 28. The steam generating system 3000 of FIG. 30 is capable of generating steam and/or hot water and comprises a top cycle 3020 and a bottom cycle 3010. The top cycle 3010 comprises a hot water heat exchanger 3022 in series with a two-phase heat exchanger 3021, wherein the two-phase heat exchanger 3021 couples the top cycle 3020 and the bottom cycle 3010. The hot water heat exchanger 3022 may receive a portion of a working fluid stream from an economizer 3023. The hot water heat exchanger 3022 may receive a water stream and transfer heat from a portion of a working fluid stream from the economizer 3023 to generate hot water. In some embodiments, a condensed working fluid output by the hot water heat exchanger 3022 may be throttled by an expansion valve 3025 to an evaporator and/or intermediate pressure before being injected back into the top cycle 3020 between compressor stages. The throttled working fluid may be injected between compressor stages 3026 and 3027 of a first compressor 3024. In some embodiments, after being throttled the hot water heat exchanger the working fluid may be a two-phase mixture. The two-phase mixture may be sufficiently mixed with a superheated vapor of a previous compressor stage.

The mixed fluid may then be superheated. When the output from the hot water heat exchanger 3022 is throttled by a valve and combined with a working fluid of the top cycle 3020 between compressor stages of the first and second compressor, the system may be configured to ensure that no liquid will be received through a compressor inlet. In an alternative embodiment, a condensed working fluid output by the hot water heat exchanger 3022 may be directly injected into an intercooler between a first compressor 3024 and a second compressor 3028 without being throttled through a valve. The generated hot water may have temperature of about 100° C. as described herein. In some embodiments, the hot water generator may receive a working fluid from an intercooler of the top cycle.

FIG. 31 illustrates an alternative embodiment of the steam generating system of FIG. 30. The steam generating system 3100 of FIG. 30 is capable of generating steam and/or hot water and comprises a top cycle 3120 and a bottom cycle 3110. The top cycle 3120 comprises a hot water heat exchanger 3122 in series with steam generator 3133. The hot water heat exchanger 3122 may receive a working fluid output from compressors 3123, wherein the working fluid is a high temperature vapor. The hot water heat exchanger 3122 may transfer the heat from the high temperature vapor and to a water stream to generate hot water. A condenser of the hot water heat exchanger 3122 may output a working fluid to a steam generator 3124. The working fluid output by the hot water heat exchanger may be a lower temperature vapor or a partially condensed two-phase fluid. The steam generator may transfer any remaining heat of the working fluid to a pressurized water stream to generate steam.

In some embodiments (not shown), the hot water heat exchanger 3122 may be downstream from a condenser of the steam generator 3124. The steam generator may receive a high temperature vapor stream from the compressors 3123, such that the steam generator transfers heat from the high temperature vapor to a pressurized water stream to generate steam. The condenser of the steam generator may then output a at least partially condensed working fluid (e.g., a two-phase mixture of vapor and liquid). The hot water heat exchanger 3122 may transfer any remaining heat from the partially condensed working fluid to a water stream to generate hot water and further condense the working fluid as described herein.

Figure 32:
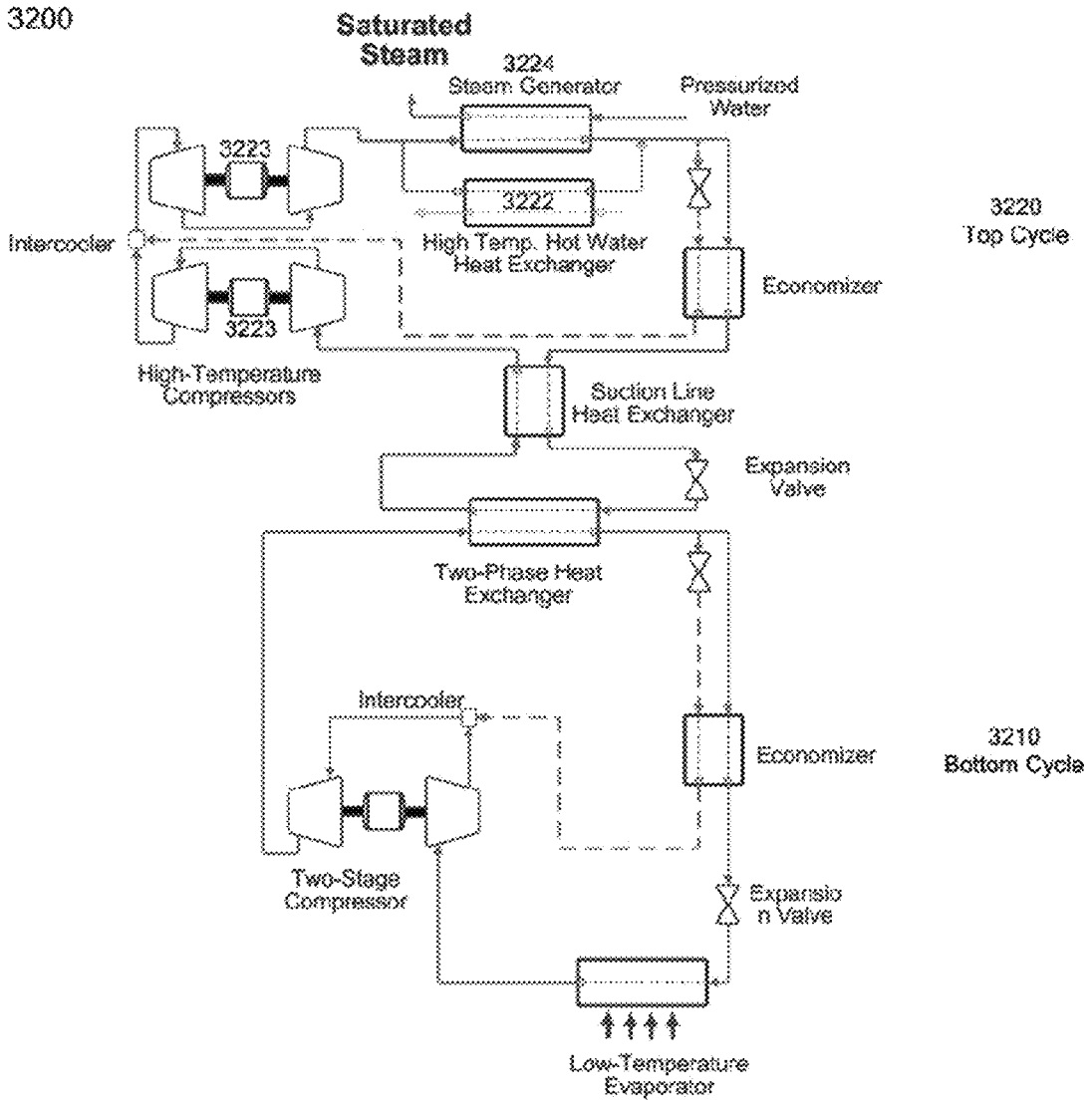

FIG. 32 illustrates an alternative embodiment of the steam generating system of FIG. 30. The steam generating system 3200 of FIG. 32 comprises a top cycle 3220 and a bottom cycle 3210. The top cycle comprises a hot water heat exchanger 3222 in parallel with a steam generator 3224. The hot water heat exchanger 3222 may receive a water stream and transfer heat from a portion of a working fluid stream from compressors 3223 to generate hot water. The steam generator 3224 may receive a remaining portion of the working fluid from the compressors 3223, wherein the steam generator transfers heat transfer heat from the remaining portion of the working fluid stream from compressors 3223 to generate steam. The working fluid from the compressors 3223 may be a high temperature vapor. The generated hot water or high temperature hot water is described herein.

Figure 33:
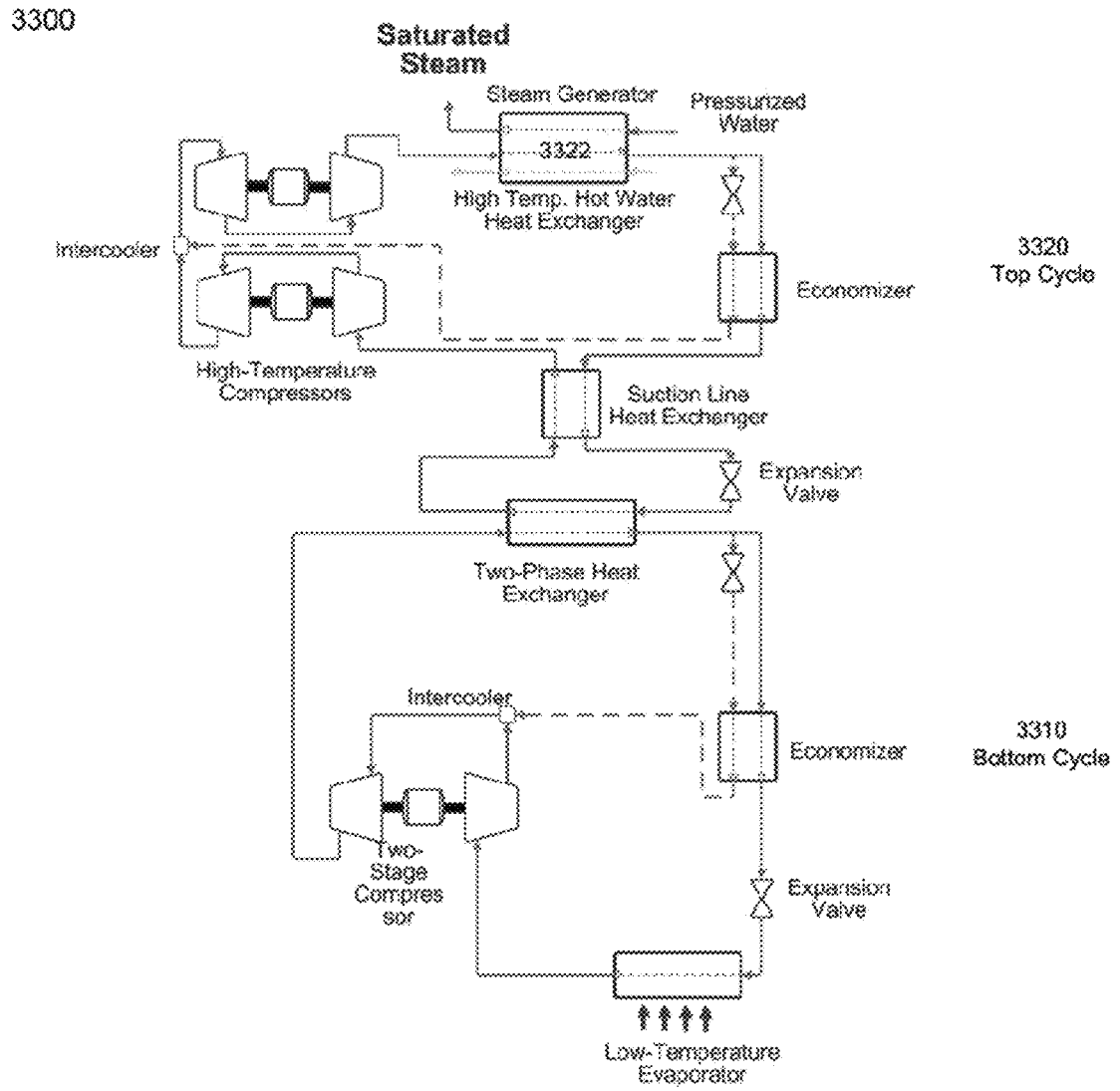

FIG. 33 illustrates an alternative embodiment of the steam generating system of FIG. 32 wherein the hot water heat exchanger and the steam generator are configured as a single, three fluid heat exchanger 3322 as described herein.

Figure 35:
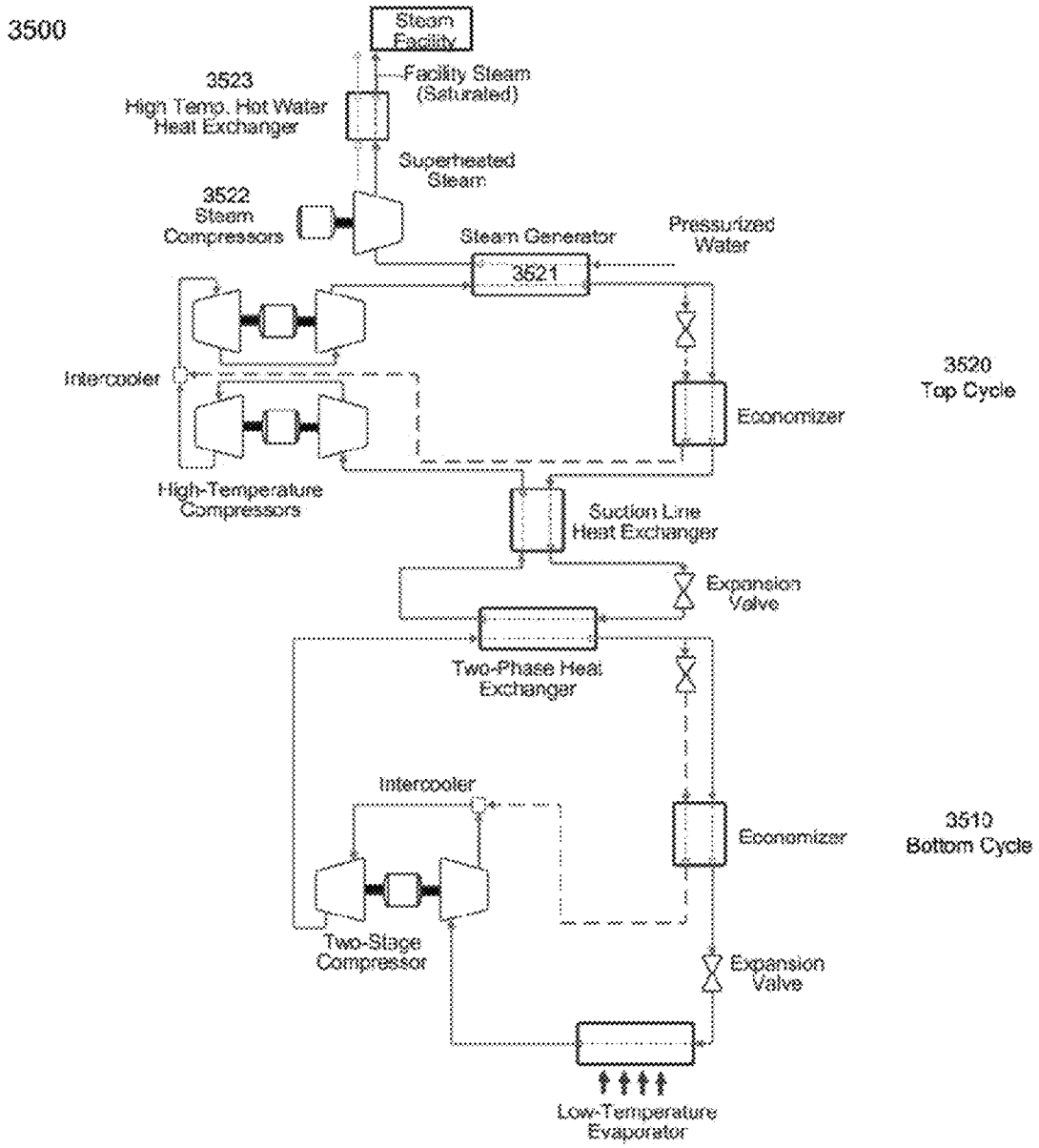

FIGS. 34-35 illustrate examples of a steam generating system in accordance with some embodiments described herein wherein the system is capable of generating steam and/or hot water in a top cycle. The steam generating system 3200 of FIG. 34 comprises a hot water heat exchanger 3422 and a steam generator 3421. The hot water heat exchanger 3422 is in parallel with a steam facility stream, wherein the hot water heat exchanger 3422 receives a portion of a steam stream generated from the steam generator 3421. The hot water heat exchanger 3422 may transfer heat from the portion of the steam stream to a water stream to generate hot water. The remaining portion of the steam stream generated by the steam generator 3421 is directed to a steam facility as described herein. Having the hot water heat exchanger 3422 in parallel to the steam facility allows for the steam facility stream to be a higher vapor quality than if the hot water heat exchanger was in series.

FIG. 35 illustrates an alternative embodiment of the steam generating system of FIG. 34. The system 3500 comprises a hot water heat exchanger 3522, a steam compressor 3523, and a steam generator 3521. The hot water heat exchanger 3522 is in series with a steam facility stream. The steam compressor 3523 is between the steam generator 3521 and the hot water heat exchanger 3522. The steam compressor 3523 superheats the steam generated by the steam generator 3521. The hot water heat exchanger 3522 may transfer some heat from the superheated steam to a water stream to generate hot water. The hot water heater outputs de-superheated steam. The de-superheated steam output by the hot water generator may then be delivered to a steam facility as described herein. The de-superheated steam may be saturated steam.

Figure 36:
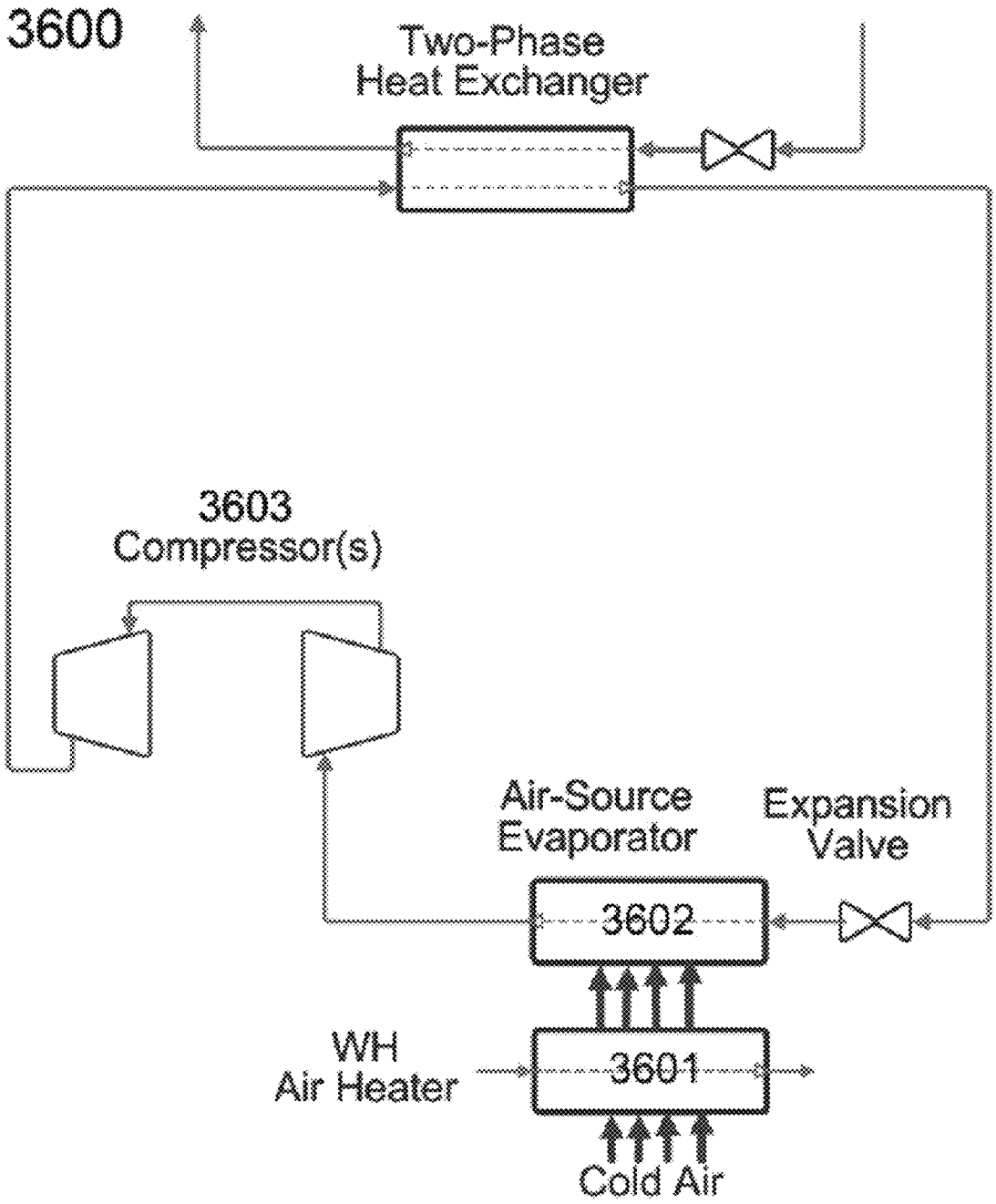
FIG. 36 illustrates an example of a heat pump cycle with an air heating element in accordance with some embodiments described herein.

FIG. 36 illustrates an example of a heat pump cycle in accordance with some embodiments described herein. The heat pump cycle 3600 in FIG. 36 comprises compressors 3603, a heat exchanger 3602 (e.g., an air-source evaporator) and a waste heat air heater 3601. The waste heat air heater may utilize waste heat from part of the heat pump cycle 3600 (e.g., from the compressors 3603) to heat air going into the air-source heat exchanger 3602 as described herein. Using a waste heat air heater 3601 as illustrated allows the air-source heat exchanger 3602 to maintain a higher working fluid saturation temperature and is easy to implement into a heat cycle.

Figure 37:
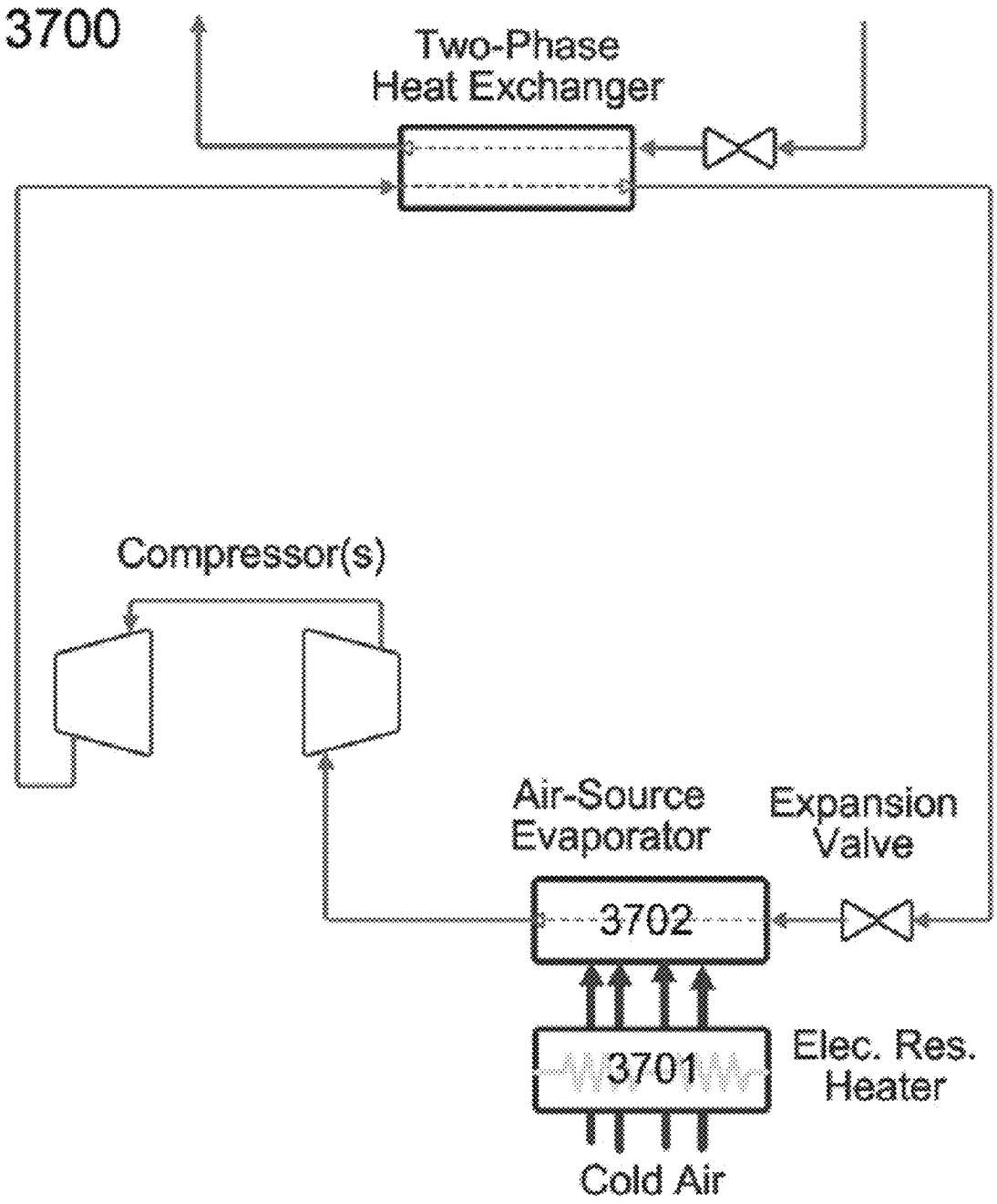
FIG. 37 illustrates an example of a heat pump cycle with an air heating element in accordance with some embodiments described herein.

FIG. 37 illustrates an example of a heat pump cycle in accordance with some embodiments described herein. The heat pump cycle 3700 in FIG. 37 comprises a heat exchanger 3702 (e.g., an air-source evaporator) and an electric resistance heater 3701. The electric resistance heater 3701 may heat air going into the air-source heat exchanger 3702. Using an electric resistance heater 3701 as illustrated allows the air-source heat exchanger 3702 to maintain a higher working fluid saturation temperature and is easy to implement into a heat cycle. In some embodiments, an electric resistance heater 3701 may be used when there is not sufficient waste heat to heat the air.

FIG. 38 illustrates an example of a heat pump cycle in accordance with some embodiments described herein. The heat pump cycle 3800 in FIG. 38 comprises a first heat pump cycle 3820 and a separate cycle 3810. The separate cycle 3910 may comprise a first heat exchanger 3811 (e.g., an air-source evaporator) and a second heat exchanger 3812. The first heat pump cycle 3820 may comprise a heat exchanger 3821 (e.g., an evaporator). The first heat pump cycle 3820 may be coupled to the separate cycle 3810 by an intermediate loop 3830. The second heat exchanger of the separate cycle may transfer heat from a working fluid of the separate cycle to an intermediate fluid (e.g., glycol, water, etc.). The intermediate loop 3830 may then be coupled to the first heat cycle 3810 by the heat exchanger 3821. The heat exchanger 3821 may transfer heat from the intermediate fluid to a working fluid of the first heat pump cycle. In some embodiments, the first heat pump cycle may be a bottom cycle and the separate cycle 3810 may be a bottoming cycle as described herein. The bottoming cycle may be used in extreme cold weather cases to deliver cool water to a bottom cycle of a steam generating system.

FIG. 39 illustrates an example of a heat pump cycle in accordance with some embodiments described herein. The heat pump cycle 3900 in FIG. 39 comprises a first heat pump cycle 3920 and a separate cycle 3910. The separate cycle 3910 may comprise a first heat exchanger 3911 (e.g., an air-source evaporator). The first heat pump cycle 3920 may comprise a heat exchanger 3921 (e.g., an evaporator). The first heat pump cycle 3920 may be directly coupled to the separate cycle 3810 by heat exchanger 3921. In some embodiments, the first heat pump cycle may be a bottom cycle and the separate cycle 3810 may be a bottoming cycle as described herein. The bottoming cycle may be used in cold weather cases to deliver cool water to a bottom cycle of a steam generating system.

Figure 40A:
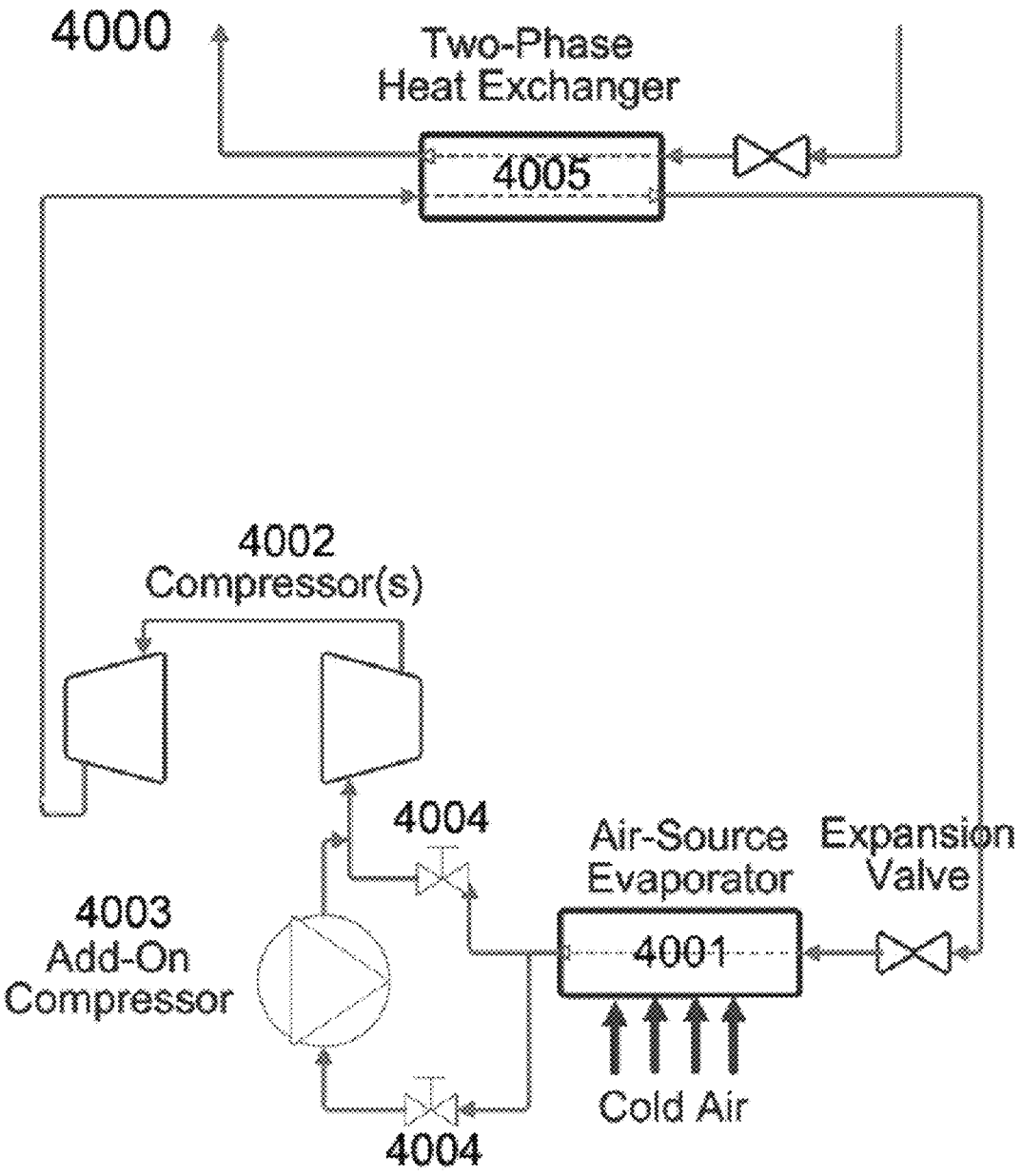
FIG. 40A illustrates an example of a heat pump cycle comprising an add-on compressor in accordance with some embodiments described herein.

FIG. 40A illustrates an example of a heat pump cycle in accordance with some embodiments described herein. The heat pump cycle 4000 in FIG. 40A comprises main compressors (e.g., centrifugal compressors) 4002 in the heat pump cycle between a heat exchanger (e.g., an air-source evaporator) 4001 and a two-phase heat exchanger 4005. The heat pump cycle 4000 further comprises an add-on compressor and valves 4004. The add-on compressor 4003 may help maintain constant suction pressure in the main compressor (e.g., centrifugal compressors) 4002. The valves 4004 are configured to control the flow of a working fluid of the cycle. The valves 4004 may isolate the add-on compressor 4003 when no further lift is required. The valves 4004 may direct the working fluid to the add-on compressor and the centrifugal compressors 4002 when the main compressors are not providing sufficient lift to the working fluid as described herein. In some embodiments the add-on compressor 4003 is added to a bottom cycle (as shown). In some embodiments the add-on compressor 4003 is added to a top cycle (not shown) in a similar manner as illustrated in FIG. 40A. In some embodiments, when a saturation temperature/heat delivery temperature of a top and/or bottom cycle drops due to cold weather or other operational changes, an add-on compressor may be integrated into the cycle to maintain the cycle's main compressors at relatively constant operating conditions.

Figure 40D:
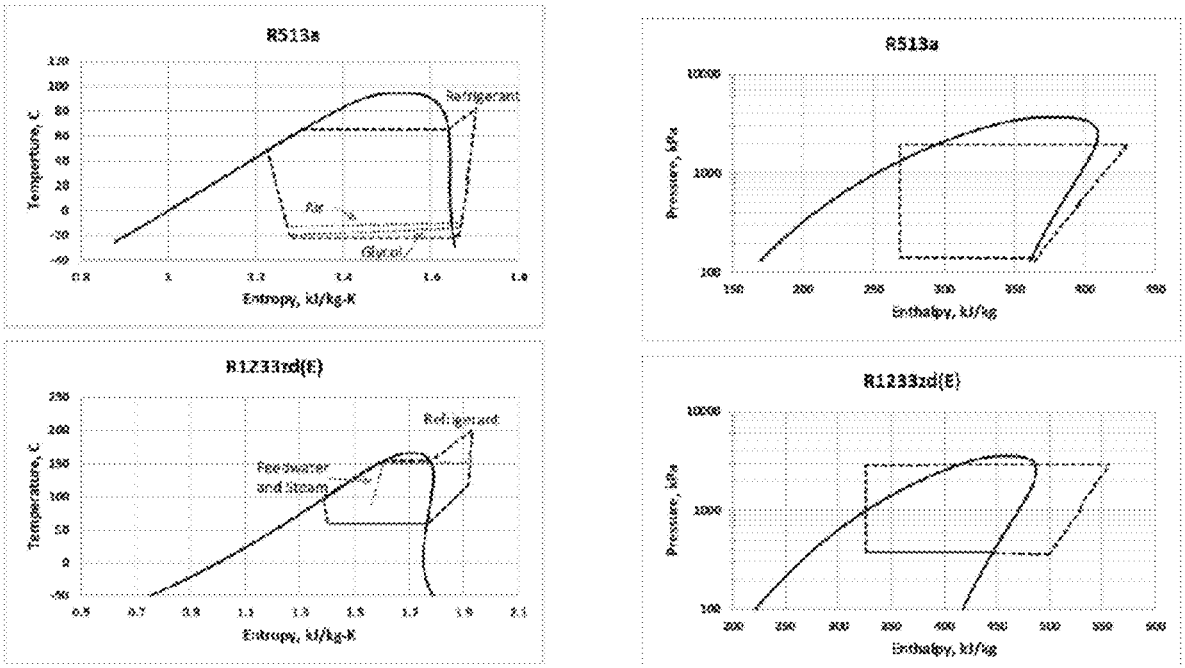
Figure 40F:
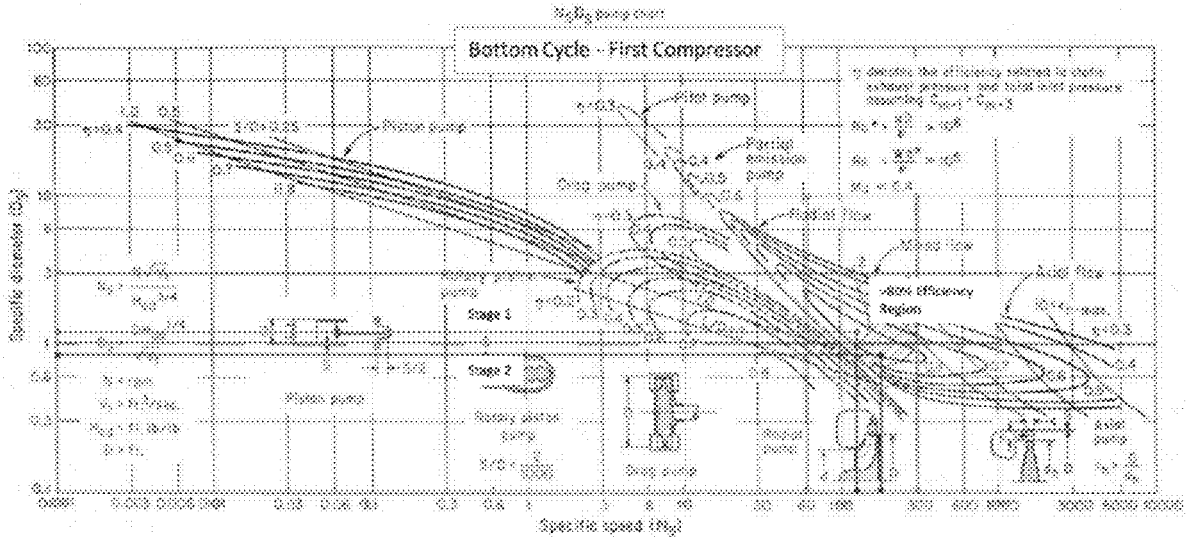

FIGS. 40B-F illustrate an operational example for the steam generating system in FIG. 16 with the addition of add-on compressors as shown in FIG. 40A. FIGS. 40B-C are tables showing the parameters of the system and their operation values given a set of example constraints (e.g., inlet air temperature, steam duty). Notably, the % Carnot is greater than 50%, even at an ambient air temperature of less than −10° C. FIG. 40D illustrates the thermodynamic curves of the bottom heat pump cycle using R513a and the top heat pump cycle using R1233zd(E). FIG. 40E is a table showing the specific speed (Ns) and specific diameter (Ds) of the add-on compressor. Notably, all of the compressors are operating at less than 30,000 RPM and the impeller diameters are between 3 inches and 6 inches. FIG. 40F is an NsDs graph showing the region in which greater than 80% efficiency of the add-on compressor can be achieved.

Figure 41:
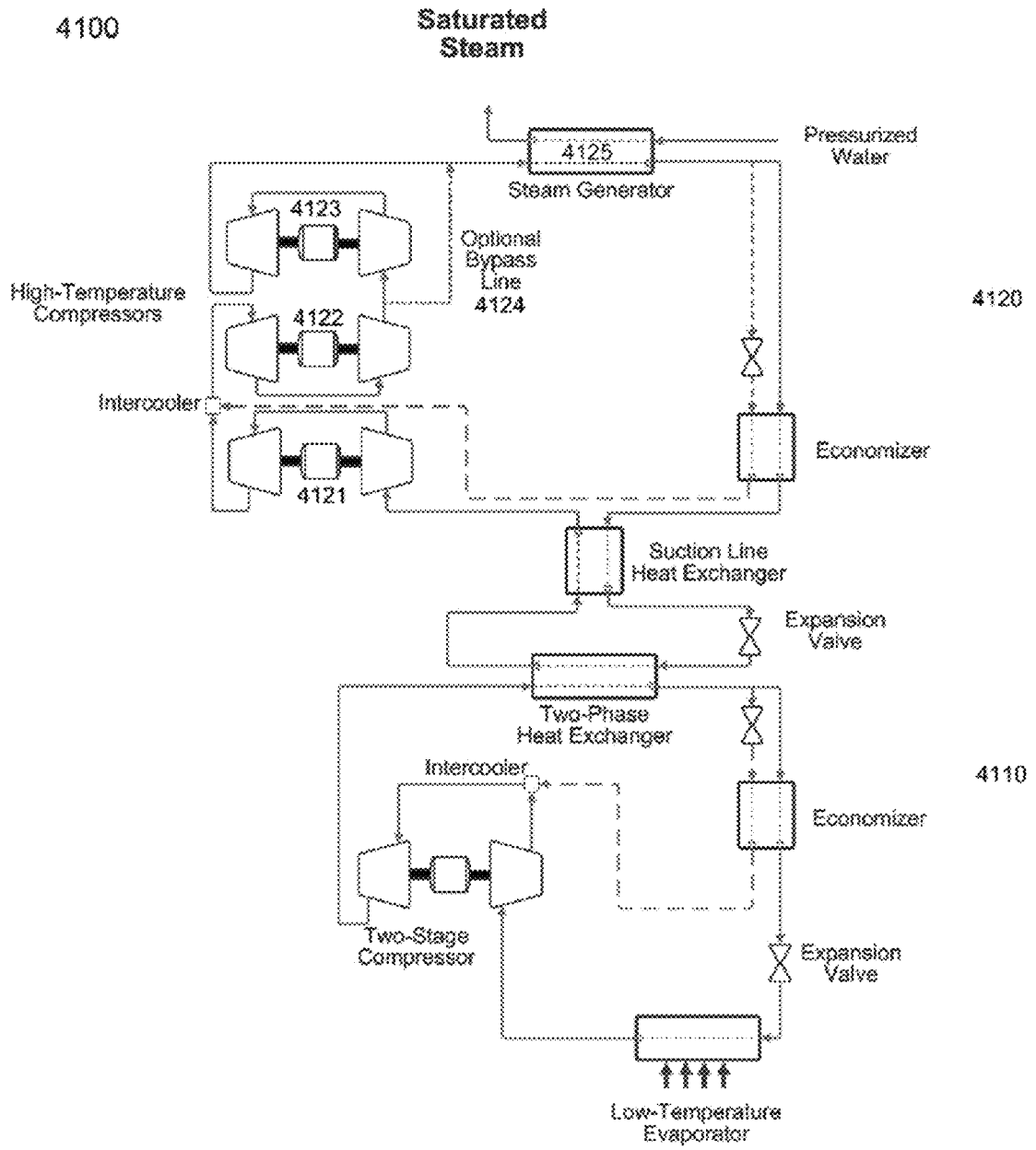
FIG. 41 illustrate examples of a steam generating system in accordance with some embodiments described herein.

FIG. 41 illustrates an example of a steam generating system in accordance with some embodiments described herein. The steam generating system 4100 of FIG. 41 comprises a top cycle 4120, a bottom cycle 4110. The top cycle comprises a first compressor 4121, a second compressor 4122, a third compressor 4123, and a steam generator 4125. The steam generator 4125 may receive a working fluid (e.g., a high temperature vapor) output by the third compressor 4123. The top cycle 4120 may further comprise an optional bypass line 4124. The optional bypass line may connect the steam generator 4125 to an intermediate stage between two compressors, such as between the second compressor 4122 and the third compressor 4123. The optional bypass line 4124 and isolation valve (not shown) may allow the top cycle 4120 to shut off one or more unnecessary compressor stages to maintain operations at optimal efficiency or the optional bypass line 4124 and isolation valve may allow one or more additional compressor to be turned on to overcome losses due to operational losses or cold weather as described herein.

FIG. 42 illustrates an example of a steam generating system in accordance with some embodiments described herein. The steam generating system 4200 of FIG. 42 comprises a top cycle 4220, a bottom cycle 4210. The top cycle comprises a first compressor stage 4221, a second compressor stage 4222, a third compressor stage 4223, and a steam generator 4224. A first compressor of the first compressor stage 4221 may receive a subcritical working fluid. A second compressor of the second compressor stage 4222 may receive a subcritical fluid from the first compression stage 4221. The second compressor of the second compressor stage 4222 may output a first supercritical fluid to the steam generator 4125. The steam generator 4125 transfers heat from the first supercritical fluid to a pressurized water stream to generate steam. The steam generator 4224 may then output a working fluid to a third compressor of the third compressor stage 4223. The third compressor of the third compressor stage 4223 may output a second supercritical fluid to the steam generator 4224. The steam generator 4224 transfers heat from the second supercritical fluid to a pressurized water stream to generate steam. The steam generator 4224 may be a single device, or multiple separate devices in series and/or in parallel. In some embodiments, an intercooler and/or an economizer (not shown) may be part of the top cycle 4220. The economizer/intercooler line should circulate a subcritical working fluid, and therefore should be located at an intermediate pressure between non-supercritical compressors (e.g., after stage 1 or 2 of a first compressor) as described herein. In alternative embodiments (not shown), the steam generator may be multiple heat exchangers configured to operate in series or in parallel. The benefits of multiple heat exchangers operating in parallel may include ability to generate steam at different pressures and temperatures (e.g., a 150° C. stream after two compressors and a 180° C. stream after the third compressor).

Figure 81:
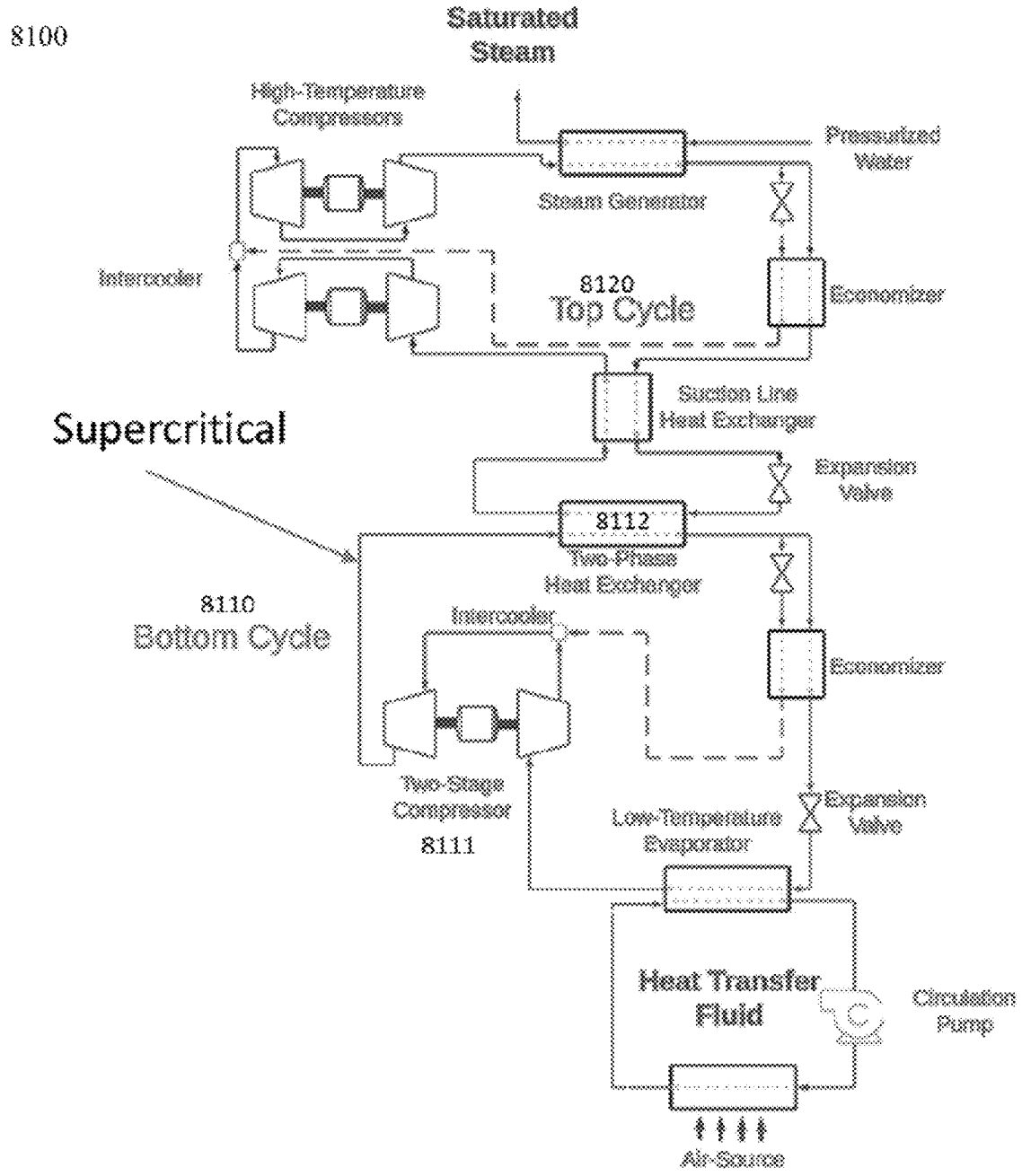
FIG. 81 illustrates an example of a steam generating system configured to generate a supercritical fluid in accordance with some embodiments described herein.

FIG. 81 illustrates an example of a steam generating system in accordance with some embodiments described herein. The steam generating system 8100 of FIG. 81 comprises a top cycle 8120 and a bottom cycle 8110. The bottom cycle comprises a compressor 8111 and a heat exchanger 8112. The compressor 8111 may output a supercritical fluid to the heat exchanger 8112. The heat exchanger 8112 transfers heat from the supercritical fluid to a working fluid of the top cycle 8120. In some embodiments, an intercooler and/or an economizer may be part of the bottom cycle 8110. The economizer/intercooler line should circulate a subcritical working fluid, and therefore should be located at an intermediate pressure.

Figure 43:
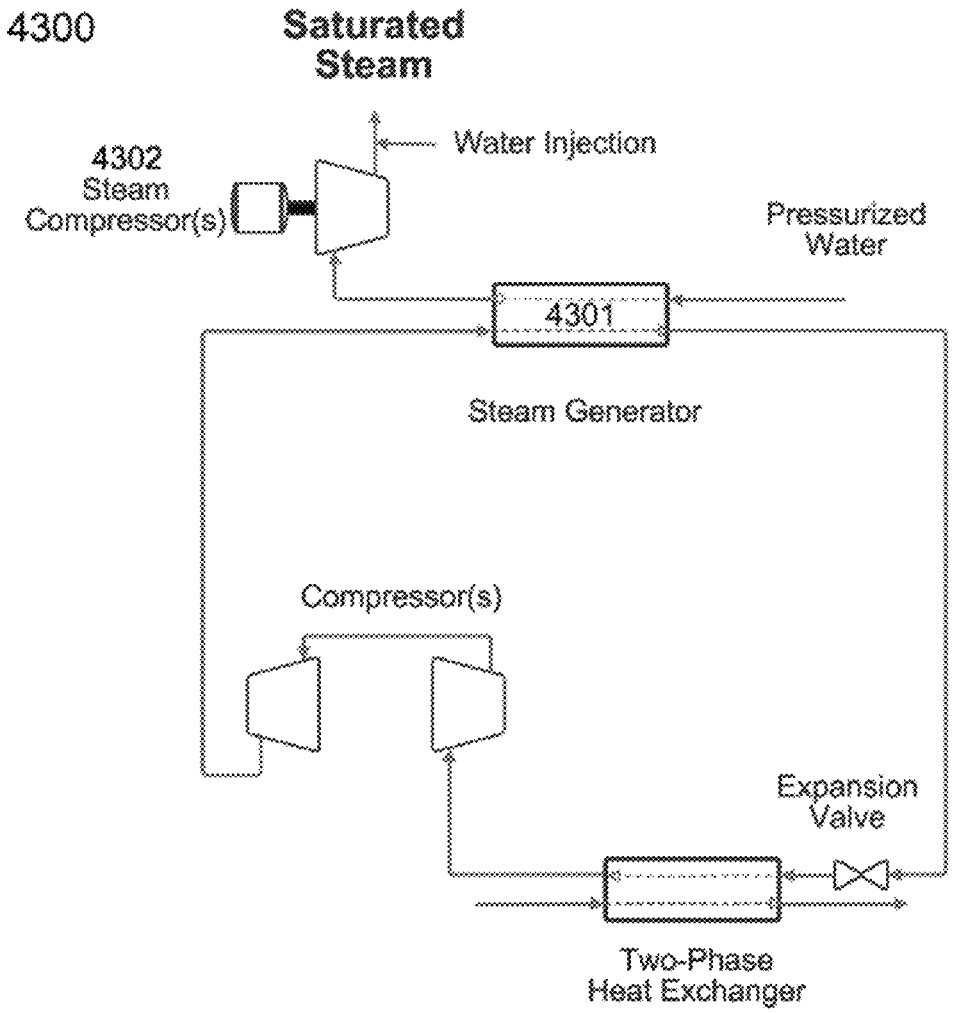
FIG. 43 illustrates an example of a heat pump cycle comprising a steam compressor in accordance with some embodiments described herein.

FIG. 43 illustrates an example of a heat pump cycle in accordance with some embodiments described herein. The heat pump cycle 4300 in FIG. 43 comprises a heat exchanger 4301 (e.g., a steam generator). In some embodiments, the steam generated by the heat exchanger 4301 is received by steam compressors 4302. The steam compressor(s) may be used to make up for a loss of heat pump steam delivery pressure during cold weather operation as described herein. When an ambient temperature is cold, the saturation point in the bottom cycle evaporator is reduced. This may cause the steam delivery temperature to be reduced from about 200° C., 175° C., 150° C., 125° C., or 100° C., or lower down to about 150° C., 130° C., 120° C., 110° C., 100° C., or lower. The steam delivery temperature may be reduced from a temperature between any two values described herein. The steam delivery temperature may be reduced to a temperature between any two values described herein. The steam compressor(s) 4302 can be used to increase the steam temperature back up to the facility demand. A water injection may be used in-side and/or downstream of the steam compressors 4302 to de-superheat the steam. This increases the steam delivery flow rate of a steam generating system.

Figure 91:
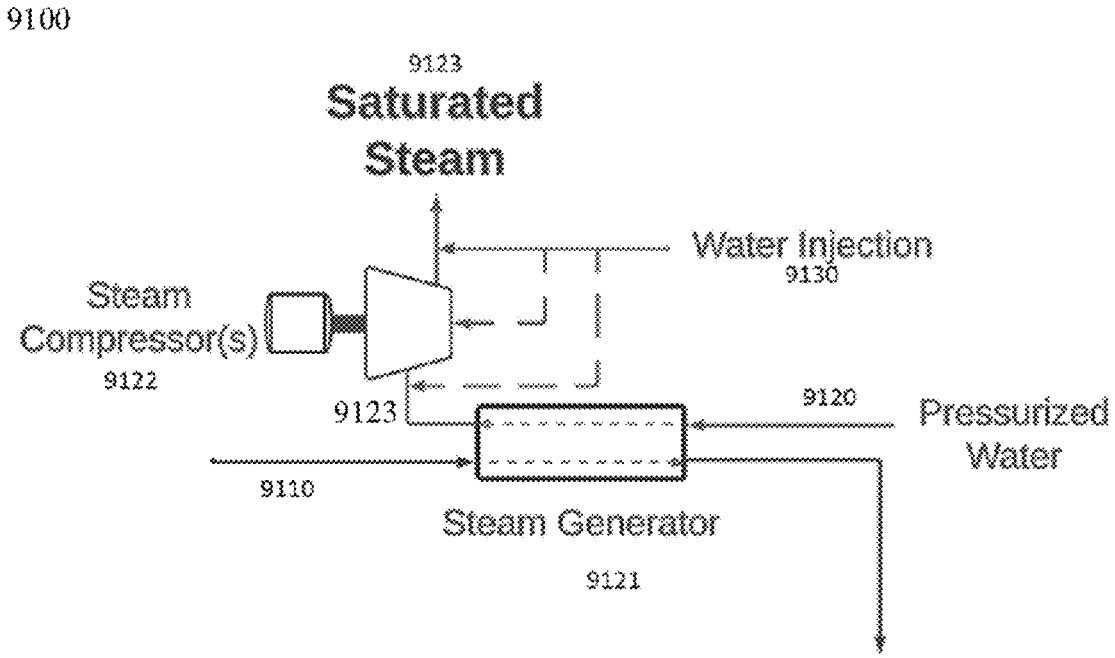
FIGS. 91-92 illustrate examples of steam generating systems with steam compressors in accordance with some embodiments described herein.

FIG. 91 illustrates an example of a steam generating system in accordance with some embodiments described herein. The steam generating system 9100 in FIG. 91 comprises a top cycle 9110, a working fluid stream 9120, and a steam generator 9121. The working fluid stream 9120 enters the steam generator 9121 as pressurized water and exits as saturated steam 9123. The working fluid stream 9120 comprises a steam compressor 9122. The steam compressor 9122 may be configured to increase the pressure of the output water or steam 9123 (thereby increasing the temperature). One or more water streams 9130 may be injected into the working fluid stream 9120 upstream of, into, or downstream of the steam compressor 9122. The injections of the working fluid stream upstream of or into the steam compressor 9122 may enable use of more commercial equipment (e.g., steam compressors, valve around the steam compressors, or seals) as the steam compressor will operate at a lower temperature.

Figure 92:
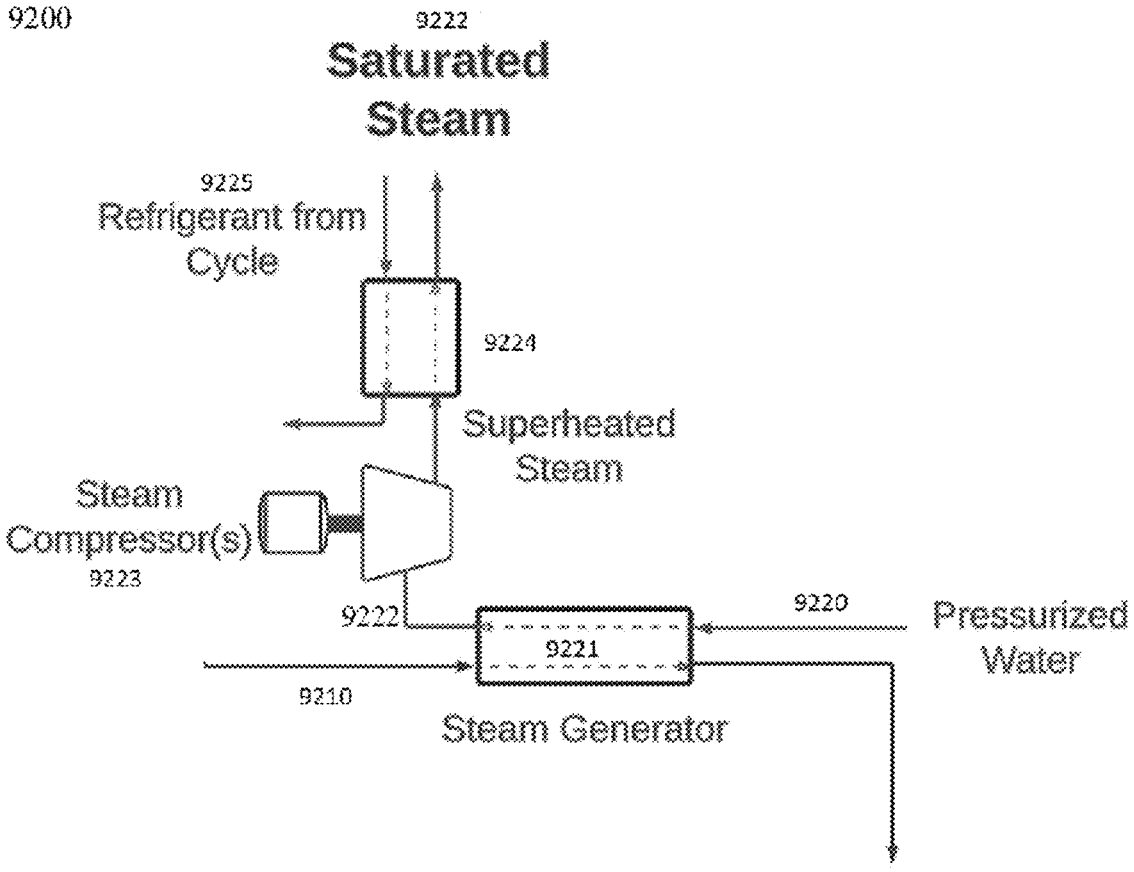

FIG. 92 illustrates an example of a steam generating system in accordance with some embodiments described herein. The steam generating system 9200 in FIG. 92 comprises a top cycle 9210, a working fluid stream 9220, and a steam generator 9221. The working fluid stream 9220 enters the steam generator 9221 as pressurized water and exits as saturated steam. The working fluid stream 9220 comprises a steam compressor 9223. The steam compressor 9223 may be configured to increase the pressure of the steam (thereby increasing the temperature). The working fluid stream 9220 may further comprise a heat exchanger 9224 which uses refrigerant 9225 from another location in the system to cool the stream 9222. Alternatively, the heat exchanger 9224 may use a different heat transfer fluid (e.g., glycol from the bottom heat pump cycle). In alternative embodiments (not shown), the heat exchanger may be located downstream or within the compressor. The benefits of the heat exchanger may include the benefits as described herein for water injection.

FIG. 44 illustrates an example of a steam generating system in accordance with some embodiments described herein. The steam generating system 4400 of FIG. 44 comprises a top cycle 4420, a bottom cycle 4410 and a topping cycle 4430. The topping cycle may comprise a heat exchanger 4432 (e.g., a steam generator) a compressor 4431 and an expansion valve 4433 as described herein. The topping cycle may be coupled to the top cycle 4420 by a two-phase heat exchanger 4421. The topping cycle 4430 may circulate a working fluid comprising a hydrocarbon, a natural fluid, an exotic fluid, a supercritical fluid, and/or another working fluid described herein to achieve higher steam delivery temperatures and/or to deal with cold weather.

FIG. 45 illustrates an example of a steam generating system in accordance with some embodiments described herein. The steam generating system 4500 of FIG. 45 comprises a top cycle 4520, a bottom cycle 4510 and a topping cycle 4530 (as illustrated in FIG. 44). The topping cycle may comprise a heat exchanger 4532 (e.g., a steam generator) a compressor and an expansion valve. The topping cycle may be coupled to the top cycle 4520 by a two-phase heat exchanger 4521. The top cycle 4520 may further comprise a steam generator 4522 upstream from the two-phase heat exchanger 4521. The topping cycle may be turned on when where is a need for additional heat and/or pressure for generating steam. The topping cycle may be turned on in response to cold weather and/or elevated steam pressure demand. The topping cycle 4530 may circulate a working fluid comprising a hydrocarbon, a natural fluid, an exotic fluid, a supercritical fluid, or another working fluid described herein to achieve higher steam delivery temperatures and/or to deal with cold weather. In some embodiments, the system 4500 may comprise one or more topping cycles. The topping cycles may be configured to generate steam and hot water or steam at multiple pressures as described herein.

Figure 46:
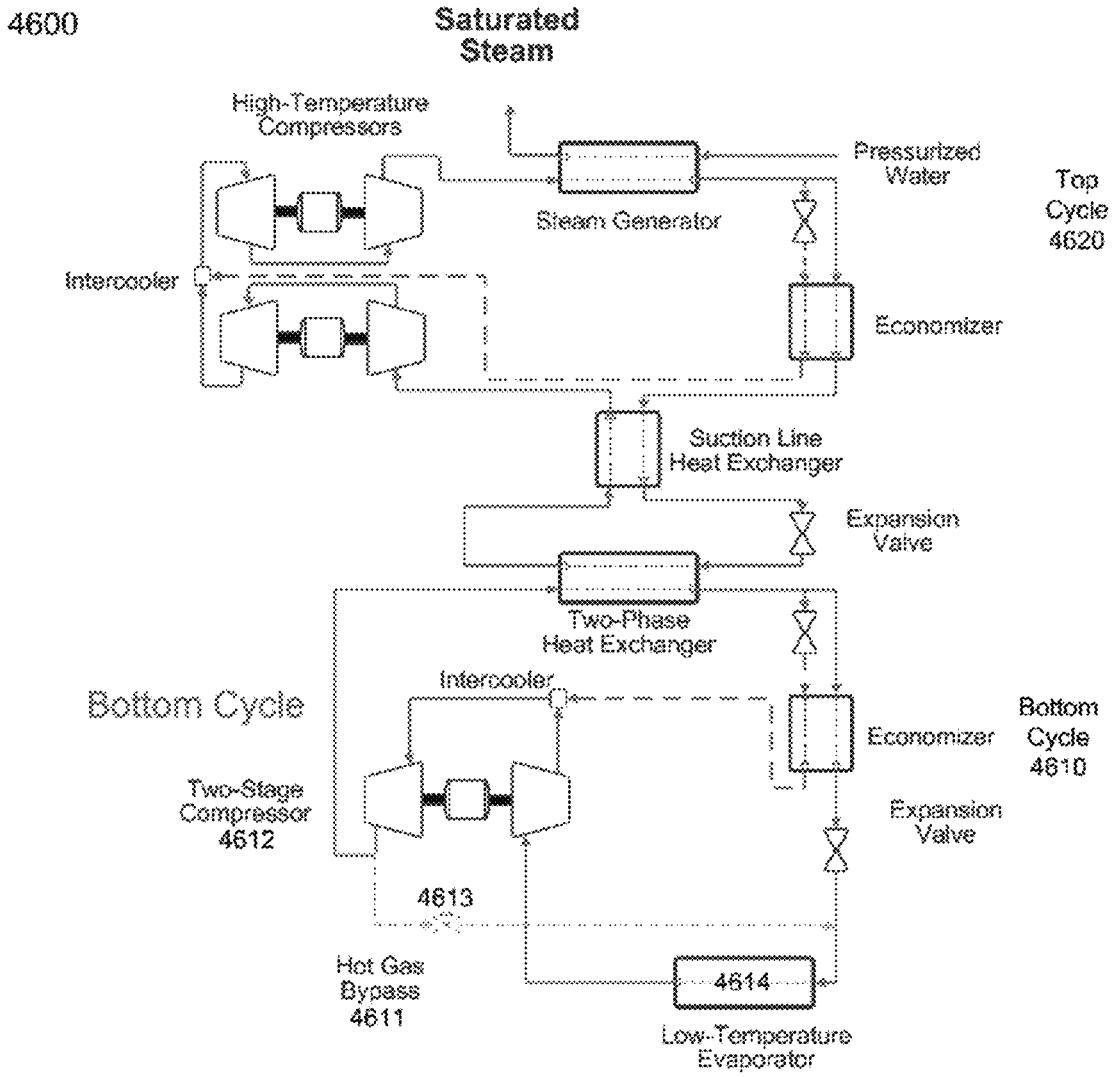
FIGS. 46-47 illustrate examples of a steam generating system comprising bypass lines in accordance with some embodiments described herein.

FIG. 46 illustrates an example of a steam generating system in accordance with some embodiments described herein. The steam generating system 4600 of FIG. 46 comprises a top cycle 4620 and a bottom cycle 4610. The bottom cycle comprises a hot gas bypass line 4611. The hot gas bypass line 4611 is configured to receive a working fluid (e.g., a hot gas) from a compressor 4612. The hot gas bypass line 4611 comprises a valve 4613 configured to turn on and off the hot gas bypass line 4611. The hot gas bypass line 4611 may be turned on to deliver a working fluid to a heat exchanger 4614 (e.g., a low temperature evaporator) to defrost the coils of the evaporator. The hot gas bypass line 4611 may be turned on to defrost and evaporator during cold weather as described herein.

Figure 47:
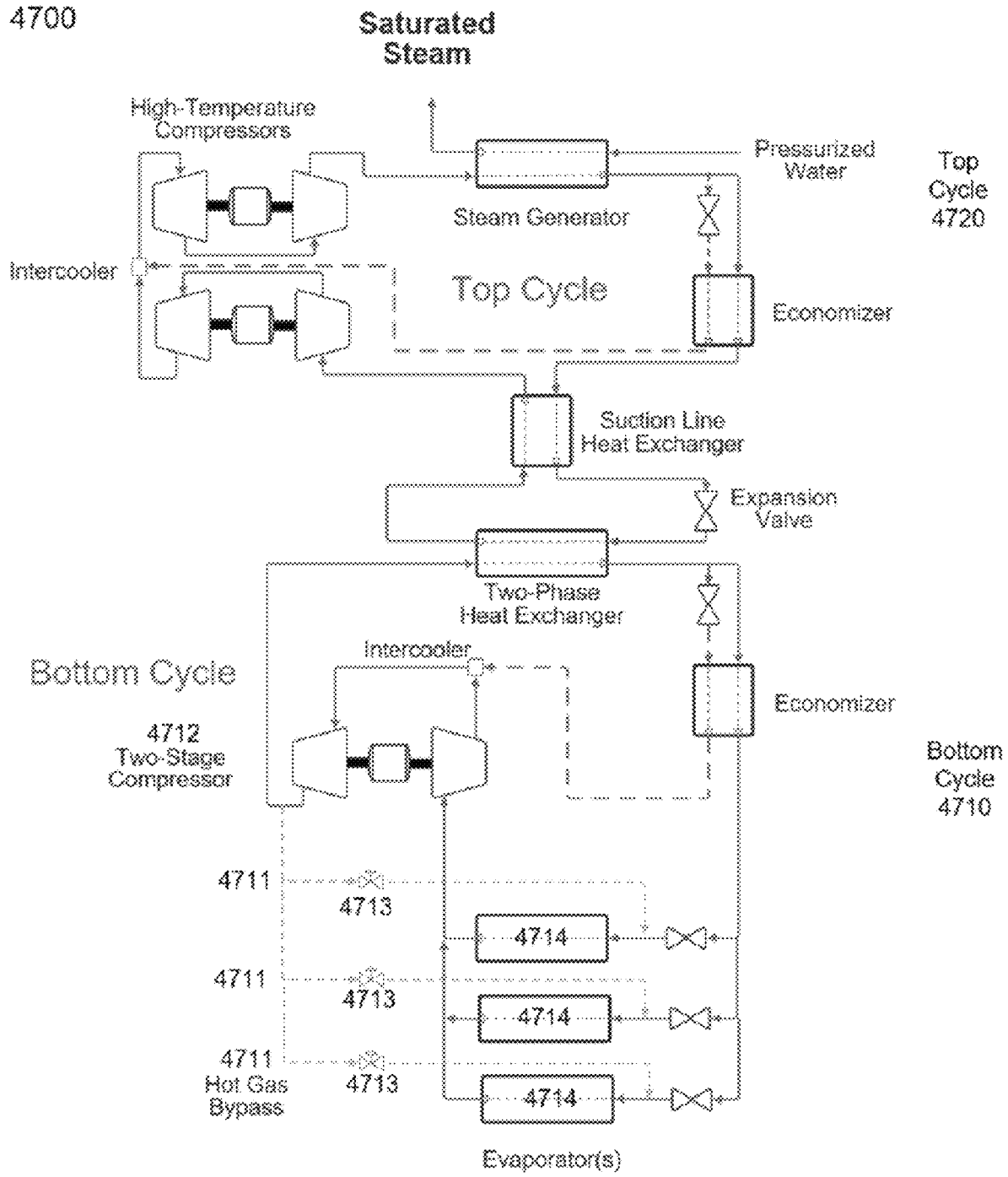

FIG. 47 illustrates an alternative embodiment of the steam generating system of FIG. 46. The system 4700 comprises a top cycle 4720 and a bottom cycle 4710. The bottom cycle comprises multiple hot gas bypass line 4711 configured in parallel. The hot gas bypass lines 4711 are configured to receive a working fluid (e.g., a hot gas) from a compressor 4712. The hot gas bypass lines 4711 comprise a valve 4713 configured to turn on and off the hot gas bypass lines 4611. The hot gas bypass lines 4611 may be turned on to deliver a working fluid to heat exchangers 4614 (e.g., evaporator) configured in series. The hot gas bypass lines 4611 may deliver the working fluid form the compressor 4712 to defrost the coils of the evaporators 4714 as described herein. The hot gas bypass line 4611 may be turned on to defrost and evaporator during cold weather and be operated independently from each other.

FIG. 48 illustrates an example of a steam generating system in accordance with some embodiments described herein. The steam generating system 4800 of FIG. 48 comprises a top cycle 4820 and a bottom cycle 4810. The bottom cycle 4810 comprises a two-phase heat exchanger 4815, a low temperature heat exchanger 4811, a cooler/recondenser 4813, a first valve 4812 (e.g., an expansion valve), and a second valve (e.g., an expansion valve) 4814. The first valve 4812 may be configured to receive a working fluid from the two-phase heat exchanger 4815. The first valve 4812 may partially expand the working fluid to an intermediate pressure between the two-phase heat exchanger and the low-temperature evaporator. The cooler/recondenser 4813 may be located between the first valve 4812 and the second valve 4814. The cooler/recondenser 4813 may then recondense and/or subcool the partially expanded working fluid output by the first expansion valve 4812 and deliver the condensed working fluid to low temperature heat exchanger 4811. The system 4800 may operate as described herein.

FIG. 49 illustrates an example of a heat pump cycle in accordance with some embodiments described herein. The heat pump cycle 4900 in FIG. 49 comprises a heat exchanger 4902 (e.g., an air-source evaporator) and an electric resistance heater 4901. The electric resistance heater 4901 may heat air going into the air-source heat exchanger 4902. Using an electric resistance heater 4901 as illustrated allows the air-source heat exchanger 4902 to maintain a higher working fluid saturation temperature and is easy to implement into a heat cycle. In some embodiments, an electric resistance heater 4901 may be used when there is not sufficient waste heat to heat the air.

FIG. 50 illustrates an alternative embodiment of the steam generating system of FIG. 49. The heat pump cycle 5000 of FIG. 50 comprises a heat exchanger 5001 (e.g., an air-source evaporator) wherein an electric resistance heater is wrapped directly around the coils of the heat exchanger 5001. Using an electric resistance heater may help maintain a higher working fluid saturation temperature and is easy to implement into a heat cycle. In some embodiments, an electric resistance heater 4901 may be used when there is not sufficient waste heat to heat the air as described herein.

In some embodiments, an electric resistance heater may be used for an air-source heat exchanger of an intermediate loop (e.g., a glycol loop) and/or cycle (e.g., a heat transfer cycle).

Figure 51:
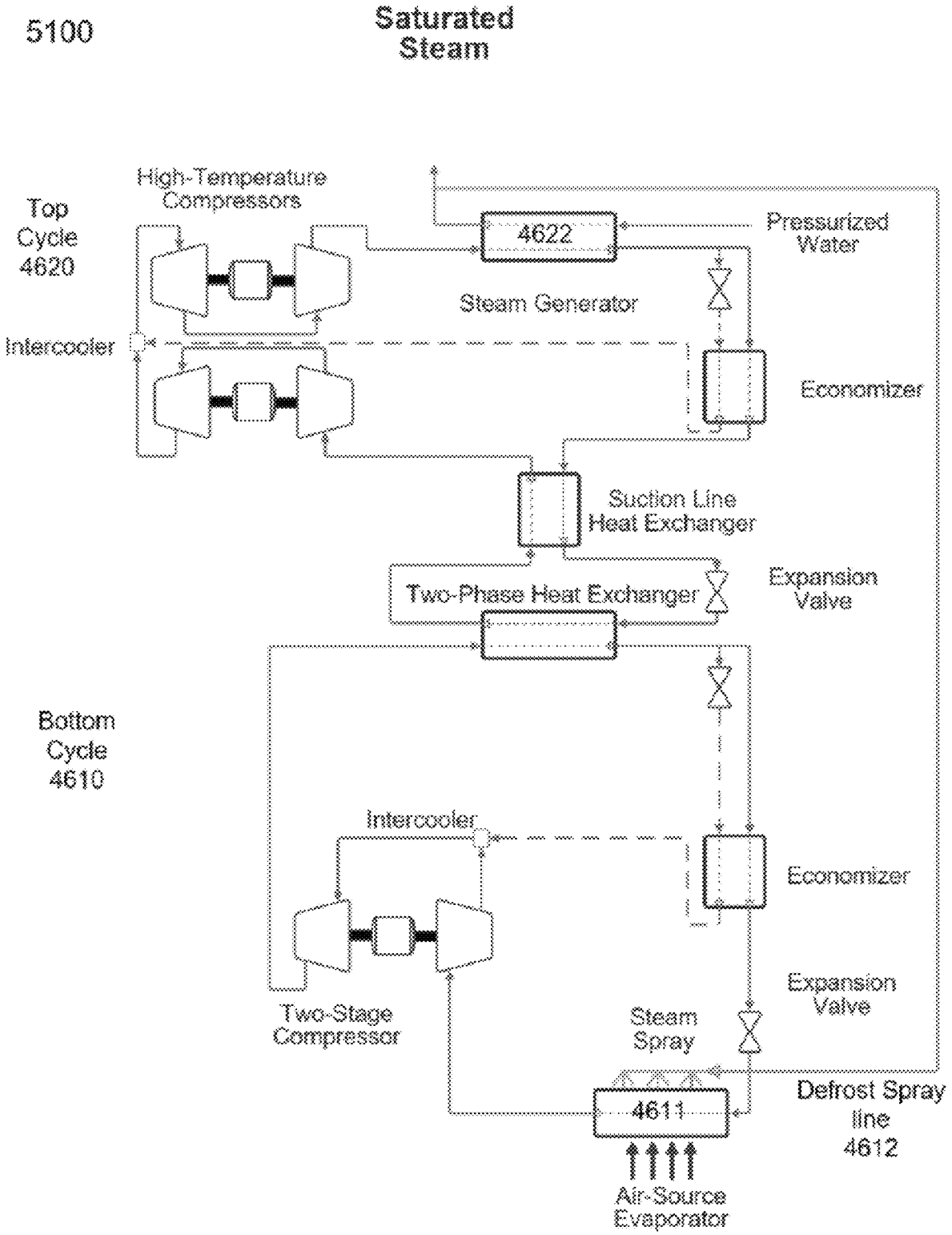
FIGS. 51-53 illustrate examples of a steam generating system comprising a defrost spray line in accordance with some embodiments described herein.
Figure 52:
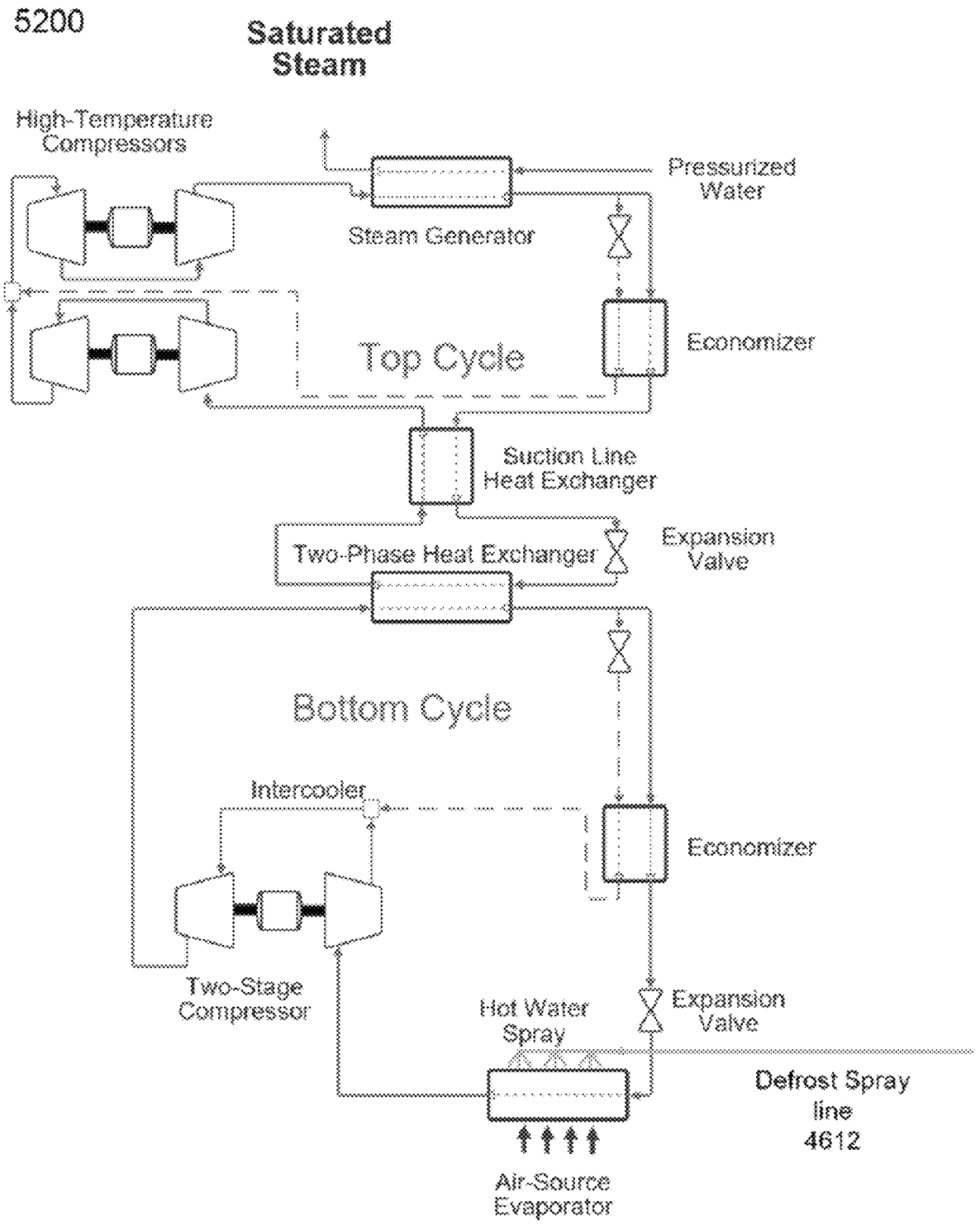
Figure 53:
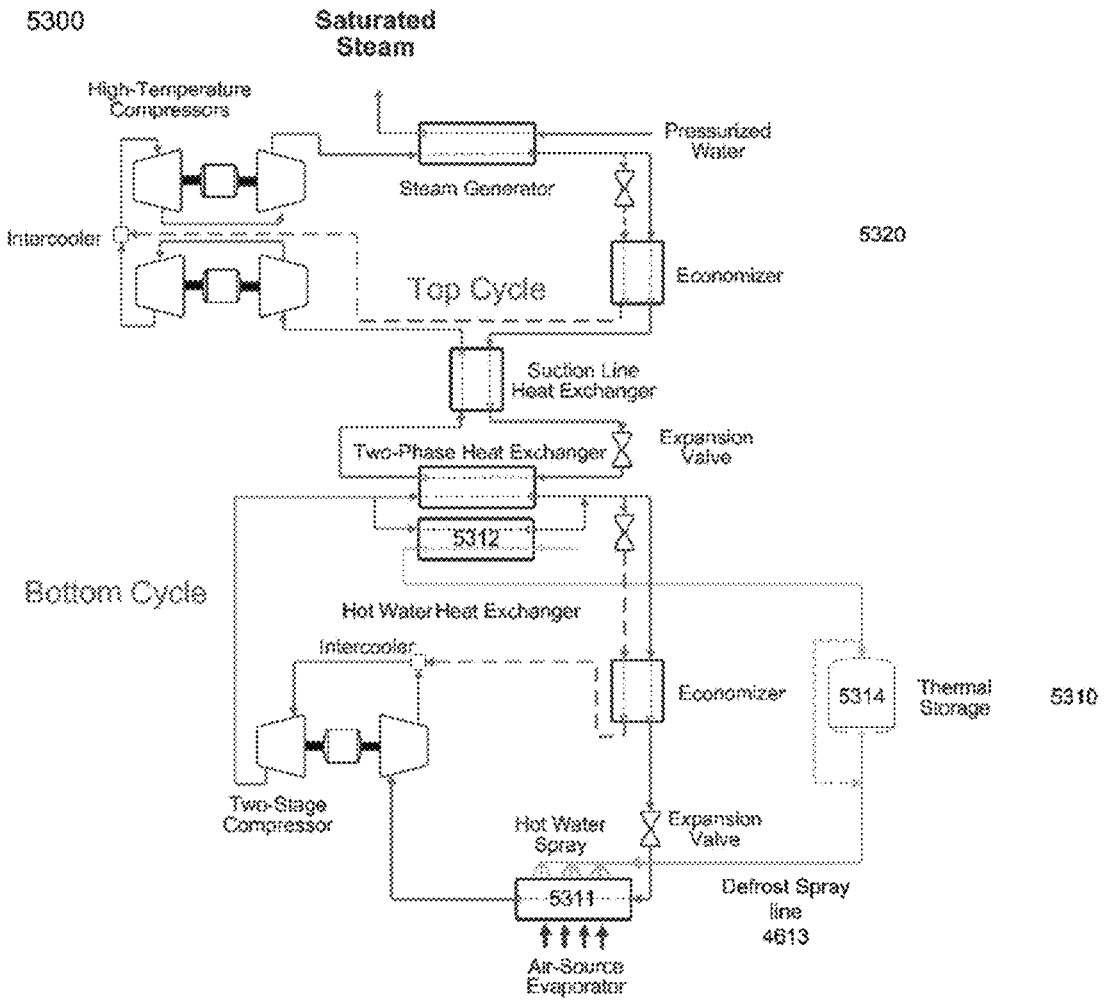

FIGS. 51-53 show examples of a steam generating system in accordance with some embodiments described herein. The system 5100 comprises a top cycle 5120 and a bottom cycle 5110. The system further comprises a defrost spray line 5112, wherein the defrost spray line 5112 receives a portion of the steam generated by the steam generator 5122 and delivers it to a heat exchanger 5111 (e.g., an air-source heat exchanger). The delivered steam may be used to defrost the coil of the heat exchanger 5111 as described herein.

FIG. 52 illustrates an alternative embodiment of the steam generating system of FIG. 51. The system 5200 comprises a top cycle 5220 and a bottom cycle 5210. The system further comprises a defrost spray line 5212, wherein the defrost spray line 5212 receives hot water from a facility and delivers it to a heat exchanger 5211 (e.g., an air-source heat exchanger). The delivered steam may be used to defrost the coil of the heat exchanger 5211 as described herein.

FIG. 53 illustrates an alternative embodiment of the steam generating system of FIG. 51. The system 5300 comprises a top cycle 5320 and a bottom cycle 5310. The system further comprises a defrost spray line 5313, wherein the defrost spray line 5313 receives hot water from a hot water heat exchanger 5312 of the bottom cycle 5310 and delivers it to a heat exchanger 5311 (e.g., an air-source heat exchanger). The delivered steam may be used to defrost the coil of the heat exchanger 5311. The defrost spray line 5313 may further comprise a thermal storage unit 5314 as described herein. The thermal storage unit may be used to generate the hot water during peak efficient periods (e.g., during the day) and then released during cold weather (e.g., night).

Figure 54:
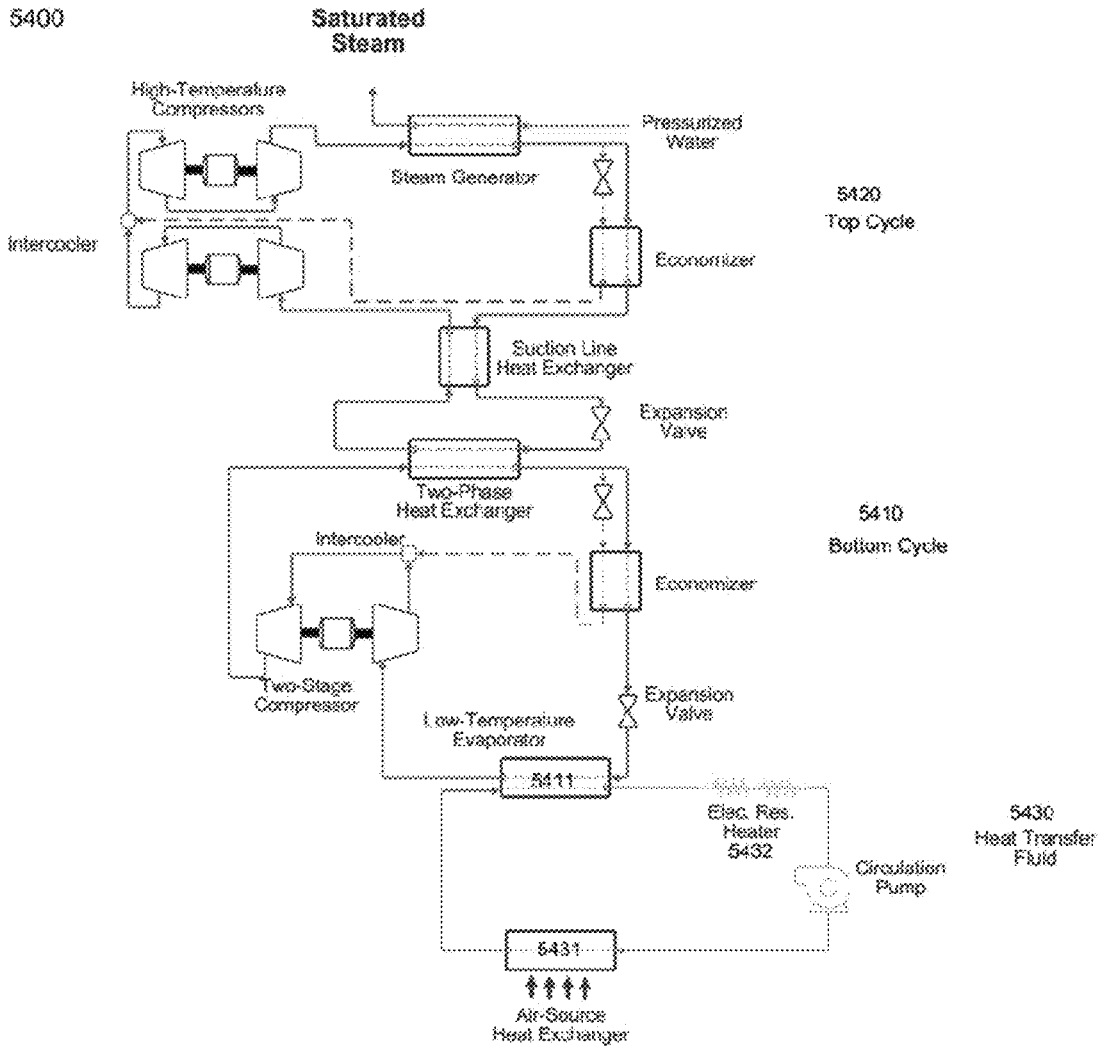
FIGS. 54-56 illustrate examples of steam generating systems in accordance with some embodiments described herein.
Figure 55:
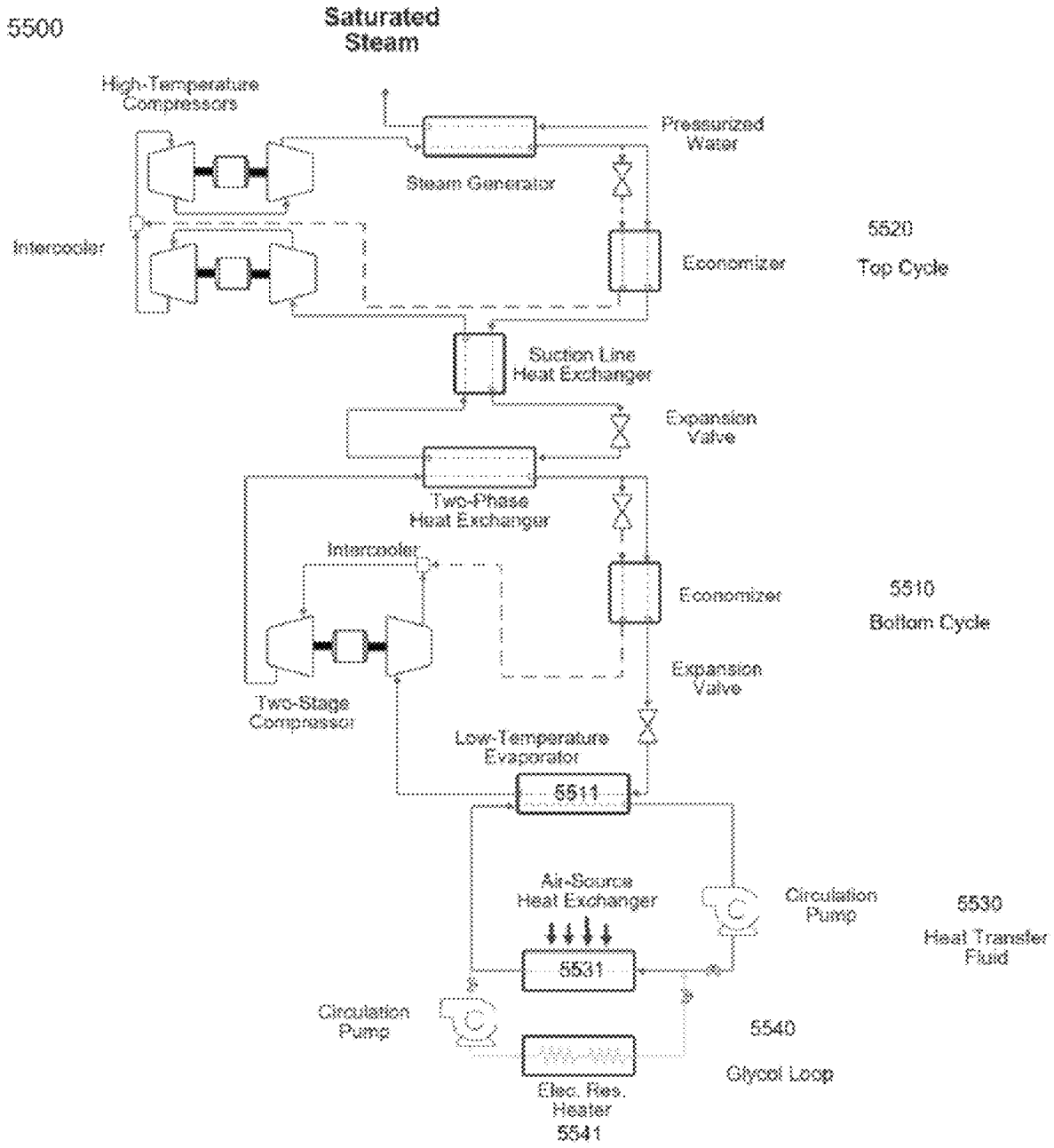
Figure 56:
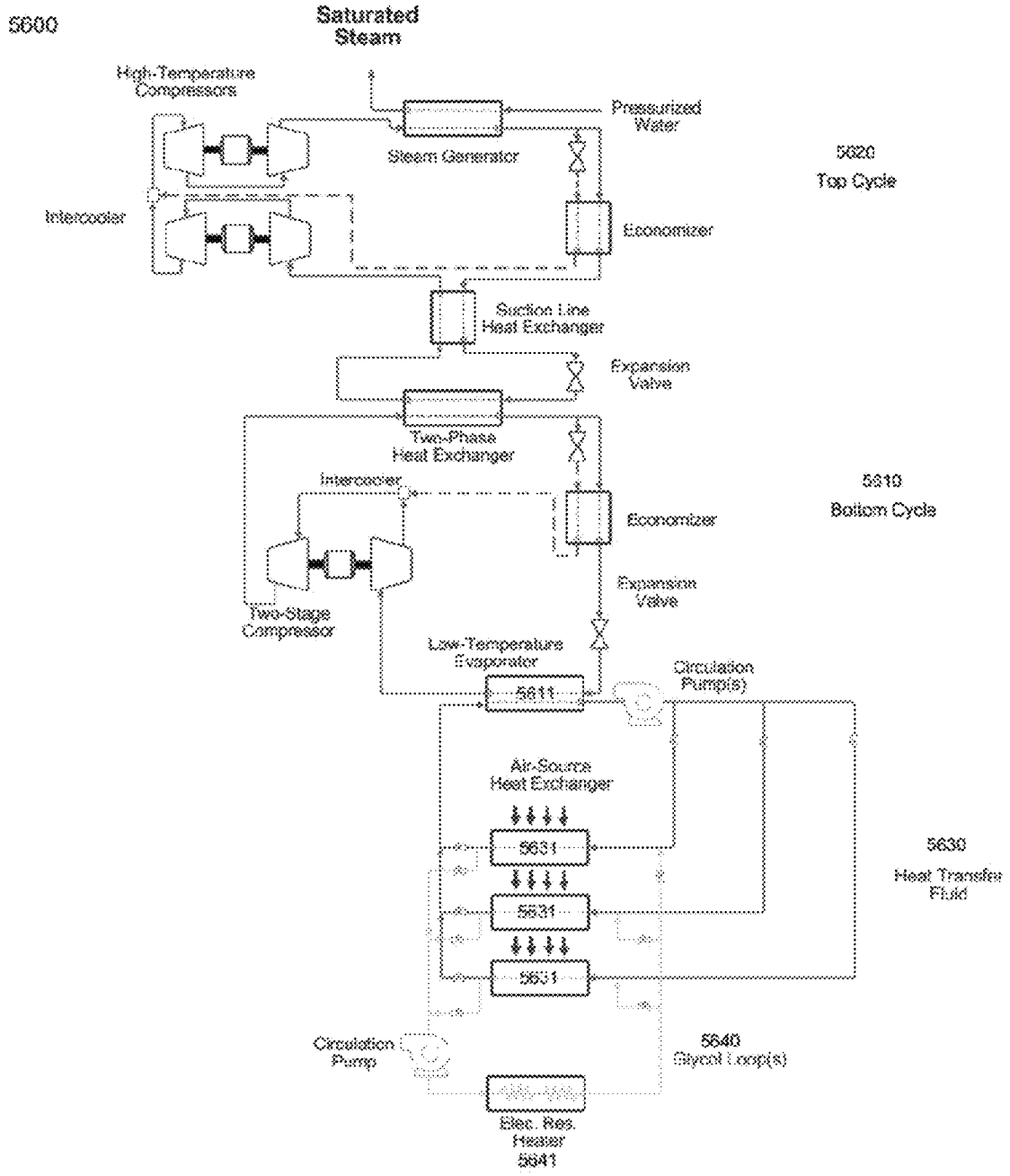

FIG. 54-56 illustrate examples of steam generating systems in accordance with some embodiments described herein. The steam generating system 5400 in FIG. 54 comprises a top cycle 5420, a bottom cycle 5410, and a heat transfer fluid cycle 5430. The heat transfer fluid cycle 5430 comprises a heat exchanger 5431 (e.g., an air-source heat exchanger). The heat transfer fluid cycle 5430 may be coupled to the bottom cycle 5410 by a heat exchanger 5411 (e.g., a low temperature evaporator). The heat transfer fluid cycle 5430 may further comprise an electric resistance heater 5432 between the low temperature heat exchanger 5411 and the air-source heat exchanger 5431 The electric. Resistance heater 5432 is configured to heat a working fluid output by the heat exchanger 5411 and before the air-source heat exchanger 5431. The electric resistance heater 5432 may be used to defrost the air-source heat exchanger 5431 and/or help prevent freezing of the evaporator coils during cold weather. In some embodiments, the heat transfer fluid cycle 5430 may be an intermediate loop (e.g., a glycol loop).

FIG. 55 illustrates an alternative embodiment of the steam generating system of FIG. 54. The steam generating system 5500 in FIG. 55 comprises a top cycle 5520, a bottom cycle 5510, and a heat transfer fluid cycle 5530. The heat transfer fluid cycle 5530 comprises a heat exchanger 5531 (e.g., an air-source heat exchanger). The heat transfer fluid cycle 5530 may be coupled to the bottom cycle 5510 by a heat exchanger 5511 (e.g., a low temperature evaporator). The heat transfer fluid cycle 5530 may further comprise a glycol loop 5540. The glycol loop 5540 may comprise an electric resistance heater 5541. The electric resistance heater 5541 may receive a portion of a working fluid output by the air-source heat exchanger 5531 and heat the portion of the working fluid before injecting the heated portion of the working fluid upstream of the air-source heat exchanger 5531. The electric resistance heater 5541 may be used to defrost the heat exchanger 5531 and/or help prevent freezing of the evaporator coils during cold weather as described herein.

FIG. 56 illustrates an alternative embodiment of the steam generating system of FIG. 55. The steam generating system 5600 in FIG. 56 comprises a top cycle 5620, a bottom cycle 5610, and a heat transfer fluid cycle 5630. The heat transfer fluid cycle 5630 comprises multiple glycol loops 5640 configured in parallel. The multiple glycol loops 5640 are configured to receive a portion of a working fluid (e.g., glycol) from one or more heat exchanger 5631 (e.g., an air-sourced heat exchanger) in parallel. The multiple glycol loops 5640 comprise valves configured to turn on and off each of the multiple glycol loops 5640. The multiple glycol loops 5640 may be turned on to deliver a portion of a working fluid to an electric resistance heat exchanger 5641. Wherein the electric resistance heat exchanger 5641 may heat the portion of the working fluid and inject up stream of the heat exchangers 5631. The multiple glycol loops 5640 may be turned on to defrost and air-source heat exchangers 5631 during cold weather and may be operated independently from each other as described herein.

In some embodiments, one or more additional defrosting methods, as described herein, may be used along with one or more electric resistance heaters.

FIGS. 69-72 illustrate examples of steam generating systems in accordance with some embodiments described herein. The steam generating system 6900 in FIGS. 69A-B comprises a top cycle 6920, a bottom cycle 6910, and a heat transfer fluid cycle 6930. The heat transfer fluid cycle 6930 comprises a heat exchanger 6931 (e.g., an air-source heat exchanger). The heat transfer fluid cycle 6930 may be coupled to the bottom cycle 6910 by a heat exchanger 6911 (e.g., a low temperature evaporator). The heat transfer fluid cycle 6930 may further comprise a glycol loop 6940. The glycol loop 6940 may comprise a glycol heater 6941. The glycol heater 6941 may be located in the bottom cycle 6910. The glycol heater 6941 may be located upstream of a heat exchanger 6912 (e.g., a two-phase heat exchanger) and downstream a compressor 6913 (e.g., a two-stage compressor). The glycol heater 6941 may be configured to heat the glycol entering the glycol heater 6941 from the heat transfer fluid cycle 6930 by transferring heat from the bottom cycle 6910. The glycol loop may be configured to inject upstream of the heat exchanger 6931. The glycol heater 6941 may be configured to receive all of the working fluid exiting the compressor 6913 (e.g., as shown in FIG. 69A). Alternatively, the glycol heater 6941 may be configured to receive a portion of the working fluid exiting the compressor 6913, and the remaining portion of the working fluid 6914 may be diverted around the glycol heater 6941 (e.g., as shown in FIG. 96B). The portion of the working fluid exiting the compressor that is routed through the glycol heater may be about 0-10%, 10-20%, 20-30%, 30-40%, 40-50%, 50-60%, 60-70%, 70-80%, 80-90% or 90-100%. The glycol loop 6940 may be used to defrost the heat exchanger 6931 and/or help prevent freezing of the heat exchanger coils during cold weather.

Figure 69A:
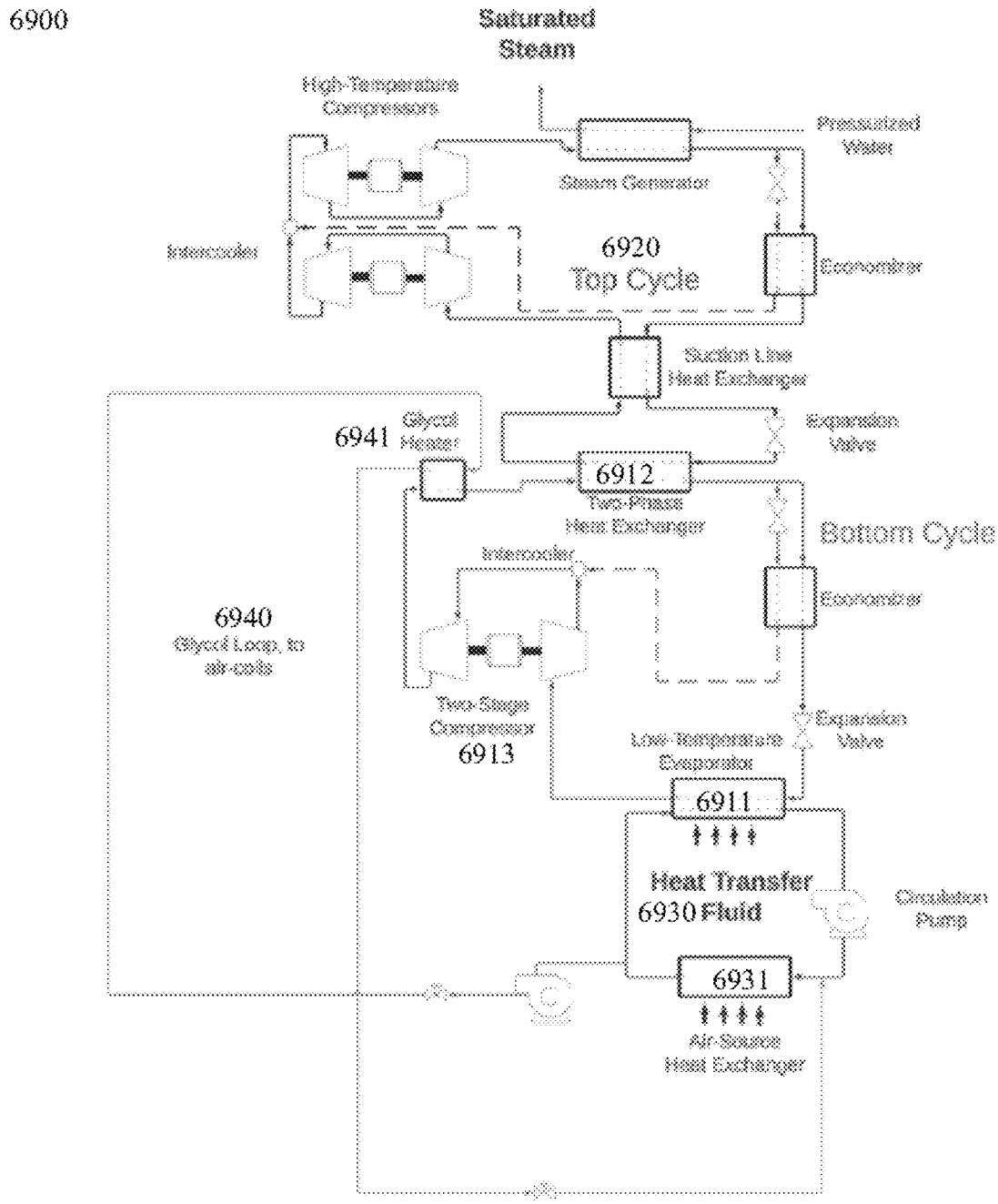
FIGS. 69A, 69B, 70, 71, and 72 illustrate examples of steam generating systems with glycol heaters in accordance with some embodiments described herein.
Figure 69B:
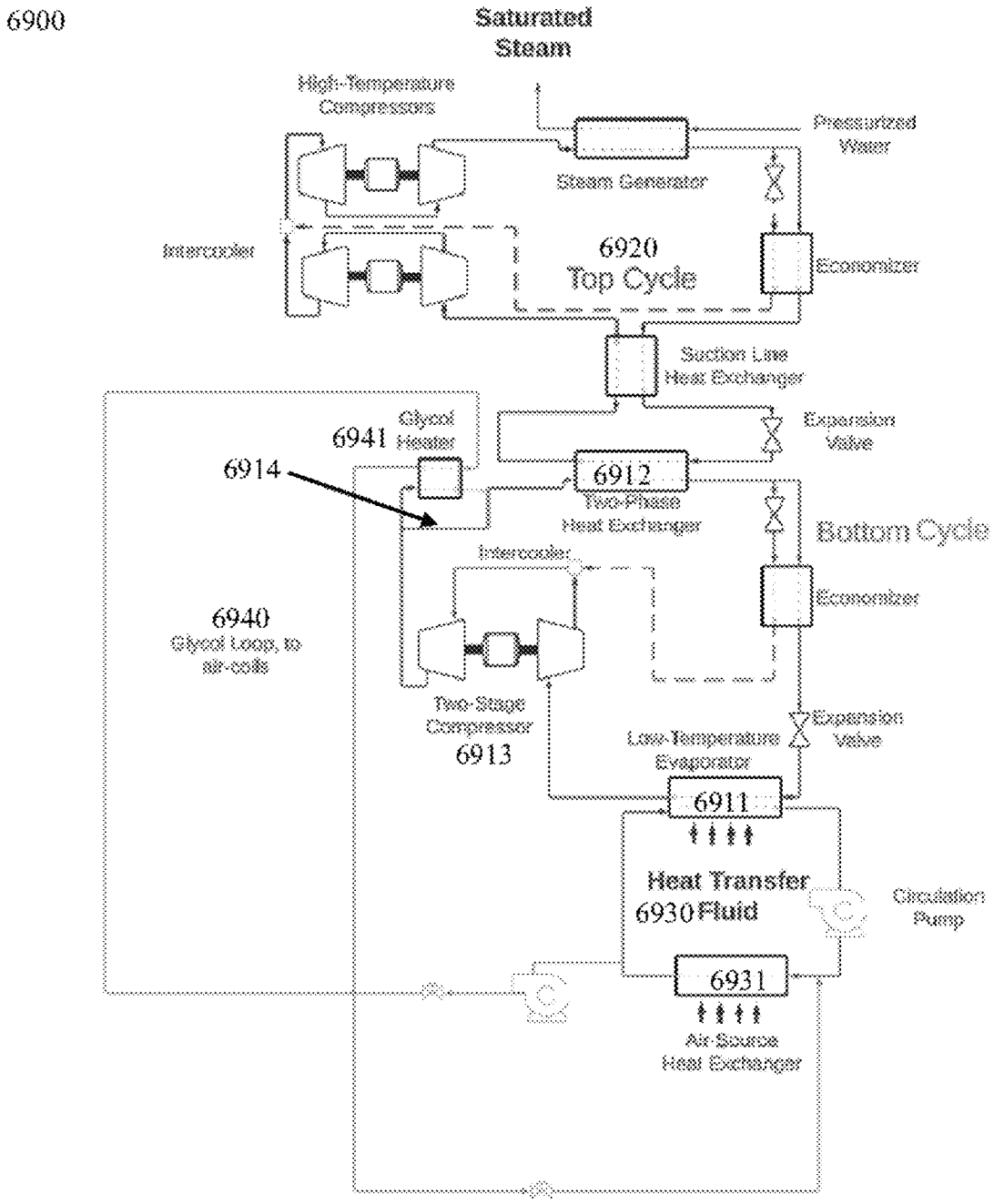
Figure 70:
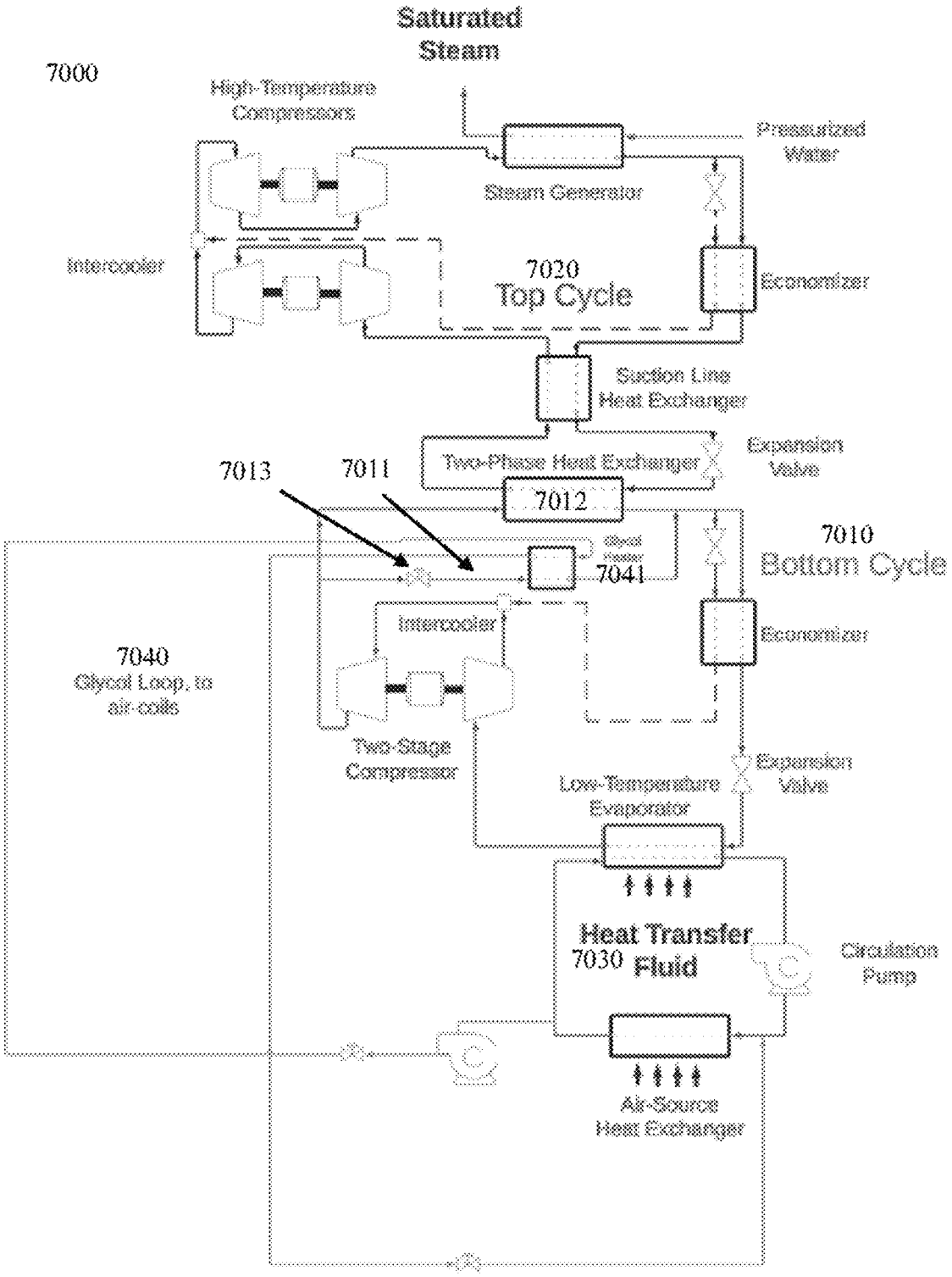

FIG. 70 illustrates an alternative embodiment of the steam generating system of FIGS. 69A-B. The steam generating system 7000 in FIG. 70 comprises a top cycle 7020, a bottom cycle 7010, and a heat transfer fluid cycle 7030. The heat transfer fluid cycle 7030 may comprise a glycol loop 7040 which may comprise a glycol heater 7041. The glycol heater 7041 may be located in the bottom cycle 7010 on a parallel stream 7011 which bypasses a heat exchanger 7012 (e.g., a two-phase heat exchanger). The glycol heater 7041 may be configured to condense the working fluid of the bottom cycle 7010 before the working fluid re-enters the bottom cycle downstream of the heat exchanger 7012. A control valve 7013 may be used to close off the parallel stream 7011 when not in use.

Figure 71:
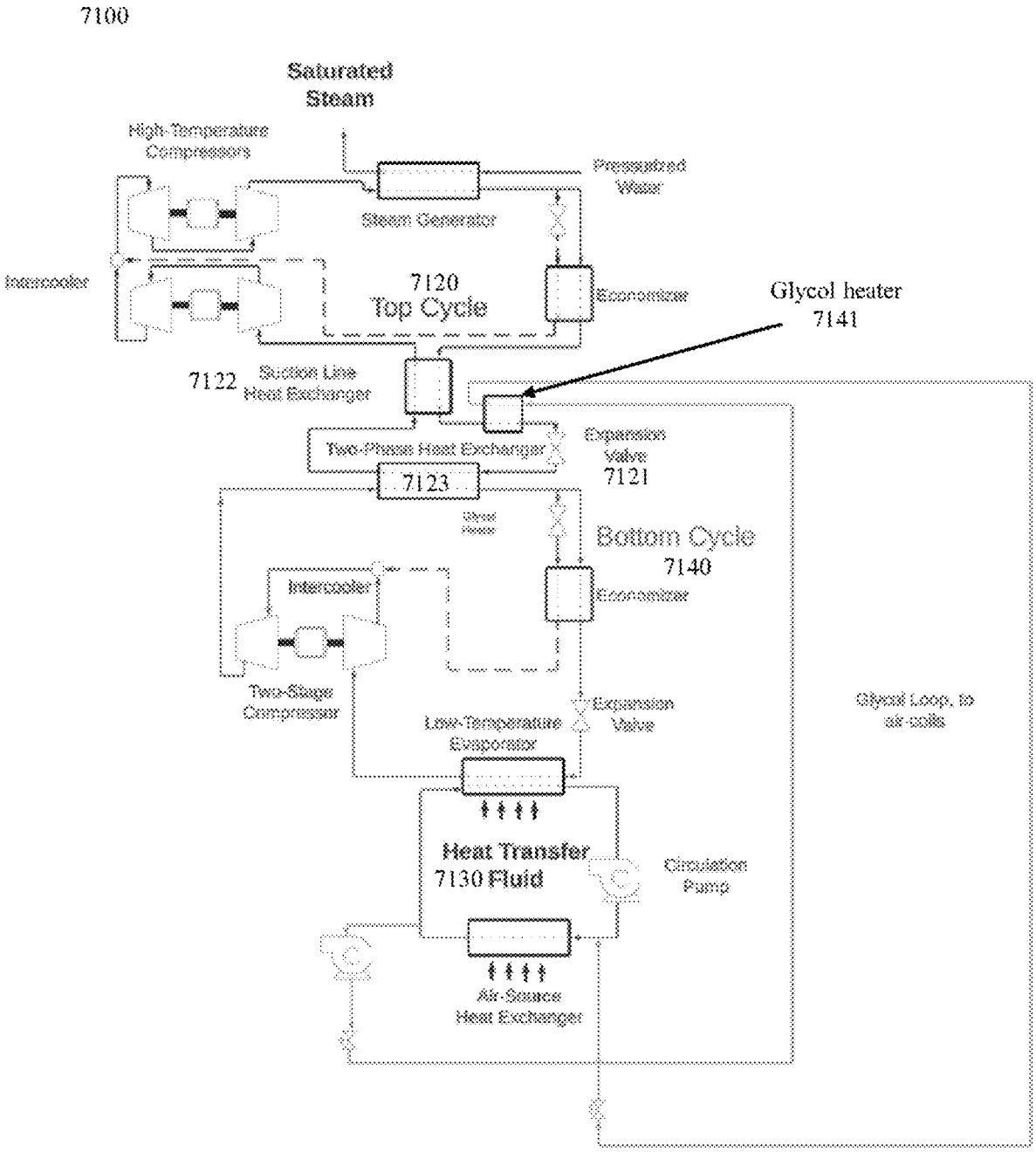

FIG. 71 illustrates an alternative embodiment of the steam generating system of FIGS. 69A-B. The steam generating system 7100 in FIG. 71 comprises a top cycle 7120, a bottom cycle 7110, and a heat transfer fluid cycle 7130. The heat transfer fluid cycle 7130 may comprise a glycol loop 7140 which may comprise glycol heater 7141. The glycol heater 7141 may be located in the top cycle 7120 upstream of an expansion valve 7121 and downstream of a heat exchanger 7122 (e.g., a suction-line heat exchanger). The subcooling of a working fluid of the top cycle 7120 may provide a positive effect on the performance of the top cycle by reducing the vapor quality at the inlet of an evaporator 7123.

Figure 72:
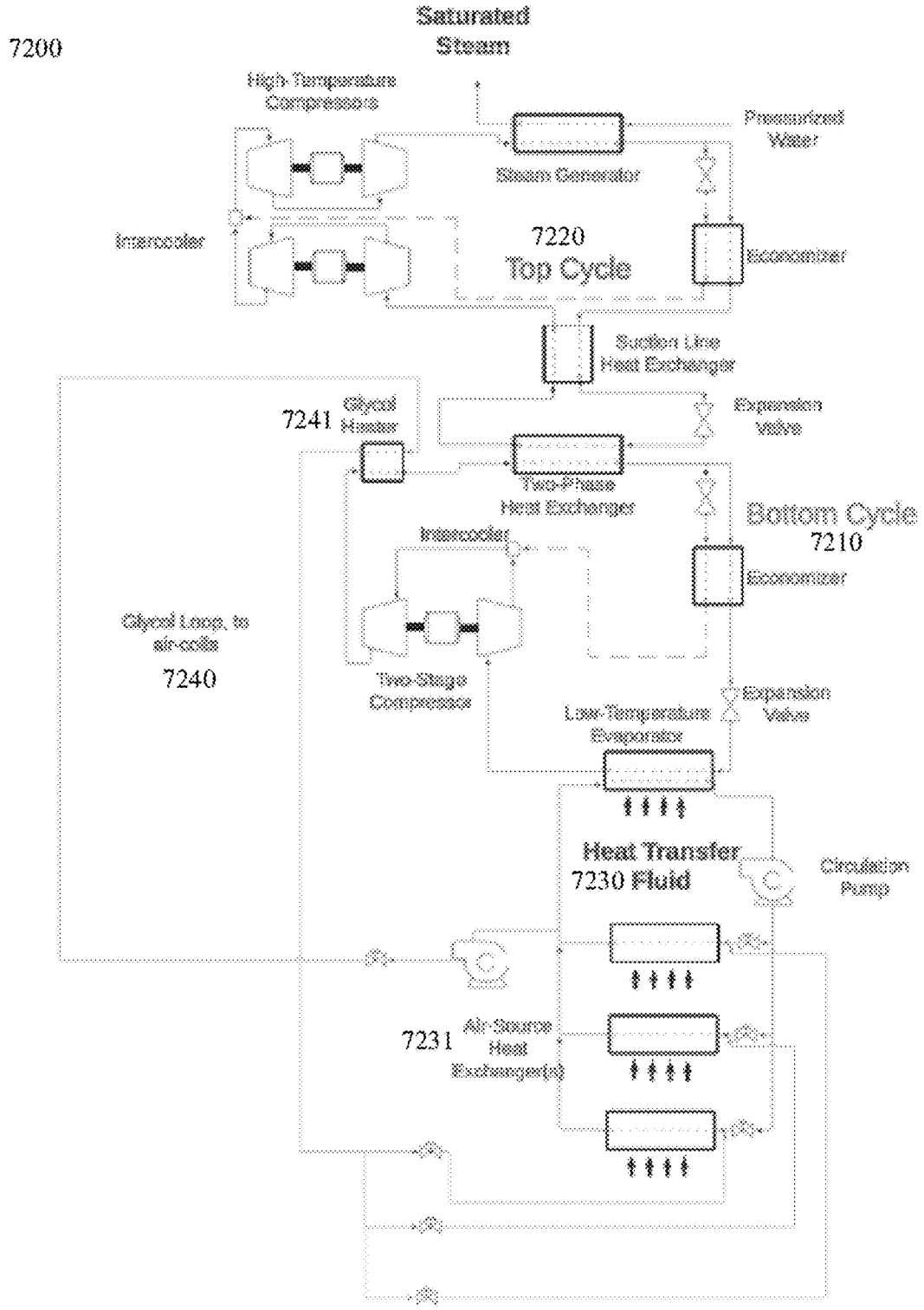

FIG. 72 illustrates an alternative embodiment of the steam generating system of FIGS. 69A-B. The steam generating system 7200 in FIG. 72 comprises a top cycle 7220, a bottom cycle 7210, and a heat transfer fluid cycle 7230. The heat transfer fluid cycle 7230 comprises multiple glycol loops 7240 configured in parallel. The multiple glycol loops 7240 are configured to receive a portion of a working fluid (e.g., glycol) from one or more heat exchanger 7231 (e.g., an air-sourced heat exchanger) in parallel. The multiple glycol loops 7240 comprise valves configured to turn on and off each of the multiple glycol loops 7240. The multiple glycol loops 7240 may be turned on to deliver a portion of a working fluid to a glycol heater 7241. The glycol heater may be located at any location on either the top cycle or the bottom cycle as described herein. The glycol heater 7241 may heat the portion of the working fluid and inject up stream of the heat exchangers 7231. The multiple glycol loops 7240 may be turned on to defrost and air-source heat exchangers 7231 during cold weather and may be operated independently from each other as described herein.

Figure 73:
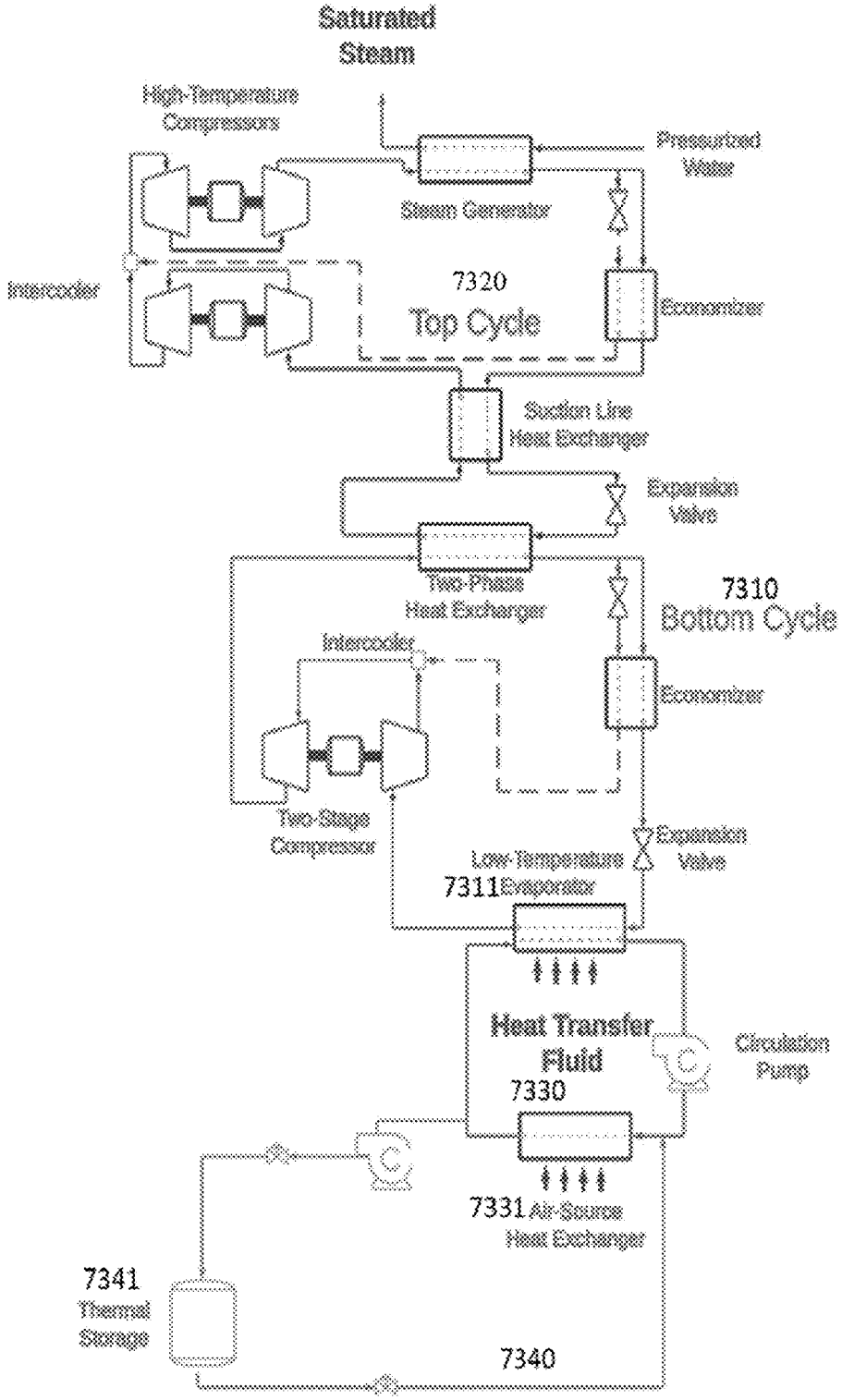
FIG. 73 illustrates an example of a steam generating system with thermal storage in accordance with some embodiments described herein.

FIG. 73 illustrates an example of a steam generating system in accordance with some embodiments described herein. The steam generating system 7300 in FIG. 73 comprises a top cycle 7320, a bottom cycle 7310, and a heat transfer fluid cycle 7330. The heat transfer fluid cycle 7330 comprises a heat exchanger 7331 (e.g., an air-source heat exchanger). The heat transfer fluid cycle 7330 may be coupled to the bottom cycle 7310 by a heat exchanger 7311 (e.g., a low temperature evaporator). The heat transfer fluid cycle 7330 may comprise a glycol loop 7340. The glycol loop 7340 may comprise a thermal storage 7341. The thermal storage 7341 may be any thermal storage previously described herein. The glycol loop may be configured to inject upstream of the heat exchanger 7331. The glycol loop 7340 may be used to defrost the heat exchanger 7331 and/or help prevent freezing of the heat exchanger coils during cold weather. The heat transfer fluid cycle may comprise one or more heat exchangers (e.g., an air-sourced heat exchanger) in parallel (e.g., as shown in FIG. 72).

Figure 57:
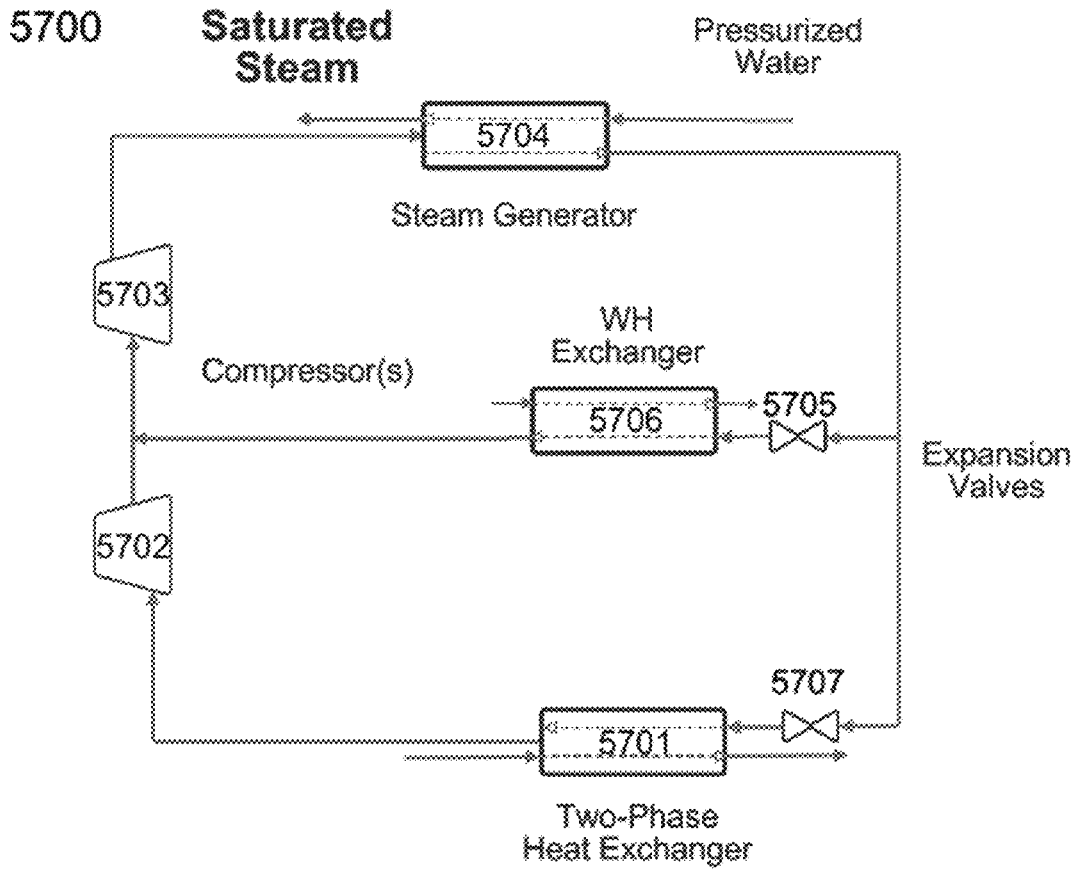
FIGS. 57-66 illustrate examples of a heat pump cycle with waste heat features in accordance with some embodiments described herein.

FIGS. 57-66 illustrates an example of a heat pump cycle in accordance with some embodiments described herein. The heat pump cycle 5700 in FIG. 57 comprises a heat exchanger 5701 (e.g., a two-phase heat exchanger) a first compressor 5702, a second compressor 5703, a heat exchanger 5704 (e.g., a steam generator), a heat exchanger 5706 (e.g., a waste heat (WH) heat exchanger), a first valve 5705 and a second valve 5707. The two-phase heat exchanger 5701 may be in parallel with WH heat exchanger 5706. The WH heat exchanger 5706 may receive a working fluid output by the heat exchanger 5704 and output the working fluid at an intermediate pressure stage between the first compressor 5702 and the second compressor 5702. The two-phase heat exchanger 5701 may receive a working fluid output by the heat exchanger 5704 and output the working fluid to the first compressor 5702. The WH heat exchanger 5706 may receive waste heat from a compressor stage, or an external heat source (e.g., process heat, combined heat and power, geothermal heat, etc.) to heat the working fluid. The valves 5705 and 5707 may control the flow of a working fluid between the WH exchanger 5706 and the two-phase heat exchanger 5701. Valve 5705 may be used to turn on and/or off the WH exchanger 5706. The WH exchanger 5706 configured as illustrated in FIG. 57 may evaporate the working fluid at a temperature of about 30° C. in a bottom cycle and/or of about 100° C. in a top cycle. The WH exchanger 5706 configured as illustrated in FIG. 57 may evaporate the working fluid at a temperature in the range of about 0° C. to about 60° C. in a bottom cycle and/or of about 60° C. to about 130° C. or about 90° C. to about 100° C. in a top cycle.

Figure 58:
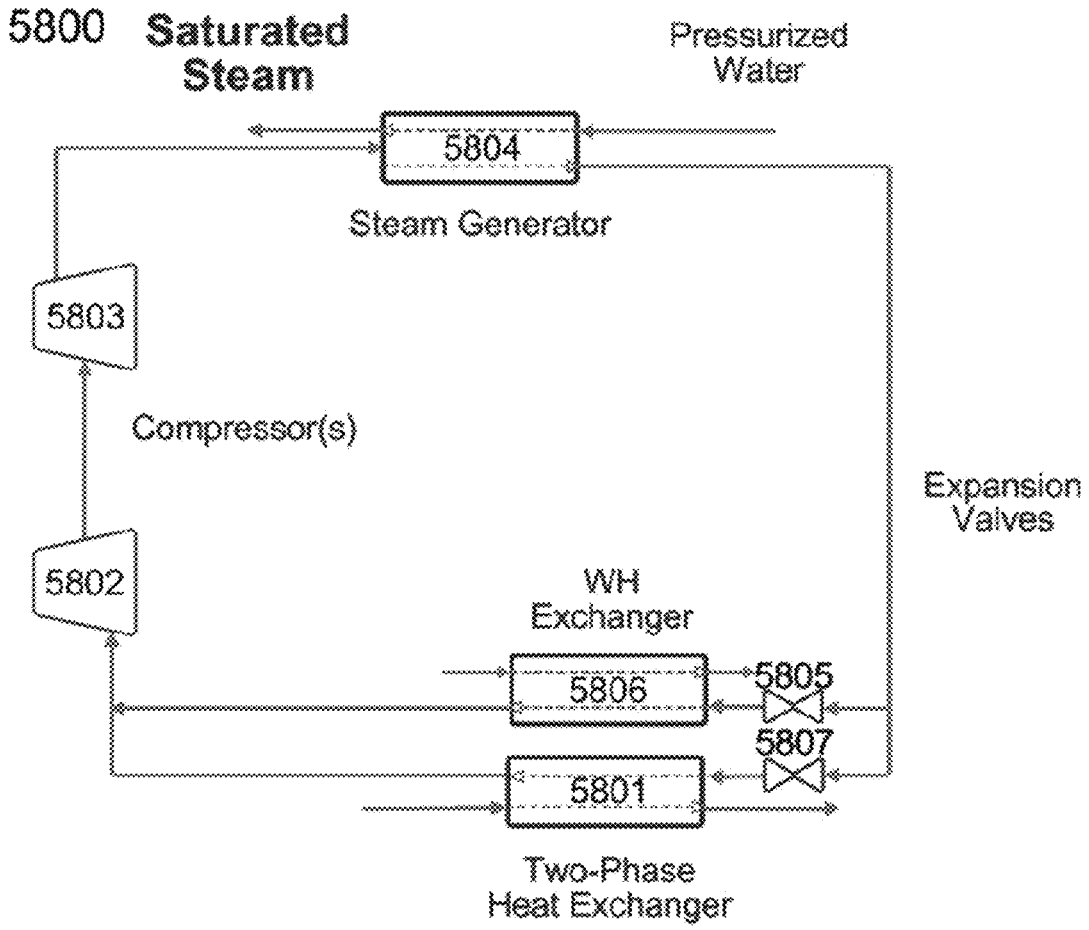

FIG. 58 illustrates an alternative embodiment of the heat pump cycle in FIG. 57. The heat pump cycle 5800 in FIG. 58 comprises a heat exchanger 5801 (e.g., a two-phase heat exchanger) a first compressor 5802, a second compressor 5803, a heat exchanger 5804 (e.g., a steam generator), a heat exchanger 5806 (e.g., a waste heat (WH) heat exchanger), a first valve 5805 and a second valve 5807. The two-phase heat exchanger 5801 may be in parallel with WH heat exchanger 5806. The WH heat exchanger 5806 may receive a working fluid output by the heat exchanger 5804 and output the working fluid to the first compressor 5802. The two-phase heat exchanger 5801 may receive a working fluid output by the heat exchanger 5804 and output the working fluid to the first compressor 5802. The WH heat exchanger 5806 may receive waste heat from a compressor stage, or an external heat source (e.g., process heat, combined heat and power, geothermal heat, etc.) to heat the working fluid. The heat pump cycle 5800 comprising a WH heat exchanger 5806 as illustrated in FIG. 58 may be used with refrigeration system integration (e.g., chilled water) as described herein, and very low-grade engine waste heat (e.g., lubrication oil), and/or hot water storage as described herein. The WH heat exchanger 5806 configured as illustrated in FIG. 58 may evaporate the working fluid at a temperature of about 15° C. in a bottom cycle and/or of about 60° C. in a top cycle. The WH heat exchanger 5806 configured as illustrated in FIG. 58 may evaporate the working fluid at a temperature in the range of about −20° C. to about 50° C. in a bottom cycle and/or of about 50° C. to about 90° C. in a top cycle.

Figure 59:
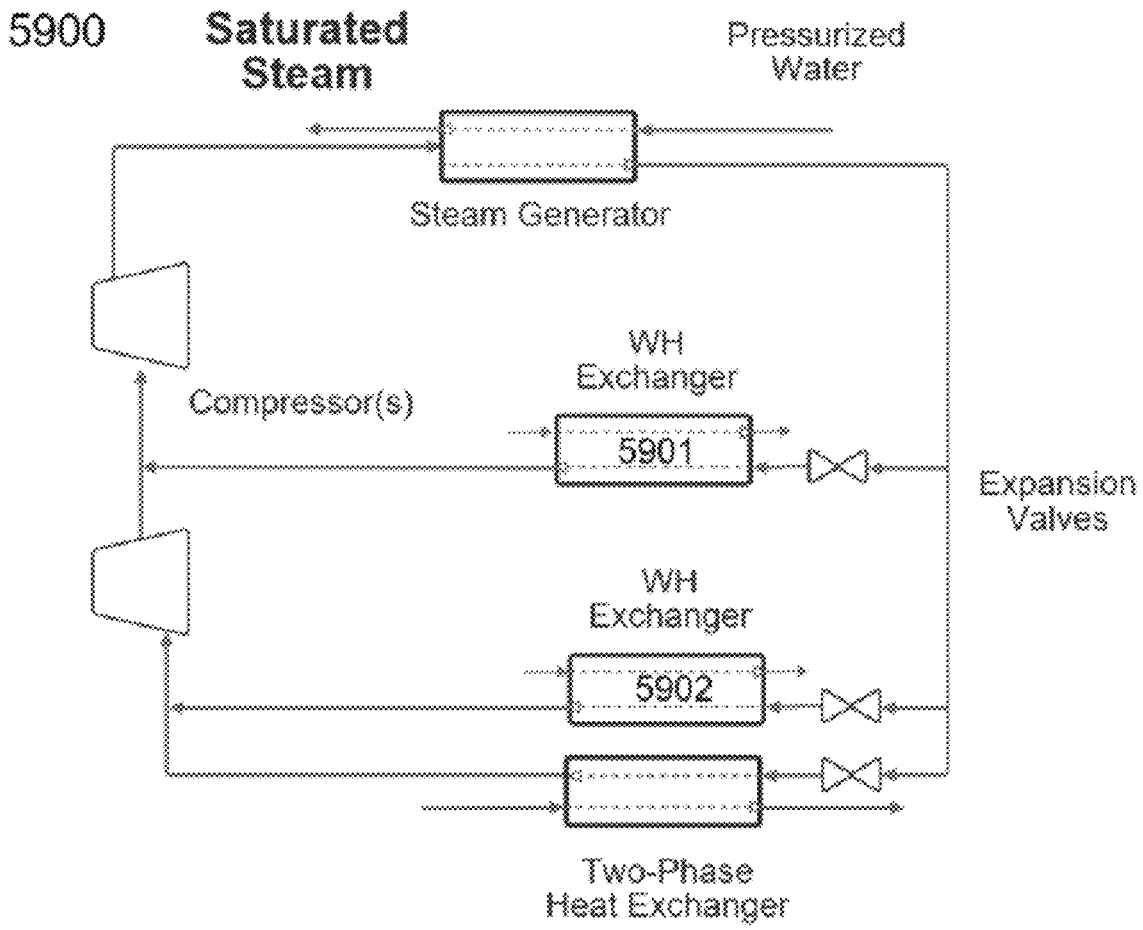

FIG. 59 illustrates an alternative embodiment of the heat pump cycle having a combination of the WH heat exchanger configuration illustrated in FIG. 57 and FIG. 58. The heat pump cycle 5900 in FIG. 59 comprises a first WH heat exchanger 5901 as illustrated in FIG. 57 and a second WH heat exchanger 5902 as illustrated in FIG. 58. The heat pump cycle 5900 having combined WH heat exchanger configurations may evaporate the working fluid at a temperature of about 0-15° C. in a bottom cycle and/or of about 55-65° C. in a top cycle. The heat pump cycle 5900 having combined WH heat exchanger configurations may evaporate the working fluid at a temperature in the range of about −20° C. to about 60° C. in a bottom cycle and/or of about 50° C. to about 130° C. in a top cycle.

Figure 60:
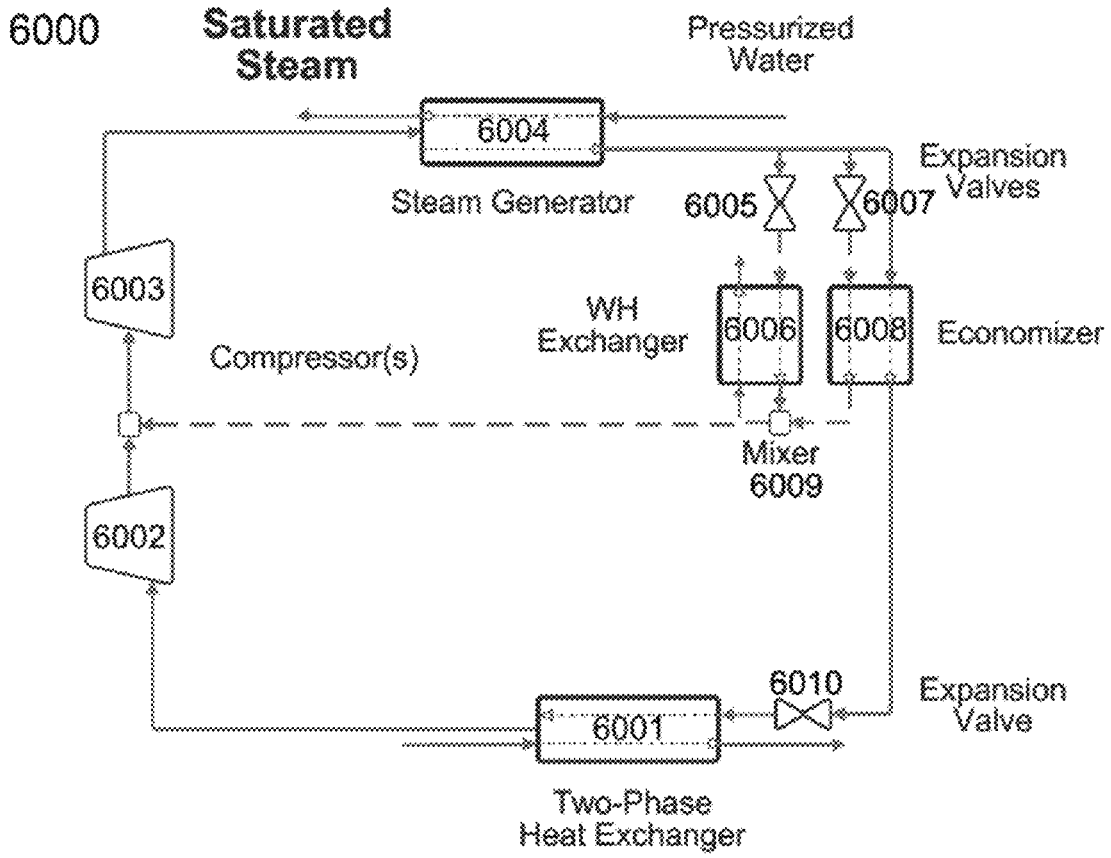

FIG. 60 illustrates an alternative embodiment of the heat pump cycle in FIG. 57. The heat pump cycle 6000 in FIG. 60 comprises a heat exchanger 6001 (e.g., a two-phase heat exchanger) a first compressor 6002, a second compressor 6003, a heat exchanger 6004 (e.g., a steam generator), a heat exchanger 6006 (e.g., a waste heat (WH) heat exchanger), an economizer 6008, a first valve 6005, a second valve 6007, and a third valve 6010. The economizer 6008 may be in parallel with a WH heat exchanger 6006. The WH heat exchanger 6006 may receive a working fluid output by the heat exchanger 6004 and output the working fluid to a mixer 6009. The economizer may receive a working fluid output by the heat exchanger 6004 and output the working fluid to the mixer 6009. The mixer combines the working fluids output by the WH heat exchanger 6006 and the economizer 6008 before injecting the combined working fluid between the first compressor 6002 and the second compressor 6003 (e.g., at an intermediate compression stage). The WH heat exchanger 6006 configured as illustrated in FIG. 60 may evaporate the working fluid at a temperature of about 30° C. in a bottom cycle (e.g., using a refrigeration system condenser heat) and/or of about 100° C. in a top cycle (e.g., using engine exhaust). The WH heat exchanger 6006 configured as illustrated in FIG. 60 may evaporate the working fluid at a temperature in the range of about 0° C. to about 60° C. in a bottom cycle and/or of about 60° C. to about 130° C. or about 90° C. to about 100° C. in a top cycle.

Figure 61:
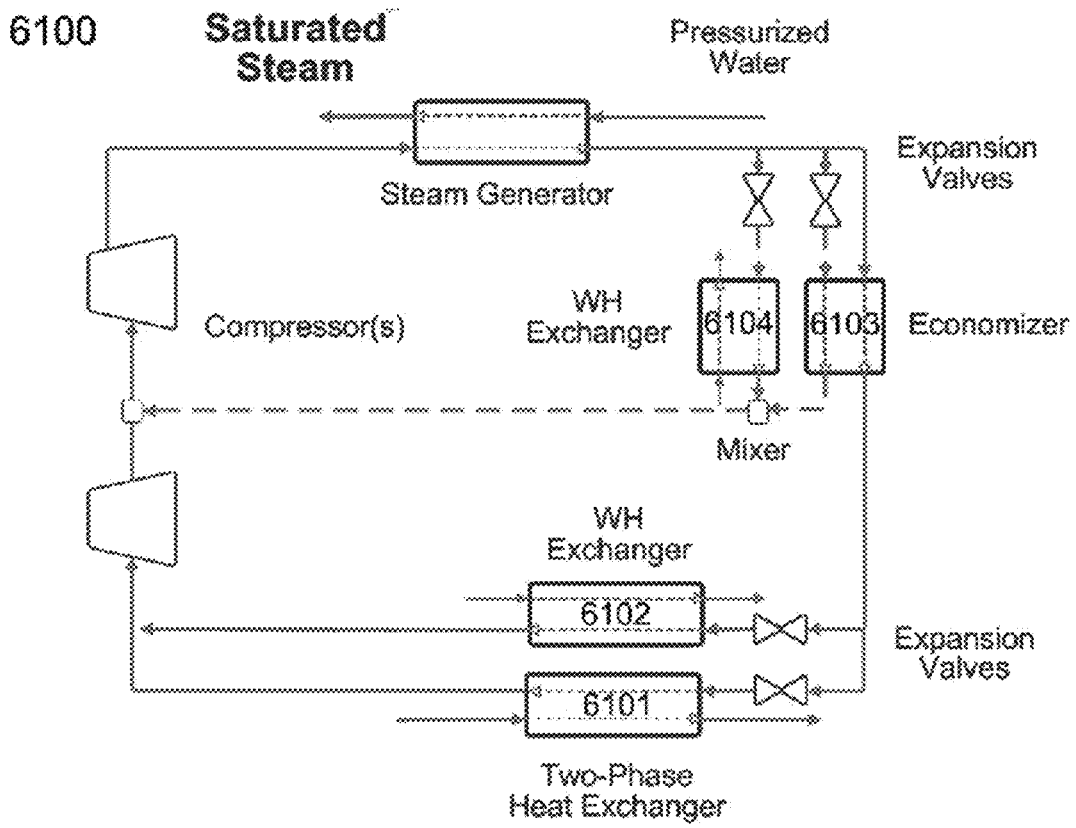

FIG. 61 illustrates an alternative embodiment of the heat pump cycle having a combination of the WH heat exchanger configuration illustrated in FIG. 58 and FIG. 60. The heat pump cycle 6100 in FIG. 61 comprise a first WH heat exchanger 6102 in parallel with a two-phase heat exchanger 6101 as illustrated in FIG. 58 and a second WH heat exchanger 6104 in parallel with an economizer 6103 as illustrated in FIG. 60.

Figure 62:
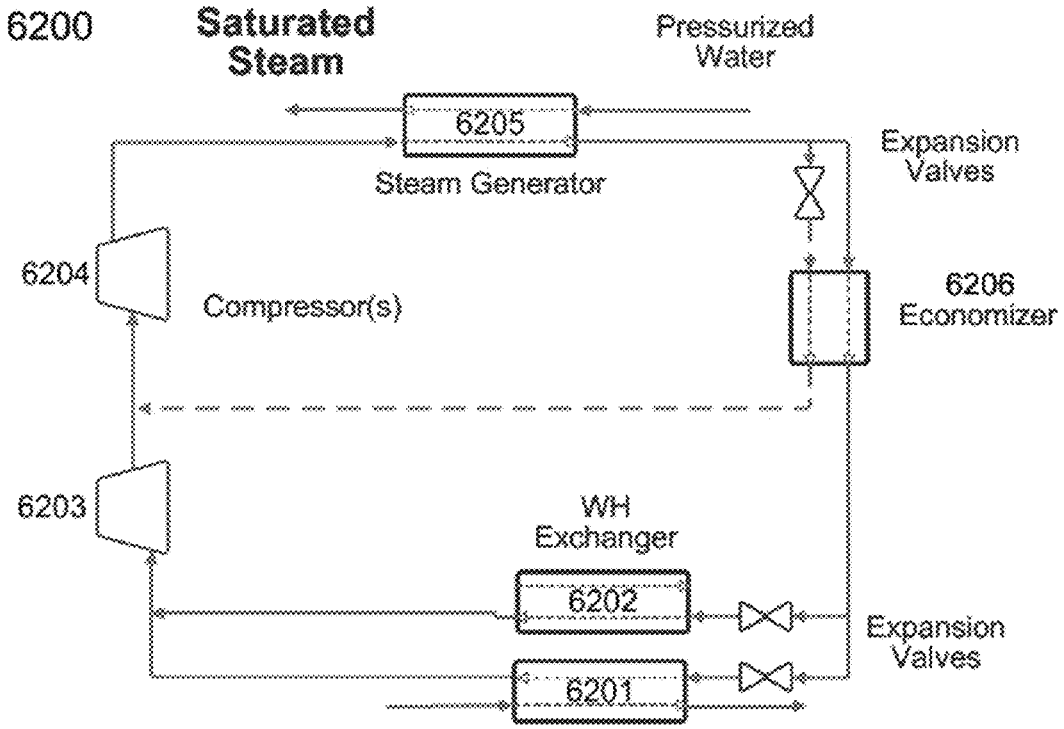

FIG. 62 illustrates an alternative embodiment of the heat pump cycle having a combination of the WH heat exchanger configuration illustrated in FIG. 59. The heat pump cycle 6200 in FIG. 62 comprises a heat exchanger 6201 (e.g., a two-phase heat exchanger) a first compressor 6203, a second compressor 6204, a heat exchanger 6205 (e.g., a steam generator), a heat exchanger 6202 (e.g., a waste heat (WH) heat exchanger) and an economizer 6206. The two-phase heat exchanger 6201 may be in parallel with the WH heat exchanger 6202. The WH heat exchanger 6202 may receive a working fluid output by the heat exchanger 6205 and output the working fluid the first compressor 6203. The two-phase heat exchanger 6201 may receive a working fluid output by the heat exchanger 6205 and output the working fluid to the first compressor 6203. The economizer 6206 may receive a working fluid output by the heat exchanger 6205 and output the working fluid at an intermediate pressure stage between the first compressor 6203 and the second compressor 6204. The cycle 6200 may further comprise one or more valves configured to control the flow of the working fluid into each of the two-phase heat exchanger 6201 the WH heat exchanger 6202 and the economizer 6206.

Figure 63:
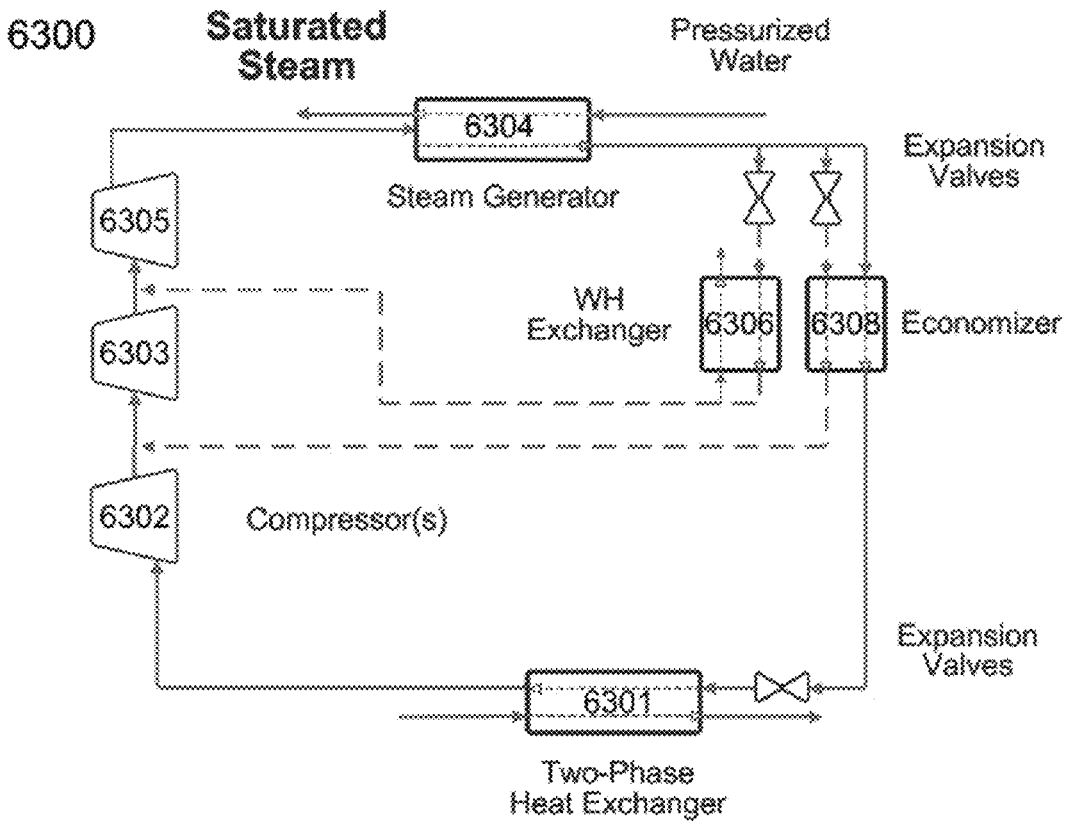

FIG. 63 illustrates an alternative embodiment of the heat pump cycle in FIG. 60. The heat pump cycle 6300 in FIG. 63 comprises a heat exchanger 6301 (e.g., a two-phase heat exchanger) a first compressor 6302, a second compressor 6303, a third compressor 6305 a heat exchanger 6304 (e.g., a steam generator), a heat exchanger 6306 (e.g., a waste heat (WH) heat exchanger), an economizer 6308. The economizer 6308 may be in parallel with WH heat exchanger 6306. The WH heat exchanger 6306 may receive a working fluid output by the heat exchanger 6304 and inject the working fluid at a first pressure between the second compressor 6303 and the third compressor 6305. The economizer may receive a working fluid output by the heat exchanger 6304 and inject the working fluid at a second pressure between the first compressor 6302 and second compressor 6303. The first pressure may a higher than the second pressure. In some embodiments, when the first pressure is lower than the second pressure, the WH exchanger 6306 injects the working fluid into a lower pressure stage (e.g., between the first compressor 6302 and the second compressor 6303) and the economizer injects the working fluid into a higher-pressure stage (e.g., between the second compressor 6303 and the third compressor 6305). WH exchanger 6306 configured as illustrated in FIG. 63 may evaporate the working fluid at a temperature of about 20-45° C. in a bottom cycle (e.g., an economizer at 30° C., and a WH heat exchanger at 20-45° C.) and/or of about 80-100° C. in a top cycle (e.g., an economizer to about 100° C. and a WH heat exchanger to about 80° C.). WH exchanger 6306 configured as illustrated in FIG. 63 may evaporate the working fluid at a temperature in the range of about 0° C. to about 60° C. in a bottom cycle and/or of about 60° C. to about 130° C. or about 90° C. to about 100° C. in a top cycle.

Figure 64:
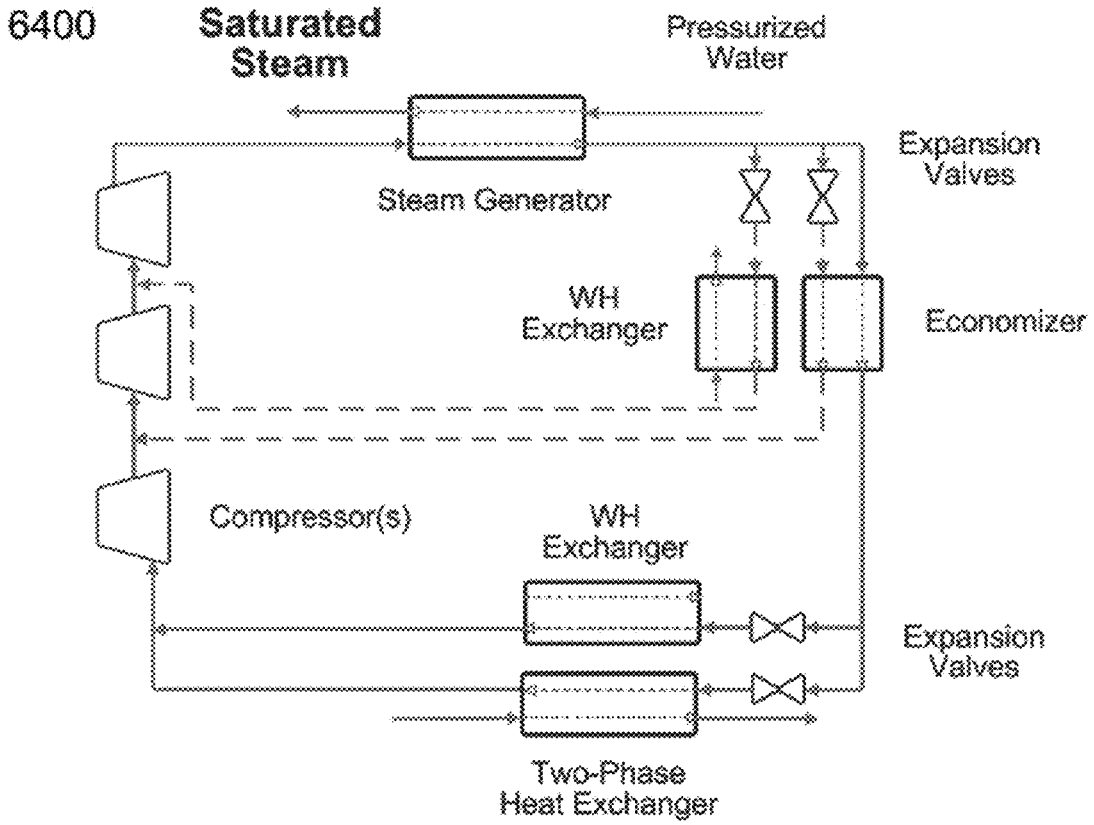

FIG. 64 illustrates an alternative embodiment of the heat pump cycle in FIG. 63. The heat pump cycle 6400 in FIG. 64 comprises the heat pump cycle illustrated in FIG. 63, and further comprises a WH heat exchanger 6401 incorporated into the cycle similar to FIG. 58. The configuration of heat pump cycle 6400 may be more thermodynamically optimal than combining the outputs of a WH heat exchanger and an economizer with an intercooler stream. In some embodiments, compressors of the heat pump cycle 6400 may utilize a mixed fluid stream to help with thrust balancing.

Figure 65:
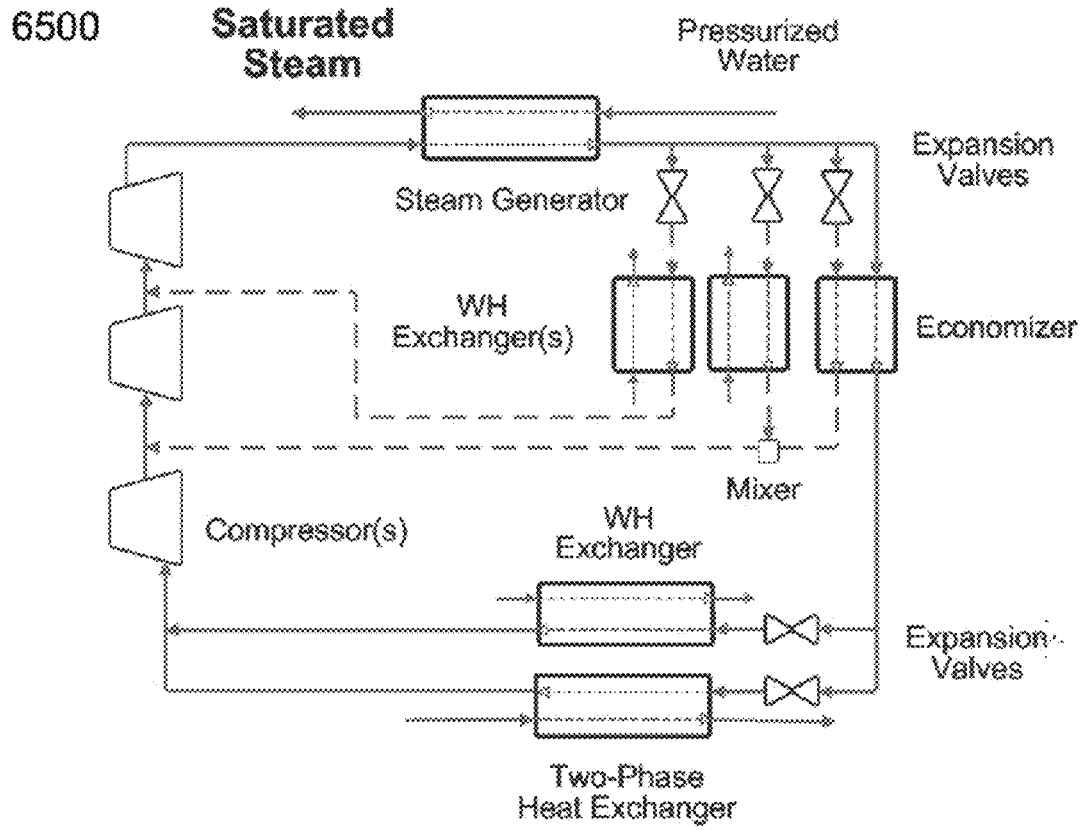

FIG. 65 illustrates an alternative embodiment of the heat pump cycle in FIG. 57. The heat pump cycle 6500 in FIG. 65 incorporates all the waste heat features of the heat pump cycles illustrated in FIG. 57-64. This configuration may provide the most control and operational options for a cycle. In some embodiments, the heat pump cycle 6500 may further comprise a suction-line heat exchanger 6601 as illustrated shown in the heat pump cycle 6600 of FIG. 66.

In some embodiments of the heat pump cycles illustrated in FIGS. 57-66, all elements are optional for the cycle except for an evaporator or steam generator, a two-phase heat exchanger, and at least one compressor.

Figure 66:
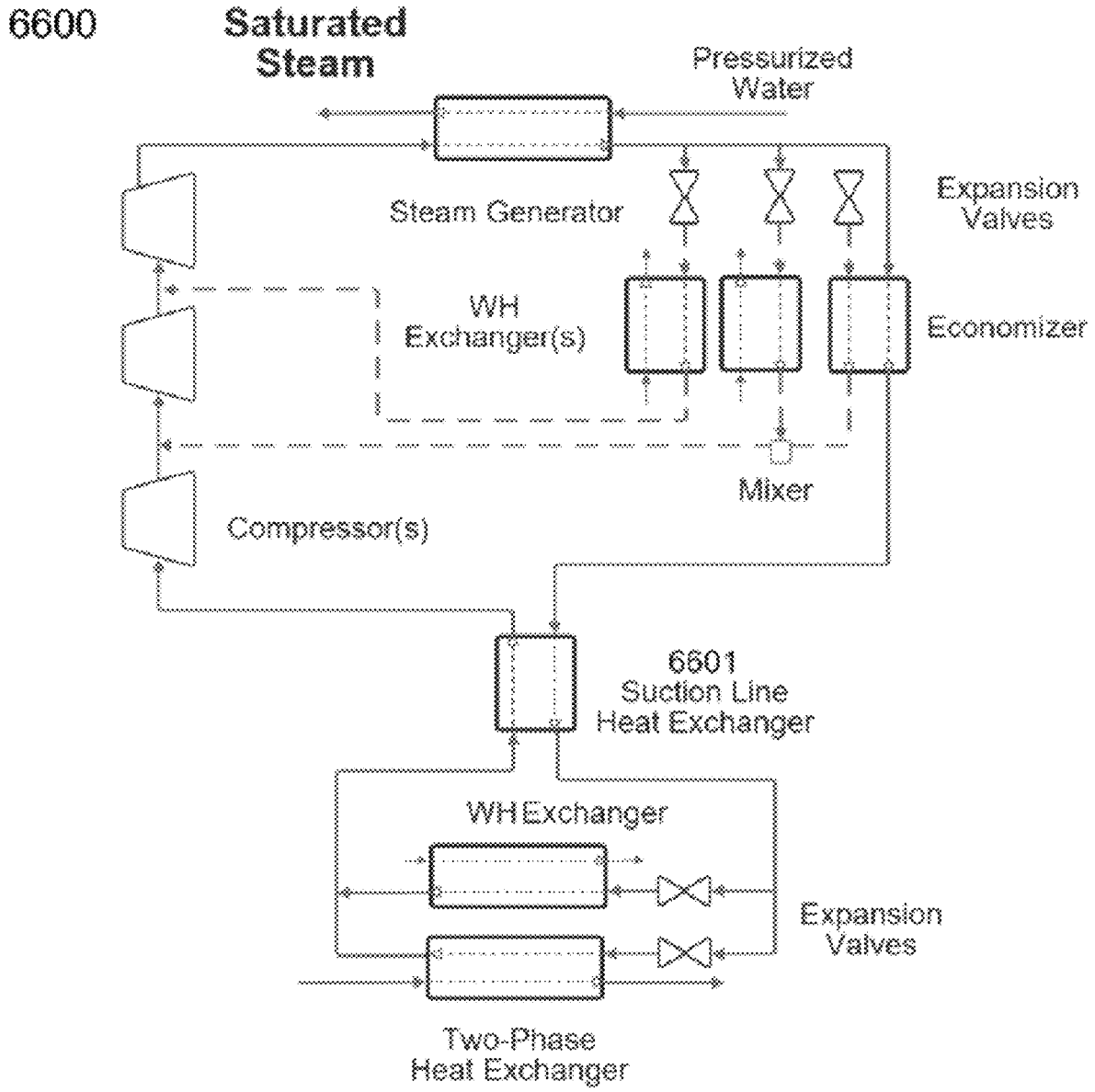
Figure 67:
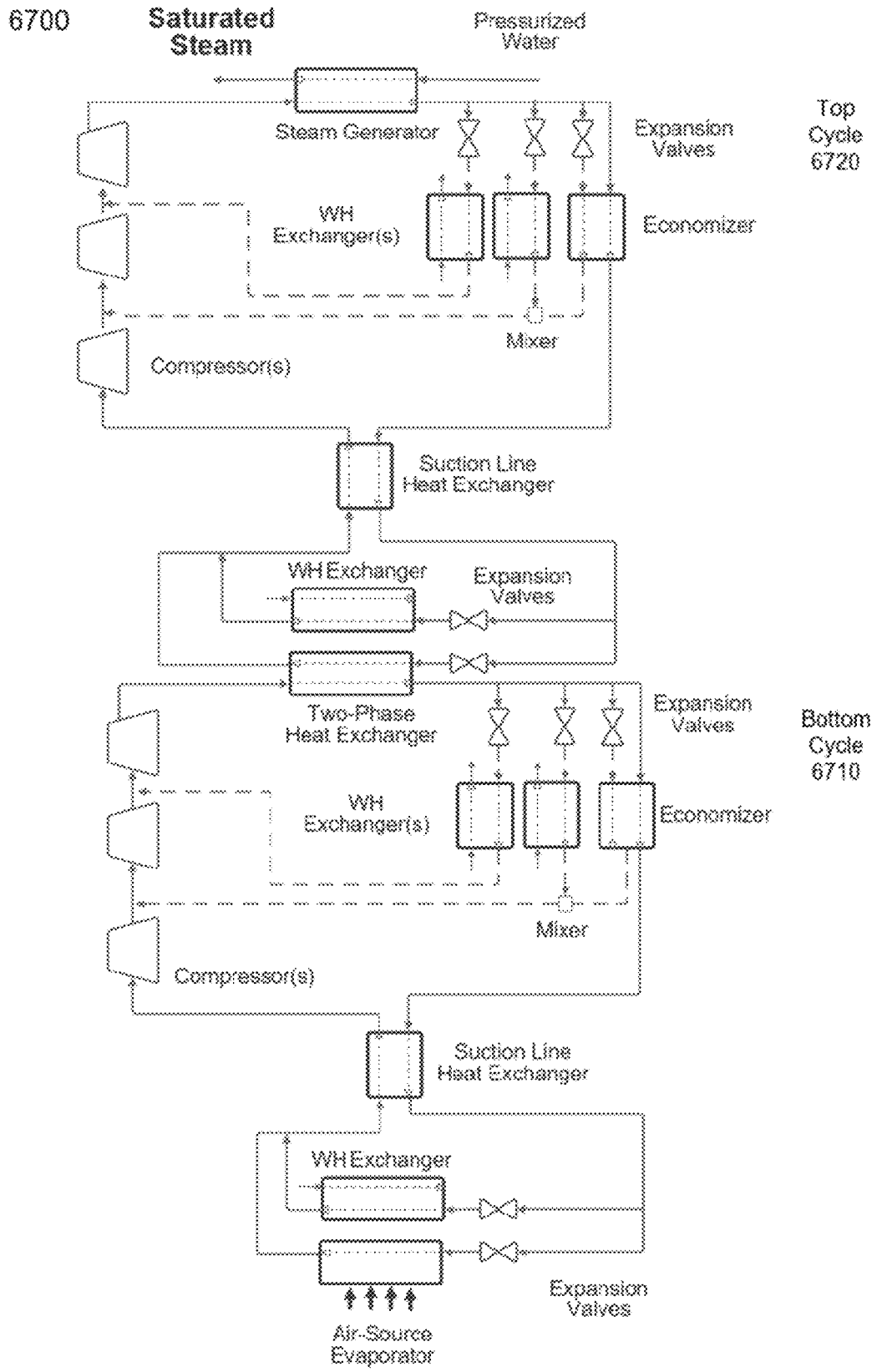
FIG. 67 illustrate examples of a steam generating system with waste heat feature in accordance with some embodiments described herein.
Figure 68:
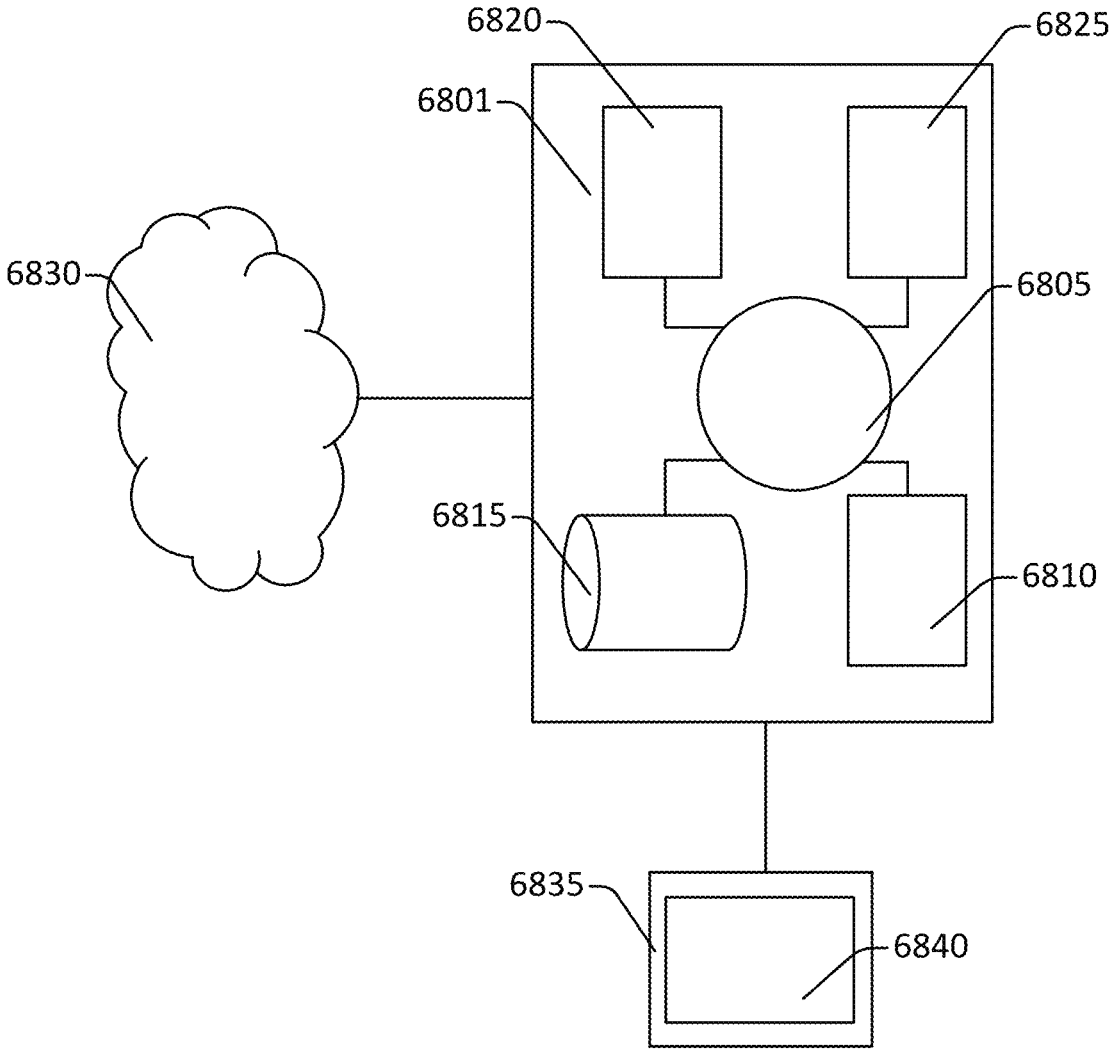
FIG. 68 illustrates a computer system that is programmed or otherwise configured to implement methods provided herein.

FIG. 67 illustrates an example of a steam generating system in accordance with some embodiments described herein. The system 6700 comprises a top cycle 6720 and a bottom cycle 6710. Both the top cycle 6620 and the bottom cycle 6710 comprise all the waste heat features as illustrated in FIG. 66. The system 6700 may control the functions of waste heat features as described herein.

Figure 74:
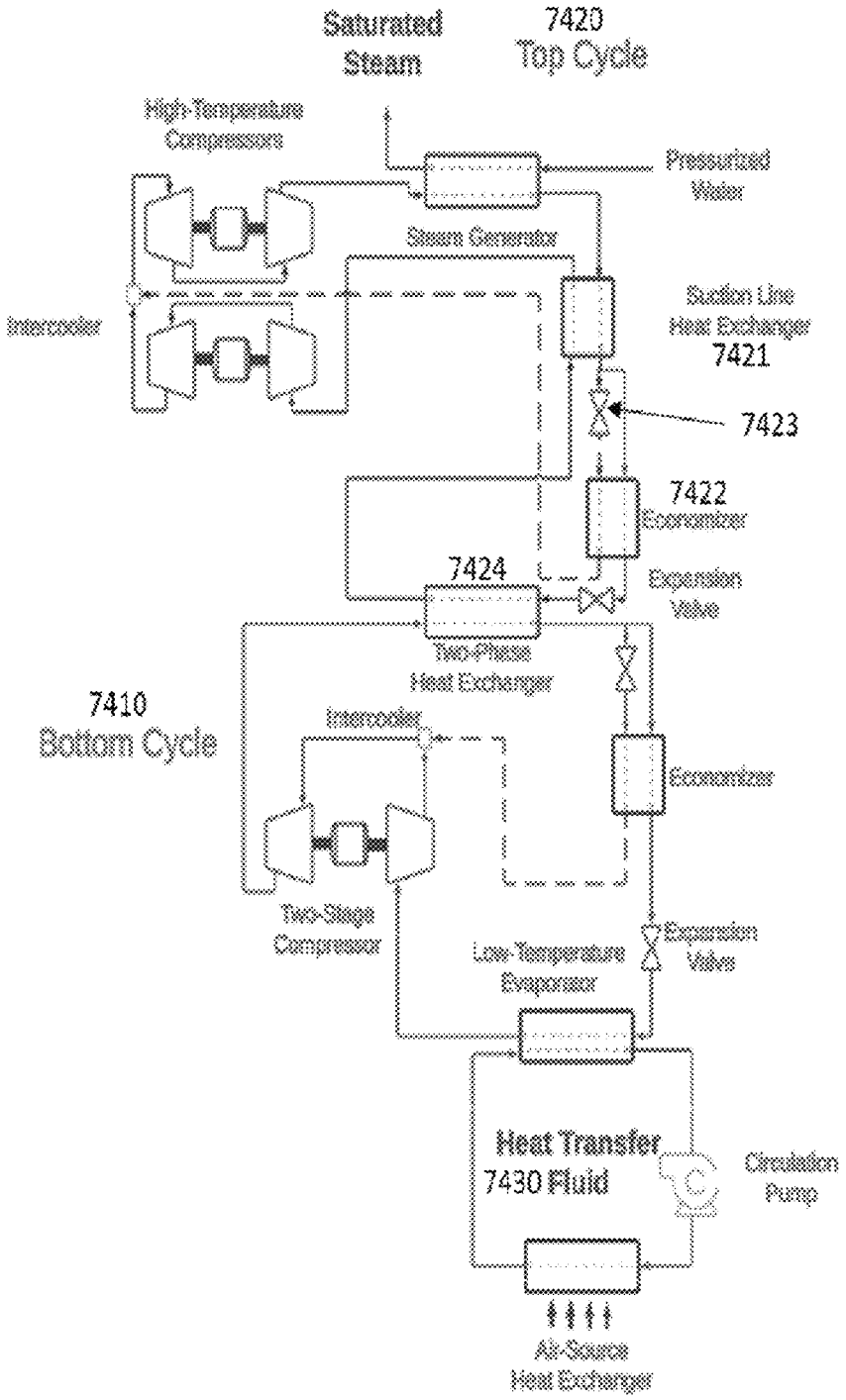
FIG. 74-75 illustrate examples of steam generating systems with economizers in accordance with some embodiments described herein.

FIG. 74 illustrates an example of a steam generating system in accordance with some embodiments described herein. The system 7400 comprises a top cycle 7420, a bottom cycle 7410, and a heat transfer fluid cycle 7430. The top cycle 7420 comprises a suction-line heat exchanger 7421, an economizer 7422, an economizer expansion valve 7423, and a two-phase heat exchanger 7424. The economizer 7422 may be located downstream of the suction-line heat exchanger 7421 and upstream of the two-phase heat exchanger 7424. This configuration may cool the working fluid entering the economizer expansion valve 7423 (e.g., to less than 120° C., which is the typical heat rating for commercial expansion valves) and decrease risk to damage to the economizer expansion valve 7523 due to high temperatures. In some embodiments, the economizer may cool the working fluid entering the expansion valve to less than 150° C., 140° C., 130° C., 120° C., 115° C., 110° C., 105° C., 100° C., 95° C., 90° C., 85° C., 80° C., 75° C., 70° C. or lower.

Figure 75:
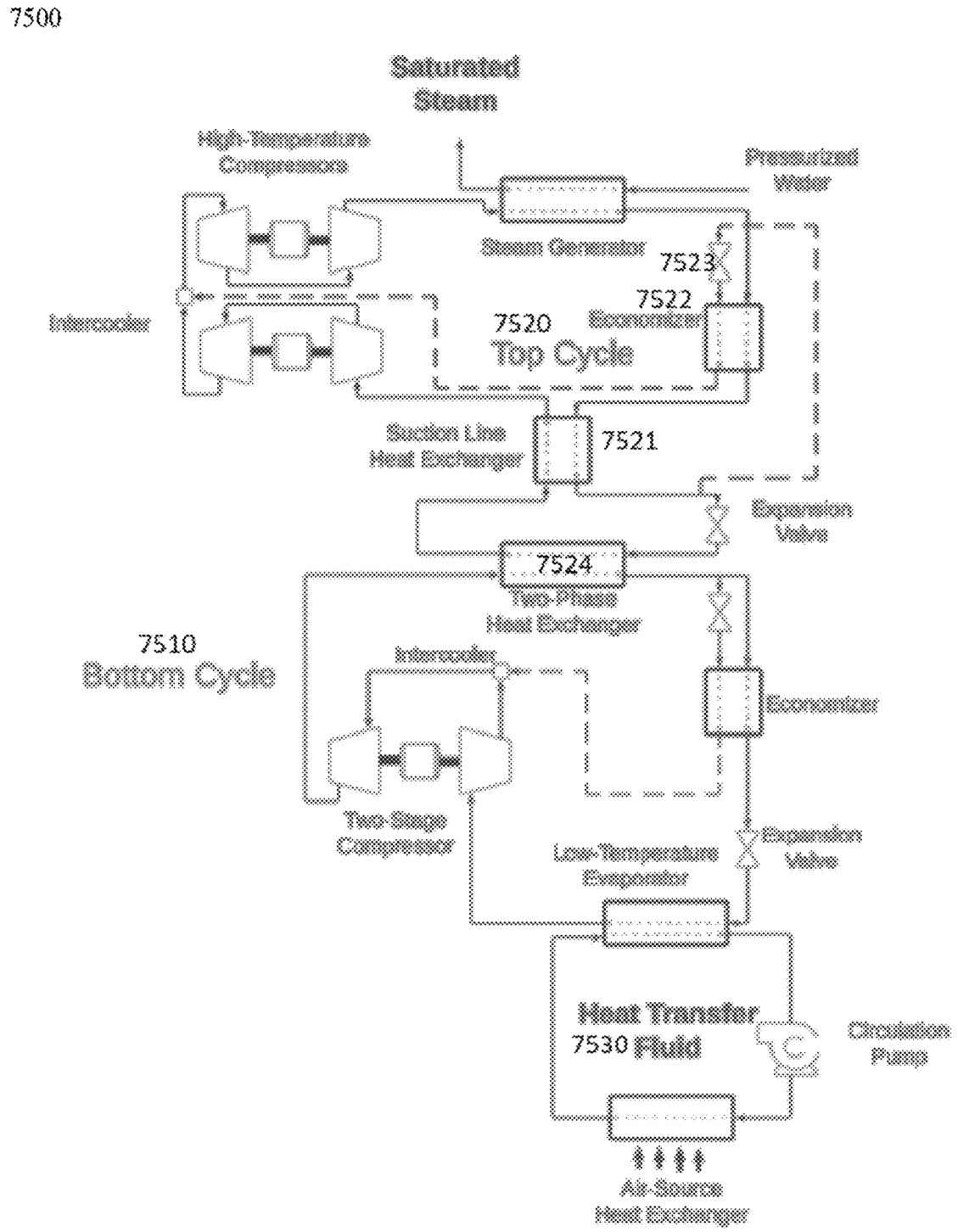

FIG. 75 illustrates an example of a steam generating system in accordance with some embodiments described herein. The system 7500 comprises a top cycle 7520, a bottom cycle 7510, and a heat transfer fluid cycle 7530. The top cycle 7520 comprises a suction-line heat exchanger 7521, an economizer 7522, an economizer expansion valve 7523, and a two-phase heat exchanger 7524. The economizer 7522 may be located upstream of the suction-line heat exchanger 7521. The working fluid entering the economizer expansion valve 7523 may be pulled from the outlet stream of the suction-line heat exchanger 7521. This configuration may cool the working fluid entering the economizer expansion valve 7523 by about 0° C. to about 10° C., about 10° C. to about 20° C., about 20° C. to about 30° C., about 30° C. to about 40° C., about 40° C. to about 50° C. Cooling the working fluid may decrease risk to damage to the economizer expansion valve 7523 due to high temperatures.

Figure 76:
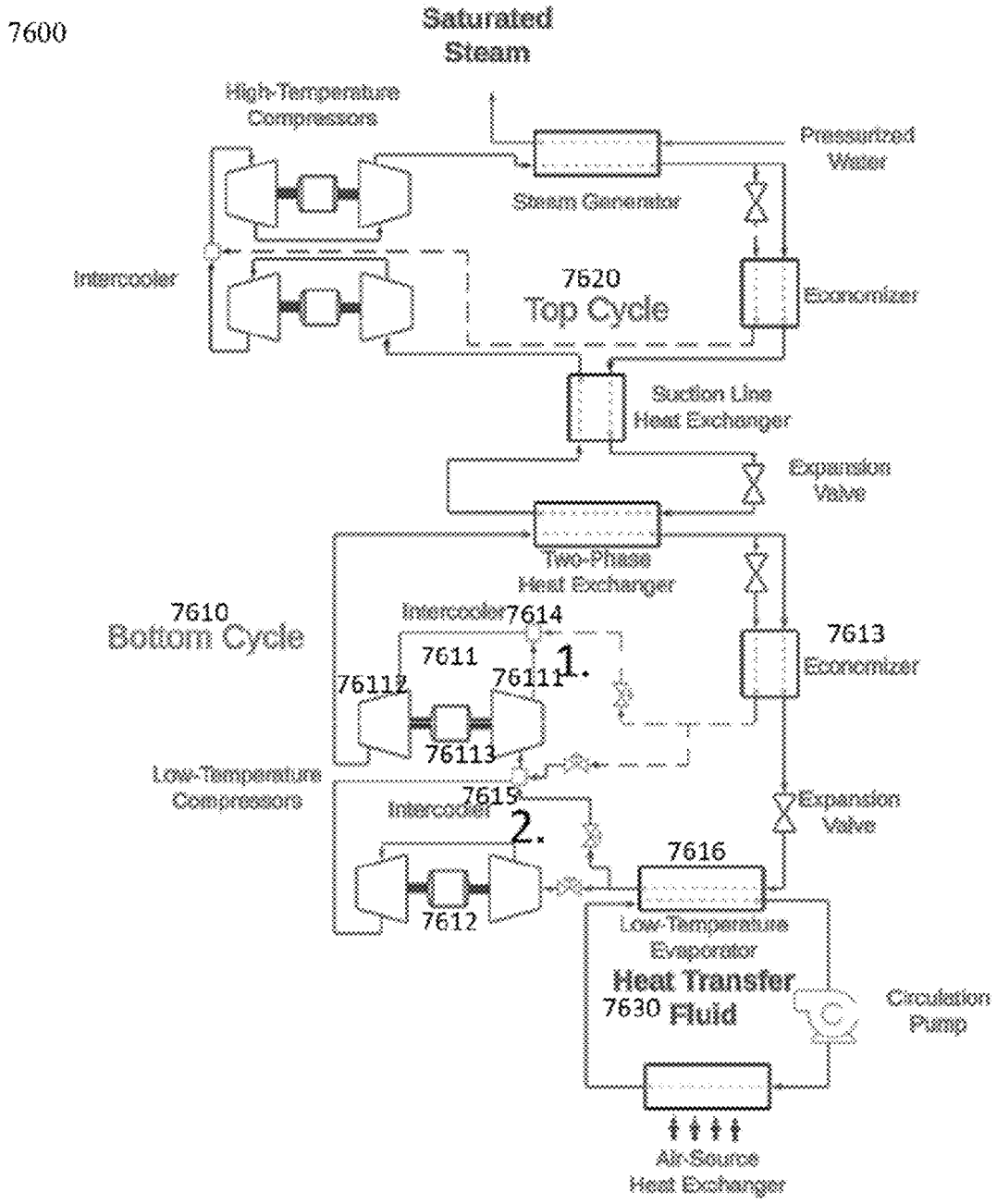
FIGS. 76-79 illustrate examples of steam generating systems with intercoolers in accordance with some embodiments described herein.

FIG. 76 illustrates an example of a steam generating system in accordance with some embodiments described herein. The system 7600 comprises a top cycle 7620, a bottom cycle 7610, and a heat transfer fluid cycle 7630. The bottom cycle 7610 comprises a first two-stage compressor 7611 and a second two-stage compressor 7612. The bottom cycle further comprises an economizer 7613, a first intercooler 7614, and a second intercooler 7615. The two-stage compressors comprise first stage compressors 76111, second stage compressors 76112, and motors 76113 between the first stage compressors 76111 and the second stage compressors 76112. The economizer 7613 may be configured to deliver a fluid to the first intercooler 7614 and the second intercooler 7615. The first intercooler 7614 may be between the first stage compressors 76111 and the second stage compressor 76112 of the second two-stage compressor 7611. The first intercooler 7614 may be configured to decrease the temperature of the working fluid stream between the first stage compressor 76111 and the second stage compressor 76112 by about 0.1° C., 0.2° C., 0.3° C., 0.4° C., 0.5° C., 0.6° C., 0.8° C., 1° C., 1.2° C., 1.5° C., 2° C., 3° C., 4° C., 6° C., 8° C., 10° C., 12° C., 15° C., 20° C., or more. The decrease in temperature of the working fluid stream between the first stage compressor 76111 and the second stage compressor 76112 may be between any two values described herein. The second intercooler 7615 may be between the first two-stage compressor 7611 and the second two-stage compressor 7612. The second intercooler 7615 may be configured to receive fluid from the economizer 7613 and/or a heat exchanger 7616. The second intercooler 7615 may be configured to decrease the temperature of the working fluid stream between the first two-stage compressor 7611 and the second two-stage compressor 7612 by about 0.1° C., 0.2° C., 0.3° C., 0.4° C., 0.5° C., 0.6° C., 0.8° C., 1° C., 1.2° C., 1.5° C., 2° C., 3° C., 4° C., 6° C., 8° C., 10° C., 12° C., 15° C., 20° C., or more. The decrease in temperature of the working fluid stream between the first two-stage compressor 7611 and the second two-stage compressor 7612 may be between any two values described herein. During operation, the second two-stage compressor 7612 can be bypassed. In this case, the fluid from the economizer 7613 may be delivered only to the first intercooler 7614. Alternatively, the first two-stage compressor 7611 and the second two-stage compressor 7612 can be in operation. In this case, some or all of the fluid from the economizer 7613 may be delivered to the second intercooler 7615. In alternative embodiments (not shown), more than two compressors or more than two intercoolers may be used. In alternative embodiments (not shown), the multiple intercoolers may be located in the top cycle. In alternative embodiments (not shown), the intercoolers may be located at various locations in the top cycle or the bottom cycle.

Figure 77:
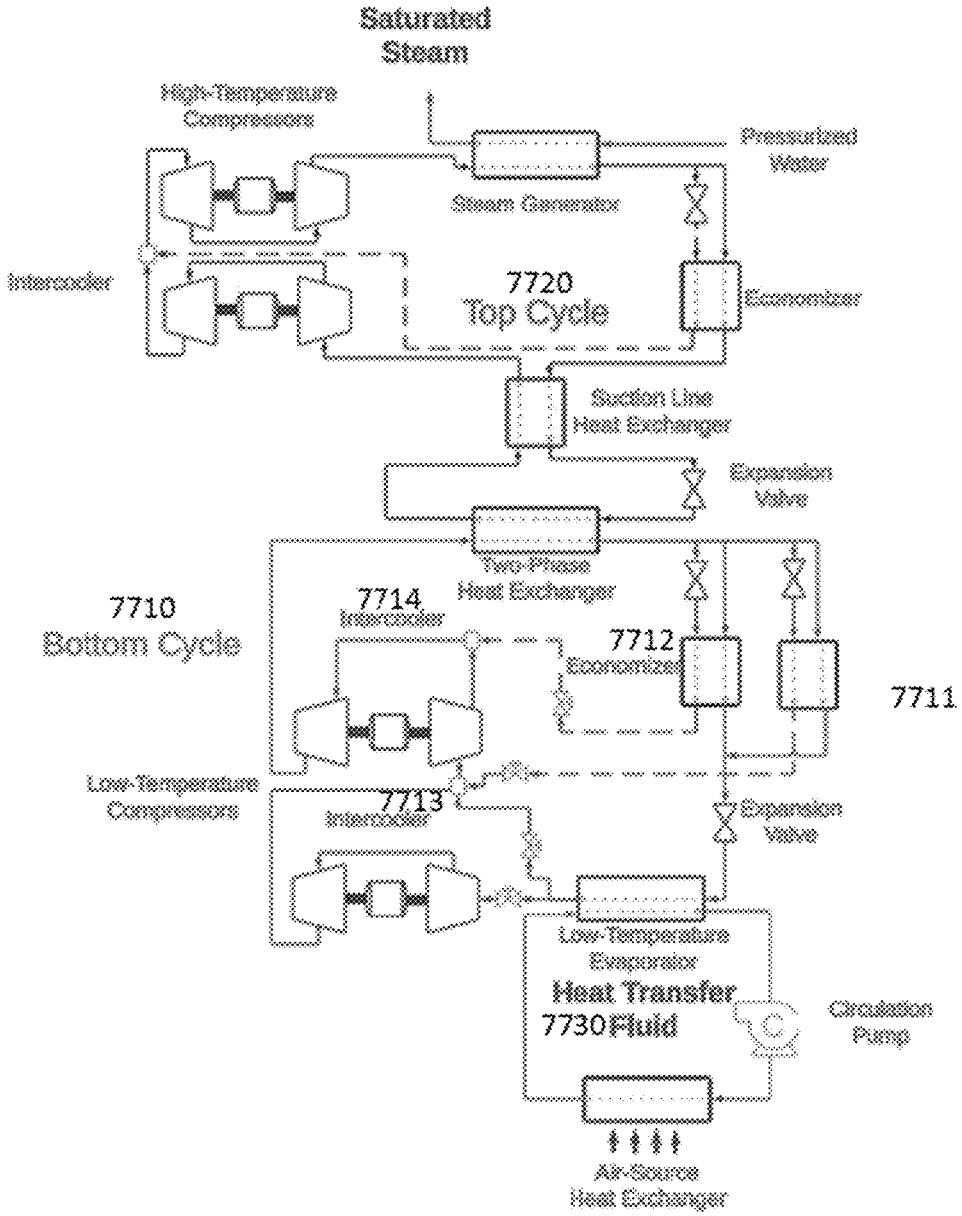

FIG. 77 illustrates an alternative embodiment of the steam generating system of FIG. 76. The steam generating system 7700 in FIG. 77 comprises a top cycle 7720, a bottom cycle 7710, and a heat transfer fluid cycle 7730. The bottom cycle comprises a first economizer 7711, a second economizer 7712, a first intercooler 7713 and a second intercooler 7714. The first economizer 7711 may be configured to deliver a fluid to the first intercooler 7713. The second economizer 7712 may be configured to deliver a fluid to the second intercooler 7714. The first economizer 7711 and the second economizer 7712 are configured to operate in parallel.

Figure 78:
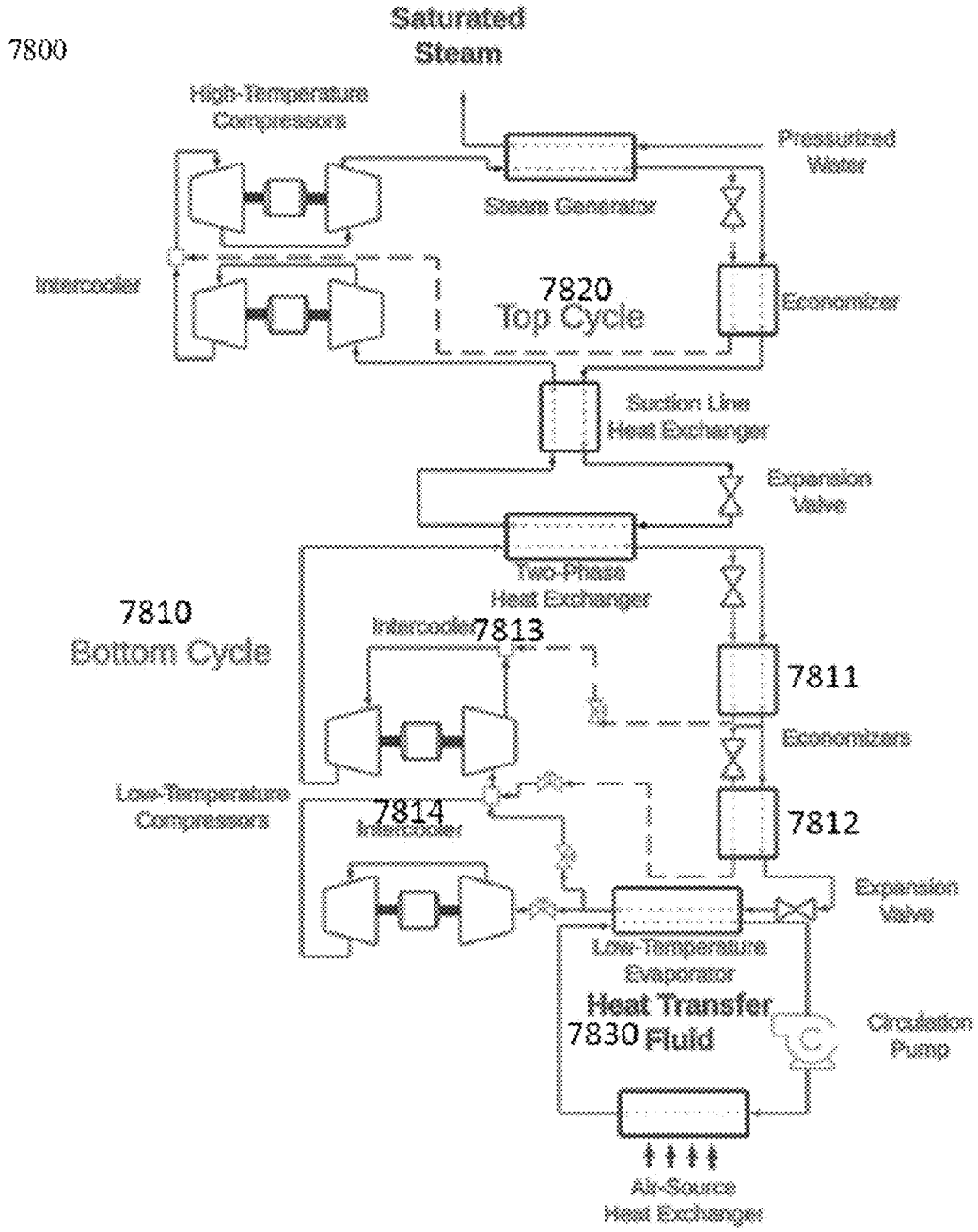

FIG. 78 illustrates an alternative embodiment of the steam generating system of FIG. 76. The steam generating system 7800 in FIG. 78 comprises a top cycle 7820, a bottom cycle 7810, and a heat transfer fluid cycle 7830. The bottom cycle comprises a first economizer 7811, a second economizer 7812, a first intercooler 7813 and a second intercooler 7814. The first economizer 7811 may be configured to deliver a fluid to the first intercooler 7813. The second economizer 7812 may be configured to deliver a fluid to the second intercooler 7814. The first economizer 7811 and the second economizer 7812 are configured to operate in series.

Figure 79:
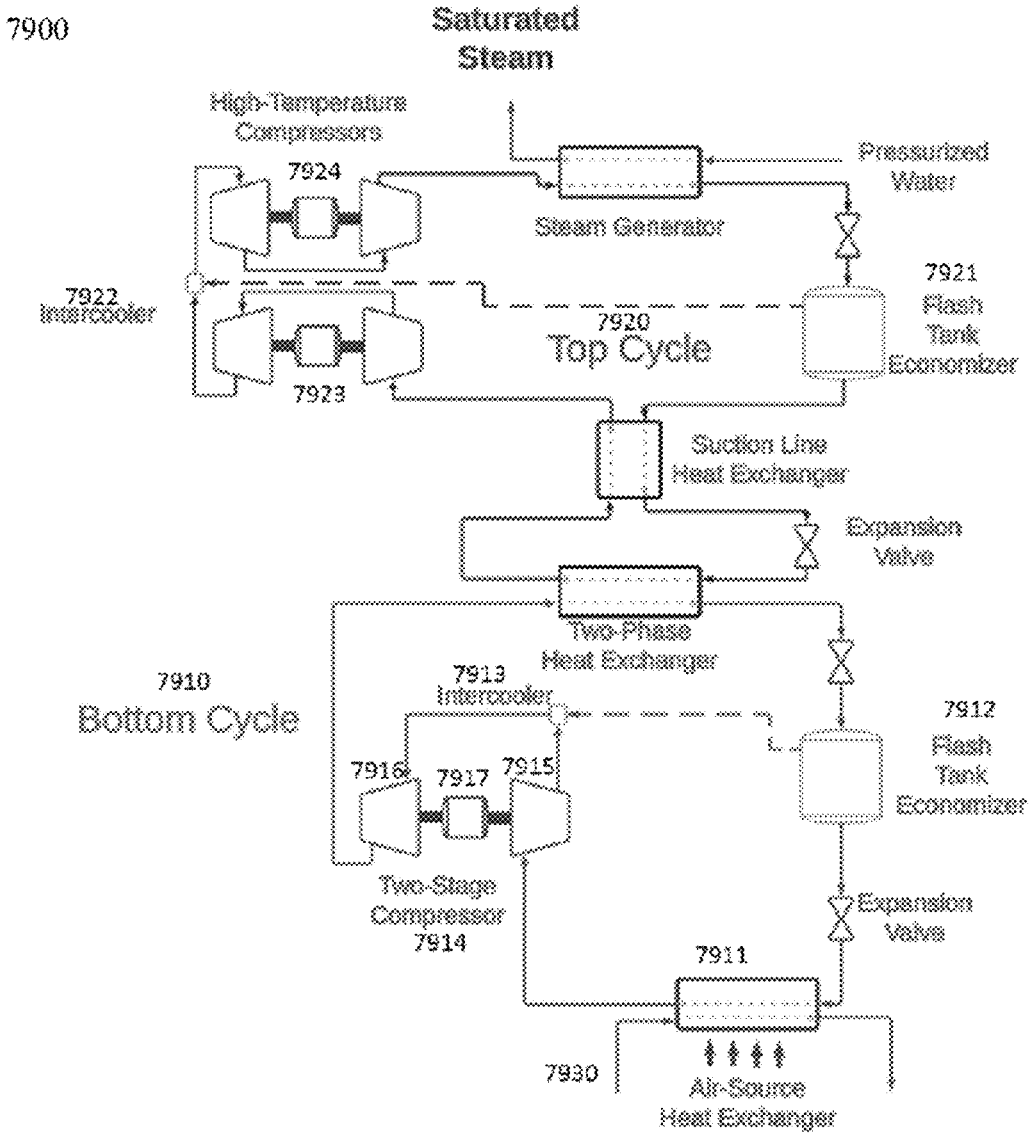

FIG. 79 illustrates an example of a steam generating system in accordance with some embodiments described herein. The steam generating system 7900 in FIG. 79 comprises a top cycle 7920, a bottom cycle 7910, and a heat transfer fluid cycle 7930. The bottom cycle 7910 comprises a heat exchanger 7911, a flash tank economizer 7912, an intercooler 7913 and a two-stage compressor 7914. The two-stage compressor comprises a first stage compressor 7915, a second stage compressor 7916, and a motor 7917 between the first stage compressor 7915 and the second stage compressor 7916. The intercooler is configured to receive a vapor stream from a flash tank economizer 7912 and the first stage compressor 7915. The intercooler 7913 may be between the first stage compressor 7915 and a second stage compressor 7916. The second stage compressor is configured to receive a fluid from the intercooler 7913. The intercooler 7913 may be configured to decrease the temperature of the working fluid stream between the first stage compressor 7915 and the second stage compressor 7916 by about 0.1° C., 0.2° C., 0.3° C., 0.4° C., 0.5° C., 0.6° C., 0.8° C., 1° C., 1.2° C., 1.5° C., 2° C., 3° C., 4° C., 6° C., 8° C., 10° C., 12° C., 15° C., 20° C., or more. The decrease in temperature of the working fluid stream between the first stage compressor 7915 and the second stage compressor 7916 may be between any two values described herein. The top heat pump cycle 7920 comprises a flash tank economizer 7921, an intercooler 7922, a first two-stage compressors 7923, and a second two-stage compressor 7924. The intercooler 7922 is configured to receive a vapor stream from a flash tank economizer 7921. The intercooler 7922 may be between the first two-stage compressor 7923 and a second two-stage compressor 7924. The intercooler 7922 may be configured to decrease the temperature of the working fluid stream between the first two-stage compressor 7923 and the second two-stage compressor 7924 by about 0.1° C., 0.2° C., 0.3° C., 0.4° C., 0.5° C., 0.6° C., 0.8° C., 1° C., 1.2° C., 1.5° C., 2° C., 3° C., 4° C., 6° C., 8° C., 10° C., 12° C., 15° C., 20° C., or more. The decrease in temperature of the working fluid stream between the first two-stage compressor 7923 and the second two-stage compressor 7924 may be between any two values described herein. The second two-stage compressor 7924 is configured to receive a fluid from the intercooler 7922.

Figure 95:
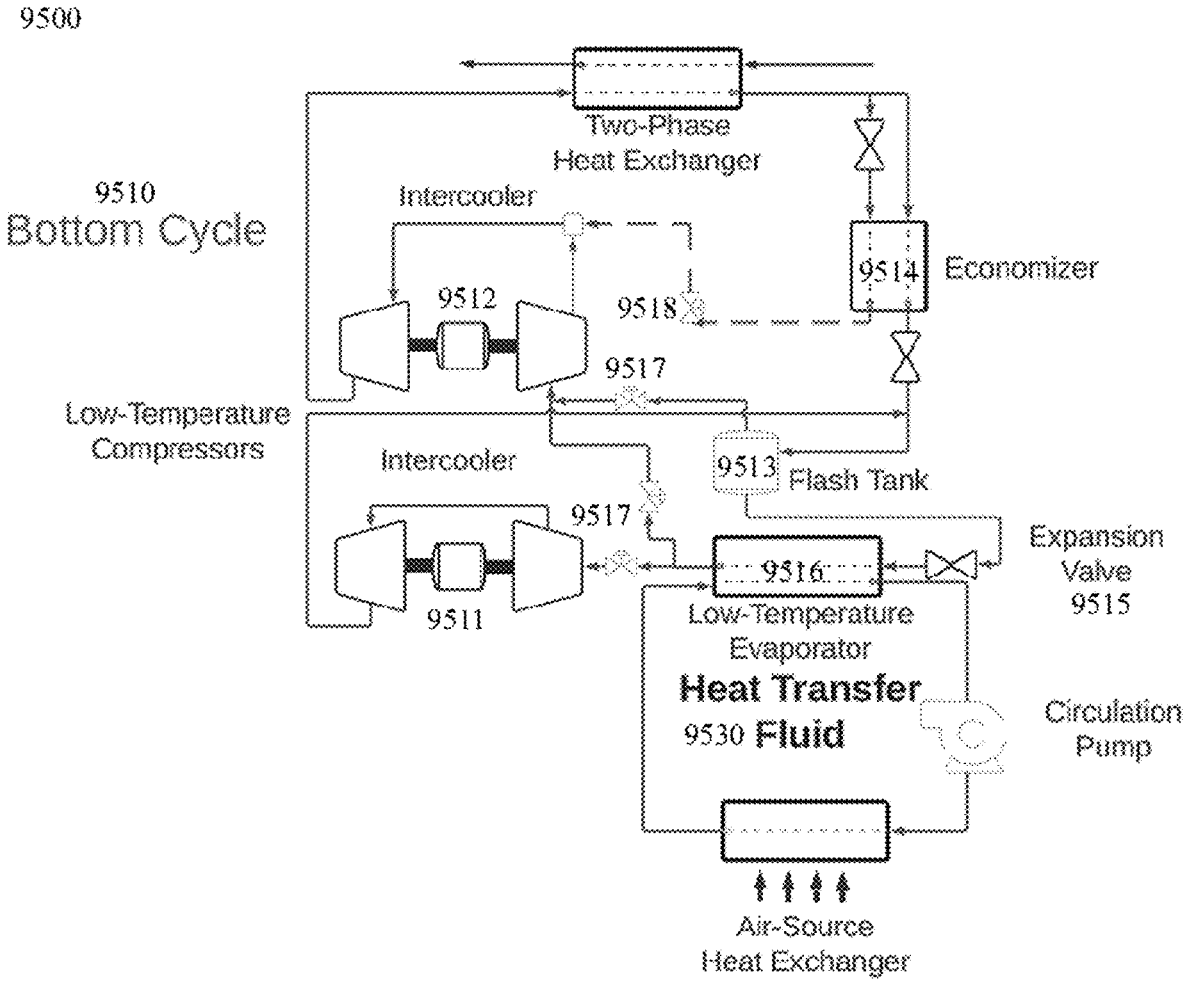
FIG. 95 illustrates an example of a steam generating system with a flash tank in accordance with some embodiments described herein.

FIG. 95 illustrates an example of a steam generating system in accordance with some embodiments described herein. The steam generating system 9500 in FIG. 95 comprises a bottom cycle 9510 and a heat transfer fluid cycle 9530. The bottom cycle 9510 may comprise a first compressor 9511, a second compressor 9512, a flash tank 9513, and an economizer 9514. The flash tank 9513 may be configured to receive a working fluid stream output stream from the first compressor 9511 and an economizer 9514. The flash tank 9513 may be configured to comprise a saturated liquid at the bottom of the tank and an evaporated fluid at the top of the tank. The saturated liquid may be routed to an expansion valve 9515 then a low-temperature evaporator 9516. The expansion valve 9515 and the low-temperature evaporator 9516 may cause the saturated liquid to decrease in pressure, absorb heat from an external source, and evaporate. The evaporated fluid exiting the evaporator 9516 may enter the first compressor 9511. The evaporated fluid in the flash tank 9513 may be routed to the second compressor 9512. Locating a flash tank 9513 between two compressors may reduce the superheat at the second compressor 9512 suction or reduce the volumetric flow rate on the first compressor 9511. This configuration may shift more of the flow to the second compressor 9512. Bypass valves 9517 may be used to bypass the first compressor 9511. A valve 9517 may be used on the line exiting the top of the flash tank 9513. The valve 9517 may be closed to force the entire flow through the evaporator 9516 (e.g., when the first compressor 9511 is bypassed). A valve 9518 may be used on the outlet working fluid stream of the economizer 9514. The valve 9518 may be closed during high ambient temperature conditions.

Figure 80:
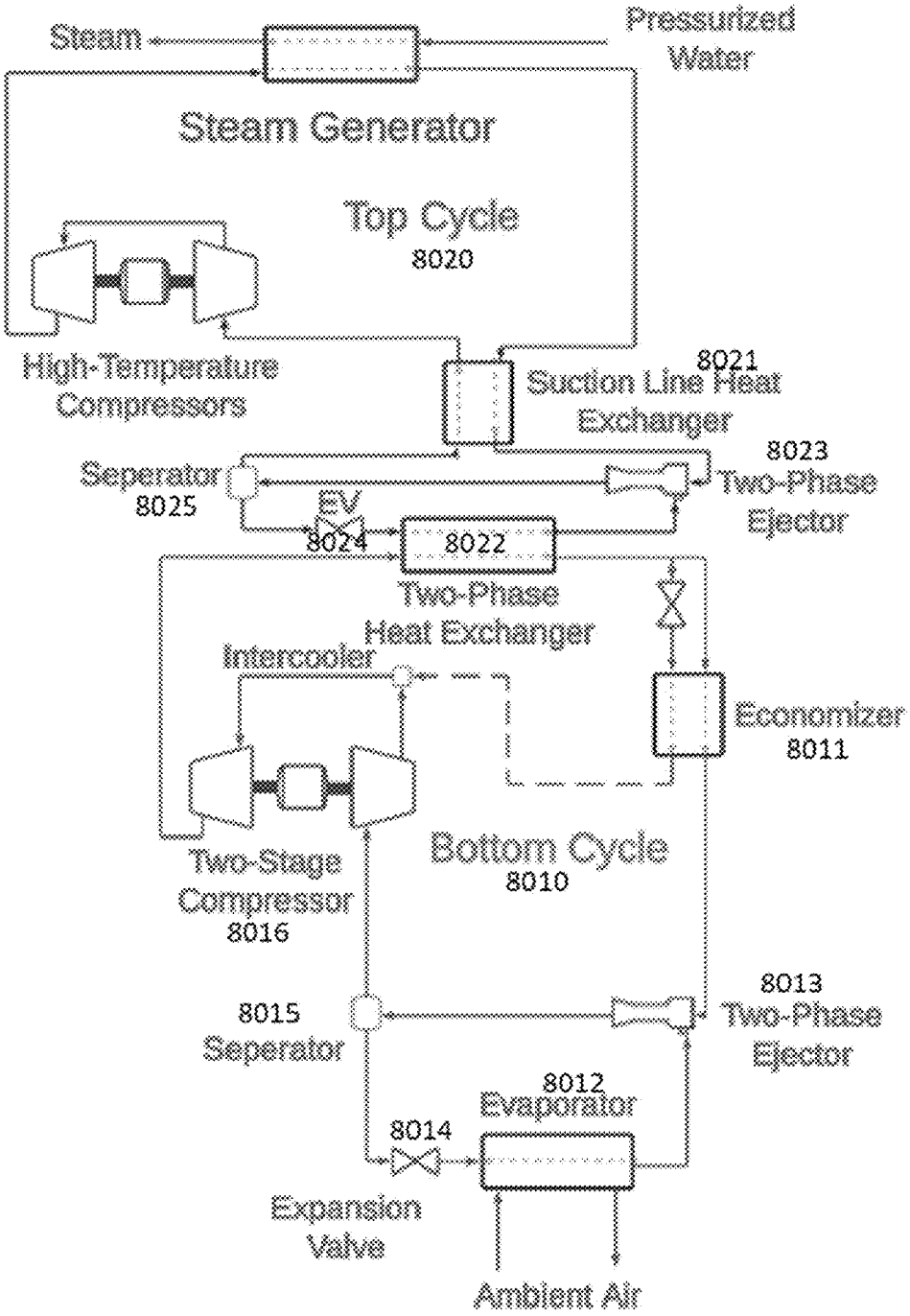
FIG. 80 illustrates an example of a steam generating system with an ejector in accordance with some embodiments described herein.

FIG. 80 illustrates an example of a steam generating system in accordance with some embodiments described herein. The steam generating system 8000 in FIG. 80 comprises a top cycle 8020 and a bottom cycle 8010. The top cycle 8020 comprises a suction-line heat exchanger 8021, a two-phase heat exchanger 8022, a two-phase ejector 8023, an expansion valve 8024, and a separator 8025. The bottom cycle 8010 comprises an economizer 8011, an evaporator 8012, a two-phase ejector 8013, an expansion valve 8014, a separator 8015, and a two-stage compressor 8016. The two-phase ejectors 8023 and 8013 may be configured to recover energy in a refrigerant flow's throttling process. The two-phase ejectors 8023 and 8013 may be configured to ensure that the refrigerant enters the two-phase heat exchanger 8022 or the evaporator 8012 with a lower vapor quality or as saturated liquid, thereby increasing heat absorption capacity. The vapor quality entering the two-phase heat exchanger 8022 may be greater than or equal to about 0%, 5%, 10%, 15%, 20%, 25%, 30%, 40%, 50%. The vapor quality entering the two-phase heat exchanger 8022 may be between any two values described herein. The two-phase ejectors 8023 and 8013 may be configured to act as thermo-compressors, providing a higher compressor suction pressure, thereby reducing compressor work. The ratio of pressure between the pressure at a separator and the pressure at a downstream heat exchanger may be greater than or equal to about 1, 1.2, 1.4, 1.5, 1.6, 1.8, 2.0, 2.5, 3.0, 3.5, 4.0, 4.5 or 5.0. The ratio of pressure between the pressure at a separator and the pressure at a downstream heat exchanger may be between any two values described herein.

FIG. 82-85 illustrate examples of steam generating systems in accordance with some embodiments described herein. The steam generating system 8200 of FIG. 82 comprises a top cycle 8220 and a bottom cycle 8210. The bottom cycle 8210 and the top cycle 8220 comprise a two-phase heat exchanger 8211 and a subcooler 8212. The top cycle 8220 further comprises an expansion valve 8221 and top cycle liquid line 8222. A working fluid from the top cycle is pulled from the bottom of the two-phase heat exchanger 8211 to the subcooler 8212. The subcooler 8212 may be configured to transfer heat from a working fluid from the bottom cycle to a working fluid from the top cycle. The subcooler 8212 may behave as a thermosyphon (e.g. passively cooling a working fluid of the bottom cycle without needing additional valves or pumps). The subcooler 8212 may be located at a location equal to or below the two-phase heat exchanger 8211. The benefits of locating the subcooler 8212 at a location equal to or below the two-phase heat exchanger 8211 include ensuring substantial flow on the top cycle portion of the subcooler by creating a pressure differential across two-phase heat exchanger and the connected piping (e.g., through both density differences and hydrostatic pressure differences). The working fluid may evaporate and be driven upwards where it combines with an expansion valve 8221 outlet or is injected directly into the two-phase heat exchanger 8211.

Figure 82:
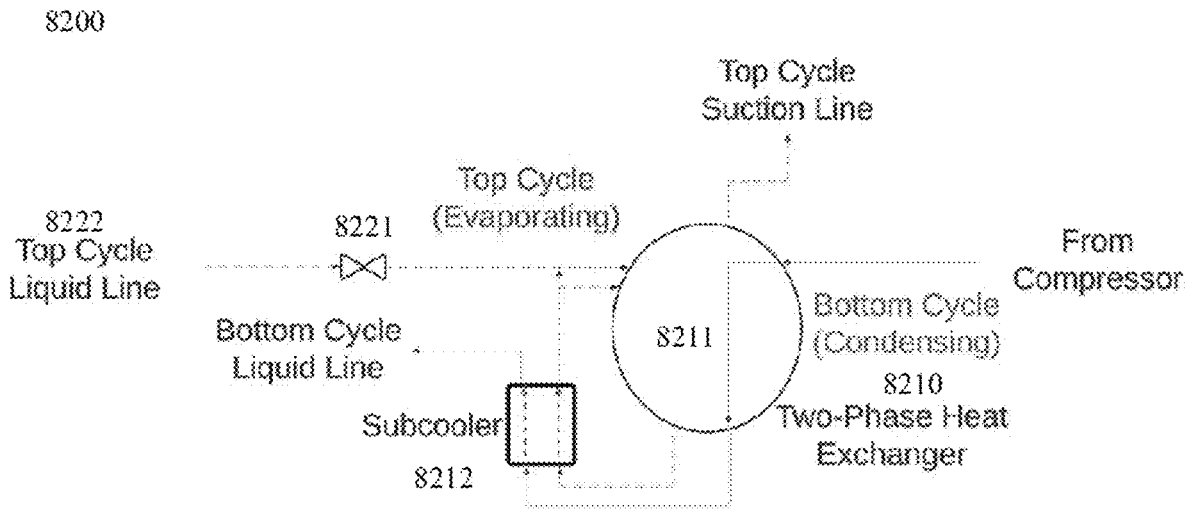
FIGS. 82-85 illustrate examples of steam generating systems with subcoolers in accordance with some embodiments described herein.
Figure 83:
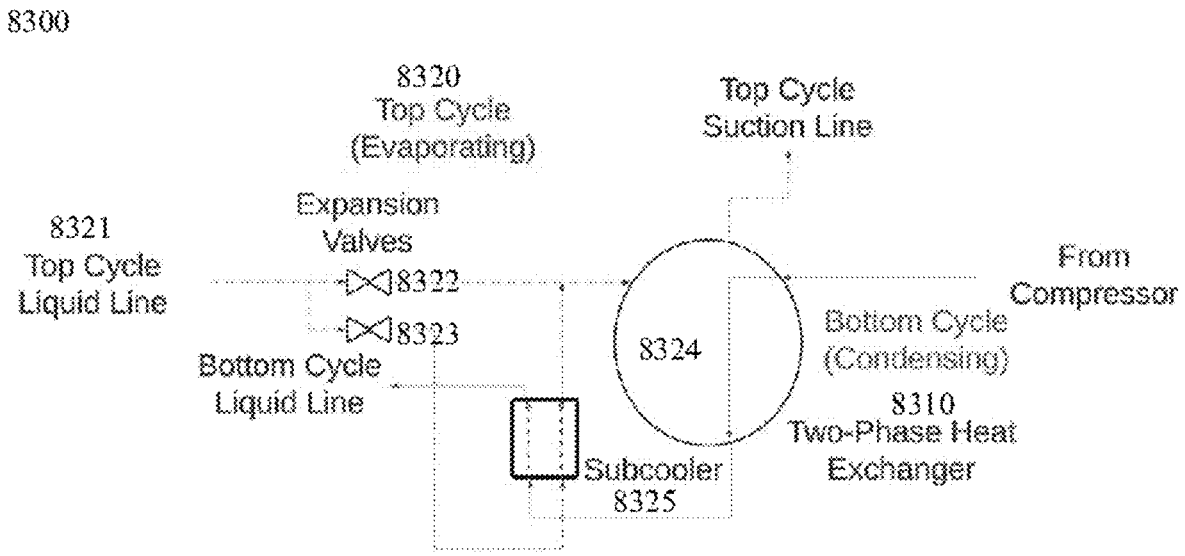

FIG. 83 illustrates an alternative embodiment of the steam generating system of FIG. 82. The steam generating system 8300 of FIG. 83 comprises a top cycle 8320 and a bottom cycle 8310. The top cycle 8320 comprises a top cycle liquid line 8321, a first expansion valve 8322, a second expansion valve 8323, a two-phase heat exchanger 8324, and a subcooler 8325. The top cycle liquid line 8321 enters the first expansion valve 8322 then the two-phase heat exchanger 8324 or the second expansion valve 8323 then the subcooler 8325. The working fluid output of the subcooler enters the outlet stream of the first expansion valve 8322. The second expansion valve 8323 may be configured to control the amount of flow entering the subcooler 8325.

Figure 84:
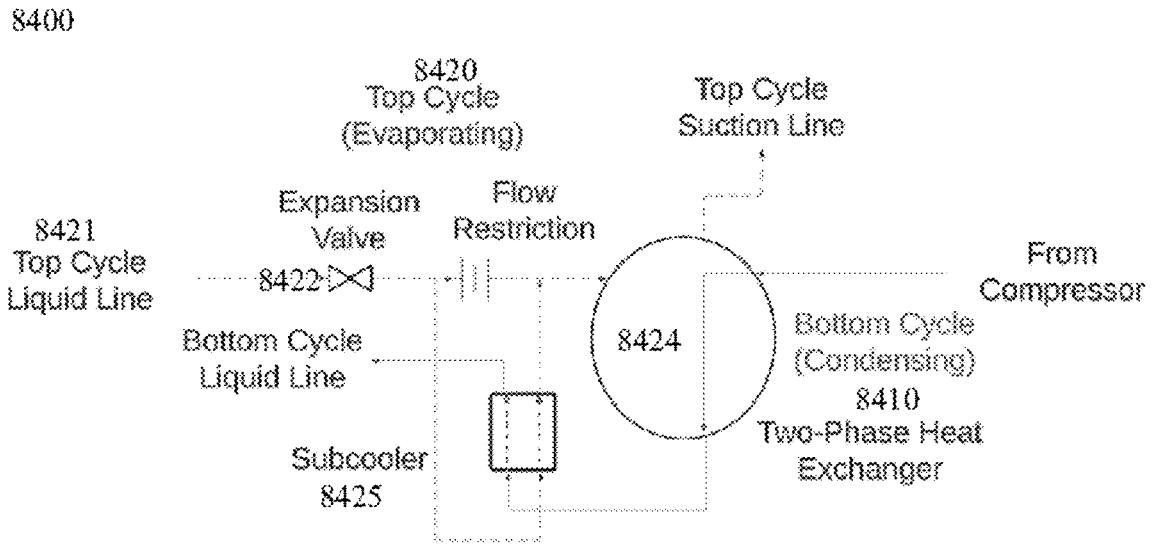

FIG. 84 illustrates an alternative embodiment of the steam generating system of FIG. 82. The steam generating system 8400 of FIG. 84 comprises a top cycle 8420 and a bottom cycle 8410. The top cycle 8420 comprises a top cycle liquid line 8421, an expansion valve 8422, a flow restriction 8423, a two-phase heat exchanger 8324, and a subcooler 8325. The top cycle liquid line 8421 enters the expansion valve 8422. The working fluid output of the expansion valve 8422 enters the flow restriction 8423 and the subcooler 8425. The working fluid output of the subcooler 8425 enters the working fluid output of the flow restriction 8423 then enters the two-phase heat exchanger 8424. The flow restriction 8423 may be configured to reduce the amount of flow entering the subcooler 8425. The flow entering the subcooler may be less than or equal to about 0%, 2%, 5%, 10%, or 20% of the total flow. The flow entering the subcooler may be greater than about 0%, 2%, 5%, 10%, or 20% of the total flow. A The flow entering the subcooler may be between any two values described herein, for example between 0% and 20%.

Figure 85:
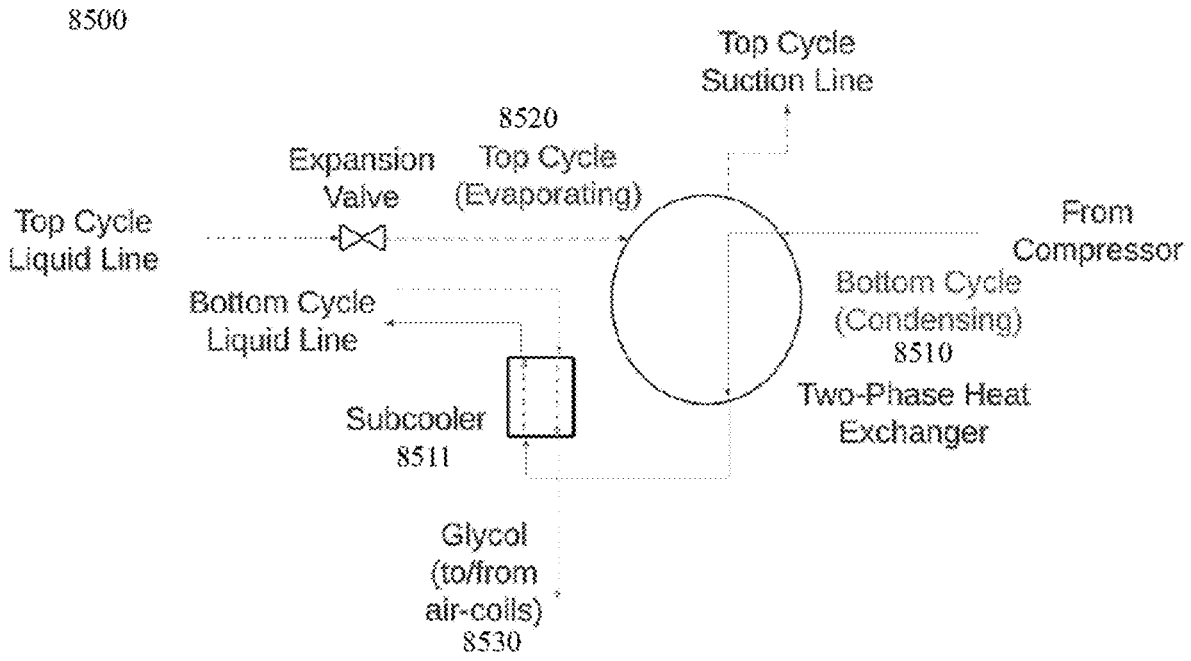

FIG. 85 illustrates an alternative embodiment of the steam generating system of FIG. 82. The steam generating system 8500 of FIG. 85 comprises a top cycle 8520, a bottom cycle 8510, and a glycol loop 8530. The bottom cycle 8510 and the glycol loop 8530 comprise a subcooler 8511. The subcooler 8511 may be configured to transfer heat from a first working fluid from the bottom cycle 8510 to a second working fluid from the glycol loop 8530.

Figure 86:
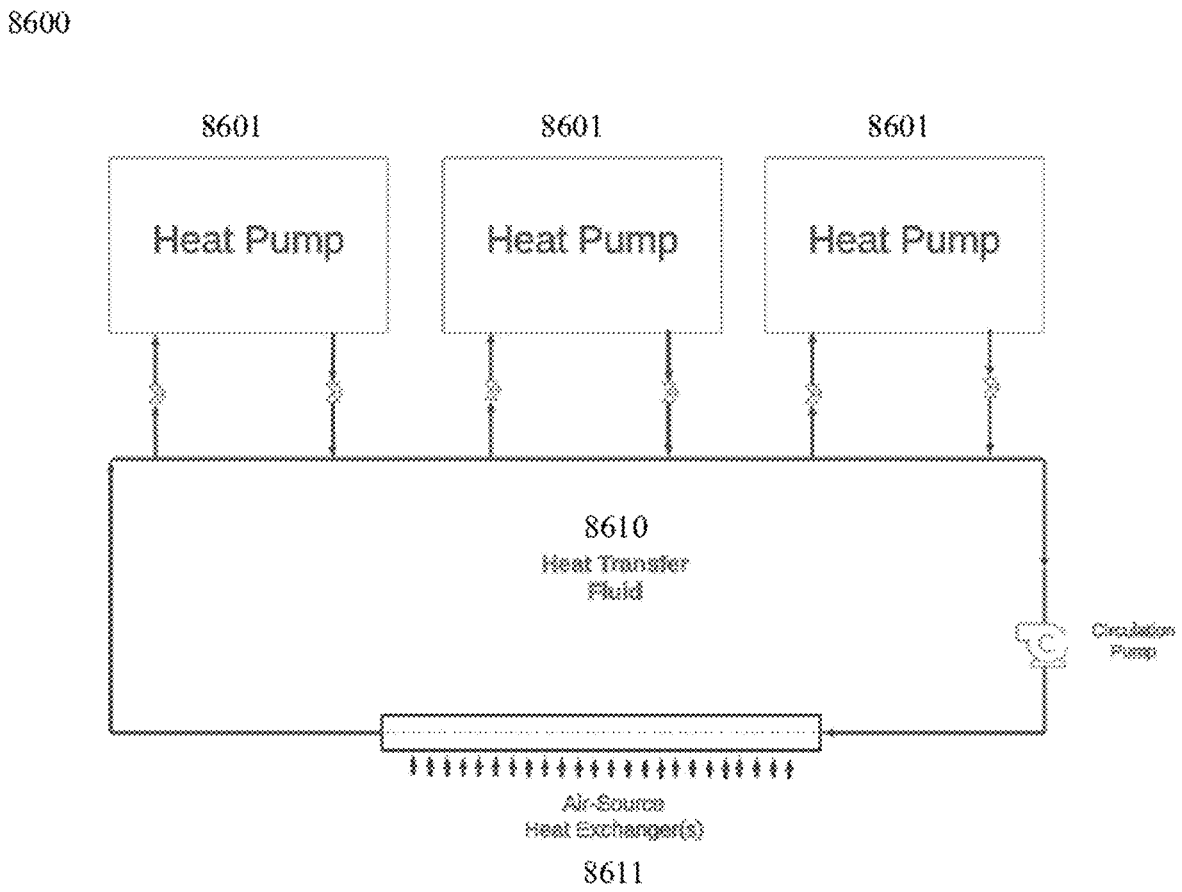
FIG. 86 illustrates an example of a steam generating system with multiple heat pumps in series in accordance with some embodiments described herein.
Figure 87:
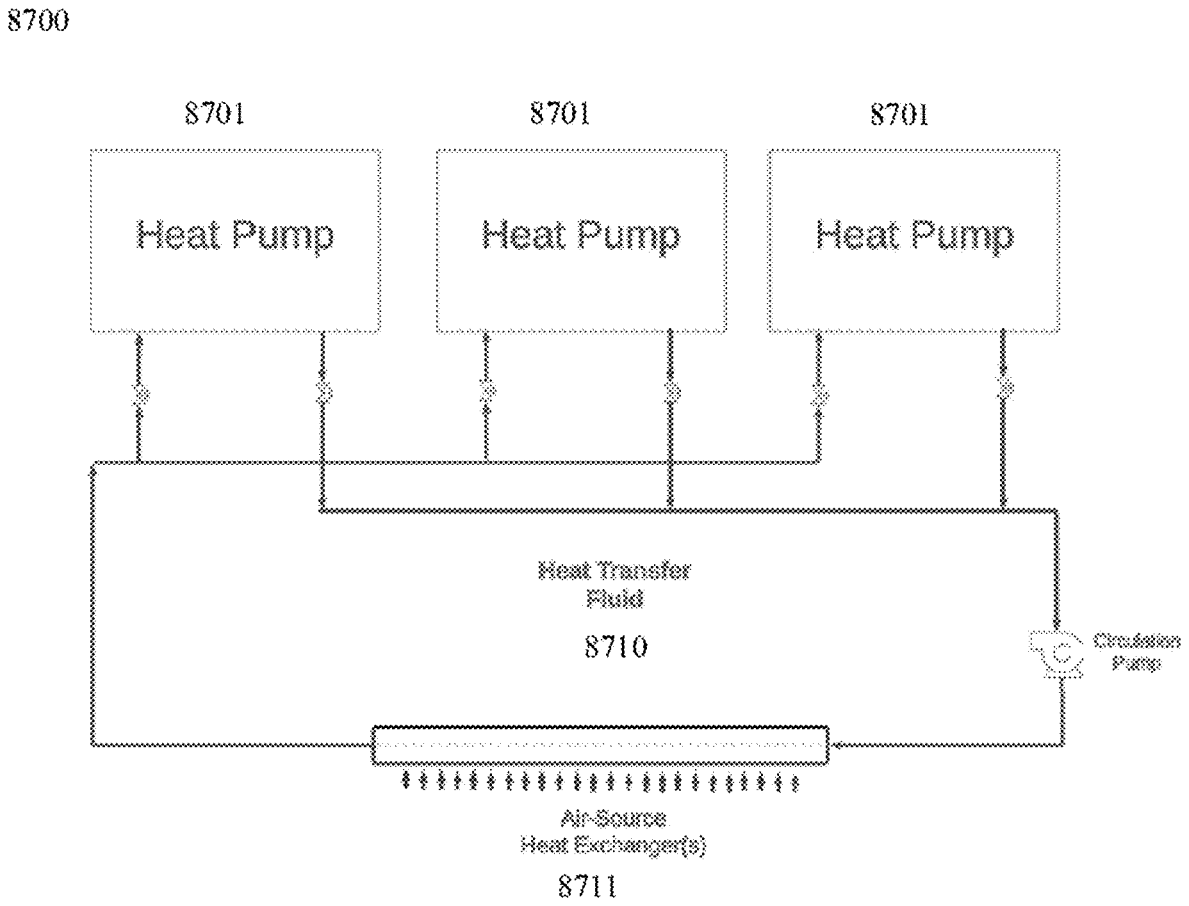
FIG. 87 illustrates an example of a steam generating system with multiple heat pumps in parallel in accordance with some embodiments described herein.

FIG. 86-87 illustrate examples of steam generating systems in accordance with some embodiments described herein. The steam generating system 8600 in FIG. 86 comprises multiple heat pumps 8601 and a heat transfer fluid cycle 8610. The multiple heat pumps 8601 may be connected to the same heat transfer fluid cycle 8610. The heat transfer fluid cycle 8610 may be a glycol loop. The heat transfer cycle may comprise one or more air-source heat exchangers 8611. The one or more air-source heat exchangers 8611 may be located in a centralized location and may be fewer than the number of heat pumps. The multiple heat pumps 8601 may be arranged in series, resulting in different source temperatures to each heat pump. This configuration may be useful if the heat pumps are delivering different pressure steam. Alternatively, or in addition, multiple heat pumps may allow steam generation closer to the end user, which may enable lower steam pressure to be generated and thus enable the heat pump to be more efficient.

FIG. 87 illustrates an alternative embodiment of the steam generating system of FIG. 86. The steam generating system 8700 of FIG. 87 comprises multiple heat pumps 8701 and a heat transfer fluid cycle 8710. The multiple heat pumps 8701 may be connected to the same heat transfer fluid cycle 8710. The heat transfer fluid cycle 8710 may be a glycol loop. The multiple heat pumps 8701 are arranged in parallel, resulting in the same source temperature to each heat pump. This configuration may be useful if the heat pumps are delivering the same pressure steam.

Figure 88:
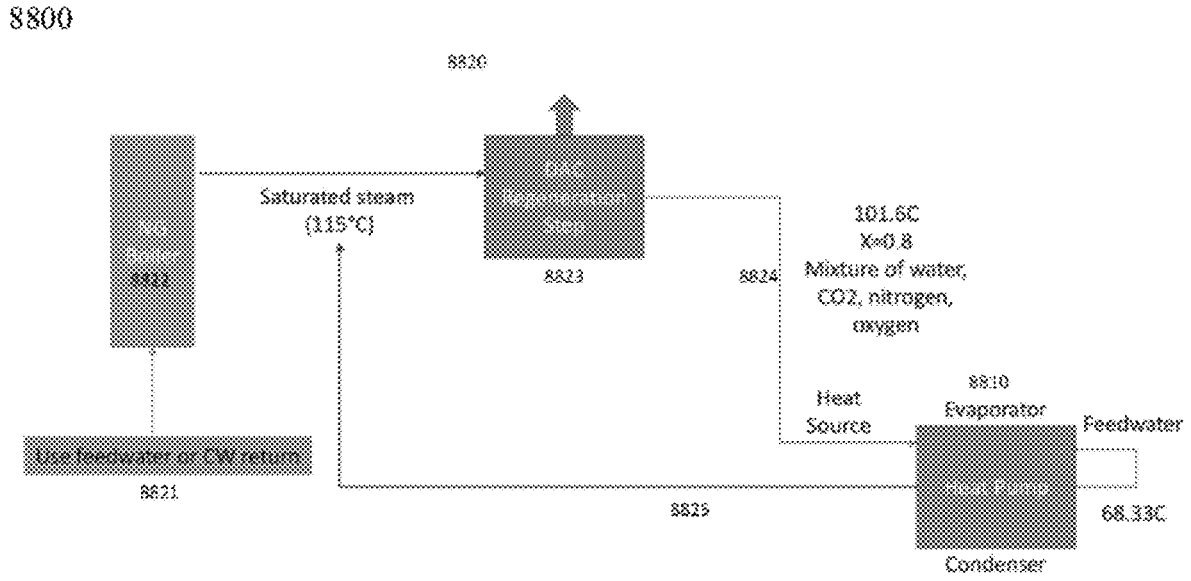
FIG. 88 illustrates an example of a steam generating system integrated with carbon capture in series in accordance with some embodiments described herein.

FIG. 88 illustrates an example of a steam generating system in accordance with some embodiments described herein further comprising a carbon capture system. The steam generating system 8800 in FIG. 88 comprises a heat pump 8810 (e.g., a condenser/evaporator) and a carbon capture system 8820. The carbon capture system 8820 comprises a feedwater stream 8821, a natural gas boiler 8822, and a direct air capture regeneration system 8823. The natural gas boiler 8822 is configured to receive feedwater from the feedwater stream 8821. The natural gas boiler 8822 is configured to produce saturated steam (e.g., at 115° C.). The saturated steam may be at a temperature greater than or equal to about 100° C., 105° C., 110° C., 115° C., 120° C., 125° C., 130° C., or greater. The temperature of the saturated steam may be between any two valued described herein.

The direct air capture system 8823 is configured to receive the saturated steam from the natural gas boiler 8822 and the heat pump 8810. The direct air capture system 8823 is configured to convert the steam and additional components from the air into a mixture 8824 of water, CO2, nitrogen and oxygen (e.g., at 101.6° C.). The mixture 8824 is configured to be used as a heat source for the heat pump 8810. The heat pump 8810 is configured to condense and subcool the mixture 8824, which is necessary to separate the CO2 and the water. A heat pump outlet stream 8825 of separated water is configured to be used as feedwater for the heat pump and turned into steam. In alternative embodiments (not shown), the heat pump may be part of the direct air capture regeneration system (e.g., operating in between the CO2 and the sorbent regeneration steps). In some embodiments, cooled air-source air may be used for cooling a space, and after cooling the space, the air-source air may be routed into the sorbent bed to capture CO2. The benefits of routing air-source air into the sorbent bed may include further increasing the air temperature for return to be used as a heat source for the heat pump. Alternatively, or in addition, steam could be used for sorbent regeneration.

Figure 96A:
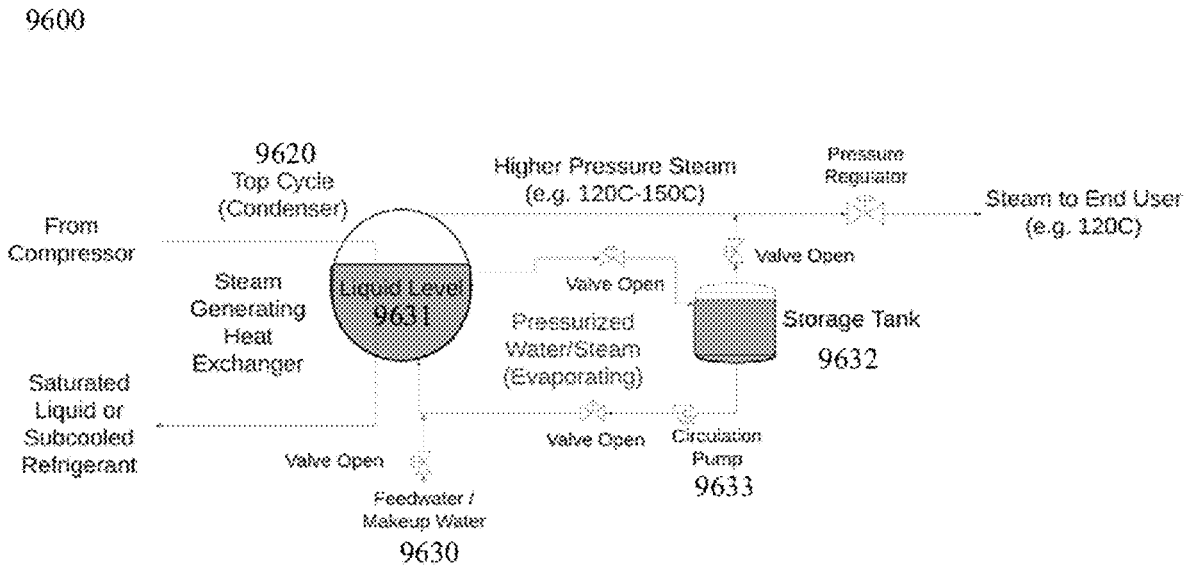
FIGS. 96A-96C illustrate an example of a steam generating system with a thermal storage tank in accordance with some embodiments described herein.
Figure 96B:
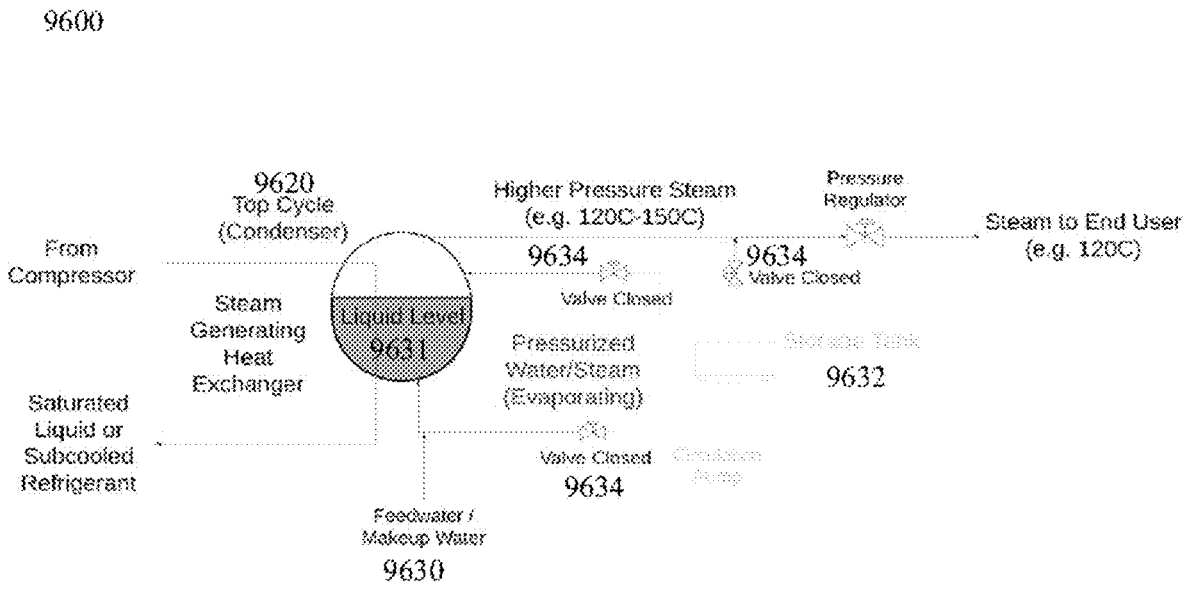
Figure 96C:
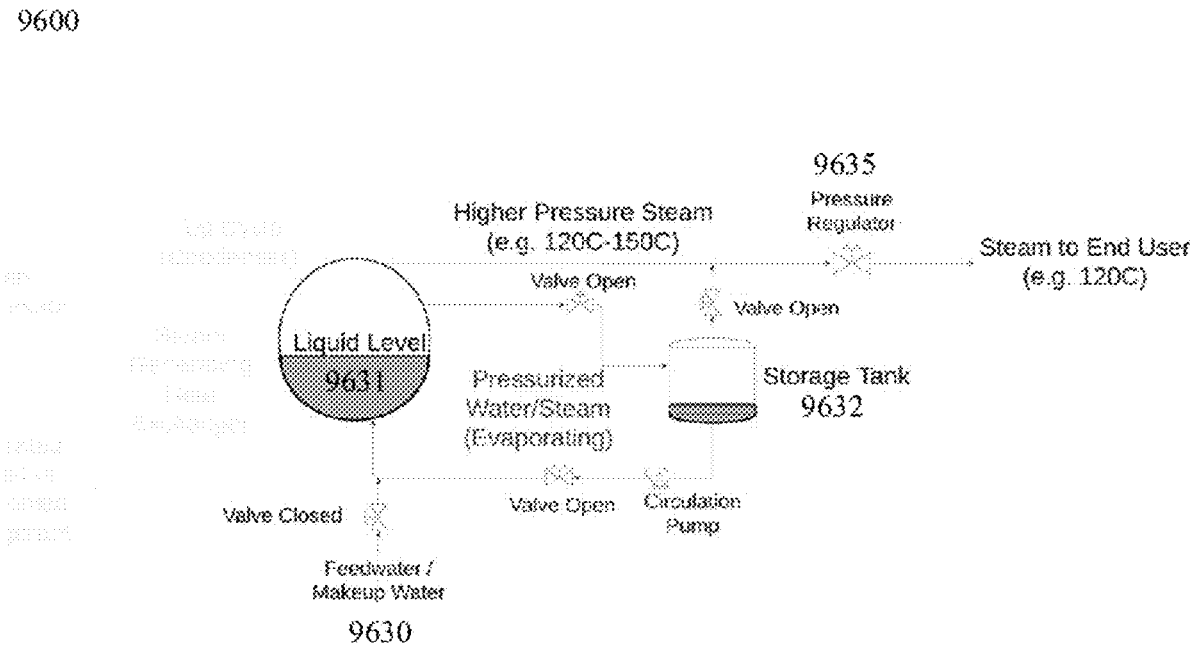

FIG. 96A illustrates an example of a steam generating system in accordance with some embodiments described herein. The steam generating system 9600 in FIG. 96A comprises a top cycle 9620 and a working fluid stream 9630. The working fluid stream may comprise a steam generating heat exchanger 9631 and a storage tank 9632. The storage tank 9632 may be configured to receive a working fluid output stream from the steam generating heat exchanger 9631 (e.g., as shown in FIG. 96A). The storage tank 9632 may receive a working fluid output stream from the steam generating heat exchanger 9631 during periods when the steam consumption of the end user is lower than the steam generation. The amount of liquid in the storage tank 9632 and the steam generating heat exchanger 9631 may be increased to maximize the liquid water mass. A circulation pump 9633 may be used to ensure that the temperature of the liquid in the storage tank 9632 is the same temperature as the liquid in the steam generating heat exchanger 9631. The storage tank 9632 may be configured to be isolated and bypassed using shutoff valves 9634 (e.g., as shown in FIG. 96B). The storage tank 9632 may be isolated during periods when the heat pump is providing baseload steam without turndown. The storage tank 9632 may be configured to discharge steam (e.g., as shown in FIG. 96C). The storage tank 9632 may discharge steam during periods when the steam consumption of the end user is higher than the steam generation (e.g., when the heat pump is off). Alternatively, or in addition, the storage tank 9632 may discharge steam when the heat pump is off and the steam flow rate needed by the end-user is below a certain threshold. As the storage tank 9632 discharges steam, the pressure and temperature within the storage tank may decrease. A pressure regulator 9635 may be used to ensure that the steam reaching the end user from the storage tank is above the end user saturation pressure. The pressure regulator may also create backflow into the storage tank and steam generating heat exchanger so that the vapor quality of the storage tank and steam generator remains low. The end user saturation temperature may be greater than or equal to about 100° C., 110° C., 120° C., 130° C., 140° C., 150° C., 160° C., 170° C., 180° C., 200° C., or 225° C. The end user saturation temperature may be between any two valued described herein. Multiple storage tanks may be used in parallel. Alternatively, or in addition, multiple heat pumps may operate in parallel to charge a single storage tank. The benefits of this configuration include allowing the heat pump to cycle on and off at peak capacity or efficiency points while maintaining steam delivery flow and pressure to the customer or the ability to efficiently meet steam demands during times when steam demands are fluctuating.

Figure 97:
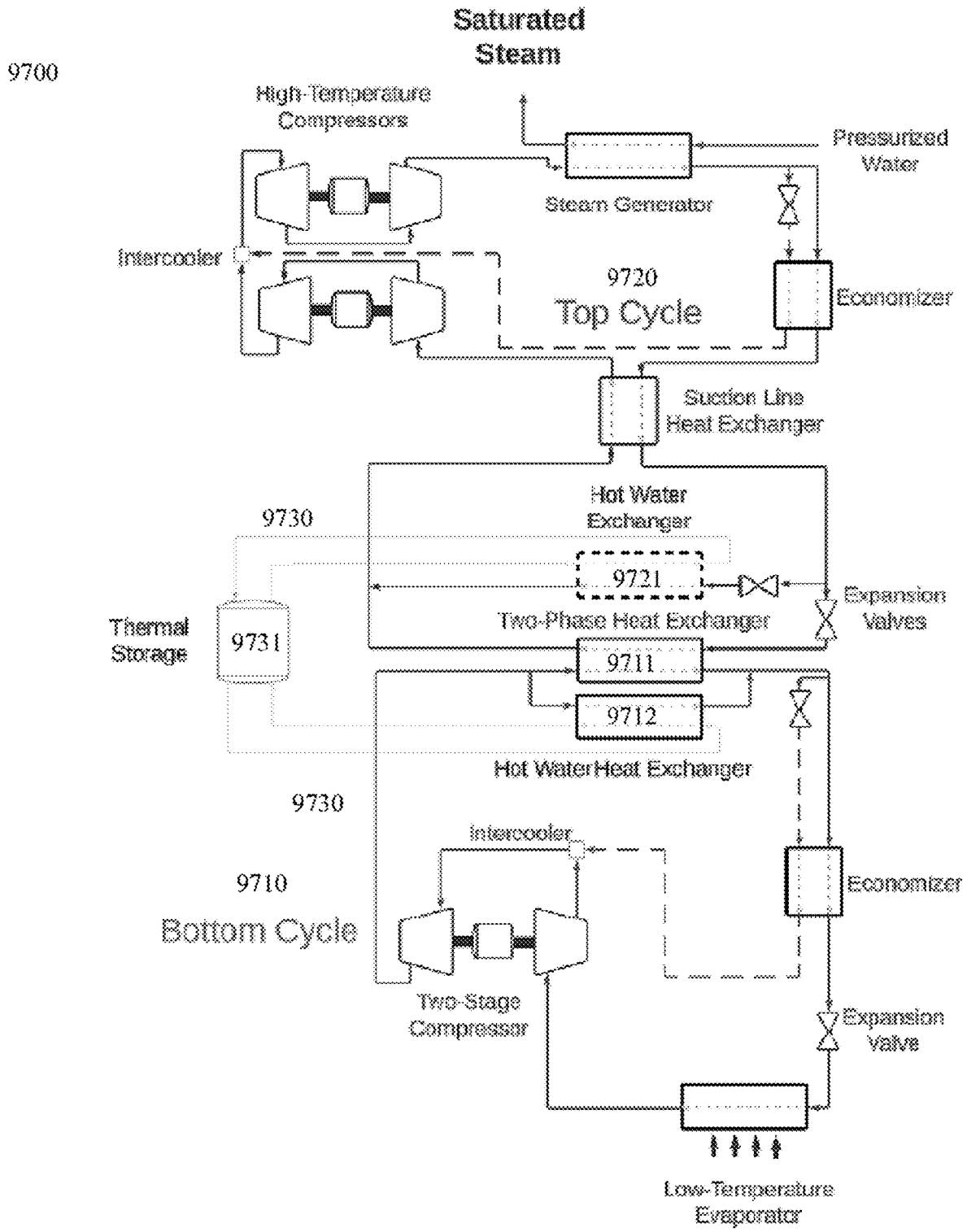
FIG. 97 illustrates an example of a steam generating system with a thermal storage tank in accordance with some embodiments described herein.

FIG. 97 illustrates an example of a steam generating system in accordance with some embodiments described herein. The steam generating system 9700 in FIG. 97 comprises a bottom heat pump cycle 9710 and a top heat pump cycle 9720. The bottom heat pump cycle 9710 further comprises a two-phase heat exchanger 9711 and a first hot water heat exchanger 9712. The first hot water heat exchanger 9712 may be configured to operate in parallel with the two-phase heat exchanger 9711. The top heat pump cycle 9720 may further comprise a second hot water exchanger 9721. The second hot water exchanger 9721 may be configured to operate in parallel with the two-phase heat exchanger 9711. The steam generating system may further comprise one or more thermal storage loops 9730. The thermal storage loops 9730 may further comprise a thermal storage 9731. The thermal storage loops 9730 may be configured to transfer heat to or from the bottom heat pump cycle 9710 or the top heat pump cycle 9720 through the first hot water exchanger 9712 or the second hot water exchanger 9721, respectively. During normal operation, the thermal storage loop 9730 may not be in use. During charging, the thermal storage loops 9730 may receive heat from either the bottom heat pump cycle 9710, the top heat pump cycle 9720, or the steam (not shown). During discharging, the thermal storage loop 9730 connected to the top heat pump cycle 9720 may transfer heat to the top heat pump cycle 9720, and the bottom heat pump cycle 9710 may remain in use (e.g., when heat from the bottom heat pump cycle is required for steam generation). Alternatively, during discharging, the bottom heat pump cycle 9710 may be not in use (e.g., when the stored energy is enough to generate steam). In an alternative embodiment (not shown), if steam or higher temperature heat is stored, the heat may be used at a higher pressure (e.g., between compressor stages).

Figure 98:
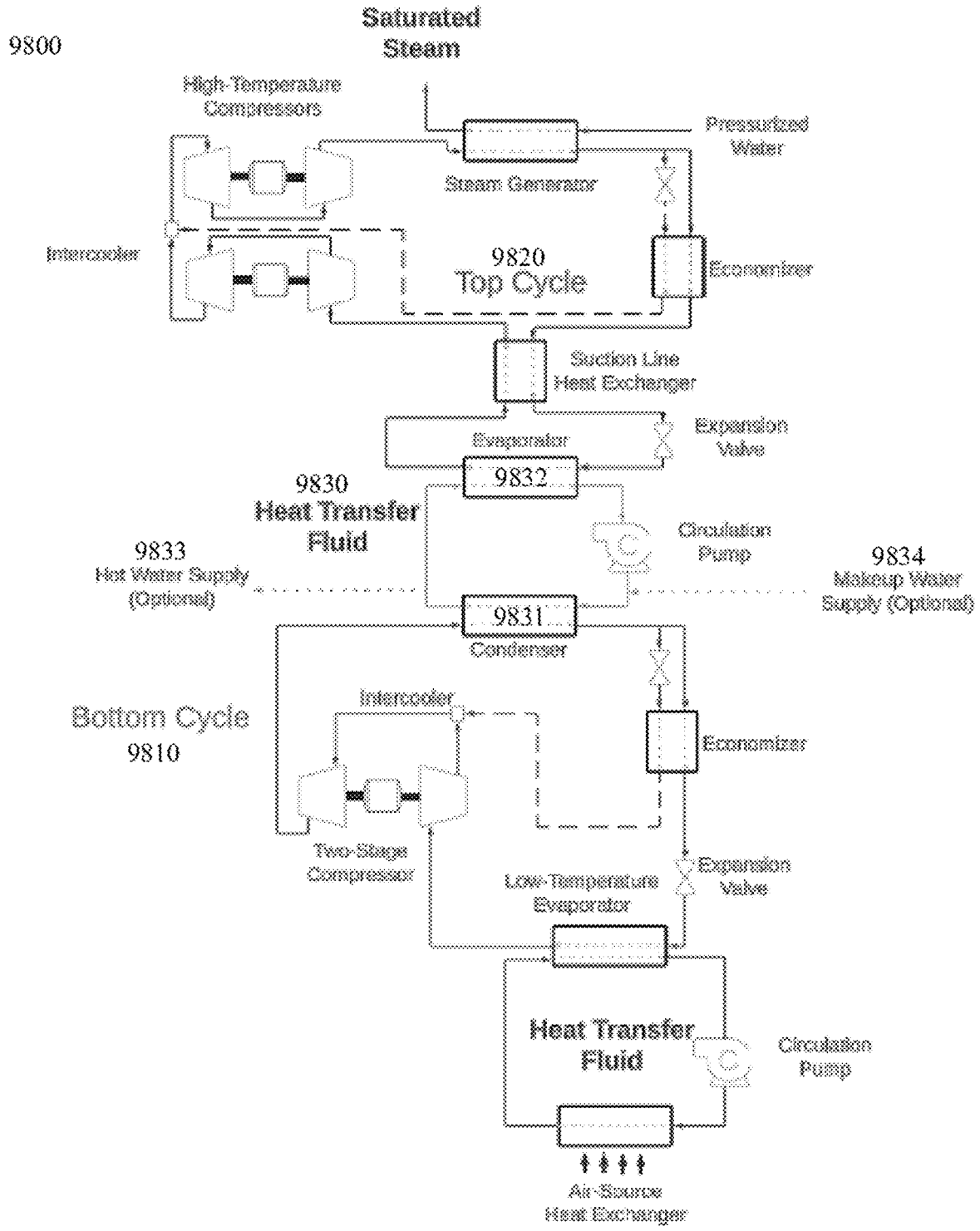
FIG. 98 illustrates an example of a steam generating system with a heat transfer fluid cycle in accordance with some embodiments described herein.

FIG. 98 illustrates an example of a steam generating system in accordance with some embodiments described herein. The steam generating system 9800 in FIG. 98 comprises a bottom heat pump cycle 9810, a top heat pump cycle 9820, and a heat transfer fluid loop 9830. The heat transfer fluid loop 9830 comprises a first heat exchanger 9831 (e.g., a condenser) and a second heat exchanger 9832 (e.g., an evaporator). The first heat exchanger 9831 may be configured to transfer heat from a working fluid of the bottom cycle 9810 to a working fluid of the heat transfer fluid loop 9830. The second heat exchanger 9832 may be configured to transfer heat from a working fluid of the heat transfer fluid loop 9830 to a working fluid of the top cycle 9820. The heat transfer cycle may be configured to divert a portion of the working fluid to the end user (e.g., as a hot water supply 9833). The heat transfer cycle may be configured to receive new working fluid via an external stream (e.g., a makeup water supply 9834). The working fluid of the heat transfer fluid cycle may be water. The benefits of this configuration may include the ability to combine two separate technologies (e.g., an air-to-water heat pump and a water-to-steam heat pump) or the ability to produce both hot water and steam. The ability to produce both hot water and steam may be beneficial for facilities that use both hot water and steam. The bottom cycle 9810 may be oversized compared to the heat load and may provide both hot water and a heat source for steam generation in the top cycle.

While preferred embodiments have been shown and described herein, it will be obvious to those skilled in the art that such embodiments are provided by way of example only. It is not intended that the disclosure be limited by the specific examples provided within the specification. While the disclosure has been described with reference to the aforementioned specification, the descriptions and illustrations of the embodiments herein are not meant to be construed in a limiting sense. Numerous variations, changes, and substitutions will now occur to those skilled in the art without departing from the disclosure. Furthermore, it shall be understood that all aspects of the disclosure are not limited to the specific depictions, configurations or relative proportions set forth herein which depend upon a variety of conditions and variables. It should be understood that various alternatives to the embodiments described herein may be employed in practice. It is therefore contemplated that the disclosure shall also cover any such alternatives, modifications, variations, or equivalents. It is intended that the following claims define the scope of the disclosure and that methods and structures within the scope of these claims and their equivalents be covered thereby.

The invention claimed is:

1. A method for generating heated fluid steam-using a cascading heat pump system comprising a heat transfer fluid cycle, a first heat pump cycle, and a second heat pump cycle, the method comprising:

circulating a heat transfer fluid through the heat transfer fluid cycle, wherein:

the heat transfer fluid cycle comprises a first heat exchanger, an additional heat exchanger, a second heat exchanger, and a circulation pump circulating the heat transfer fluid through at least one of the additional heat exchanger and the second heat exchanger, the additional heat exchanger is thermally coupled to a heat source subunit and transfers heat from the heat source subunit to the heat transfer fluid, and the second heat exchanger receives the heat transfer fluid and a first working fluid to transfer heat from the heat transfer fluid to the first working fluid;

circulating the first working fluid through the first heat pump cycle, wherein:

the first heat pump cycle comprises the second heat exchanger, a first compressor, a third heat exchanger, and a first expansion valve, the first compressor compresses the first working fluid received from the second heat exchanger and delivers the first working fluid to the third heat exchanger, the third heat exchanger receives the first working fluid and a second working fluid and transfers heat from the first working fluid to the second working fluid, and the first expansion valve expands the first working fluid received from the third heat exchanger and delivers the first working fluid to the second heat exchanger; and circulating the second working fluid through the second heat pump cycle, wherein:

the second heat pump cycle comprises the third heat exchanger, a second compressor, a heated-fluid generator, and a second expansion valve, the second compressor compresses the second working fluid received from the third heat exchanger and delivers the second working fluid to the heated-fluid generator, the heated-fluid generator receives the second working fluid and a feed stream comprising water and transfers heat from the second working fluid to the feed stream thereby generating the heated fluid, and the second expansion valve expands the second working fluid received from the heated-fluid generator and delivers the second working fluid to the third heat exchanger; and delivering a first motor coolant stream, being a liquid, into a first motor of the first compressor or a second motor coolant stream, being a liquid, into a second motor of the second compressor, wherein:

the first motor coolant stream is the first working fluid received from the first heat pump cycle between the second heat exchanger and the third heat exchanger, and the second motor coolant stream is the second working fluid received from the second heat pump cycle between the third heat exchanger and the heated fluid generator.

2. The method of claim 1, wherein the first heat exchanger receives an ambient air stream and transfers heat from the ambient air stream to the heat transfer fluid.

3. The method of claim 1, wherein:

the heated-fluid generator is a steam generator, and the heated fluid is steam.

4. The method of claim 1, wherein:

the heated-fluid generator is a hot-water generator, and the heated fluid is hot water.

5. The method of claim 1, wherein the heat source subunit is selected from the group consisting of a (i) refrigeration system, (ii) a geothermal heat source, (iii) a waste heat stream from a process, a wastewater or waste heat stream from a heat system, a power system, or a combined heat and power system, (iv) a carbon capture process, (v) a body of water, (vi) a district energy system, (vii) a solar thermal heat source, and (viii) a nuclear reactor.

6. The method of claim 5, wherein the heat source subunit is the refrigeration system.

7. The method of claim 1, wherein the additional heat exchanger and the first heat exchanger form a vapor compression cycle further comprising an additional compressor and an additional expansion valve.

8. The method of claim 1, wherein the additional heat exchanger is connected in series or in parallel with the first heat exchanger, receives a subunit fluid, and transfers heat from the subunit fluid to the heat transfer fluid.

9. The method of claim 8, wherein the subunit fluid comprises one or more of ammonia ($NH_3$), water ($H_2O$), carbon dioxide ($CO_2$) pentane ($C_5H_{12}$), butane ($C_4H_{10}$), isobutane ($HC(CH_3)_3$), propane ($C_3H_8$), or propene ($C_3H_6$), a hydrofluoro-olefin (HFO) fluid, and a hydrofluoro-chlorine (HFC) fluid, a hydrochlorofluoro-olefin (HCFO) fluid, or a natural refrigerant.

10. The method of claim 1, further comprising compressing the heated fluid using a steam compressor.

11. The method of claim 1, wherein the first motor coolant stream, received from the first heat pump cycle, or the second motor coolant stream, received from the second heat pump cycle, is directed through a heat exchanger that is a part of (i) a glycol cooler, (ii) an air cooler, or (iii) a vapor compression cycle, before being delivered to the first motor or the second motor, respectively.

12. The method of claim 1, wherein:

the first heat exchanger is one of multiple air-source heat exchangers, connected in parallel with each other in the heat transfer fluid cycle, and the method comprises defrosting one of the multiple air-source heat exchangers while operating the first heat exchanger.

13. The method of claim 12, wherein defrosting the one of the multiple air-source heat exchangers is performed using an electric resistance heater embedded in or on one or more coils of one of the multiple air-source heat exchangers.

14. The method of claim 12, wherein defrosting the one of the multiple air-source heat exchangers is performed by:

heating the heat transfer fluid, thereby producing a heated heat transfer fluid, and circulating the heated heat transfer fluid through the one of the multiple air-source heat exchangers.

15. The method of claim 14, wherein heating the heat transfer fluid is performed using the first working fluid or the second working fluid and a heat transfer fluid heater receiving the first working fluid from the first compressor or receiving the second working fluid from the second compressor and transferring heat to the heat transfer fluid, thereby producing the heated heat transfer fluid.

16. The method of claim 15, wherein the heat transfer fluid heater is connected in parallel with the second heat exchanger.

17. The method of claim 15, wherein the heat transfer fluid heater is connected in series and upstream from the second heat exchanger.

18. The method of claim 15, wherein the heat transfer fluid cycle comprises a set of valves for selectively controlling flow of the heated heat transfer fluid from the heat transfer fluid heater or the heat transfer fluid from the second heat exchanger through each of the multiple air-source heat exchangers.

19. The method of claim 1, wherein the first heat pump cycle comprises a first economizer that:

splits the first working fluid from the third heat exchanger into a first sub-stream and a second sub-steam, passes the first sub-stream through a first-economizer expansion valve, transfers heat from the second sub-steam to the first sub-stream received from the first-economizer expansion valve, directs the first sub-stream to the first compressor, and directs the second sub-steam to the second heat exchanger.

20. The method of claim 1, wherein the first working fluid is received from the first heat pump cycle between the first expansion valve and the third heat exchanger.

* * * * *